US006373014B1

(12) United States Patent
Mitsuhashi et al.

(10) Patent No.: US 6,373,014 B1
(45) Date of Patent: Apr. 16, 2002

(54) CURRENT LIMITING DEVICE AND CIRCUIT INTERRUPTER HAVING A CURRENT LIMITING FUNCTION

(75) Inventors: Takao Mitsuhashi; Mitsuru Tsukima; Mitsugu Takahashi; Masahiro Fushimi; Kazunori Fukuya; Shiro Murata; Shinji Yamagata, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/641,268

(22) Filed: Aug. 17, 2000

Related U.S. Application Data

(63) Continuation of application No. PCT/JP99/07303, filed on Dec. 24, 1999.

(30) Foreign Application Priority Data

| | | |
|---|---|---|
| Dec. 28, 1998 | (JP) | 10-372462 |
| Jan. 19, 1999 | (JP) | 11-010745 |
| Mar. 16, 1999 | (JP) | 11-069986 |
| Aug. 26, 1999 | (JP) | 11-240066 |

(51) Int. Cl.[7] ..... H01H 9/44
(52) U.S. Cl. ..... 218/22; 335/16; 218/34
(58) Field of Search ..... 335/16, 147, 195, 335/202; 218/22, 29, 34–42, 155–157

(56) References Cited

U.S. PATENT DOCUMENTS 4,644,307 A * 2/1987 Tanimoto ..... 335/16

FOREIGN PATENT DOCUMENTS

| | | |
|---|---|---|
| JP | 1-43973 | 9/1989 |
| JP | 8-8048 | 1/1996 |
| JP | 8-250006 | 9/1996 |
| JP | 10-269923 | 10/1998 |

* cited by examiner

*Primary Examiner*—Lincoln Donovan
(74) *Attorney, Agent, or Firm*—Leydig, Voit, & Mayer, Ltd.

(57) ABSTRACT

A current limiting device includes first and second contact members, each contact member having, at a first end, contacts defining a contact pair; a contacting pressure is applied to said contact pair; and a cylindrical insulator cylindrically surrounding the contacts when the contacts are closed. The device is arranged such that at least one of the first and second contact members is rotatably supported at a second end. Also, an electrical path is defined through which currents flow in substantial opposition to the first and second contact members and in opposite directions to each other. The first ends of the first and second contact members are positioned within the space defined by the cylindrical insulator in the closed contact state. The contact of at least one of the rotatably supported contact members is positioned outside of the space defined by the cylindrical insulator when the contacts are open.

20 Claims, 115 Drawing Sheets

FIG. 2
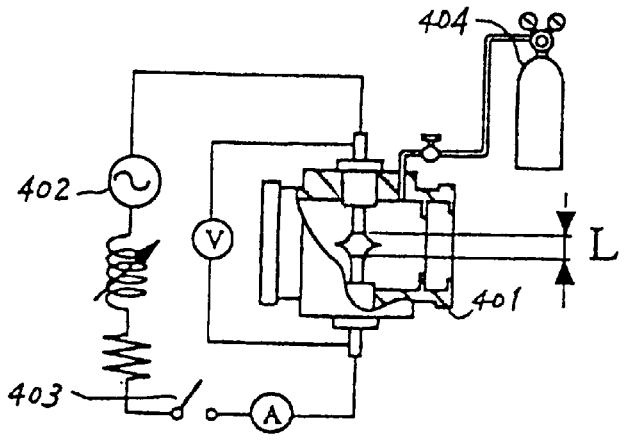
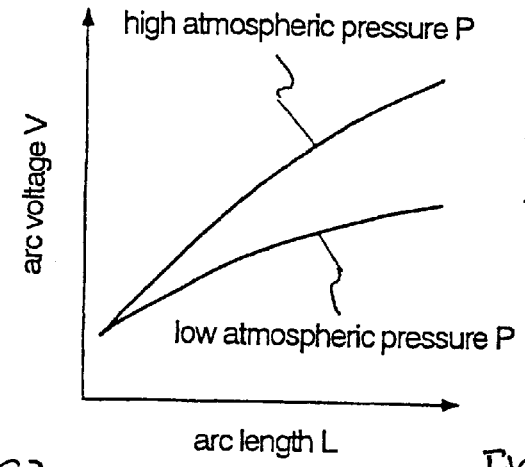
FIG.3 (a) with relatively small current value
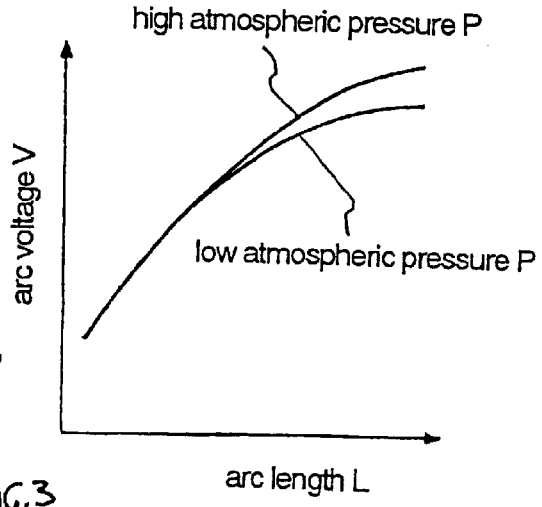
FIG.3 (b) with relatively large current value FIG. 8(a) no high speed opening means used FIG. 8 (b) high speed opening means used FIG 62 (a) with relatively small current value FIG 62 (b) with relatively large current value FIG. 66 (a) no high speed opening means used FIG. 66 (b) high speed opening means used

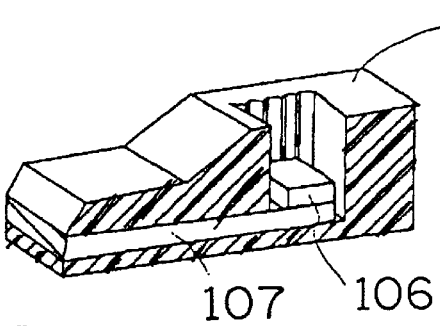
FIG. 68 (a)
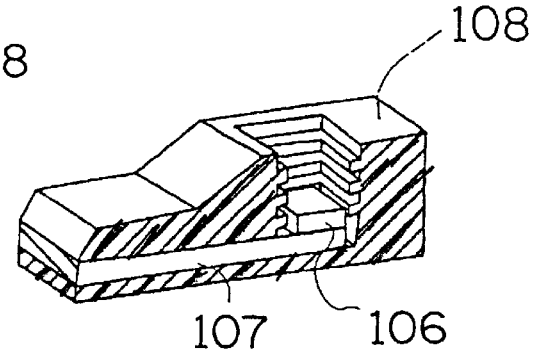
FIG. 68 (b)
FIG. 69
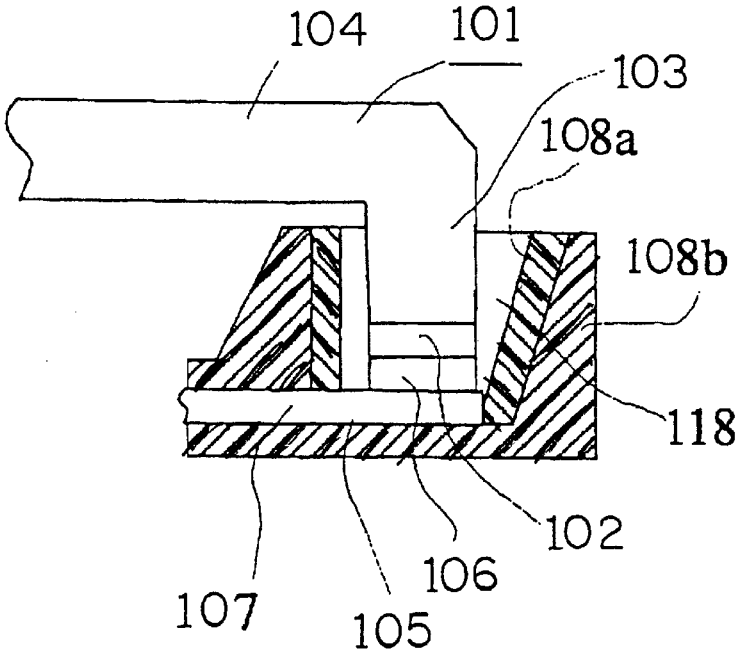

$$By = \frac{\mu I}{2\pi} \cdot \frac{L1}{(L1^2+L2^2)} + \frac{\mu I}{2\pi} \cdot \frac{1}{L1}$$

$$By = \frac{\mu I}{\pi} \cdot \frac{L1}{(L1^2+L2^2/4)}$$

$$By = \frac{\mu I}{2\pi} \cdot \frac{1}{(L1+L2)} + \frac{\mu I}{2\pi} \cdot \frac{1}{L1}$$

By: y-direction flux density (flux component generating separating force)

$\mu$ : permeability

I : current sectional area S = b x c
insulating distance a

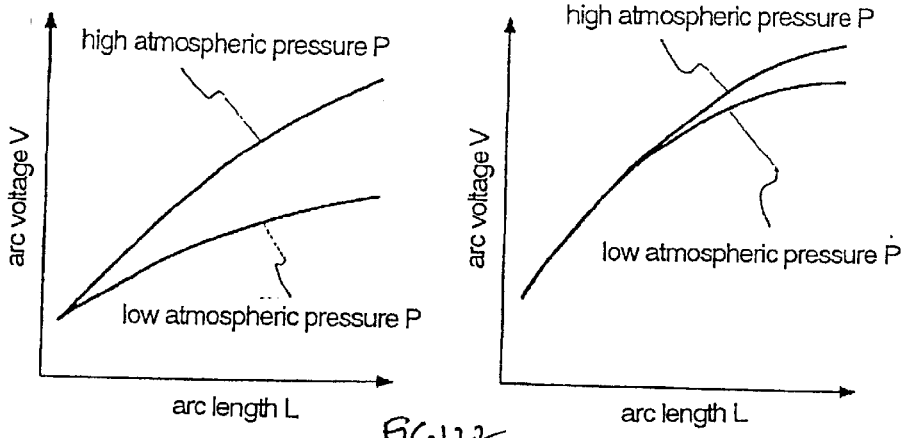
FIG 122 (a) with relatively small current value FIG. 122 (b) with relatively large current value
FIG. 123
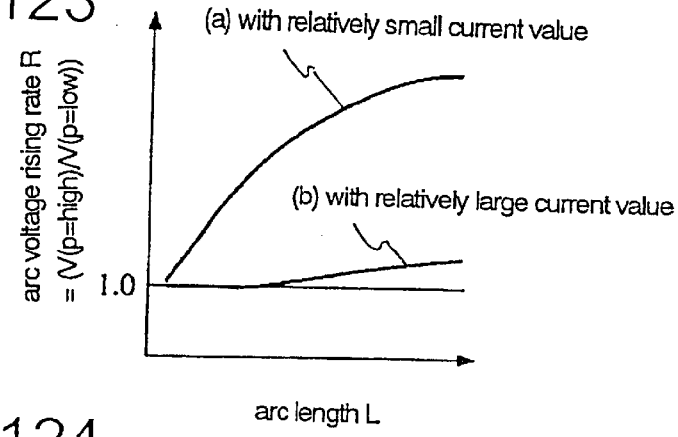
FIG. 124
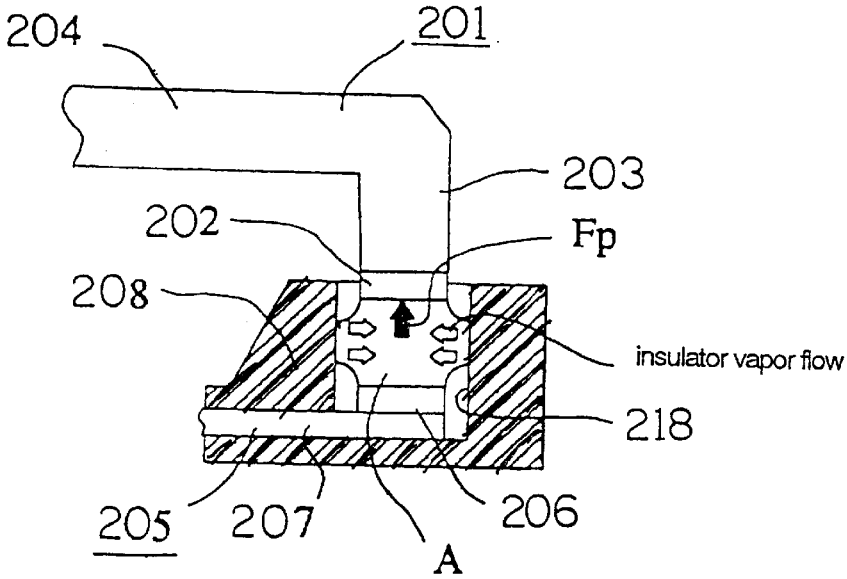

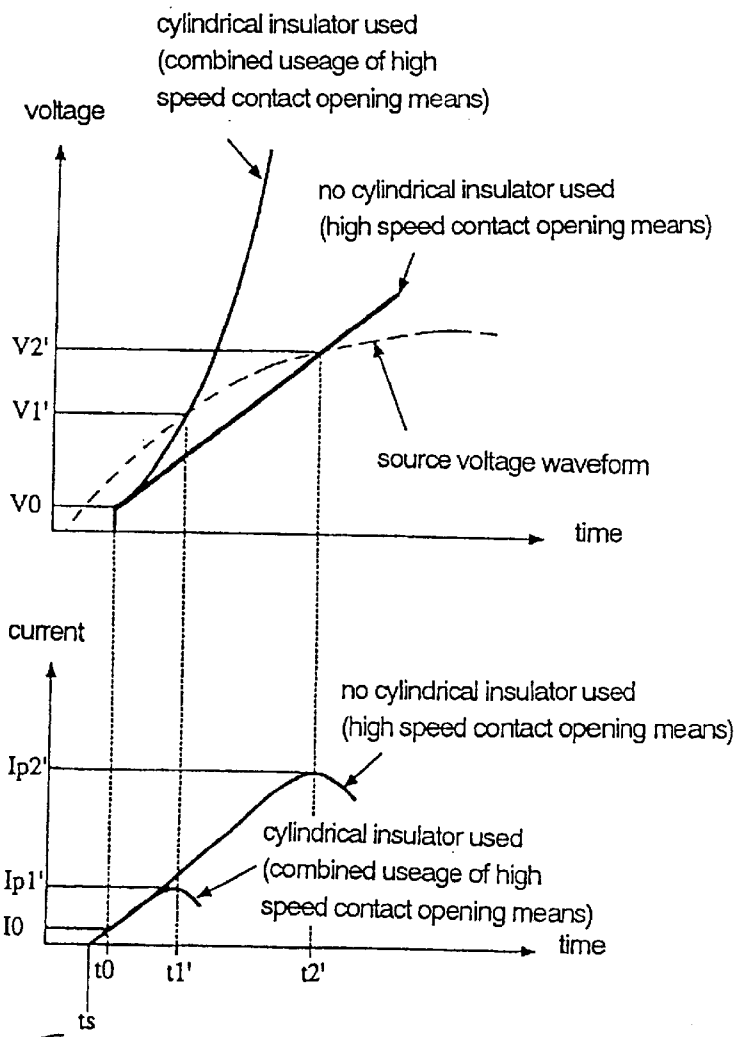
FIG. 12S (b) high speed opening means used
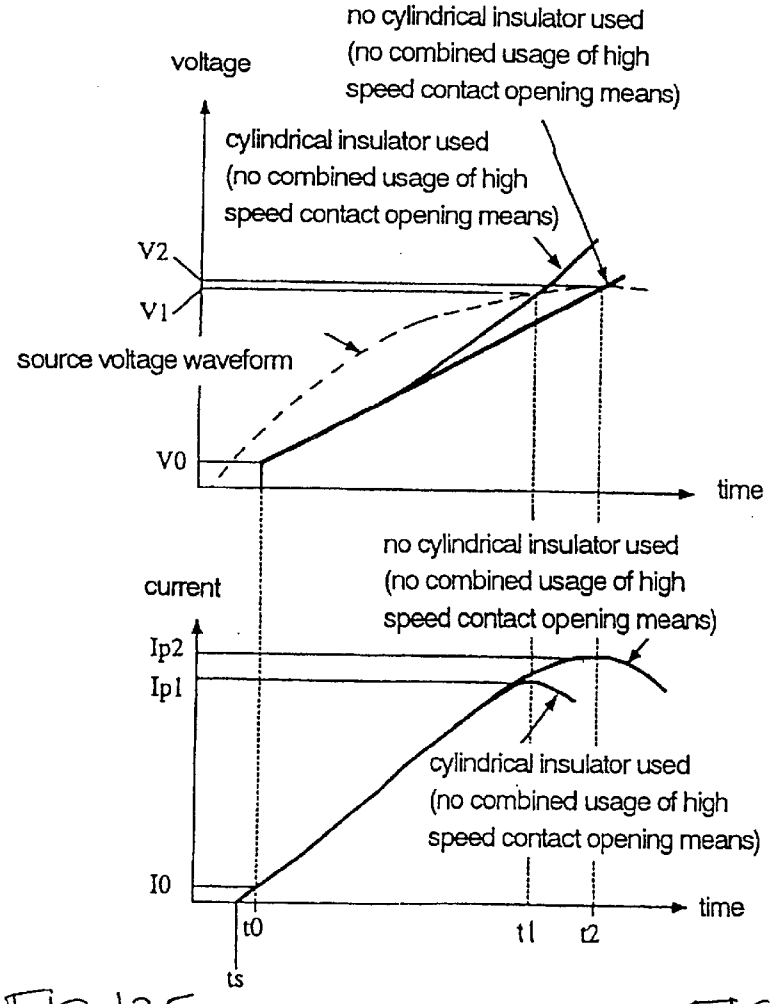
FIG. 12S (a) no high speed opening means used

CURRENT LIMITING DEVICE AND CIRCUIT INTERRUPTER HAVING A CURRENT LIMITING FUNCTION

CROSS REFERENCE TO RELATED APPLICATION

This is a continuation of International Application PCT/JP99/07303, with an international filing date of Dec. 24, 1999, and designating the United States the contents of which are hereby incorporated by reference.

TECHNICAL FIELD

This invention relates to a current limiting device and a circuit interrupter having a current limiting function.

BACKGROUND ART

FIG. 147 is a perspective view and a partial sectional view showing a conventional circuit interrupter disclosed for example in Japanese Patent Publication No. 1-43973, in which 1130 is a current limiting element portion connected in electrically series to the interrupter portion 1140 by a conductor 1290, 1001 is a movable member of the current limiting element portion 1130 having a support member 1711 including a movable contact 1002 and a magnetic material, 1005 is a stationary member of the current limiting element portion 1130 and having a stationary contact 1006, the movable member 1001 and the stationary member 1005 together constituting a contact pair. 1280 is an excitation coil connected in electrically series to the contact pair, 1018 is a movable member contacting pressure spring for generating a suitable contacting pressure in the contact pair. 1015 is a terminal portion, 1045 is a handle, 1721 is a flexible conductor, 1095 is a spring seat, 1110 are exhaust holes, 1135 is a piston, and 1300 is a packing. FIG. 148 is a right hand side view of FIG. 147.

During the normal current supplying operation, a current flows through the circuit interrupter from the interrupter portion 1140, the conductor 1290, the excitation coil 1280, the movable member 1001, the stationary member 1005 and the terminal portion 1015. When a current of an amount with which the current limiting element portion 1130 is to achieve the current limiting operation flows, the contacts separate due to an electromagnetic repulsive force generated between the movable contact 1002 and the stationary contact 1006 and generate an electric arc. This arc increases the pressure between the contacts, so that the piston 1135 of the movable member 1001 is moved against the force of the spring 1018. Also, since one portion of the movable member 1001 is a support member 1711 made of a magnetic material, the excitation coil 1280 constituting a coil plunger also provides a force assisting the contact opening. When the movable member 1001 moves in the contact opening direction, the gas on the back side of the movable contact is exhausted through the exhaust holes 1110, whereby the pressure increased by the arc is also additionally exhausted. The contact open state is maintained until the pressure sufficient to hold the contact in the opened state against the force of the movable contact contacting pressure spring 1018 is not provided Then, when the current flowing through the current limiting element portion decrease and the arc pressure decreased to a certain value, the movable member 1001 initiates its contact closing operation due to the force of the movable contact contacting pressure spring 1018. At this time, in order to delay the contact closing process, the exhaust holes 1110 are formed at an acute angle with respect to the contact opening direction, thereby to increase the fluid resistance of the gas to be exhausted. Also, the direction of tilt of the exhaust holes 1110 serves to reduce the fluid resistance of the gas at the time of the contact opening operation. In the current limiting element portion 1130 having such the structure, the fault current flowing through the circuit is limited mainly by an inductance of the excitation coil 1280 and the electrical resistance generated between the contacts 1002 and 1006. Since the contact pair is positioned within a narrow cylindrical space, the arc pressure generated upon the current limiting operation is increased to increase the resistivity of the arc. Therefore, a high arc voltage necessary for current limiting can be obtained. The current thus current-limited is eventually interrupted by the interrupter portion 1140 connected in series to the current limiting element portion.

FIG. 149 is a partial sectional view showing a conventional three pole current limiting unit disclosed for example in Japanese Patent Publication No. 8-8048, in which a current limiting unit 1200 constitutes a current limiting interrupter (a circuit interrupter with a current limiting function) together with a standard circuit interrupter 1300 which are connected at their housings. FIG. 151 is a partial sectional view with one portion of the housing side wall removed in order to show the internal structure of the current limiting interrupter. The current limiting unit 1200 contains in the respective inner poles two pairs of contact pairs connected in series as shown in FIG. 152. FIG. 153 is an exploded perspective view in which main parts are disassembled in order to show the structure of the two contact pairs shown in FIG. 152.

In FIGS. 148 to 153, 1*a* and 1*b* are first movable member and a second movable member constituted by the movable contacts 1002*a* and 1002*b* and the movable arms 1004*a* and 1004*b*, respectively, and 1005*a* and 1005*b* are first stationary contact and a second stationary contact constituted by the stationary contacts 1006*a* and 1006*b* and the stationary conductors 1007*a* and 1007*b*, respectively. The first movable member 1001*a* and the first stationary member 1005*a*, and the second movable member 1001*b* and the second stationary member 1005*b* constitute contact pairs, respectively. 1015*a*, 1015*b* and 1015*c* are terminal portions disposed at one face of the housing, 1016*a*, 1016*b* and 1016*c* are terminal portions disposed at the opposite face of the housing, the first stationary member 1005*a* being connected to the terminal portion 1016*a* and the second stationary member 1005*b* being connected to the terminal portion 1015*a* through the connecting conductor 1014, and the first movable member 101*a* and the second movable member 1001*b* are electrically connected by the flexible conductor 1072 to the end portion opposite to the movable contacts 1002*a* and 1002*b*.

Therefore, the current path extends from the terminal portion 1016*a*, the stationary conductor 1007*a*, the stationary contact 1006*a*, the movable contact 1002*a*, the movable arm 1004*a*, the flexible conductor 1072, the movable arm 1004*b*, the movable contact 1002*b*, the stationary contact 1006*b*, the stationary conductor 1007*b*, the connecting conductor 1014 and the terminal portion 1015*a*, and two pairs of contact pairs are electrically connected in series. The two contact pairs are separated and arranged in plane symmetry with respect to a plane of the partition wall 1100 substantially perpendicularly disposed with respect to a plane (the bottom surface of the housing) connecting the terminal portions 1015*a* and 1016*a* disposed at the opposite ends of the housing separated. A rotary shaft 1013 penetrating through the partition wall 1100 rotatably supports the first movable member 1001*a* and the second movable member 1001*b*, and the first movable member 1001*a* and the second movable member 1001*b* are urged toward the first stationary member 1005*a* and the second stationary member 1005*b*, respectively, by means of twist springs 1011*a* and 1011*b* (not shown). At the position opposing to the tip end portion on which the contacts of the above contact pairs are provided, arc extinguishing plates 1019*a* and 1019*b* (not shown) of a horse-shoe shape are provided.

At the time of normal opening and closing as well as overload current interrupting, the standard circuit interrupter 1300 achieves opening and closing operation and the interrupting operation, and the current limiting unit 1200 does not operate. On the other hand, when a large current such as a short circuited current is generated, two contact pairs disposed within the current limiting unit 1200 is rapidly separated against the spring force of the springs 1011*a* and 1011*b* by the electromagnetic repulsive force generated by the parallel and opposite currents flowing through the stationary conductor 1007*a* and the movable arm 1004*a* as well as the stationary conductor 1007*b* and the movable arm 1004*b*, respectively. Also, the current flowing through the connecting conductor 1014 generates a magnetic field component in the direction of separating the movable members 1001*a* and 1001*b*.

As these contact pairs rapidly separate, two point series arc generates and the arc voltage rapidly rises. By this rapid rise of the arc voltage, the short circuit current is quickly pinched and the current peak is suppressed. Each of two arcs generated across two contacts is elongated by the function of the current flowing through the stationary conductor 1007*a* or 1007*b* and the movable arm 1004*a* or 1004*b* and the connecting conductor 1014 toward the arc extinguishing plates 1019*a* and 1019*b*, where they are cooled and splitted. This causes the fault current to be further pinched, rapidly proceeding to the current zero point. By the current limiting operation of the current limiting unit 1200 as above discussed, the fault current pinched to be small is interrupted by the standard circuit interrupter 1300 connected in series with the current limiting unit 1200. After the current interruption, the movable members 1001*a* and 1001*b* returns to the closed state by the action of the springs 1011*a* and 1011*b*.

During the above-discussed current limiting operation, the electromagnetic repulsive forces acting on the first movable member 1001*a* and the second movable member 1001*b* are substantially equal magnitude to each other because both the contact pairs are arranged in a plane-symmetrical relationship relative to the symmetry plane of the partition wall 1100, the separating speed of both contact pairs are substantially the same. Therefore, the flexible conductor 1072 connecting the first movable member 1001*a* and the second movable member 1001*b* is not subjected to a twisting force. Also, since the arc energy treated in two spaces partitioned by the partition wall 1100 is substantially equal to each other, it is cannot happen that the parts disposed within one of the spaces, such as the movable contact, the stationary contact, the arc extinguishing plates or the like are worn significantly more than the similar parts disposed in the other space.

When a current limiting interrupter is constituted by directly connecting the current limiting unit 1200 and the standard circuit interrupter 1300, the overall length of the current limiting interrupter becomes too long and deteriorates the easy housing within the distribution panel or the like when the length L of the current limiting unit 1200 is too long. Therefore, in the conventional current limiting unit, the contact pairs are arranged so that their longitudinal direction substantially perpendicularly crosses the plane connecting the terminal portions disposed at the opposite ends of the housing and that two contact pairs are positioned side by side in the width direction, thereby to minimize the increase of the length of the longitudinal direction of the current limiting interrupter. Also, taking the easy placement within the distribution panel or the like into consideration, it is apparent that the width W and the height H of the current limiting unit 1200 is equal to or less than the width and the height of the standard circuit interrupter 1300. However, if the connection between the current limiting unit 1200 and the standard circuit interrupter 1300 is considered, the width W of the current limiting unit 1200 is preferably equal to the width of the standard circuit interrupter 1300.

In the current limiting element portion of conventional the circuit interrupter as shown in FIGS. 147 and 178, the movable contacts are always positioned within a narrow space of a cylindrical shape, so that the vapor of the electrode metal filled within the space upon the arc generation prevents sufficient insulation recovery upon the current interruption. Also, the movable contacts apt to get into contact with the cylindrical wall surface, resulting in a high possibility of insulation breakdown at the wall surface. For these reasons, it is difficult for the current limiting element portion alone to obtain a current interrupting function and it is necessary to additionally provide an interruption portion having a current interrupting function. Therefore, the overall size of the circuit interrupter becomes large, the structure becomes complex and the cost becomes high.

Also, when the current limiting element portion 1130 and the interrupting portion 1140 are connected in series as previously discussed, the impedance of the entire circuit interrupter becomes large. In particular, the excitation coil 1280 is provided in the current limiting element portion 1130 for assisting the contact separation of the movable member 1001 upon the current limiting operation, thus increasing the impedance. In such the circuit interrupter of high impedance, a high current carrying loss and an abnormal temperature rise due to the current carrying may easily be generated. Therefore, when a large current carrying capacity is required, such the conventional circuit interrupter cannot be used.

Further, in the current limiting element portion 1130 of the conventional circuit interrupter, the contact opening operation of the movable member 1001 is linearly carried out, so that the dimension of the circuit interrupter in the direction of the opening and closing movement of the contact member 1001 (contact opening and closing movement) become large in order to ensure a sufficient contact separating distance. As shown in FIG. 147, the dimension in that direction is a sum of the terminal portion, the stationary member, the movable member, the space in which the movable member moves, the space in which the flexible conductor is housed and the thickness of the housing wall. Therefore, when there is a limit in the dimension in the direction of movement of the movable member, a sufficient separating distance cannot be ensured and the high pressure cannot be effectively related to the arc voltage increase.

Also, when the high pressure could not be effectively related to the arc voltage increase, unnecessary pressure rise is generated, resulting in a problem that a very high housing strength is needed for suppressing the pressure rise.

Also, in the current limiting device shown in FIGS. 149 to 153, when the current limiting unit has a limitation on its width dimension as above discussed, and with the two contact pairs are arrange side by side in the width direction in order to reduce the length dimension of the current limiting unit, the housing side wall may be difficult to have a thickness providing a sufficiently large mechanical strength. Therefore, the housing may be damaged by the internal pressure rise due to the arc generated upon the current limiting operation. Also, even when the damages of the housing is prevented by selecting a mechanically strong material, the cost of the housing will be increased.

Also, two pairs of contact member pairs are connected in series for obtaining a high current limiting performance, so that the head generated at the contact surface of the contact element during the current carrying becomes two times, the electrical path length within the current limiting unit is increased and the heat conduction to the external conductor, an abnormal temperature rise during the current carrying can easily be generated, so that this arrangement is difficult to be applied to a circuit of a large current carrying capacity.

Also, since two pairs of contact member pairs are connected in series and two arc extinguishers are provided, number of the parts is large and the cost is high.

Also, when the circuit is composed of the conventional current limiting device and the electromagnetic switch low in welding resistivity, since the contact welding may be generated due to contact floating upon the short circuit interruption, it is necessary that the electromagnetic switch be designed to have the weld resistance. Therefore, when a current limiting performance exceeding the conventional current limiting device can be realized, the welding resistance performance of the electromagnetic switch connected in series to the circuit can be lowered and the cost of the electromagnetic switch can be decreased, so that further improvements in current limiting performance are required.

The present invention has been made in order to solve the above-discussed problems and has as its object the provision of a current limiting device of low cost having an improved current limiting performance and interrupting function with a single arc extinguisher.

Another object of this invention is to provide a current limiting device high in current limiting performance and small impedance.

Another object of this invention is to provide a small current limiting device having a small dimension in the direction of the contact opening and closing operation.

Another object of this invention is to provide a current limiting device in which the increase of the housing internal pressure upon the interruption that does not effectively contribute to the improvements in current limiting performance is suppressed, whereby the required housing strength can be reduced.

Further object of the present invention is to provide a circuit interrupter of low cost having an improved current limiting performance and interrupting function with a single arc extinguisher.

Another object of this invention is to provide a circuit interrupter having a current interrupter high in current limiting performance and small impedance.

Another object of this invention is to provide a circuit interrupter having a small current limiting device having a small dimension in the direction of the contact opening and closing operation.

Another object of this invention is to provide a circuit interrupter having a current limiting device in which the increase of the housing internal pressure upon the interruption that does not effectively contribute to the improvements in current limiting performance is suppressed, whereby the required housing strength can be reduced.

Still another object of the present invention is to provide a current limiting device having a good current limiting function and in which housing cracks due to the internal pressure rise upon the current limiting operation cannot easily be generated.

Still another object of the present invention is to provide a current limiting device having a good current limiting function and in which an abnormal temperature rise upon the current carrying cannot easily be generated.

Still another object of the present invention is to provide a current limiting device having a good current limiting function and small in number of parts.

Still another object of the present invention is to provide a current limiting device in which current limiting function is further improved.

DISCLOSURE OF INVENTION

The current limiting device of the present invention comprises: a first and a second contact member having at each one end portion to define a pair of contact pairs; means for providing a contacting pressure to the contact pairs and; a cylindrical insulator cylindrically surrounding around the contacts in the closed state; at least one of the contact of the first and second contact members being rotatably supported at the other end portion; an electrical path is being defined through which currents flow in substantial opposition to said first and second contact members and in opposite direction to each other and the one end portions having contacts of the first and second contact members are positioned within the cylindrical space defined by the cylindrical insulator in the contact closed state; and the contact of at least one of the rotatably supported contact members are positioned outside of the cylindrical space defined by the cylindrical insulator in the contact opened state.

The current limiting device may comprise: a movable member having a movable contact and a movable arm and rotatable about the movable member rotary shaft; a stationary member having a stationary contact making a contact pair with the movable contact and a stationary conductor substantially opposing to the movable arm; a cylindrical insulator cylindrically surrounding around the contact pair in the closed state; and a contact pressure spring providing a contact pressure to the contact pair; the movable arm having a movable arm horizontal portion and a movable arm vertical portion defining a substantially L-shape and, in the contact closed state, the movable arm horizontal portion being positioned to provide a current flow substantially parallel to and opposite in direction with respect to the stationary conductor, and a movable member tip portion having the movable contact and a stationary member tip portion having the stationary contact being positioned within the cylindrical space defined by the cylindrical insulator and the movable contacts, and, in the contact open state, the movable contact being positioned outside of the cylindrical space.

The arrangement may be such that the conductor is bent into a substantially U-shape with one end thereof being connected to the terminal portion on the far side far from the movable member rotary shaft, and the other end of the U-shape has on its inner side a stationary contact to provide the stationary contact with respect to the movable member; one of the stationary members on which the stationary contact is disposed defining the stationary conductor substantially opposing to the movable arm horizontal portion in the closed state, the stationary member being provided with a slit for allowing the opening and closing of the movable member at the position crossing the rotary trace of the movable member; and the portion other than the stationary contact of the stationary member directly facing with the movable contact in the contact opened state is covered by the insulating material.

Also, the arrangement may be such that the stationary member made of a conductor connected to the terminal portion on the far side from the movable member rotary shaft has defined therein a stationary conductor having the stationary contact making the contact pair with the movable contact and opposing to the movable arm horizontal portion of the movable member and through which a electric current opposite to the current through the movable arm flows, and wherein a magnetic core is disposed on the electric path disposed at both sides of the stationary conductor and introducing a current to the stationary conductor from the terminal portion.

The stationary conductor may be bent so that it is closer to the movable arm horizontal portion that to the stationary contact.

The current limiting device may comprise: a movable member having a movable contact and a movable arm and rotatable about the movable member rotary shaft; a repulsive member having a repulsive contact making a contact pair with the movable contact and a repulsive arm substantially opposing to the movable arm and rotatable about a repulsive member rotary shaft; a cylindrical insulator cylindrically surrounding around the contact pair in the closed state; a contact pressure spring providing a contact pressure to the contact pair; and a pressure accumulating space communicated at its main opening portion to the cylindrical space defined by the cylindrical insulator and having the repulsive member therein; the repulsive arm having a repulsive arm horizontal portion and a repulsive arm vertical portion defining a substantially L-shape and, in the contact closed state, the repulsive arm horizontal portion being positioned to provide a current flow substantially parallel to and opposite in direction with respect to one portion of the movable arm, and a movable member tip portion having the movable contact and a repulsive member tip portion having the repulsive contact being positioned within the cylindrical space defined by cylindrical insulator and the movable contacts, and, in the contact open state, the movable contact member tip portion being positioned outside of the cylindrical space.

The arrangement may be such that an electrical path for supplying a current to the repulsive member is provided on the side remote from the movable member of the repulsive member, and a portion opposite at least to the repulsive member tip portion of the electrical path is provided with a slit having a width substantially equal to that of the repulsive member along a plane including a locus of the repulsive member in the contact opening operation.

The arrangement may be such that an electrical path for supplying a current to the repulsive member is arranged to intersect with a plane including the contact opening locus of the repulsive member, the electrical path is provided with a slit for allowing the opening and closing movement of the repulsive member or the movable member, and wherein the electrical path is positioned closer to the movable arm than to the repulsive arm horizontal portion so that an electric current parallel to and opposite to the repulsive arm horizontal portion flows.

The current limiting device may comprise: a movable member contained within an electrically insulating housing and having a movable contact and a movable arm of substantially L-shape and rotatable about the movable member rotary shaft; a stationary member having a stationary contact making a contact pair with the movable contact and a an electrical path substantially parallel to one portion of the movable arm and allowing an electric current to flow in the opposite direction to the movable arm upon contact closing; a cylindrical insulator cylindrically surrounding the contact pair in the closed state; biasing means for providing contact pressure to the contact pair; an arc extinguishing plate disposed at a position opposing to the tip of the movable member; and a terminal portion disposed on the opposite side of the insulating housing and connected to the movable member and the stationary member; the stationary member being substantially perpendicularly provided with respect to a line connecting both of the terminal portions; and, in the contact closed state, the contact pair being positioned within the cylindrical space and, in the contact open state, the movable contact being positioned outside of the cylindrical space.

The arrangement may be such that the terminal portion is disposed at a position higher than the bottom surface of the insulating housing, and the movable member and the stationary member are arranged to be connected to the terminal portion on the side far from the respective movable member and the stationary member through a bent electrical path from the mutually parallel electrical path.

The arrangement may be such that two pairs of the contact pair of the movable member and the stationary member are provided and these contact pairs are electrically connected in series and separated by a partition wall from each other.

The arrangement may be such that the height of the wall of the cylindrical insulator cylindrically surrounding the contact pair in the closed state opposite to the movable member rotary shaft is higher than the wall on the side of the movable member rotary shaft.

The arrangement may be such that the movable member, the stationary member and the cylindrical insulator cylindrically surrounding the contact pair in the closed state are housed within a housing, the housing has an exhaust port formed in the face of the housing opposite to the movable member rotary shaft as viewed from the movable contact, and wherein the exhaust port has an area equal to or less than one half of the area of the housing including the exhaust port and is positioned at a position close to the movable member in the open state.

The current limiting device may further comprise an arc extinguisher plate disposed at a position opposing to the tip of the movable member and an arc runner extending along the current supplying conductor to the stationary member, the end portion of the arc runner being exposed to the arc extinguisher plate side from the portion of the cylindrical insulator opposite to the movable member rotary shaft.

The arrangement may be such that the portion of the stationary conductor opposing to the movable member and through which an electrical current opposite to that of the movable member flows is bent so as to be close to the movable member.

The current limiting device may further comprise a commutation electrode connected to the current supplying conductor of the movable member of which tip portion reaches close to the arc extinguishing plate is disposed behind the movable member in the closed state.

The circuit interrupter having current limiting function may comprise: a movable member having a movable contact and a movable arm and rotatable about the movable member rotary shaft; a stationary member having a stationary contact making a contact pair with the movable contact and a stationary conductor substantially opposing to the movable arm; a cylindrical insulator cylindrically surrounding the contact pair in the closed state; and a contact pressure spring providing a contact pressure to the contact pair; the arrangement being such that the contact pair is positioned within a cylindrical space defined by the cylindrical insulator in the contact closed state, and the movable contact is positioned outside of the cylindrical space in the contact open state.

The arrangement may be such that the movable arm has a movable arm horizontal portion and a movable arm vertical portion defining a substantially L-shape and, in the contact closed state, the movable arm horizontal portion being positioned to provide a current flow substantially parallel to and opposite in direction with respect to the stationary conductor.

The arrangement may be such that the cylindrical insulator comprises in an inner wall surface defining the cylindrical space a shed or grooves for increasing the area that is brought into contact with the electric arc.

The arrangement may be such that the material of the cylindrical insulator defining the cylindrical space is different between the portion surrounding the contact pair and the other remaining portion, the portion surrounding the contact pair being made of a material that easily emits a large amount of vapor by the electric arc.

The arrangement may be such that the inner wall of the cylindrical space has a configuration extending along the rotation locus of the tip of the movable member.

The arrangement may be such that the stationary member positioned within the cylindrical space has an insulating material covering around the stationary contact so that the stationary contact alone is exposed to the cylindrical space.

The arrangement may be such that the height of the wall of the cylindrical insulator cylindrically surrounding the contact pair in the closed state opposite to the movable member rotary shaft is higher than the wall on the side of the movable member rotary shaft.

The arrangement may be such that the stationary conductor defining the stationary member and one portion of the conductor for supplying the current to the movable member are arranged in parallel and close to each other so that the electric currents flowing through both of the above conductors during the current conduction are coincide in the direction of current flow.

The arrangement may be such that the stationary conductor and the conductor for supplying current to the movable member are arranged in parallel to each other in a plane including the locus along which the movable member rotates.

The arrangement may be such that a magnetic core surrounding the stationary conductor and the conductor for supplying current to the movable member is provided and the magnetic core has opposite poles arranged in opposition to the movable arm horizontal portion in the contact closed state.

The arrangement may be such that a magnetic core surrounding the stationary conductor, the conductor for supplying current to the movable member and the movable member is provided.

The arrangement may be such that the movable member, the stationary member and the cylindrical insulator cylindrically surrounding the contact pair in the closed state are housed within a housing, the housing has an exhaust port formed in the face of the housing opposite to the movable member rotary shaft as viewed from the movable contact, and wherein the exhaust port has an area equal to or less than one half of the area of the housing including the exhaust port and is positioned at a position close to the movable member in the open state.

The arrangement may be such that a commutation electrode connected to the current supplying conductor to the movable member and of which tip portion reaches close to the exhaust port above the arc extinguishing plate is provided, the commutation electrode is provided with a slit for allowing the rotation of the movable member so that the movable contact is positioned close to the commutation electrode in the movable member open position.

The arrangement may be such that a magnetic core disposed to sandwich the housing from the externally above and below the housing or surrounding the housing is provided at a position along an opening locus of the movable member.

The arrangement may be such that the stationary contact is positioned within the pressure accumulating space communicated with the cylindrical space.

The arrangement may be such that one portion of the stationary conductor around the stationary contact is covered with an electrical insulation.

The arrangement may be such that the pressure accumulating space is disposed only above the stationary member.

The circuit interrupter having a current limiting function may further comprise an arc extinguisher plate disposed at a position opposing to the tip of the movable member and an arc runner extending along the current supplying conductor to the stationary member, the end portion of the arc runner being exposed to the arc extinguisher plate side from the portion of the cylindrical insulator opposite to the movable member rotary center.

The arrangement may be such that the tip portion of the arc runner is positioned lower than the upper face of the cylindrical insulator therearound.

The arrangement may be such that the cylindrical space in which the stationary contact is positioned and the arc runner cylindrical space surrounding the arc runner tip are communicated through a conduit.

The arrangement may be such that the movable arm has a hook-shaped configuration.

The arrangement may be such that the movable arm has an S-shaped configuration.

The arrangement may be such that a portion of the movable arm directly facing the stationary contact surface on the side of the movable member rotating center is covered by an insulator.

The arrangement may be such that a portion of the stationary conductor opposing to the movable arm is bent toward the movable arm to provide a portion parallel to the movable arm.

The arrangement may be such that an arc extinguishing plate disposed at a position opposing to the tip of the movable member and an opposing electrode disposed above the arc extinguisher plate in the vicinity of the end face of the movable member on the side of the arc extinguisher plate in the open position.

The arrangement may be such that an arc extinguishing plate disposed at a position opposing to the tip of the movable member is provided, and wherein the height of the inner wall of the cylindrical insulator on the side of the movable member rotary center is higher than the wall on the opposite side of the movable member rotary shaft in order that the movable member side opening portion of the cylindrical space defined by the cylindrical insulator faces toward the arc extinguishing plate.

The arrangement may be such that a plurality of horse shoe shaped arc extinguishing plate are provided, and wherein the portion of the arc extinguishing plates at the inner surface of the central portion of the horse shoe is positioned between a plate extended from the wall surface of the cylindrical insulator opposite to the movable member rotary center and a locus of the tip portion of the movable member.

The arrangement may be such that the stationary conductor having the stationary contact is bent into a substantially U-shape to lead to a far side from the movable member rotary center, and wherein a slit for allowing closing of the movable member is provided in the portion of the stationary conductor intersecting with the rotation locus of the movable member.

The arrangement may be such that the portion of the stationary conductor opposing to the movable member and in which the current direction is opposite to the movable member is bent to be close to the movable member.

The arrangement may be such that the stationary conductor directly facing to the movable contact in the open state is covered with an electric insulator.

The arrangement may be such that the stationary conductor is lead to the side far from the movable member rotary center, and wherein the arrangement is such that one portion of the stationary conductor opposes to the movable member and that the direction of electric current flowing through the opposing portion is opposite to that of the movable member.

The current limiting device may comprise: a movable member contained within an electrically insulating housing and having a movable contact and a movable arm of substantially L-shape and rotatable about the movable member rotary shaft; a stationary member having a stationary contact making a contact pair with the movable contact and a an electrical path substantially parallel to one portion of the movable arm and allowing an electric current to flow in the opposite direction to the movable arm upon contact closing; a cylindrical insulator cylindrically surrounding the contact pair in the closed state; biasing means for providing contact pressure to the contact pair; an arc extinguishing plate disposed at a position opposing to the tip of the movable member; and a terminal portion disposed on the opposite side of the insulating housing and connected to the movable member and the stationary member; the contact pair, in the contact closed state, being positioned within the cylindrical space and, in the contact open state, the movable contact being positioned outside of the cylindrical space.

The arrangement may be such that the terminal portion is disposed at a position higher than the bottom surface of the insulating housing.

The arrangement may be such that the movable member and the stationary member are connected to the terminal portion closer to the movable member and the stationary member through an electrical path bent into a "U-shape" from an electrical path parallel to each other.

The arrangement may be such that the movable member and the stationary member are connected to the terminal portion farther from the movable member and the stationary member through an electrical path bent from an electrical path parallel to each other.

The arrangement may be such that an arc runner extending along the current supplying conductor to the stationary member is provided, the tip portion of the arc runner being exposed to the arc extinguisher plate side.

The arrangement may be such that an insulator defining an arc runner cylindrical space around the arc runner is provided.

The arrangement may be such that a commutation electrode connected to the current supplying conductor of the movable member of which tip portion reaches close to the arc extinguishing plate is disposed behind the movable member.

The arrangement may be such that the commutation electrode is provided with a slit for allowing the rotation of the movable member so that the movable contact is positioned close to the commutation electrode in the movable member open position.

The arrangement may be such that the cylindrical space of the cylindrical insulator has a configuration of expanding toward the arc extinguishing plate.

The arrangement may be such that the height of the inner wall of the cylindrical insulator on the side of the movable member rotary center is higher than the wall on the opposite side of the movable member rotary shaft in order that the movable member side opening portion of the cylindrical space defined by the cylindrical insulator faces toward the arc extinguishing plate.

The arrangement may be such that the material of the cylindrical insulator defining the cylindrical space is different between the portion surrounding the contact pair and the other remaining portion, the portion surrounding the contact pair being made of a material that easily emits a large amount of vapor by the electric arc.

The arrangement may be such that the inner wall defining the cylindrical space has a sectional shape following the rotary locus of the movable member tip.

The arrangement may be such that the portion of the stationary member positioned within the cylindrical space and around the stationary contact is covered by an insulator so that the stationary contact alone is exposed to the cylindrical space.

The arrangement may be such that, in an open end of the cylindrical space defined by the cylindrical insulator, the height of the wall of the cylindrical insulator close to the movable member rotary center is lower than the height of the wall on the side far from the movable member rotary center.

The arrangement may be such that a portion of the movable arm opposing to the stationary member and in which a current flows in opposite direction to that in the stationary member is bent to be close to the stationary member.

The arrangement may be such that the stationary conductor opposing to the movable member and in which a current flows in opposite direction to that of the movable member in the closed state is bent toward the movable member.

The arrangement may be such that a portion of the movable arm directly facing the stationary contact surface on the side of the movable member rotating center is covered with an insulator.

The arrangement may be such that two pairs of the contact pair of the movable member and the stationary member are provided and these contact pairs are electrically connected in series and separated from each other by a partition wall.

The arrangement may be such that the device is connected in the longitudinal direction to a circuit interrupter with their housings to provide a unitary structure.

BRIEF DESCRIPTION OF THE DRAWINGS

FIG. 2 is a schematic view showing an experiment apparatus for measuring the basic characters of the arc voltage;

FIGS. 3(*a*) and 3(*b*) are graphs showing the effects of the atmosphere pressure on the arc voltage;

FIG. 68(*a*) and 68(*b*) are sectional views showing the cylindrical insulator of the circuit interrupter according to the twenty-ninth embodiment of the present invention;

FIG. 69 is a fragmental sectional view showing the cylindrical insulator of the circuit interrupter according to the thirtieth embodiment of the present invention;

FIG. 91 is a sectional view taken at the magnetic core portion of the circuit interrupter according to the thirty-ninth embodiment of the present invention;

FIG. 119 is a fragmental sectional perspective view showing the three pole current limiting device according to the fifty-fifth embodiment of the present invention;

FIG. 120 is a fragmental sectional perspective view showing the main portion of one pole unit of the three pole current limiting device shown in FIG. 119;

FIG. 121 is a schematic view showing an experiment apparatus for measuring the basic characters of the arc voltage;

Figure 126:
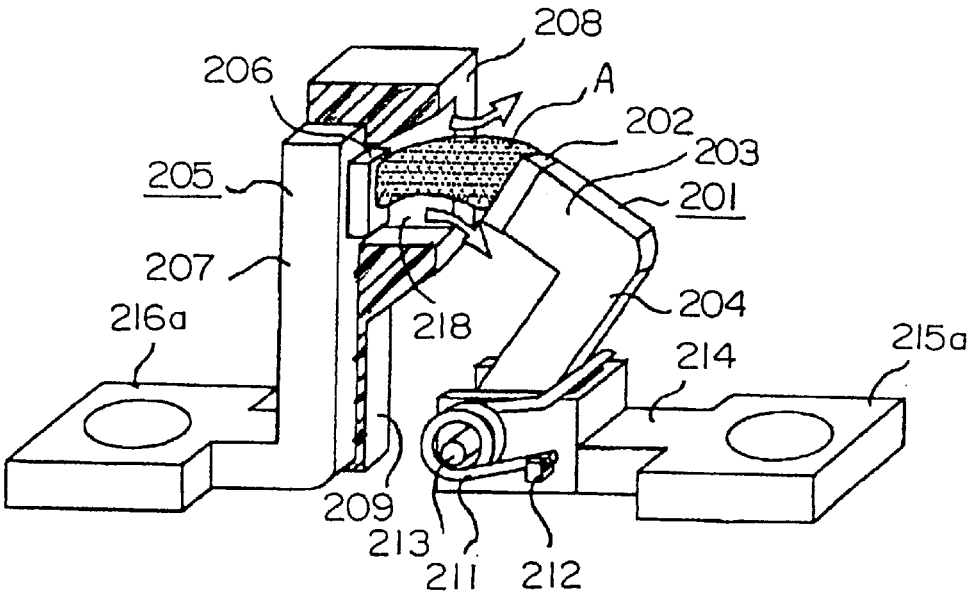
Figure 127:
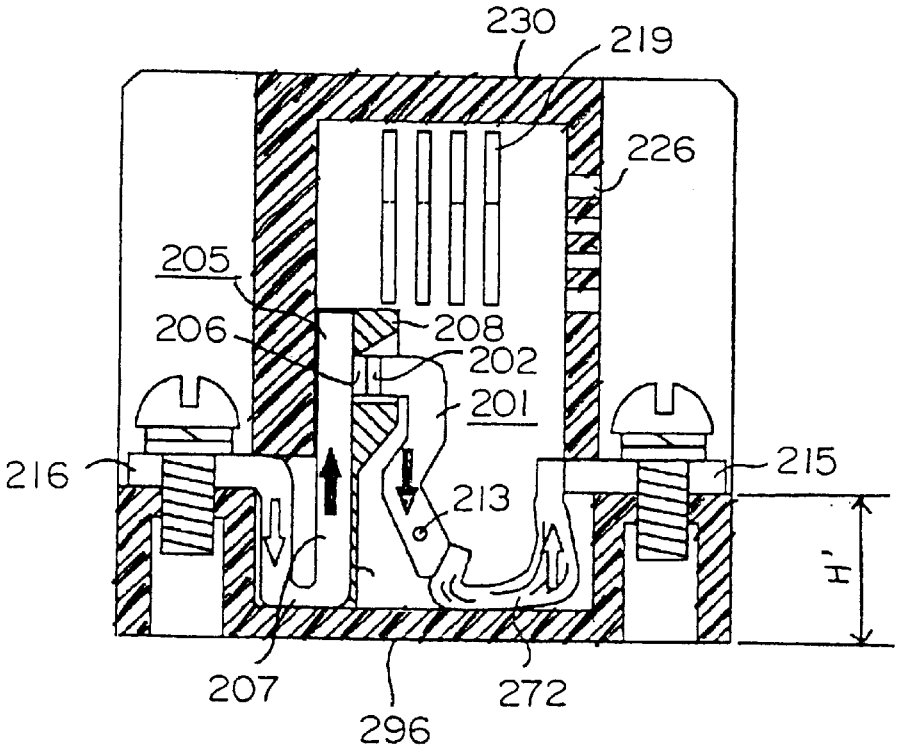
Figure 128:
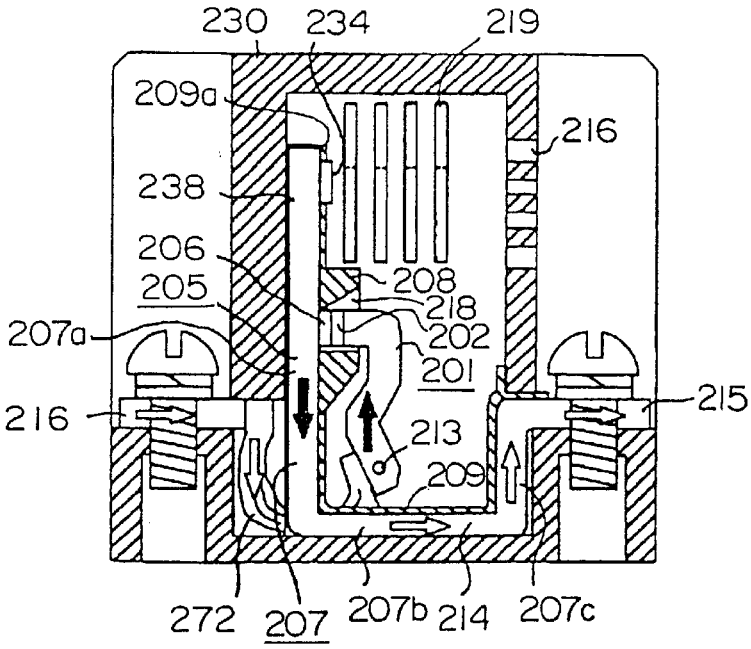
Figure 129:
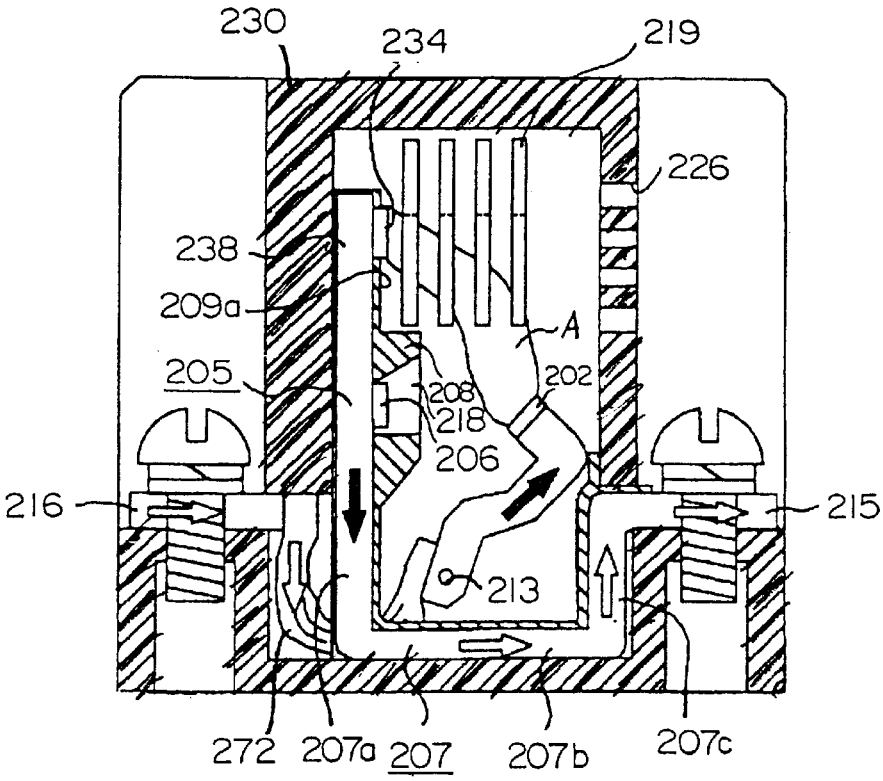
Figure 130:
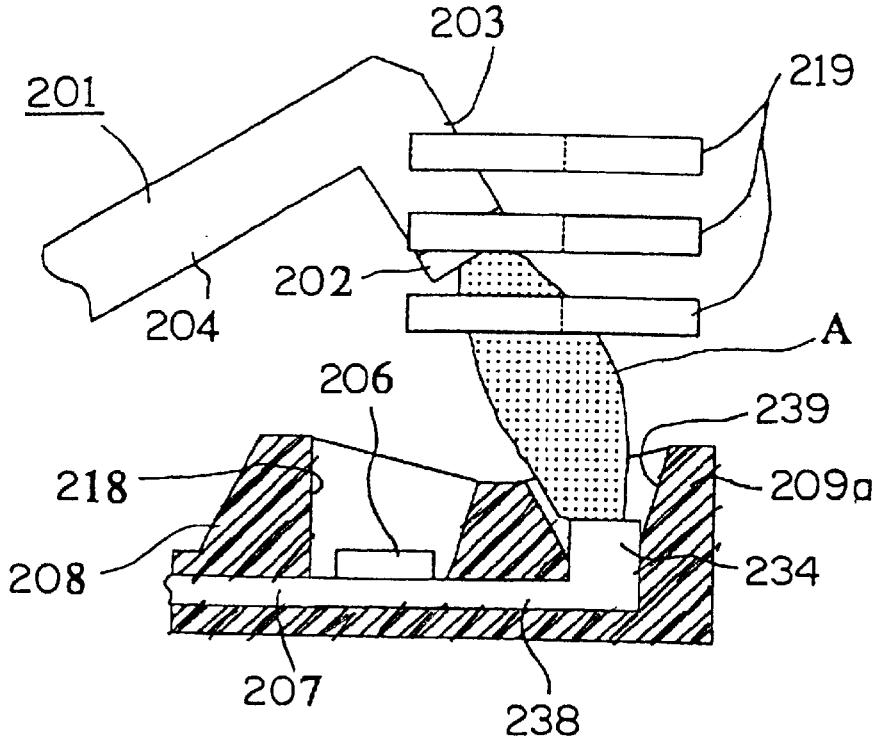
Figure 131:
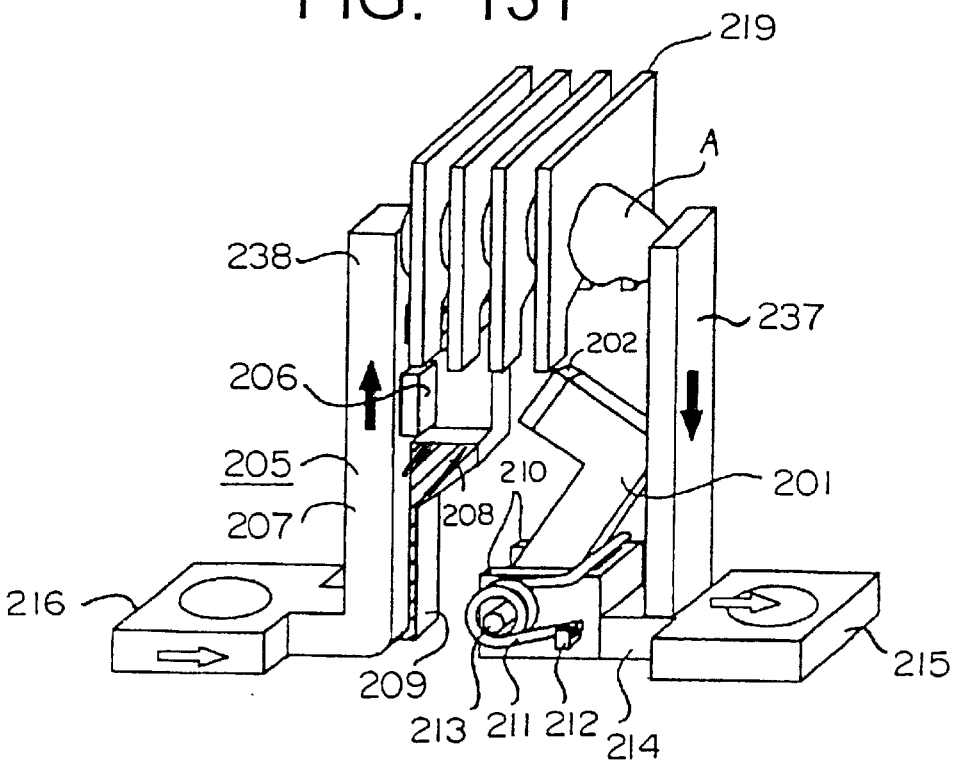
Figure 132:
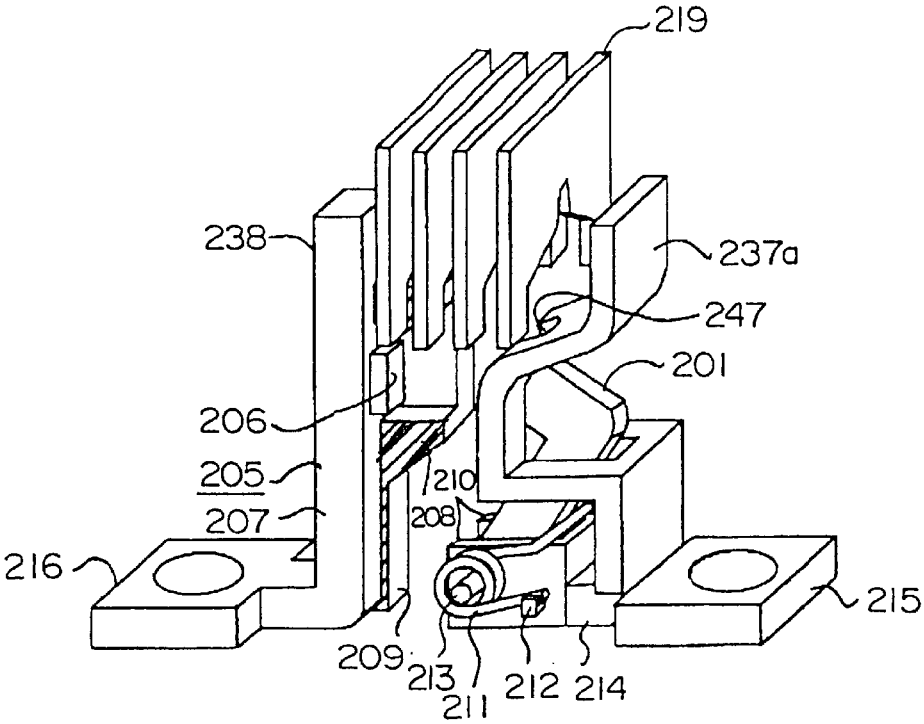
Figure 133:
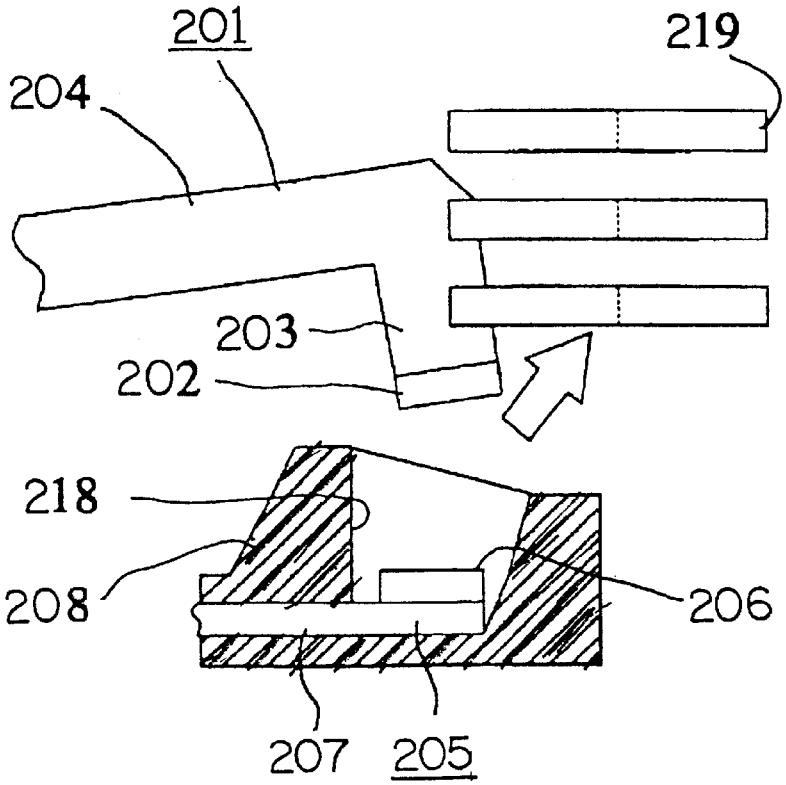
Figure 134:
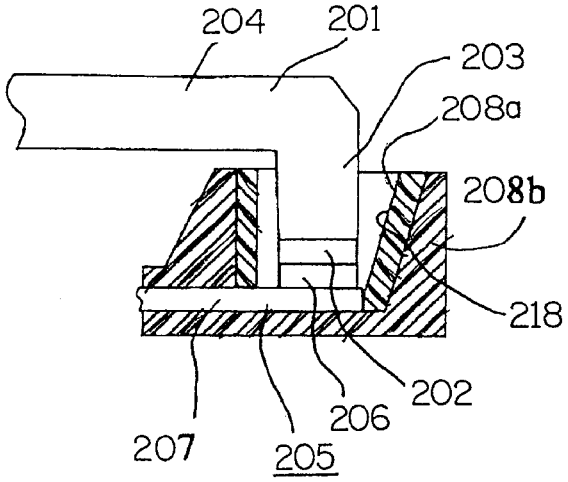
Figure 135:
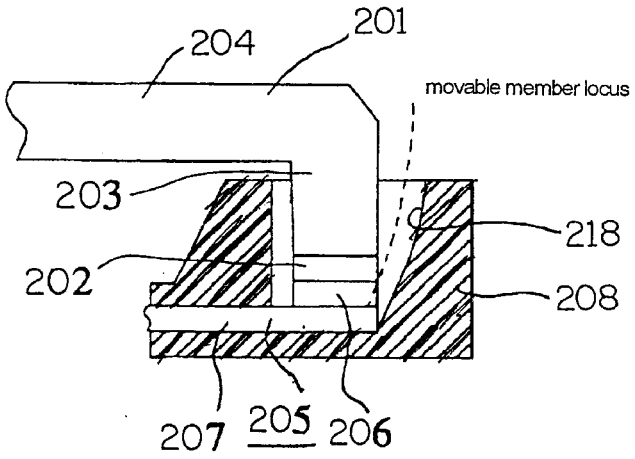
Figure 136:
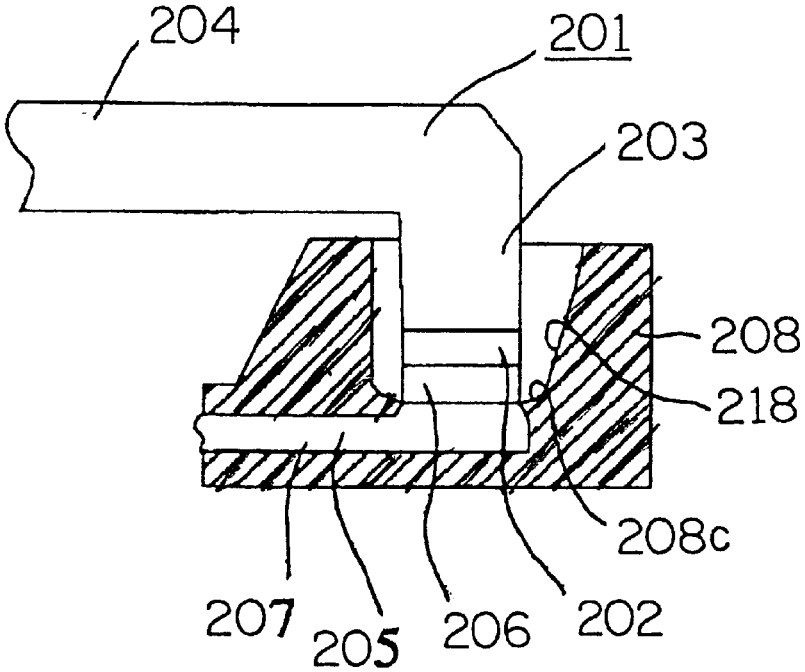
Figure 137:
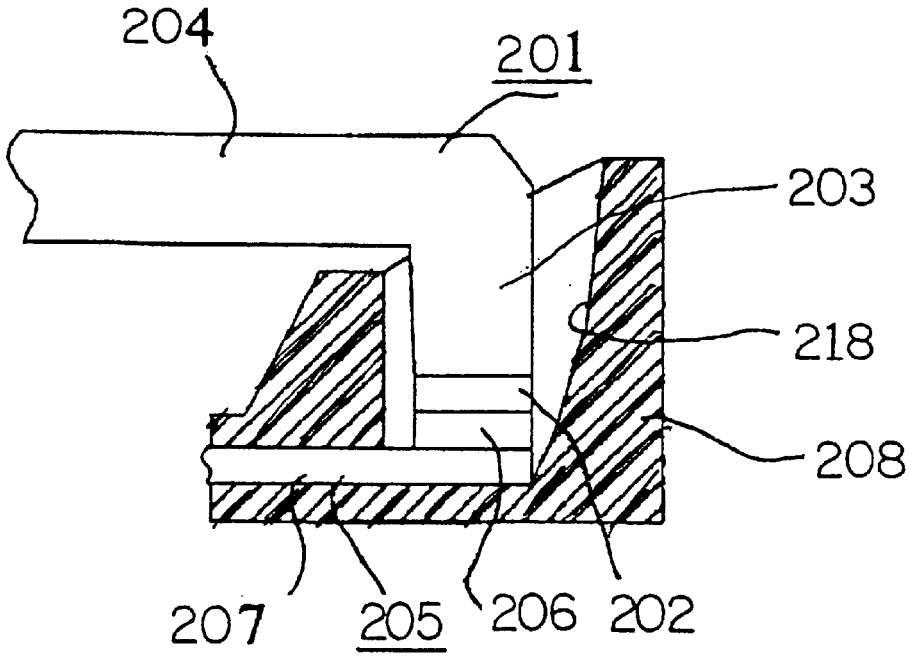
Figure 138:
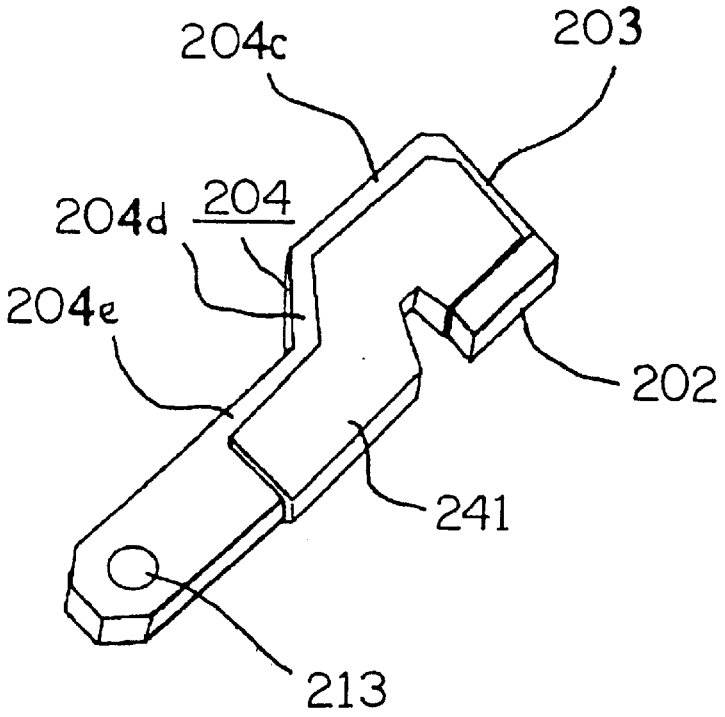
Figure 139:
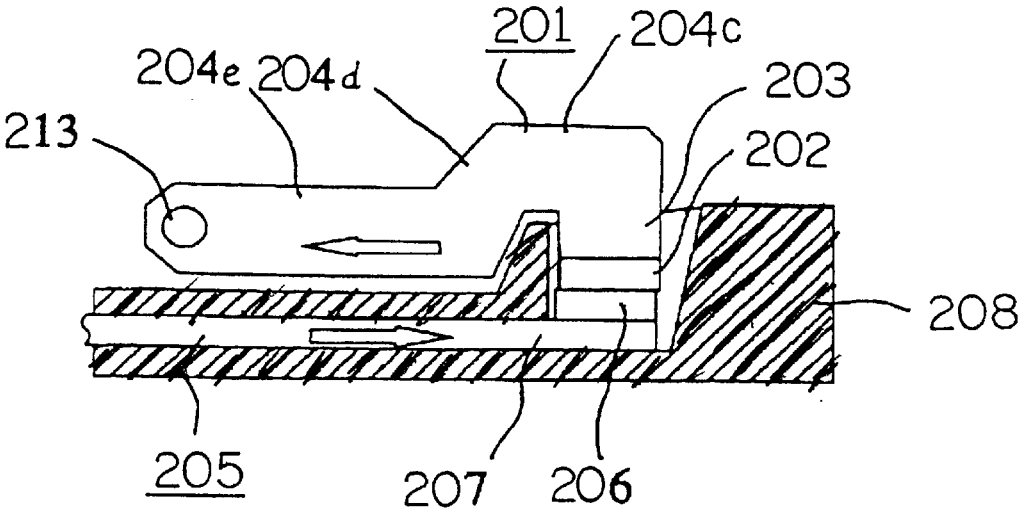
Figure 140:
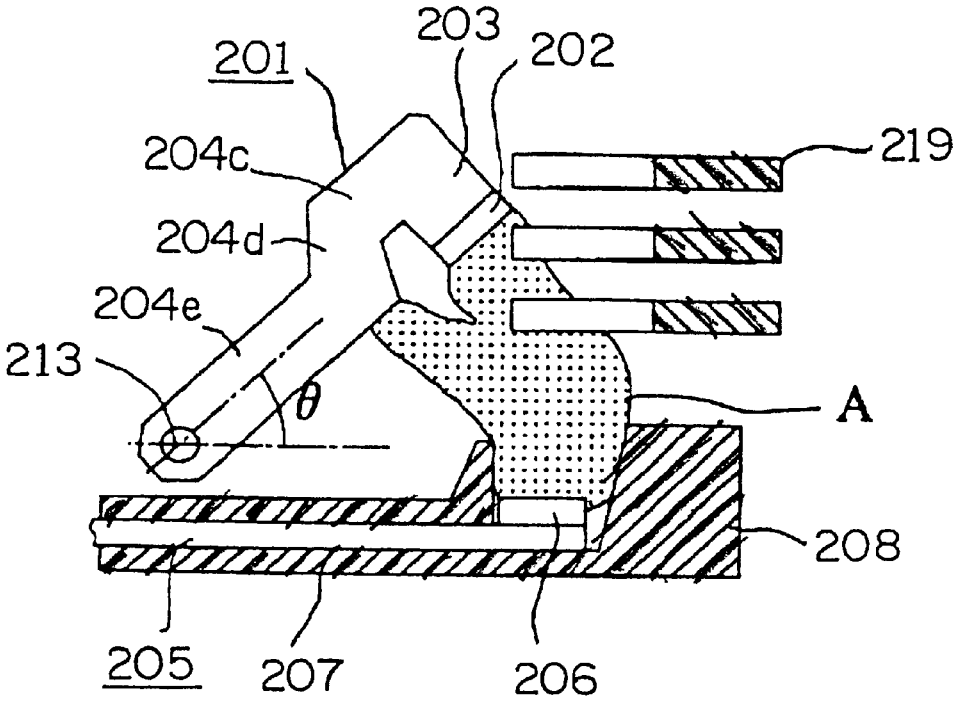
Figure 141:
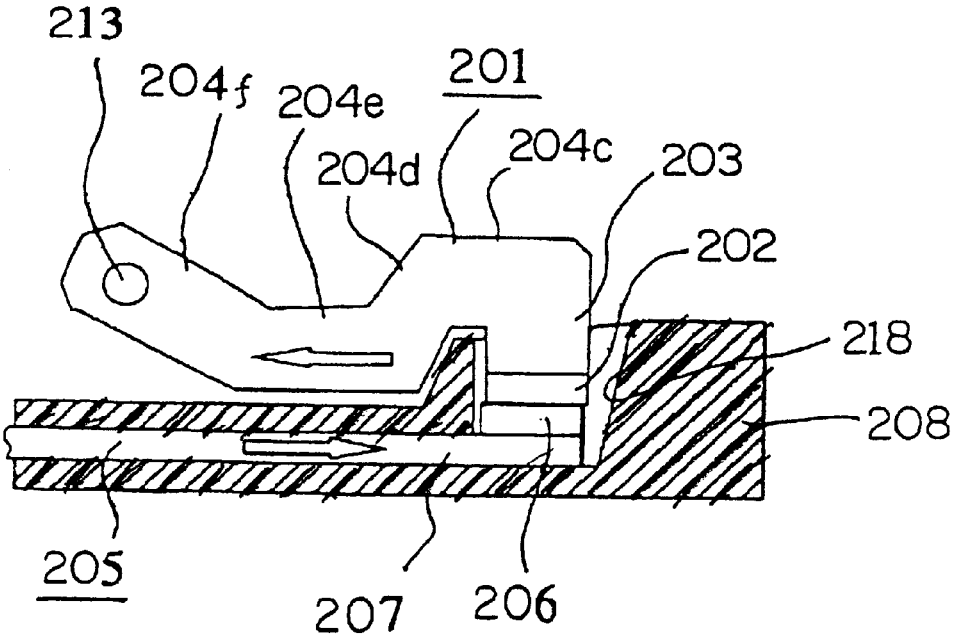
Figure 142:
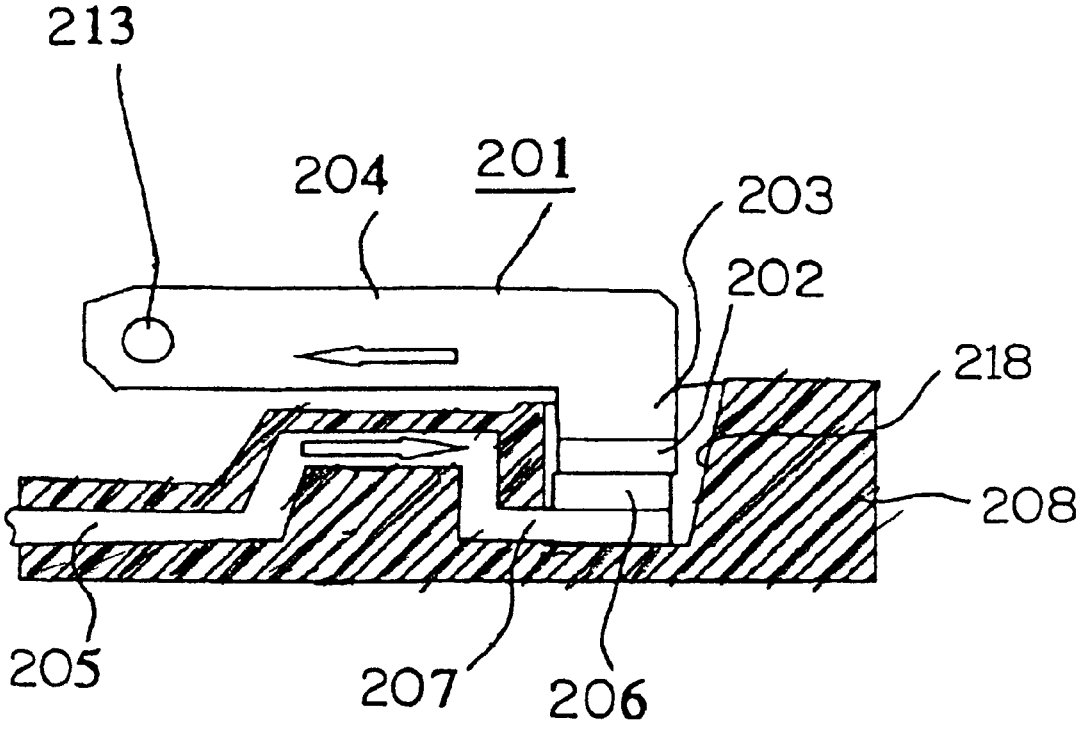
Figure 143:
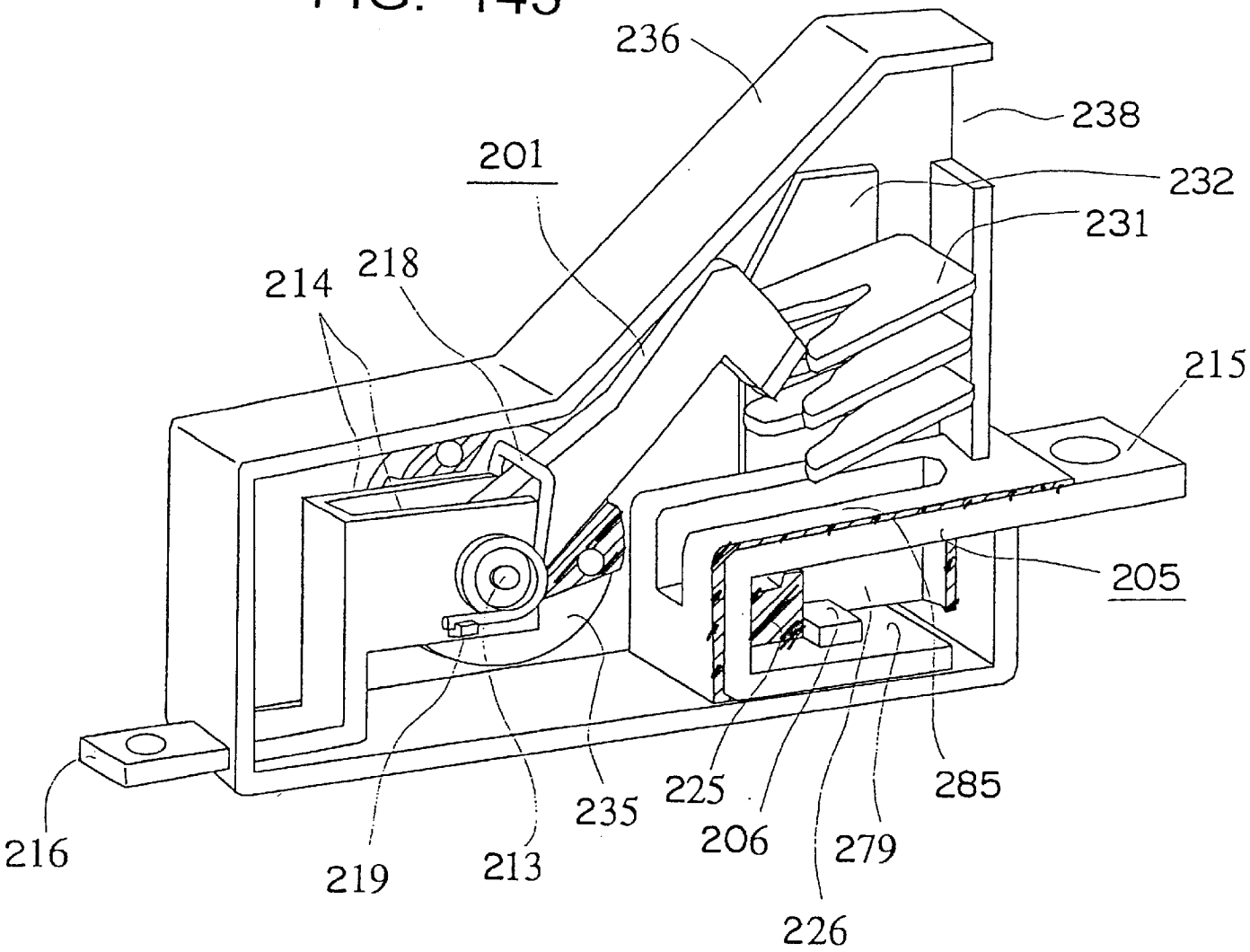
Figure 144:
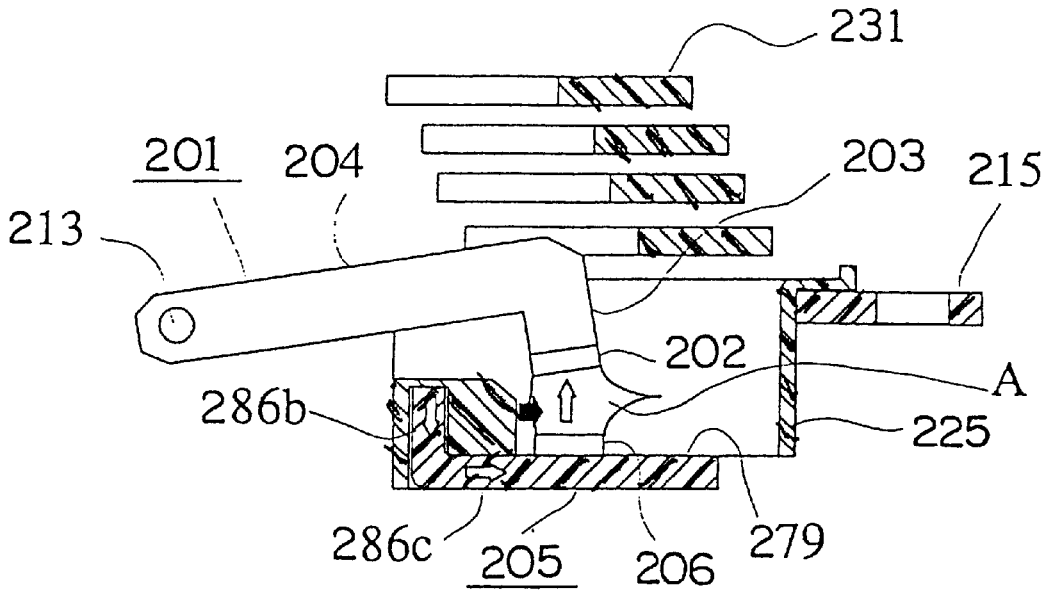
Figure 145:
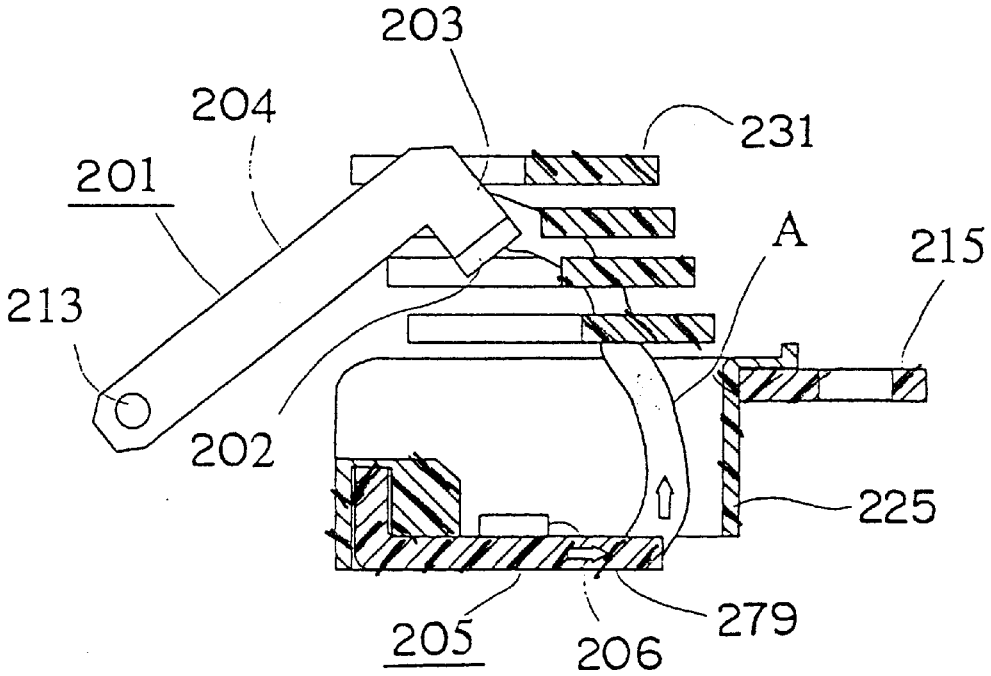
Figure 146:
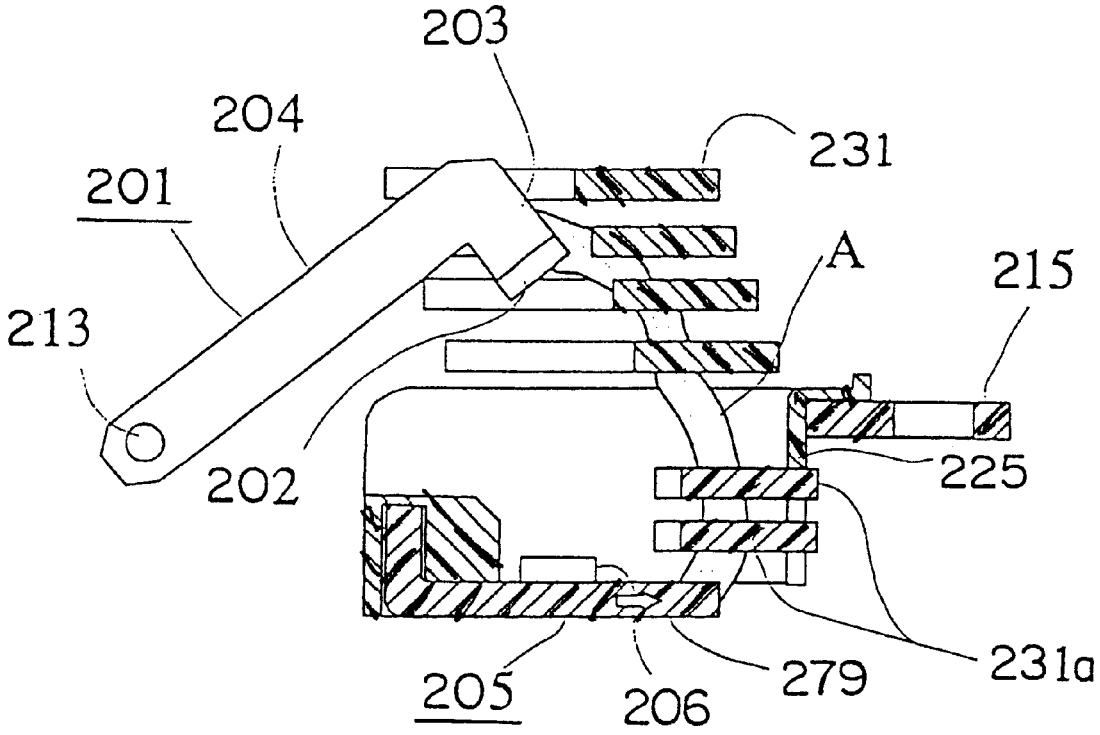
Figure 147:
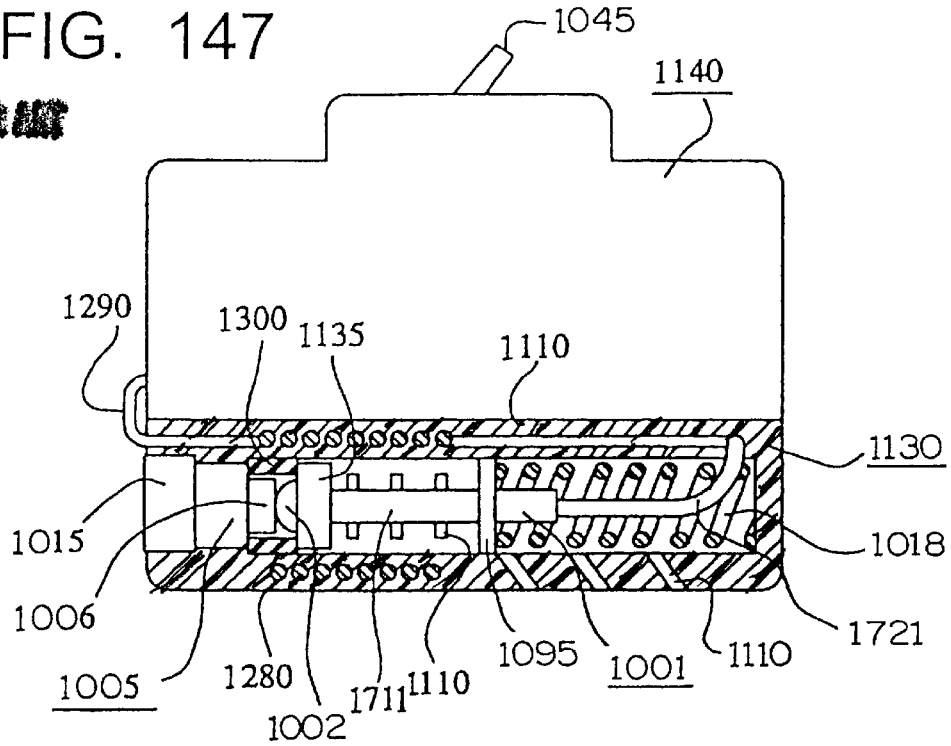
FIG. 147 PRIOR ART
Figure 148:
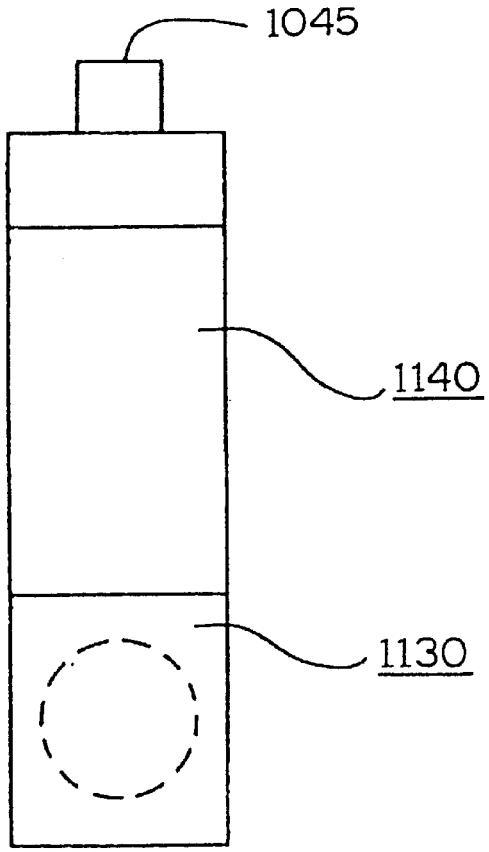
FIG. 148 PRIOR ART
Figure 149:
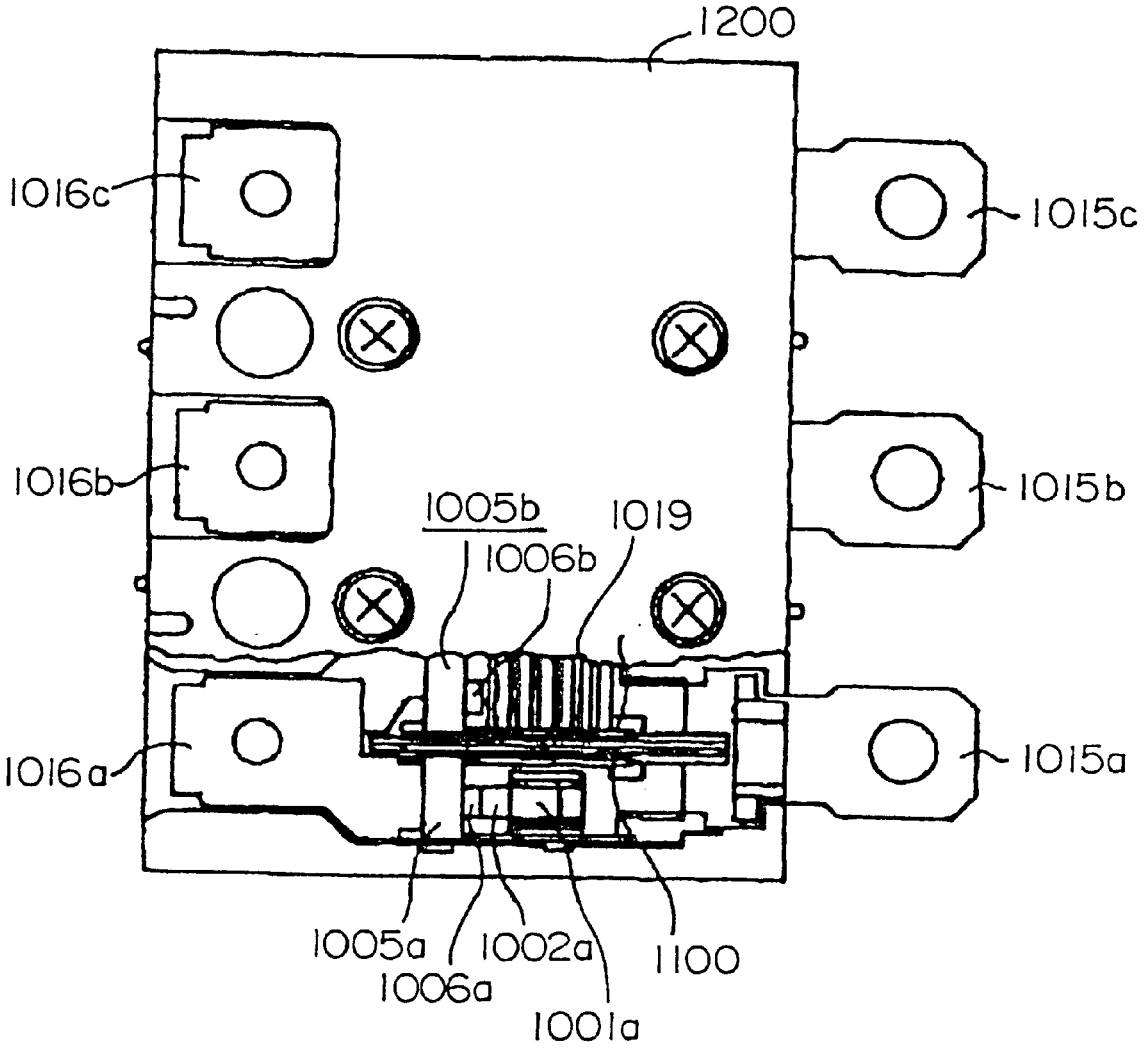
FIG. 149 PRIOR ART
Figure 150:
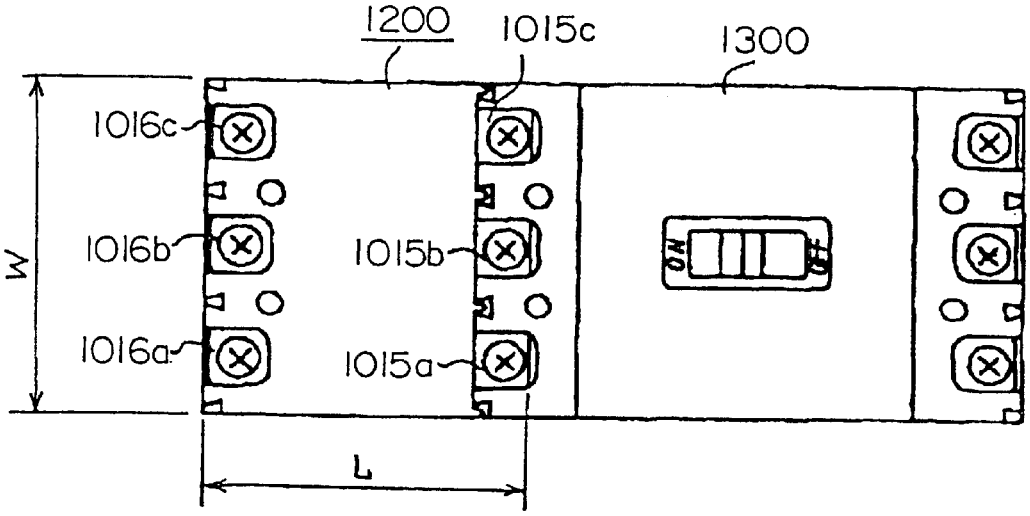
FIG. 150 PRIOR ART
Figure 151:
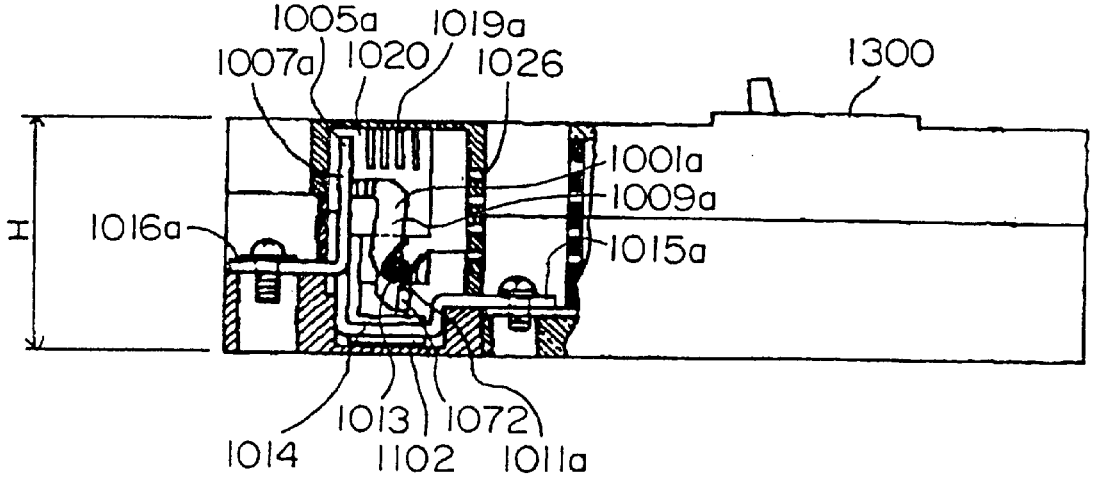
FIG. 151 PRIOR ART
Figure 152:
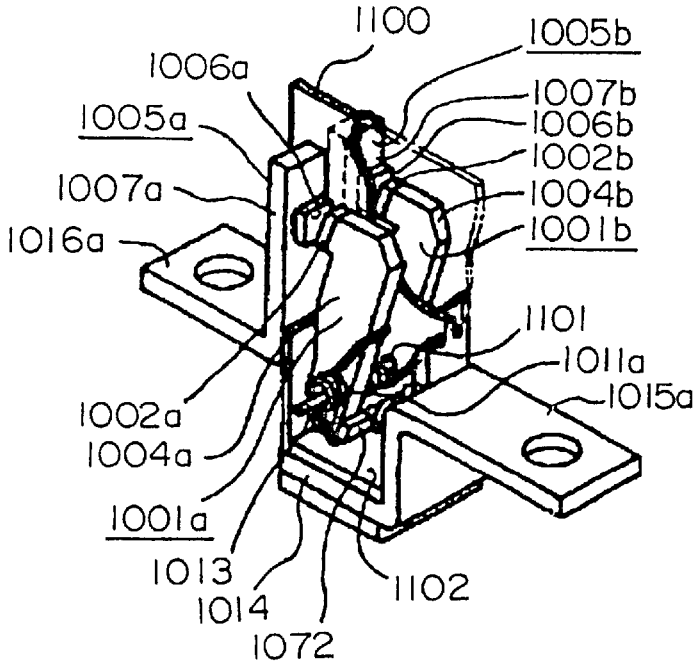
FIG. 152 PRIOR ART
Figure 153:
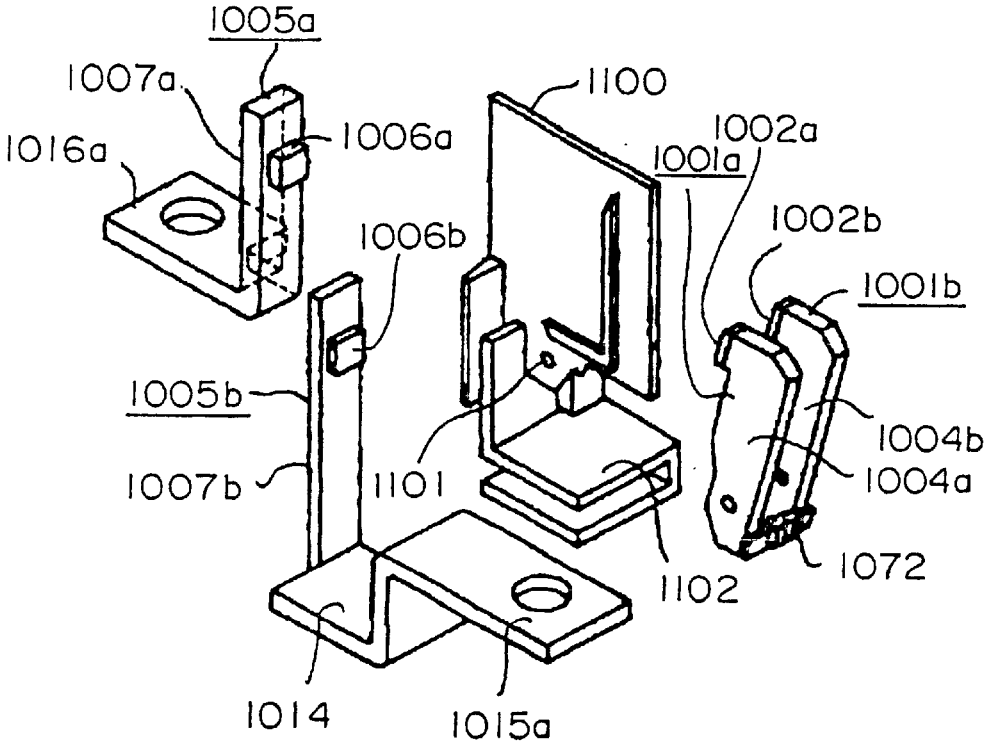
FIG. 153 PRIOR ART

FIG. 122(*a*) and 122(*b*) are graphs showing the effects of the atmosphere pressure to the arc voltage;

FIG. 123 is a graph showing the effects of the current value to the arc voltage;

FIG. 124 is a fragmental sectional view for explaining the operation of the fifty-sixth embodiment;

FIG. 125(*a*) and 125(*b*) are graphs showing the effects of the fifty-sixth embodiment;

FIG. 126 is a fragmental sectional perspective view for explaining the operation of the fifty-sixth embodiment;

FIG. 127 is a sectional view showing the current limiting device according to the fifty-sixth embodiment of the present invention;

FIG. 128 is a sectional view showing the current limiting device according to the fifty-seventh embodiment of the present invention;

FIG. 129 is a sectional view for explaining the operation of the fifty-seventh embodiment;

FIG. 130 is a fragmental sectional view showing the contact member portion of the current limiting device according to the fifty-eighth embodiment of the present invention;

FIG. 131 is a fragmental sectional view showing the main portion of the current limiting device according to the fifty-ninth embodiment of the present invention;

FIG. 132 is a fragmental sectional view showing the main portion of the current limiting device according to the sixtieth embodiment of the present invention;

FIG. 133 is a fragmental sectional view showing the contact member portion of the current limiting device according to the sixty-first embodiment of the present invention;

FIG. 134 is a fragmental sectional view showing the contact member portion of the current limiting device according to the sixty-second embodiment of the present invention;

FIG. 135 is a fragmental sectional view showing the contact member portion of the current limiting device according to the sixty-third embodiment of the present invention;

FIG. 136 is a fragmental sectional view showing the contact member portion of the current limiting device according to the sixty-fourth embodiment of the present invention;

FIG. 137 is a fragmental sectional view showing the contact member portion of the current limiting device according to the sixty-fifth embodiment of the present invention;

FIG. 138 is a fragmental sectional view showing the movable member of the current limiting device according to the sixth-sixth embodiment of the present invention;

FIG. 139 is a fragmental sectional view showing the contact member portion of the current limiting device according to the sixth-sixth embodiment of the present invention;

FIG. 140 is a fragmental sectional view for explaining the operation of the sixty-sixth embodiment;

FIG. 141 is a fragmental sectional view showing the contact member portion of the current limiting device according to the sixty-seventh embodiment of the present invention;

FIG. 142 is a fragmental sectional view showing the contact member portion of the current limiting device according to the sixty-eighth embodiment of the present invention;

FIG. 143 is a fragmental sectional view showing the arc extinguishing unit of the current limiting device according to the seventieth embodiment of the present invention;

FIG. 144 is an explanation view for explaining the operation of the main portion of the seventieth embodiment;

FIG. 145 is an explanation view for explaining the operation of the main portion of the seventieth embodiment;

FIG. 146 is an explanation view for explaining the operation of the main portion of the current limiting device according to the seventy-first embodiment of the present invention;

FIG. 147 is a fragmental sectional front view showing a conventional interrupter having a current limiting function;

FIG. 148 is a side view of the conventional interrupter having a current limiting function;

FIG. 149 is a fragmental sectional view showing the conventional three pole current limiting unit;

FIG. 150 is a front view of a current limiting circuit interrupter constituted by integrally connecting the current limiting unit shown in FIG. 149 to a standard circuit interrupter;

FIG. 151 is a fragmental sectional side view of the current limiting interrupter of FIG. 150;

FIG. 152 is a perspective view of the main portion of one pole unit of the three pole current limiting unit shown in FIG. 149; and FIG. 153 is an exploded perspective view of two pairs of contact pair shown in FIG. 152.

BEST MODES FOR CARRYING OUT THE INVENTION

Embodiment 1

Figure 1:
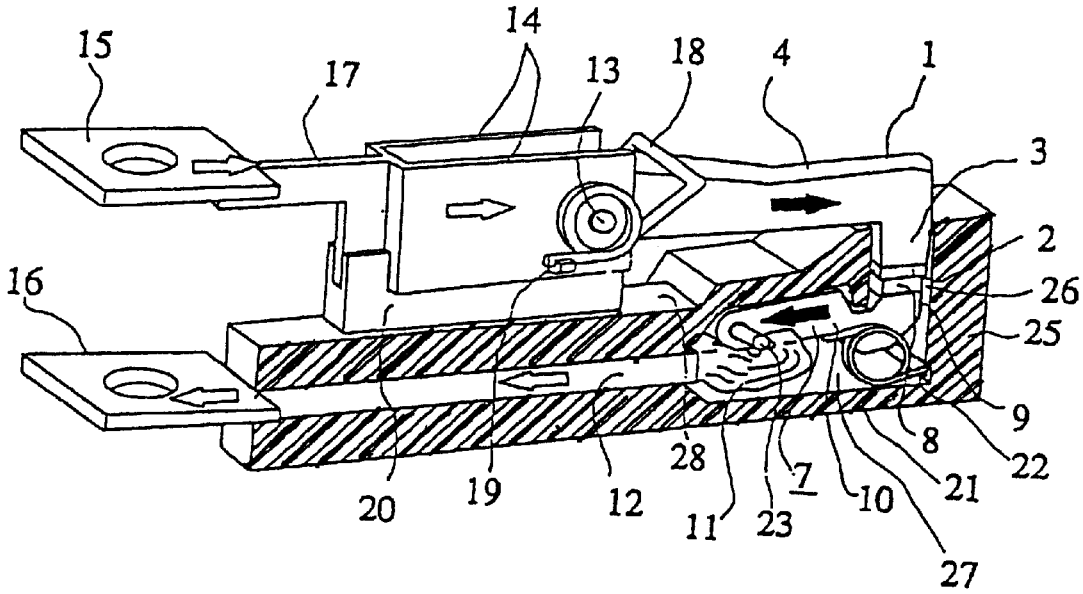
FIG. 1 is a fragmental perspective view showing the main portion of the circuit interrupter having a current limiting function according to the first embodiment of the present invention.

The first embodiment of the present invention will now be described in conjunction with FIG. 1. FIG. 1 is a perspective view showing the main portion of a circuit interrupter according to the first embodiment in the contact closed state, with one portion of a cylindrical insulator 25 and an insulating cover 28 which is an electrical insulator covering the stationary conductor 12 is removed for illustrating the internal structure. In FIG. 1, 1 is a movable member of substantially L-shape having a movable contact 2 and a movable arm vertical portion 3 to which the movable contact 2 is secured and a movable arm horizontal portion 4 substantially perpendicular to the movable arm vertical portion 3. The movable member 1 forms one contact pair together with a repulsive member 7 composed of a repulsive contact 8 and a repulsive arm vertical portion 9 and a repulsive arm horizontal portion 10, the movable member 1 and the repulsive member 7 are biased in the contacting direction to each other by a spring 18 and a spring 21, respectively. The repulsive member 7 is shorter than the movable member 1 in arm length to provide a smaller inertial moment. Also, the movable member 1 and the repulsive member 7 are supported rotatably about the movable member rotary shaft 13 and about the repulsive member rotary shaft 23, respectively. The movable member 1 is electrically connected in series to a terminal 15 through a sliding contact 14 and the connecting conductor 17. On the other hand, the repulsive member 7 is electrically connected in series to a terminal 16 through a flexible conductor 11 and a stationary conductor 12.

Arrows shown in FIG. 1 indicate a current path upon the current conduction, in which it is seen that the arrangement is such that the current in the movable arm horizontal portion 4 and the current in the repulsive arm horizontal portion 10 are substantially parallel and opposite in direction. Also, the arrangement is such that, when the movable member 1 and the repulsive member 7 are in the closed state, the repulsive contact and a portion of the repulsive arm vertical portion 9 close to the repulsive contact 8 as well as the movable contact 2 and the portion of the movable arm vertical portion 3 close to the movable contact 2 are positioned within a cylindrical space 26 surrounded by a cylindrical insulating material 25 and that, when the both contacts are in the open state, the movable contact 2 is positioned outside of the cylindrical space 26. Further, the repulsive member 7 is disposed within a pressure accumulation space 27 which is defined by the cylindrical insulating material 25 and the insulating cover 28 and the like and which does not have opening except for the cylindrical space 26.

The description will now be made as to the arc voltage increase condition under a high pressure of a large current arc at a relatively short gap generated upon the current limiting operation within the circuit interrupter having the arc type current limiting function. The measurement results of the arc voltage changes when an atmospheric pressure P of the short gap large current arc of several centimeters or less is changed with the experimentation apparatus shown in FIG. 2 is used is shown in FIG. 3. In FIG. 2, 400 is a pair of circular rod-shaped electrodes, 401 is a hermetic vessel, 402 is an ac source, 403 is a switch and 404 is a pressurization bomb.

In the experimentation apparatus shown in FIG. 2, the arc is generated between the opposing pair of rod-shaped electrodes 400, so that the inter-electrode distance equals to the arc length L. As apparent from FIG. 3(*a*), when the arc current value is relatively small, the arc voltage becomes higher as the arc atmospheric pressure P increase at most of the various arc lengths L. On the other hand, as shown in FIG. 3(*b*), when the arc current value is relatively large, the arc voltage is not substantially changed except for when the arc length L is relatively long even when the arc atmosphere pressure P is increased. The ratio R of the arc voltage V (P=high) when the atmosphere pressure P shown in FIGS. 3(*a*) and 3(*b*) is high and the arc voltage V (P=low) when the atmosphere pressure P is low is obtained and plotted into a graph as shown in FIG. 4.

Figure 4:
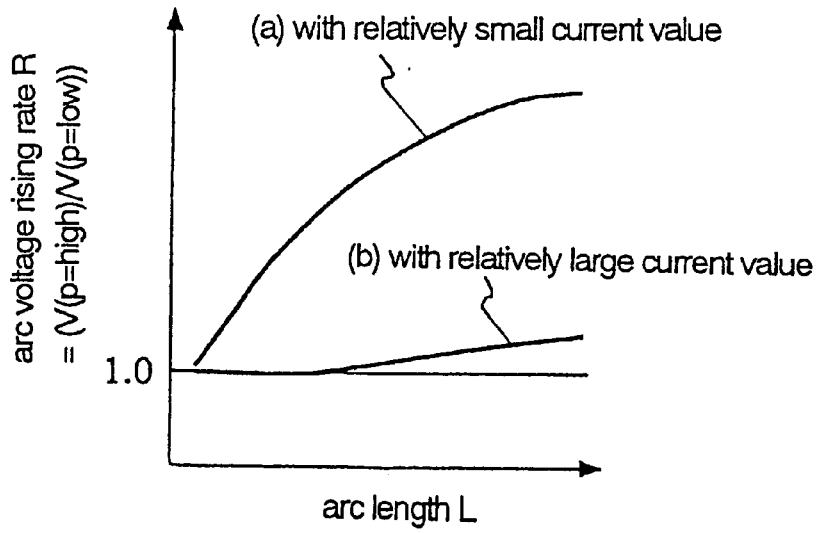
FIG. 4 is a graph showing the effects of the current value to the arc voltage.

As apparent from FIG. 4, the arc voltage rising rate R when the arc current value is relatively small becomes higher as the arc length increases. On the other hand, the arc voltage rising rate R when the arc current value is relatively large does not substantially increase until the arc length becomes equal to or higher than a certain value. From the above, it is understood that, in the short gap large current arc, the condition for effectively increase the arc voltage by increasing the arc atmosphere pressure is to simultaneously satisfy (a) that the arc current is relatively small and (b) that the arc length is large.

Upon a fault such as short-circuiting, the circuit current rapidly increases immediately after the occurrence of the fault. Therefore, in order to limit the fault current by increasing the arc voltage at a high atmosphere pressure with the above two conditions satisfied, it is necessary that (1) the high pressure atmosphere is generated at least immediately after the generation of the arc (immediately after the generation of the fault) and that (2) the arc length is elongated when the arc current is still relatively small (immediately after the generation of the fault). After the increase of the fault current, the current limiting performance is not very much improved. Further, the high pressure atmosphere after the increase of the fault current does not contribute very much to the improvements in the current limiting performance and, moreover, causes the damages to the housing or the like.

Figure 5:
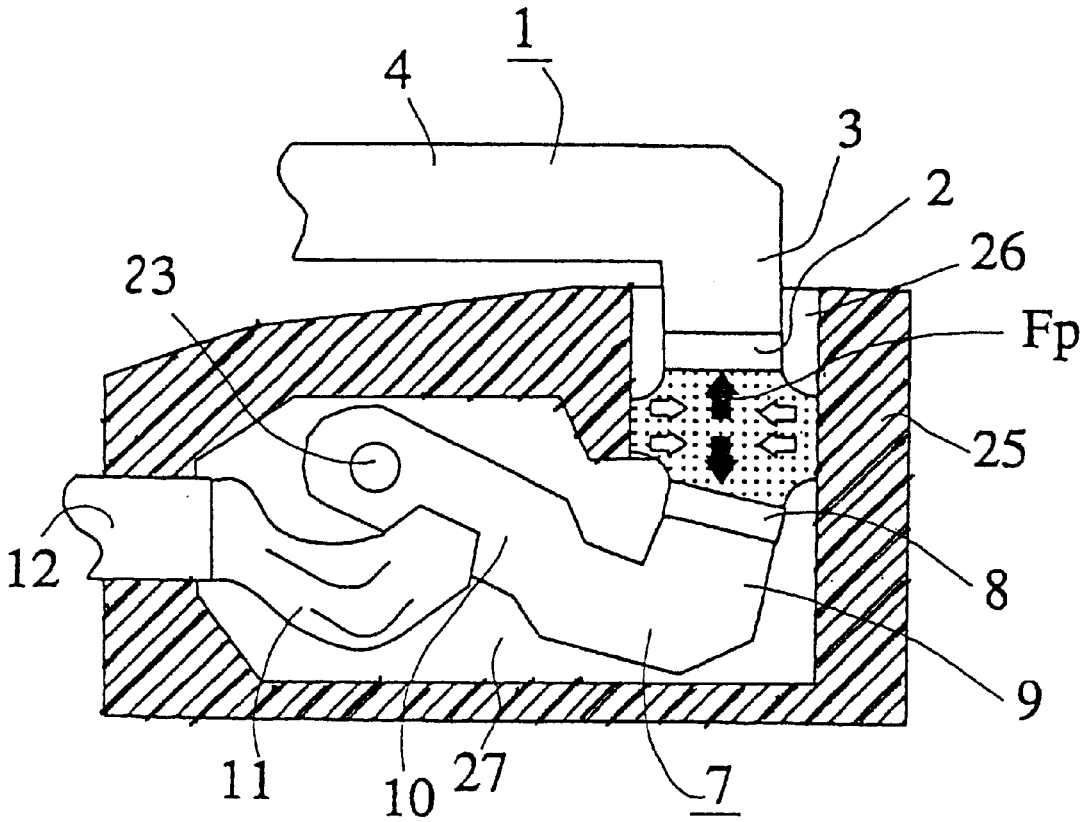
FIG. 5 is a fragmental sectional view for explaining the operation of the first embodiment.

In the current limiting device shown in FIG. 1, when the flowing current rapidly increases due to the generation of the short circuiting fault or the like, an electromagnetic repulsive force F1 by the current concentration at the contact contacting surface and an electromagnetic repulsive force F2 by a current in the movable arm horizontal portion 4 previously discussed and a substantially parallel and opposite current in the repulsive arm horizontal portion 10 cause the contacts to separate against the contacting pressure provided by springs 18 and 21 to generate an arc across the contacts. This state is illustrated in FIG. 5. Upon the arc generation, the electromagnetic repulsive force F1 due to the current concentration at the contact contacting surface diminishes, but the electromagnetic force F2 by the current in the movable arm horizontal portion 4 previously discussed and the substantially parallel and opposite current in the repulsive arm horizontal portion 10 continues to cause the rotation of the movable member 1 into the contact separating direction. The main contact separating electromagnetic forces acting on the movable member 1 and the repulsive member 7 are in the relationship of an action and a reaction and have substantially equal magnitude. However, since the moment of inertia of the repulsive member 7 is smaller than that on the movable member 7, the repulsive member 7 rotates faster than the movable member 1 does. That is, the use of the repulsive member 7 allows a significant improvement in the contact separating speed as compared to the contact separation of the movable member 1 alone.

Also, as shown by white arrows in the figure, upon the generation of an arc, a large amount of vapor generates from the inner surface of the cylindrical insulating material 25 and a high pressure atmosphere is generated within the cylindrical space 26 surrounded by the cylindrical insulating material 25. Due to this high pressure generation within the cylindrical space 26, as shown by black arrows in the figure, the movable member 1 and the repulsive member 7 are subjected to a contact separating force Fp due to the pressure difference. The contact separating force Fp due to the pressure difference and the previously described electromagnetic force F2 cause the movable member 1 and the repulsive member 7 to be rotated at a high speed to rapidly separate the contacts. This rapid contact separation causes the arc length to be quickly elongated within the high pressure atmosphere to sharply raise the arc voltage and the fault current reaches at its peak value.

Figure 6:
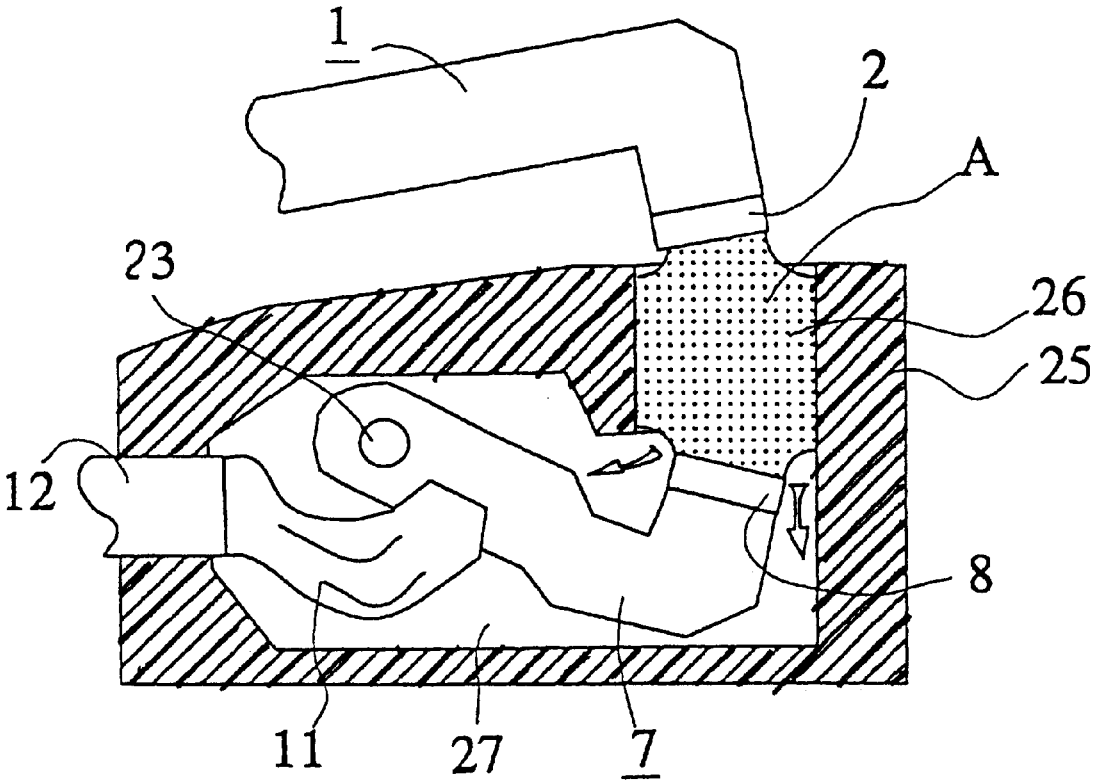
FIG. 6 is a fragmental sectional view for explaining the operation of the first embodiment.
Figure 7:
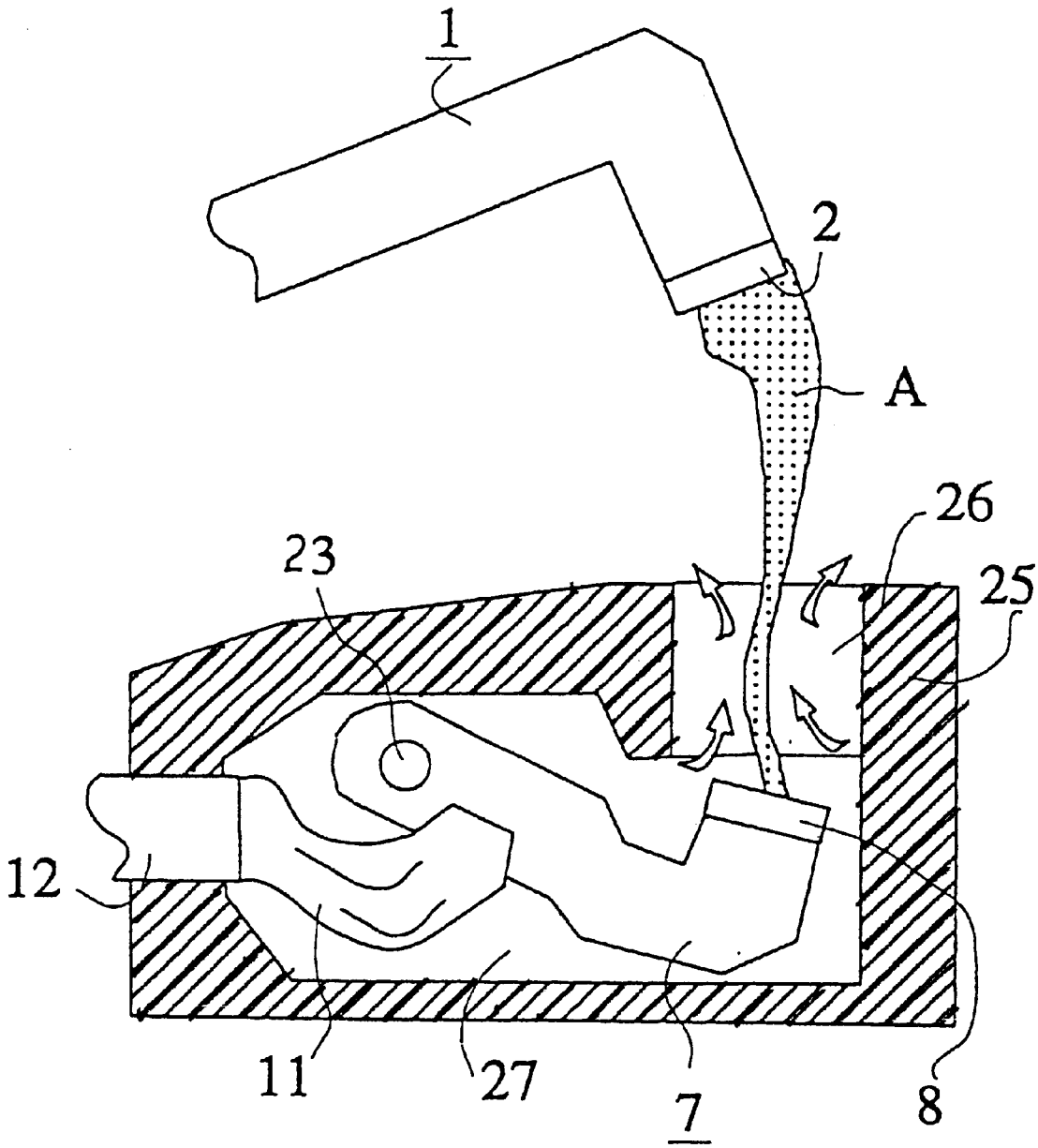
FIG. 7 is a fragmental sectional view for explaining the operation of the first embodiment.

The state in which a high current arc at about the above-discussed current peak time is illustrated in FIG. 6. As shown by white arrows, the high pressure vapor generated within the cylindrical space 26 during the generation of a high current arc flows into the pressure accumulation space 27 to raise the pressure in the pressure accumulation space 27. This pressure accumulated therein generates a flow from the pressure accumulation space 27 to the exterior of the cylindrical insulating material 25 through the cylindrical space 26 at around the time from before the arc extinction to after the current interruption. This phenomenon is illustrated in FIG. 7. In FIG. 7, the movable member 1 is rotated to substantially the most separated position, the movable contact 2 is positioned outside of the cylindrical space 26 and the state of immediately before the current interruption, i.e., immediately before the arc extinction is illustrated.

White arrows illustrate the flow starting from the pressure accumulation space 27, through the cylindrical space 26, and discharged to the outside. This flow shown by the arrows is at its fastest in the cylindrical space 26 in the shape of a nozzle, this high speed flow removes heat of the arc to promote the arc extinction. This arc extinction promotion function quickly pinches the current before the interruption, so that the passing energy which is another index of the current limiting performance is decreased. Also, this flow causes the previously discussed high temperature gas and the molten matters to be discharged to the outside, so that the insulation in the cylindrical space 26 is quickly recovered and attachment of the molten matters to the surface of the repulsive contact 8 can be prevented.

It is to be noted that, in the state where the movable member 1 reaches at its maximum contact separation position as shown in FIG. 7, the current peak has already been passed and a sufficiently high arc voltage is generated, so that the fault current rapidly decreases to reach the zero point. At this time, the movable contact 2 is positioned outside of the space surrounded by the cylindrical insulating material 25, so that the electrode metal vapor in the vicinity of the movable contact 2 can be easily diffused or cooled by an ordinary means (such as a vapor flow from an insulating material, a grid or the like), whereby the current can be easily interrupted by a sufficient insulation recovery between the electrodes. Also, even when the movable member 1 blurs and displaces, it does not contact with the inner surface of the cylindrical insulating material 25, so that no re-arcing due to surface insulating break down occurs. By additionally providing any means (such as latch mechanism, link mechanism, etc.) for restricting the movable member 1 in the vicinity of the maximum contact separation position and preventing re-closing of the movable member 1, a circuit breaker having a superior current limiting performance can be obtained. Further, the flow blasting from the pressure accumulation space 27 through the cylindrical space 26 can blow off the relatively high temperature metal vapor and particles drifting around the outlet of the cylindrical space 26 and between the movable contacts 2, so that the insulation recovery between the contacts immediately after the interruption can be further promoted to prevent the re-arcing after the current interruption.

Figure 8:
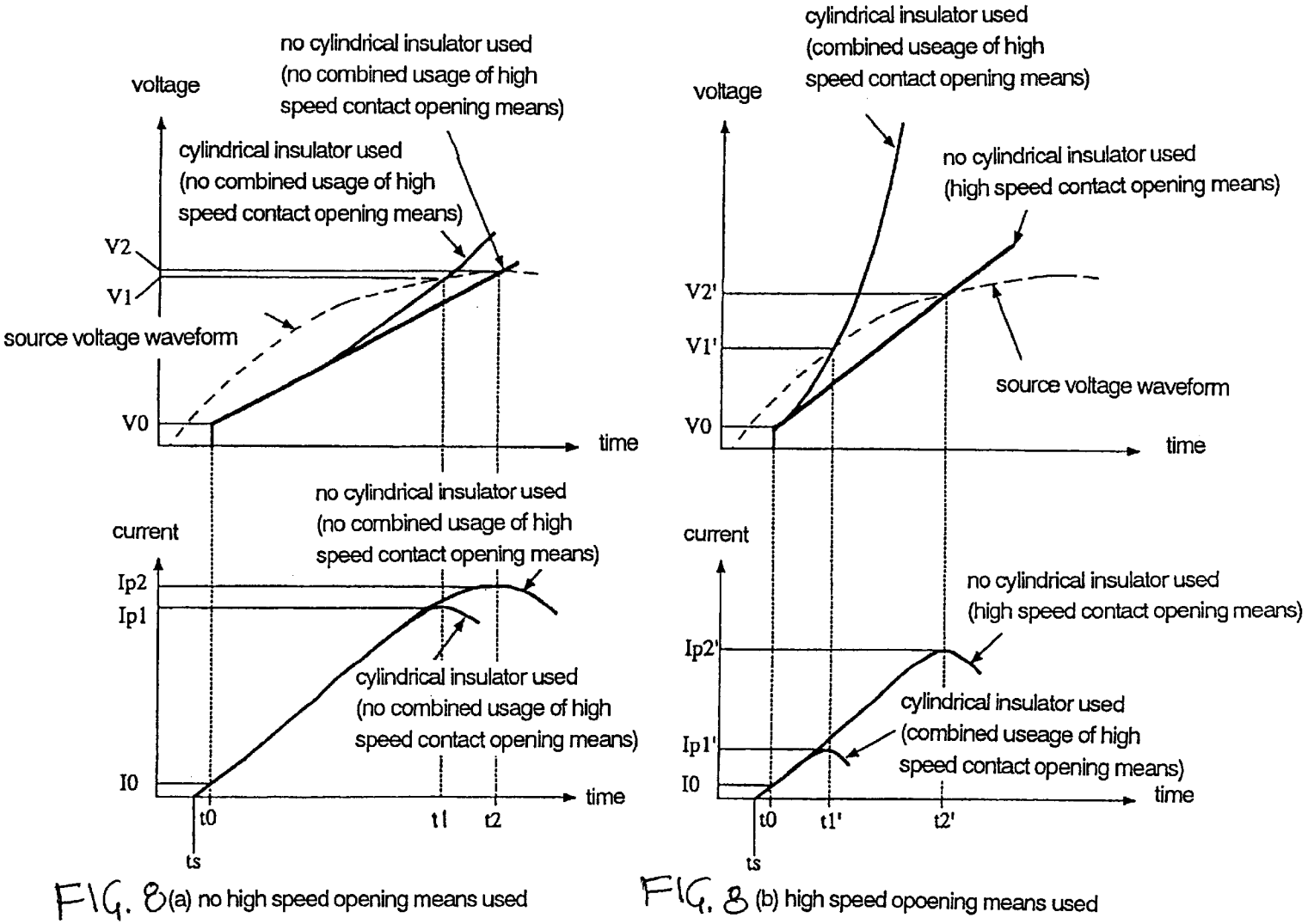
FIGS. 8(*a*) and 8(*b*) are graphs showing the effects of the first embodiment.

As described above, according to this embodiment, the high pressure atmosphere and the high speed contact separating means employing the cylindrical insulating material 25 are used together in combination, such the combined use is necessary to obtain a superior current limiting performance. FIG. 8(*a*) illustrates the effect of the cylindrical insulating material when the high speed contact separating means is not used, and FIGS. 8(*b*) illustrates there effect when the high speed contact separating means is used. In this figure, ts is a time at which the fault is generated, t0 is a time at which the contacts are separated, V0 is a voltage drop between the contacts and a broken line is a source voltage waveform. FIG. 8(*a*) illustrates where no high speed contact separating means is used and a current peak Ip1 and a current peak Ip2 are reached, respectively, at a time t1 (with the cylindrical insulating material) and a time t2 (without the cylindrical insulating material) at which the arc voltage catch up with the source voltage. When no high speed contact separating means is used, the increase of the arc length is slow as compared with the increase of the fault current, so that the above conditions in which the arc length is short and the arc voltage is increased are difficult to be satisfied even when a high pressure atmosphere is generated by the cylindrical insulating material 25. Therefore, in FIG. 8(*a*), the extent of the improvement of the current peak Ip, i.e., ΔIp=Ip2−IP1 is small even when the cylindrical insulating material is used.

On the other hand, in FIG. 8(*b*) in which the high speed contact separating means is used, the arc length becomes sufficiently long before the fault current become high, so that the above conditions for increasing the arc voltage in a high pressure atmosphere can be satisfied. It is apparent that the extent of improvement of the current peak Ip, i.e., ΔIp'=Ip2'−IP1', where a current peak Ip1' and a current peak Ip2' are reached, respectively, at a time t1' (with the cylindrical insulating material) and a time t2' (without the cylindrical insulating material) at which the arc voltage catch up with the source voltage is dramatically increased as compared with the extent of the improvement ΔIp of the current peak Ip when no high speed contact separating means is used.

Also, in this embodiment, differing from the conventional example shown in FIG. 147, the exciting coil for assisting the separation of the contact member needs not be provided, so that it is possible to obtain a current limiter superior in low impedance current limiting performance, which can be applied to a circuit where a large current carrying capacity is required.

Further, since the movable member 1 and the repulsive member 7 are rotated to be separated, the required dimensions in the direction of opening and closing of the contact pair is a sum of a lower wall thickness of the pressure accumulation space 27, the repulsive arm vertical portion 9, a thickness of the repulsive contact 8, the maximum separation distance of the contact, a thickness of the movable contact 2 and the movable arm vertical portion 3, whereby the necessary dimension in the above direction can be made smaller than that of the conventional direct movement type current limiter. Therefore, a contact separation distance necessary for efficiently associating the high pressure with the increase in the arc voltage can be easily established.

It is to be noted that, in the embodiment shown in FIG. 1, the movable member 1 and the repulsive member 7 are substantially L-shaped. However, the repulsive member 7 alone which separates more rapidly that the movable member 1 upon the fault current interruption may be made substantially L-shaped and the movable member 1 may be made substantially ordinary rod-shaped. With this structure, not only a high current limiting performance is obtained owing to the high speed separation of the repulsive member 7, an arc spot at the tip portion on the movable member side is easily transferred to an end surface opposite to the movable rotary shaft 13, elongating the arc immediately before the interruption, thereby improving the overload current interrupting performance and the direct current interrupting performance.

Embodiment 2

Figure 9:
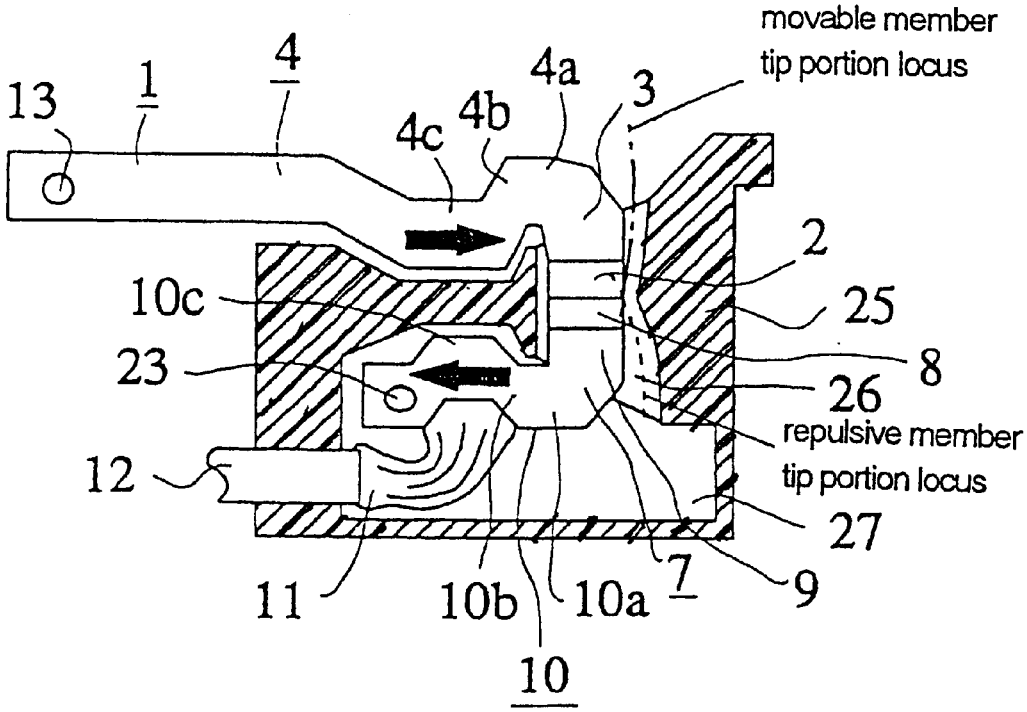
FIG. 9 is a fragmental sectional view showing the main portion of the circuit interrupter having a current limiting function according to the second embodiment.

The second embodiment of the present invention will now be described in conjunction with the figure. FIG. 9 is a fragmental sectional view showing the main portion such as the cylindrical insulating material 25, the repulsive member 7, the movable member 1 and the like of this embodiment, and in the figure, a locus drawn during the contact separating movement by the point of the movable member 1 most remote from its rotating center is depicted by a dot-and-dash line, and a locus drawn during the contact separating movement by the point of the repulsive member 7 most remote from its rotating center is depicted by a dash line. The surface portions of the cylindrical insulating material 25 that oppose to the tip portions of the movable member 1 and the repulsive member 7 are configured into an arc-shape to maintain a constant clearance with respect to the dot-and-dash line and the broken line. Generally, the rotary shaft 13 of the movable member 1 is disposed above the contact contacting surface and the rotary shaft 23 of the repulsive member 7 is disposed below the contact contacting surface, so that the locuses of the movable member 1 and the repulsive member 7 expand from the contact contacting position in the direction away from the movable member rotary shaft 13 and the repulsive member rotary shaft 23, respectively. Therefore, when the surface of the cylindrical insulating material 25 opposing to the tip portions of the movable member 1 and the repulsive member 7 are made vertical as shown in FIG. 1, that surface must be positioned far from the contact contacting position, making the volume surrounded by the cylindrical insulating material 25 is increased. This often increases the time necessary for generating a sufficiently high atmosphere. Therefore, the inner surface of the cylindrical insulating material 25 is formed to extend along the locuses of the tip portions of the movable member 1 and the repulsive member 7 as illustrated in FIG. 9, whereby the volume surrounded by the cylindrical insulating material 25 can be made small, improving the current limiting performance.

Also, in FIG. 9, the length of the walls opposite to the movable member rotary shaft 13 and the repulsive member rotary shaft 23 out of the walls of the insulating material surrounding the cylindrical space 26 are made longer than the length of the walls of the insulating material on the sides of the rotation center of the movable member and the repulsive member. The arc generated between the contacts upon the interruption is subjected to an electromagnetic drive force in the direction of opposite to the rotation centers of the movable member and the repulsive member. Therefore, the arc within the cylindrical space 26 is brought into firm contact with the walls opposite to the rotation centers of the movable member and the repulsive member. Also, while it is advantageous to make the moment of inertia of the movable member 1 and the repulsive member 7 to separate them at a high speed, the moments of inertia of the movable member 1 and the repulsive member 7 are increased as the lengths of the movable arm vertical portion 3 and the repulsive arm vertical portion 9 which depend upon the length of the cylinder portion of the cylindrical insulating material 25. Accordingly, the length of the wall of the insulating material opposite to the rotation centers of the movable member and the repulsive member are made longer than the length of the wall of the insulating material on the side of the rotation centers of the movable member and the repulsive member and the lengths of the movable arm vertical portion 3 and the repulsive arm vertical portion 9 are made short as illustrated in FIG. 9, whereby the moment of inertia can be reduced and a sufficiently high pressure atmosphere and a sufficient vapor of the cylindrical insulating material can be generated, thereby to further improve the current limiting performance.

Also in FIG. 9, a portion of the movable arm horizontal portion 4 close to the movable contact 2 is constituted by sections 4*a*, 4*b* and 4*c* and a portion of the repulsive arm horizontal portion 10 close to the repulsive contact 8 is constituted by sections 10*a*, 10*b* and 10*c*. With such the construction, the distance between the currents flowing in parallel and opposite directions through the section 4*c* of the movable arm horizontal portion 4 and the section 10*c* of the repulsive arm horizontal portion 10 in the closed position is small as indicated by black arrows in FIG. 9, so that the electromagnetic repulsive force is increased and the contact separating speed is increased.

Embodiment 3

Figure 10:
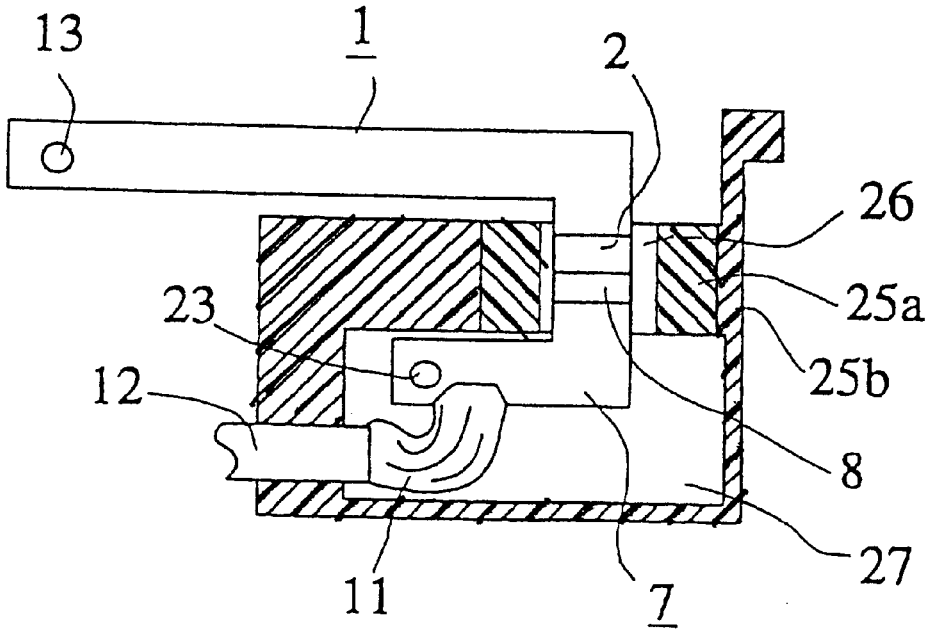
FIG. 10 is a fragmental sectional view showing the main portion of the circuit interrupter having a current limiting function according to the third embodiment.

The third embodiment of the present invention will now be described in conjunction with the figure. FIG. 10 is a fragmental sectional view illustrating the main portion such as the cylindrical insulating material 25, the repulsive member 7, the movable member 1 and the like of this embodiment, the cylindrical insulating material 25 being composed of an insulating material 25*a* defining a cylindrical inner surface and a surrounding insulating material 25*b* around the material 25*a*. The insulating material 25*a* is a mold made of a material that emits a large amount of vapor immediately when exposed to the arc, such as a resin material including only a small amount of or no reinforcing material such as glass fibers, and the insulating material 25*b* is made of an reinforced resin or a ceramic superior in mechanical strength. With this structure, a material that cannot mechanically endure the elevated pressure within the cylinder can be used as a material for defining the cylinder inner surface, so that a material for generating a large amount of vapor can be used irrespective of the mechanical properties to improve the current limiting performance.

Embodiment 4

Figure 11:
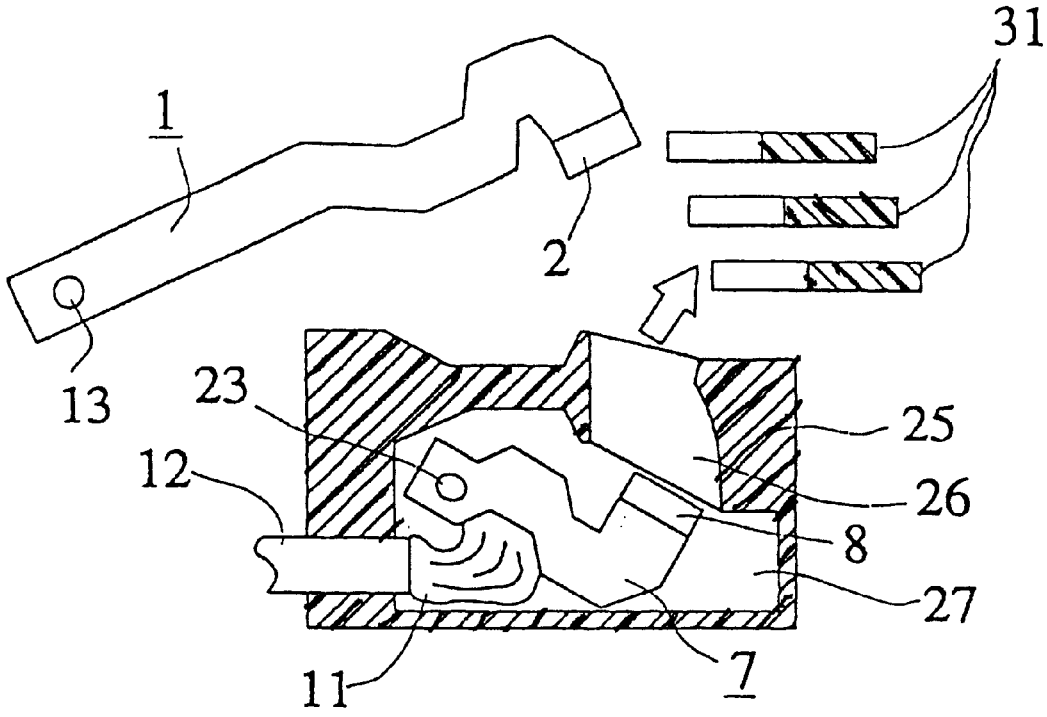
FIG. 11 is a fragmental sectional view showing the main portion of the circuit interrupter having a current limiting function according to the fourth embodiment.

The fourth embodiment of the present invention will now be described in conjunction with the figure. FIG. 11 is a fragmental sectional view illustrating the main portion such as the cylindrical insulating material 25, the repulsive member 7, the movable member 1, horse shoe-shaped arc extinguishing plates 31 and the like of this embodiment. The arc extinguishing plates 31 are disposed in the space above the cylindrical insulating material 25. Also, at the opening portion of the cylindrical insulating material 25 on the side of the movable member 1, the height of the wall of the cylindrical insulating material 25 surrounding the cylindrical space 26 and opposite to the movable member rotary shaft 13 is arranged to be lower than the height of the wall of the insulating material on the side of the rotary shaft 13 of the movable member. With such the structure, after the movable contact 2 come out of the cylindrical space 26 during the interruption, a flow of hot gas from the cylindrical space 26 toward the arc extinguishing plates 31 is generated, making it easy for the arc to contact with the arc extinguishing plates 31. Therefore, the arc can be effectively cooled by the arc extinguishing plates 31, and the fault current can be quickly pinched at the latter half of the interruption, thus making the interruption time short. As a result, this contributes to the reduction of the passing energy which is one of the indexes of the current limiting performance.

Embodiment 5

Figure 12:
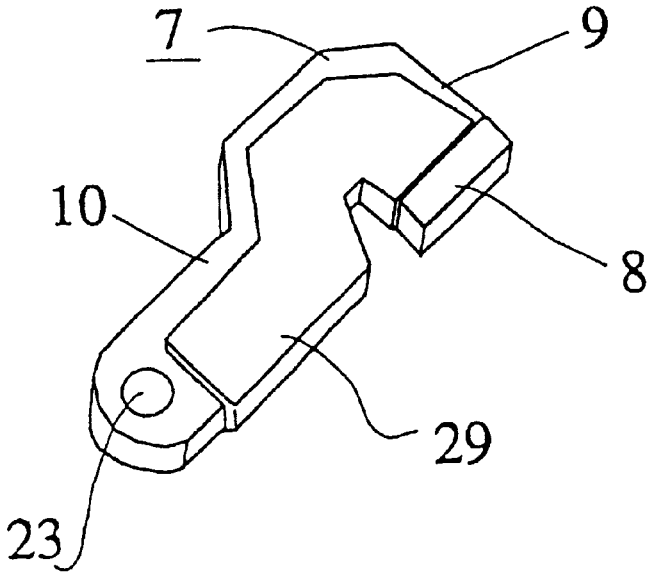
FIG. 12 is a fragmental sectional view showing the repulsive member of the circuit interrupter having a current limiting function according to the fifth embodiment.
Figure 13:
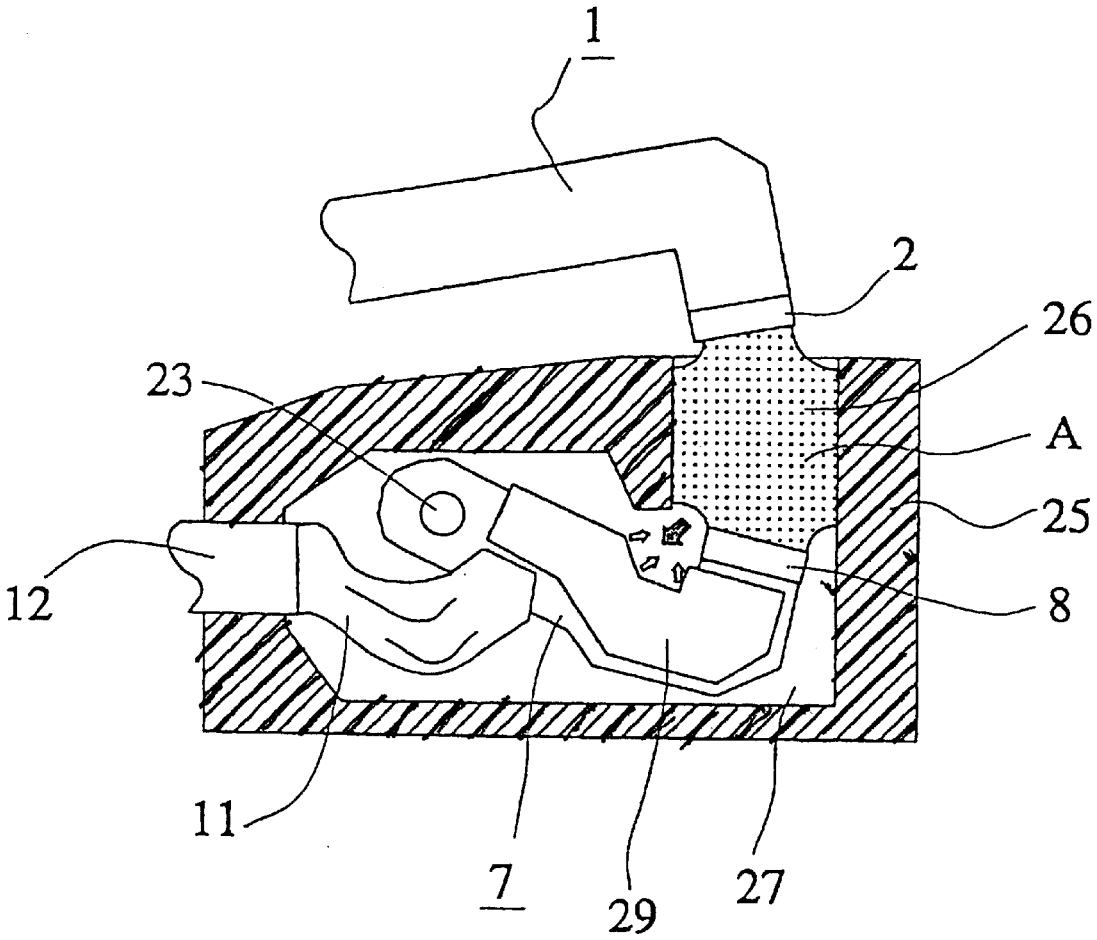
FIG. 13 is a fragmental sectional view showing the main portion of the circuit interrupter having a current limiting function according to the second embodiment.

The fifth embodiment of the present invention will now be described in conjunction with the figure. FIG. 12 is a perspective view showing the repulsive member 7 of this embodiment, and FIG. 13 is a fragmental sectional view illustrating the main portion such as the cylindrical insulating material 25, the repulsive member 7, the movable member 1 and the like of this embodiment. The repulsive member 7 shown in FIG. 12 is coated by an insulating material 29 at the surfaces of the repulsive arm on the side of the repulsive member rotary shaft 23 of the repulsive member and that can be "seen" at least from the movable contact 2 in the closed position. When such the repulsive member is used, as shown in FIG. 13, at the time of a high current arc generation upon the fault current interruption, the blasted hot gas and a strong arc light emitted from the arc that fills the cylindrical space 26 impinge against the insulating material 29 (as shown by black arrows in the figure), whereby a large amount of vapor is generated from the cylindrical insulating material 29 (as shown by white arrows in the figure). Therefore, the pressure accumulated in the pressure accumulation space 27 is increased and the speed of the gas flow from the pressure accumulation space 27 through the cylindrical space 26 before and after the current interruption is increased, whereby the previously discussed arc extinguishing function, the insulation recovery function inside and outside of the cylindrical insulating material and the attachment prevention function of the molten matter to the repulsive contact surface are improved.

Embodiment 6

Figure 14:
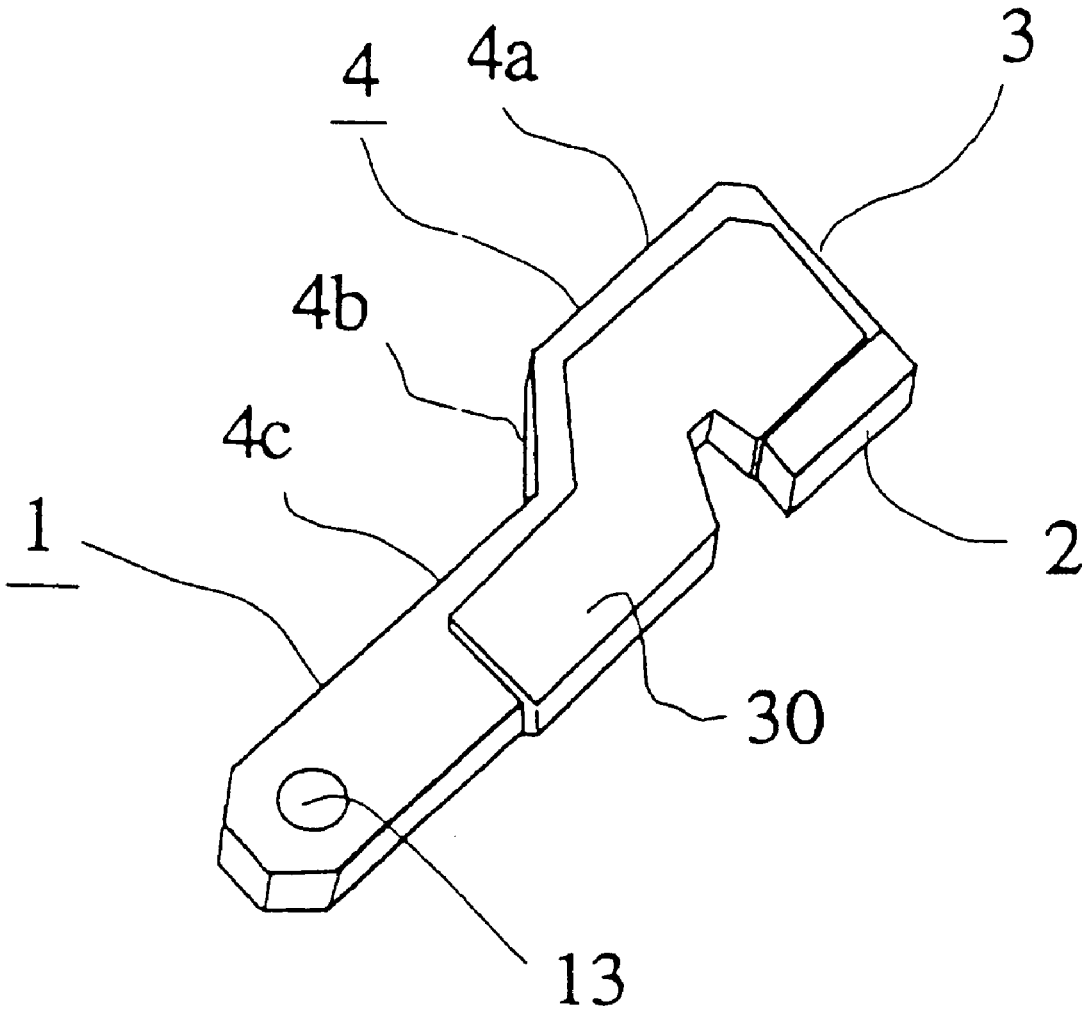
FIG. 14 is a fragmental sectional view showing the movable member of the circuit interrupter having a current limiting function according to the sixth embodiment.
Figure 15:
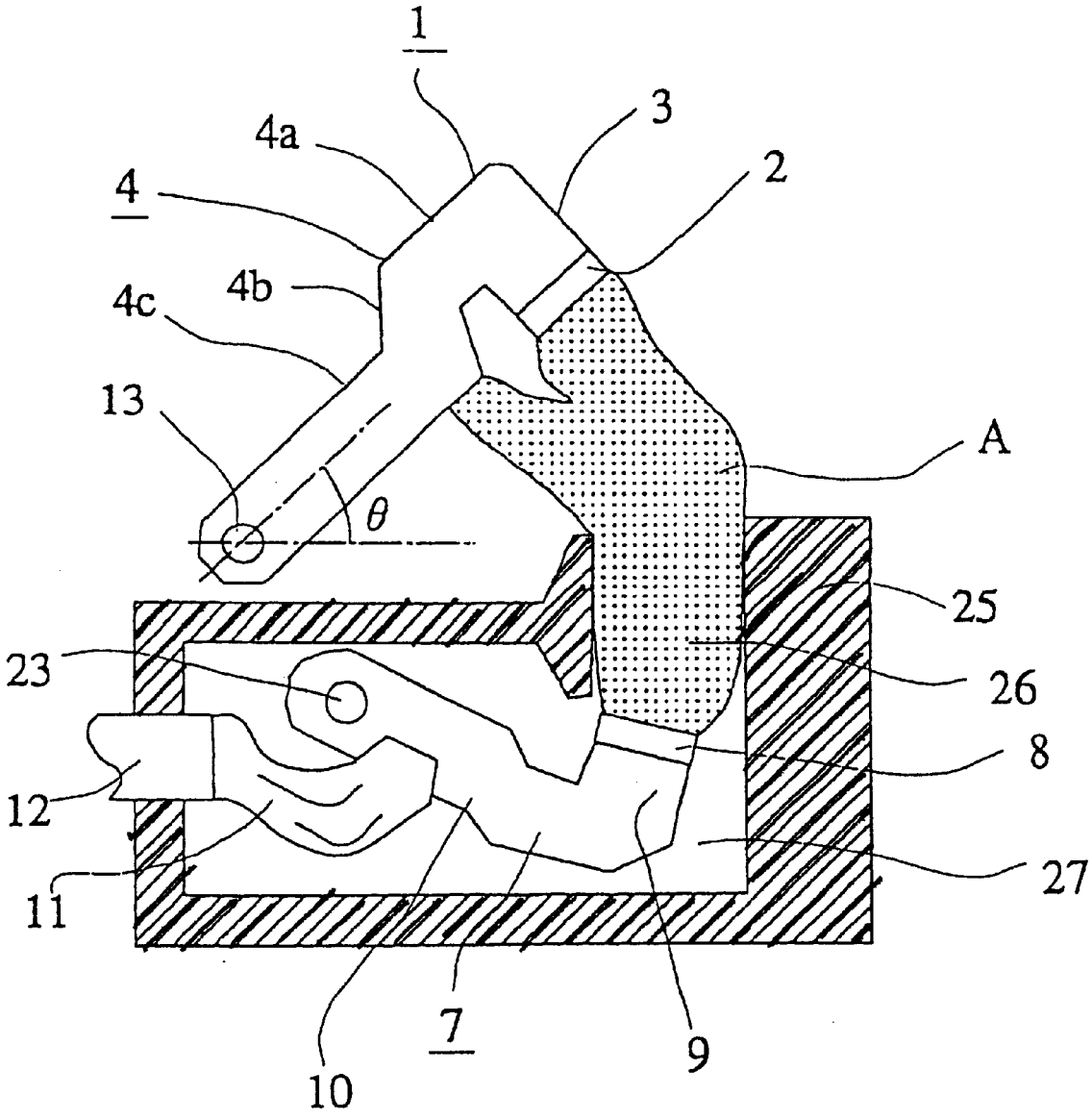
FIG. 15 is a view for explaining the operation of the main portion of the sixth embodiment.

The sixth embodiment of the present invention will now be described in conjunction with the figure. FIG. 14 is a perspective view showing the movable member 1 of this embodiment, and FIG. 15 is a fragmental sectional view illustrating the main portion such as the cylindrical insulating material 25, the repulsive member 7, the movable member 1 and the like of this embodiment. The movable member 1 shown in FIG. 14 is composed of the movable contact 2, the movable arm vertical portion 3, the movable arm horizontal portion 4 having sections 4*a*, 4*b* and 4*c*, as well as an insulating material 30 coated on the surfaces of the movable arm that can be "seen" at least from the repulsive contact 8 in the closed position and is configured into a substantially hook shape. Thus, by making the movable member 1 hook-shaped, the distance between the repulsive arm horizontal portion 10 in the closed position and the section 4*c* of the movable arm horizontal portion 4 can be made shorter and the electromagnetic contact separating force can be made stronger as previously described.

However, as shown in FIG. 15, when the rotation angle θ of the movable member 1 is large, the hook-shaped movable member 1 increases the possibility that the arc is brought into contact with the movable arc horizontal portion and that the current is shunted. When the arc in brought into contact with the movable arm, the movable arm melts and becomes narrower, whereby the movable arm cannot maintain a mechanical strength required for withstanding the opening and closing of the contacts and also the arc voltage during the latter half of the interruption decreases to deteriorate the current limiting performance. Therefore, the surfaces of the movable arm that can be "seen" at least from the repulsive contact 8 in the closed position and on the side of the movable member rotary shaft 13 should be coated with an insulating material 30. The shunting to such the movable arm may be generated even with the substantially L-shaped movable member shown in the first embodiment, necessitating the above-described insulation of the movable arm.

Embodiment 7

Figure 16:
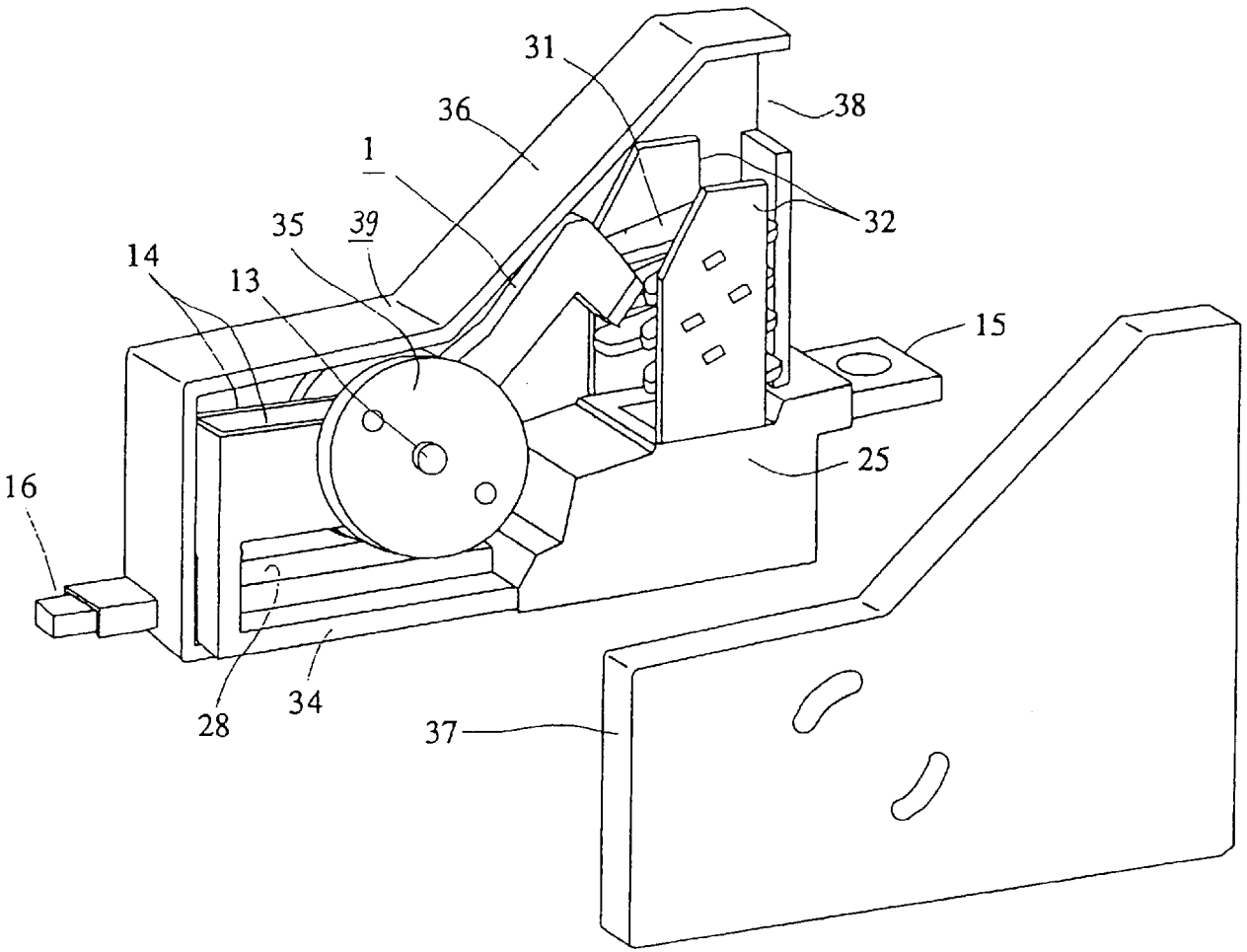
FIG. 16 is an exploded perspective view showing arc extinguishing unit of the circuit interrupter having a current limiting function according to the seventh embodiment.
Figure 17:
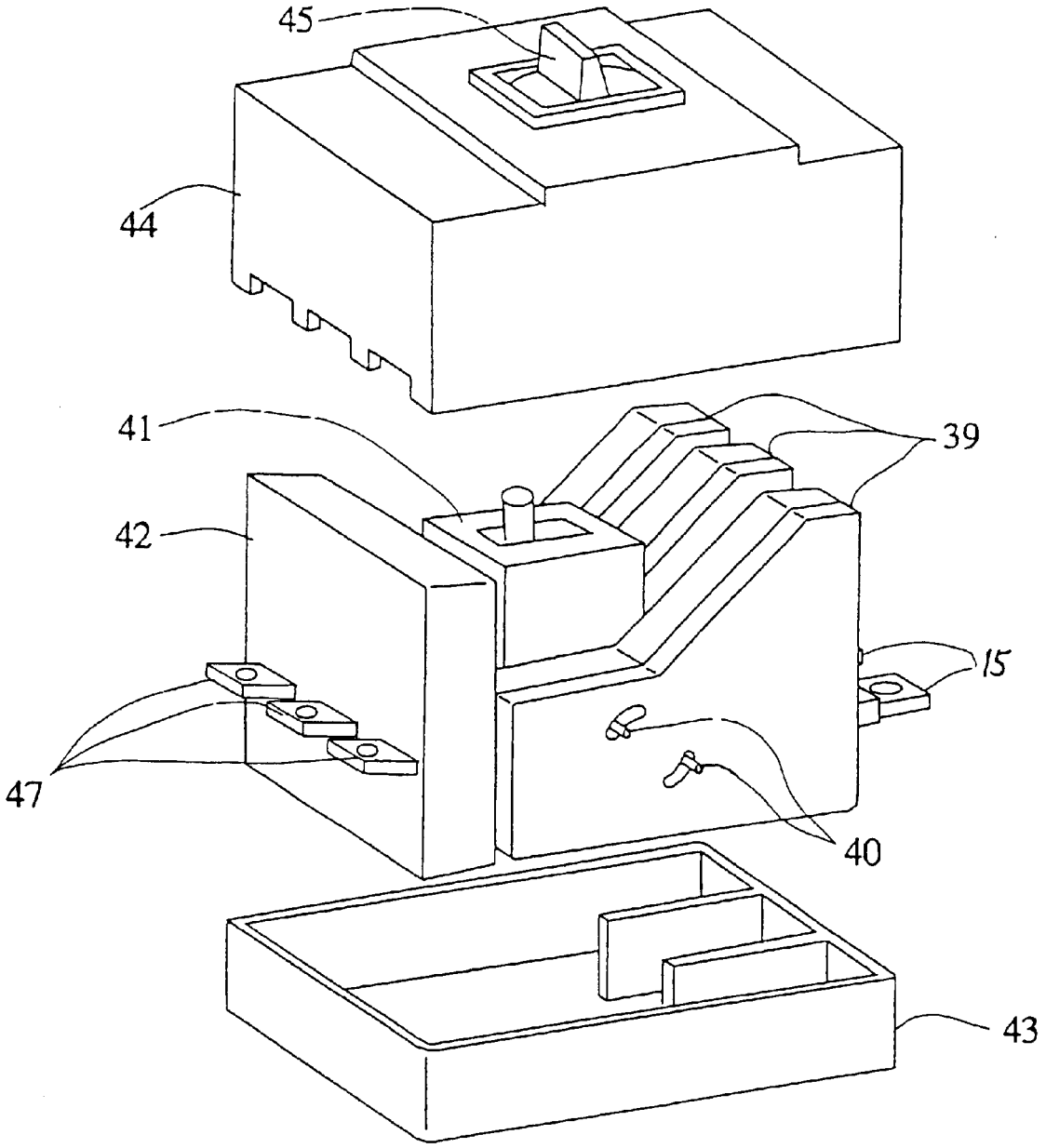
FIG. 17 is an exploded perspective view showing the circuit interrupter having a current limiting function according to the seventh embodiment.

The seventh embodiment of the present invention will now be described in conjunction with the figure. FIG. 16 is a perspective view showing an arc extinguishing device in the shape of a unit for a wiring breaker, the component parts are housed within an arc extinguishing unit housing main body 36 and an arc extinguishing unit housing cover 37, defining together an arc extinguishing unit 39. As shown in FIG. 17, the wiring breaker can be obtained by connecting a plurality of the above arc extinguishing units 39 together by a cross bar 40, and additionally providing a mechanism portion 41 for opening and closing the contacts through the cross bar 40 and a relay portion 42 detecting an abnormal current for operating the mechanism portion 41 for contact opening and closing and a handle 45 for manually operating the mechanism portion 41 within the base 43 and the cover 44. Thus, by making each component part a unit, which can be combined into a wiring breaker, the assembly is simple and the cost can be decreased.

By housing the arc extinguishing device within the arc extinguishing unit housing main body 36 and the arc extinguishing unit cover 37, the pressure increase within the wiring breaker upon the interruption needs not be directly received by the base 43 and the cover 44. The pressure receiving area of the arc extinguishing unit housing is smaller than the pressure receiving area of the base 43 and the cover 44. Therefore, even when an arc extinguishing unit housing of the same material and the same wall thickness as those of the base 43 and the cover 44 is used, the housing can take a larger internal pressure increase, becoming suitable to utilize the current limiting procedure in which the arc atmosphere pressure is increased to increase the arc voltage. Also, while the base and the cover has been made of a mechanically strong and expensive molding material in the conventional design in order to resist the internal pressure increase upon the interruption, the amount of the material of the pressure receiving housing can be decreased by employing the arc extinguishing unit housing.

Figure 18:
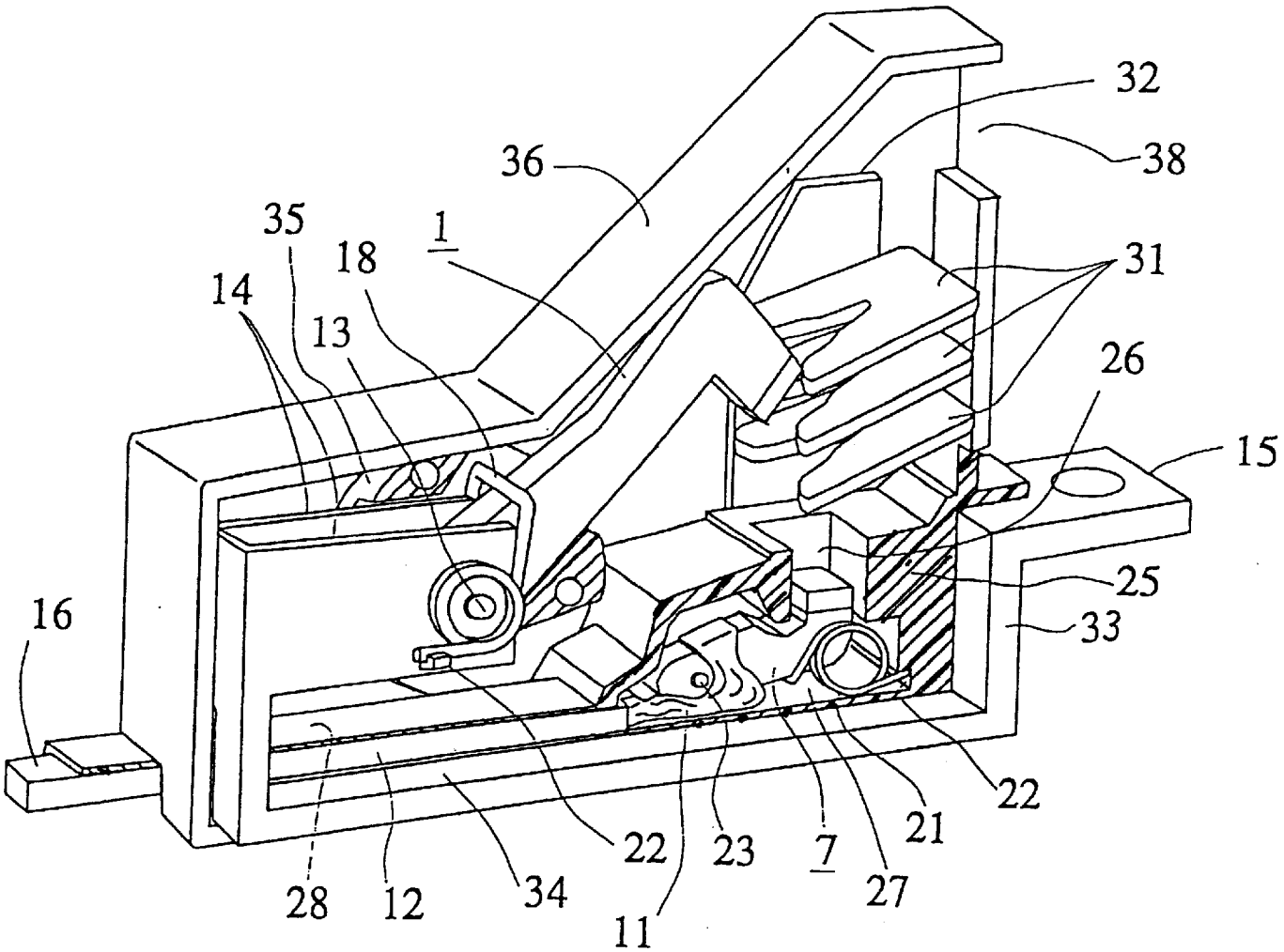
FIG. 18 is a perspective view showing arc extinguishing unit internal structure according to the seventh embodiment.
Figure 19:
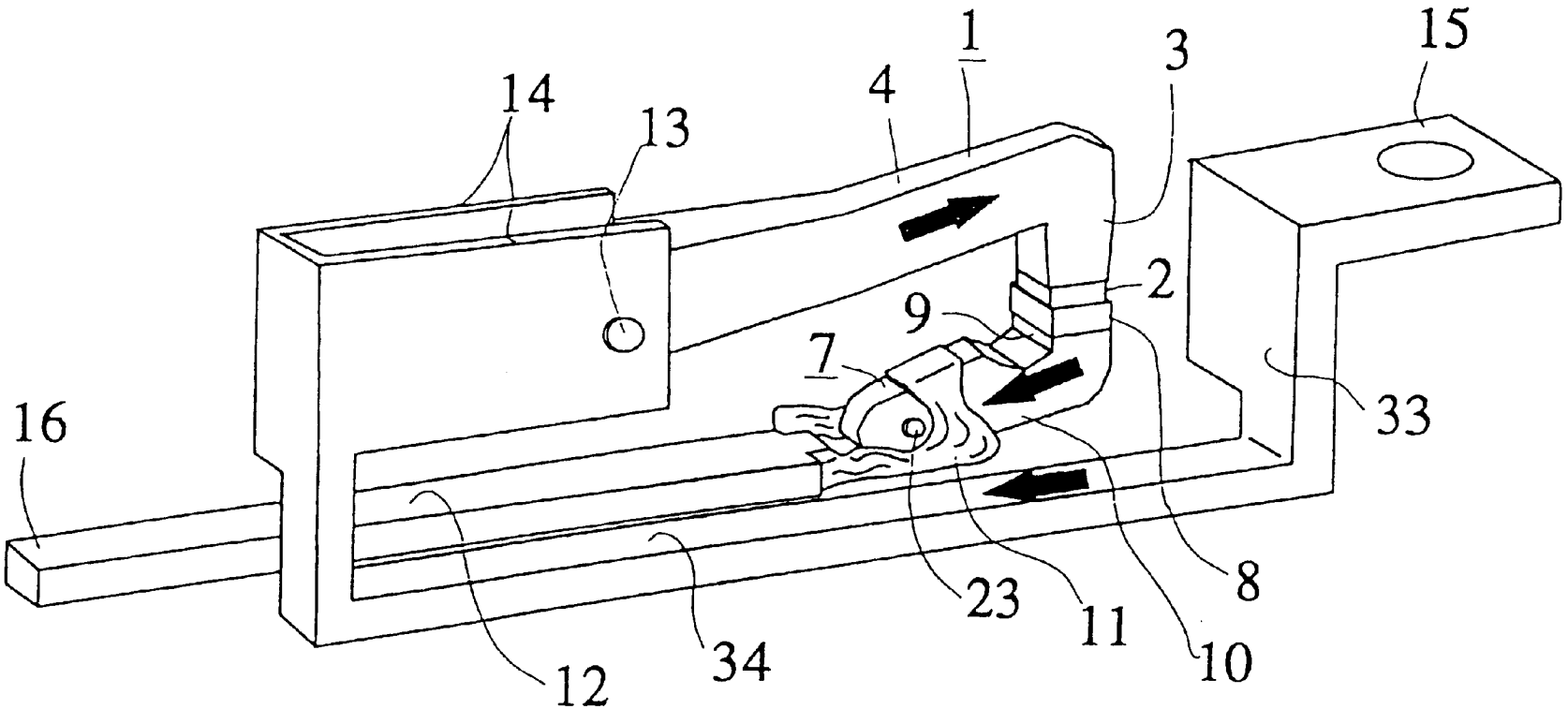
FIG. 19 is a perspective view showing conductor arrangement according to the seventh embodiment.

FIG. 18 is a perspective view of the arc extinguishing unit 39 shown in FIG. 16 with one part of the component parts shown in section for illustrating the inner structure. Also, FIG. 19 is a perspective view of the current carrying parts in the closed state with other parts omitted. In FIG. 19, the flow directions of the current through the movable arm horizontal portion 34, the repulsive arm horizontal portion 10 and the conductor horizontal portion 34 are shown by arrows. The conductor horizontal portion 34, which is one portion of the conductor electrically connecting the terminal portion 15 and the movable member 1, is connected so that a current flow in substantially parallel and in the same direction as the stationary conductor 12 and is disposed at the position displaced right or leftward from a plane in which the repulsive member 7 is rotated.

Then, the operation of this embodiment will be described. Ordinary opening and closing operation is achieved by manually operating the handle 45. By this handle operation, a rotor 35 is rotated through the mechanism portion 41 and the cross bar 40, and the movable member 1 achieves the opening and closing operation. Also, upon the overload current interruption, the relay portion 42 detects an abnormal current and supplies a trip signal to the mechanical portion 41, and the mechanical portion 41 is operated to rotate the rotor 35 to raise the movable member 1 to open the contacts. However, upon the large current interruption such as during the short-circuiting fault or the like, prior to the rotation of the rotor 35, the repulsive member 7 initiates the contact opening operation against the contact pressure of the spring 21 because of an electromagnetic force Ft, which is a combined force of an electromagnetic repulsive force F1 due to the current concentration into the contact contacting portion and an electromagnetic repulsive force F2 due to the current in the movable arm horizontal portion 4 and the parallel and opposite current in the repulsive arm horizontal portion 10 as shown in FIG. 19.

At the same time, the movable member 1 initiates the contact opening operation due to a electromagnetic force Ft' which is a combined force of the above combined electromagnetic force Ft and a component force F3' in the contact opening direction of the electromagnetic repulsive force F3 due to the current in the movable arm horizontal portion 4 and the parallel and opposite current in the conductor horizontal portion 34. In this contact opening operation, it is similar to the first embodiment 1 that the repulsive member 7 having a smaller moment of inertia opens more rapidly than the movable member 1. Upon this opening operation, an arc is generated between the contacts and the electromagnetic repulsive force F1 due to the current concentration at the contact points on the contact surface is diminished, but the electromagnetic repulsive force F2 causes the movable member 1 and the repulsive member 7 to rotate in the contact separating direction and the component force F3' of the electromagnetic repulsive force causes the movable member 1 to rotate in the contact separating direction. Also, upon the arc generation, a large volume of vapor is generated from the inner surface of the cylindrical insulating material 25 due to the arc heat, generating a force Fp due to the difference in pressure for separating the movable member 1 and the repulsive member 7. These forces cause the repulsive member 7 and the movable member 1 to rapidly rotate, separating the contacts at a high speed. This high speed separation causes the arc length to quickly elongate, raising the arc voltage quickly, and the fault current reaches at its peak value.

After the current peak, the movable member 1 is further rotated to increase the distance between the contacts. Due to this increase in the distance between the contacts, the are voltage is further increased the fault current is direct rapidly toward the zero. When the fault current is pinched to become small, the attractive force due to the current flowing through the conductor vertical portion 33 and the attractive force of the horse shoe-shaped iron arc extinguishing plates 31 cause the arc to be withdrawn into the arc extinguishing plates 31, whereby the arc is splitted, quenched and extinguished. At this time, the movable contact 2 is positioned outside of the space surrounded by the cylindrical insulating material 25 and the insulation between the contacts is sufficiently recovered, so that no current flows again even when a source voltage is applied across the electrodes, completing the interrupting operation. Further, similarly to the first embodiment, the pressure accumulated in the pressure accumulating space 27 during the large current arcing generates a gas flow to the exterior of the cylindrical space 26 through the cylindrical space 26 to promote the recovery of the insulation at the inside and the outside of the cylindrical space 26, so that the interrupting time is shortened and the re-firing can be prevented. Also, the interrupting time can be significantly decreased by a high arc voltage due to a large distance between the contacts which is large after the current peak. Therefore, the passing energy $I^2t$ (time integrated second power of the current) which is one of the indexes indicating the current limiting performance is small.

It is to be noted that, in this embodiment, the exhaust port 38 is provided only on the side of the arc extinguishing plates 31 as viewed from between the contact 2 and the contact 8. With such the arrangement, during the current interrupting operation, as the arc current increases, the pressure is accumulated in the space within the housing on the side of the rotor 35 with respect to the arc. As the arc current decreases after the arc current peak, the above accumulated pressure generates a gas flow between the electrodes from the side of the rotor 35 to the side of the exhaust port 38, thereby elongating the arc to the arc extinguishing plates 31. Further, at around the current zero point, the recovery of the insulation between the contacts is significantly improved by the function of the above flow which blasts off the charged particles between the contacts. Therefore, a highly reliable circuit breaker in which the interruption failure is difficult to occur even when applied to a high voltage circuit.

The insulation recovery function of the gas flow by the accumulated pressure becomes larger as the speed of gas flow upon the current interruption increases. In order to increase the flow speed, the accumulation pressure should be made higher or the flow cross-sectional area should be made smaller and for this reason the area of the exhaust port 38 must be small. According to this embodiment, the exhaust port 38 having a relatively small area is provided on the side of the movable contact 2 in the open position. When the current limiting performance is to be improved through the use of the cylindrical insulating material 25, the arc in the vicinity of the arc spot on the side of the repulsive contact 8 is positioned within the pressure accumulation space 27, so that the metal particles constituting the arc cannot be blown off by the gas flow by the accumulator pressure in the space on the side of the rotor 35. On the other hand, the arc in the vicinity of the arc spot on the side of the movable contact 2 is positioned outside of the pressure accumulation space 27 upon current interruption, so that the arc is easily affected by the function of the gas flow. Therefore, the insulation recovery between the electrodes can be effectively ensured by providing the exhaust port 38 having a relatively small cross-sectional area on the side of the movable contact 2 in the open position.

Figure 20:
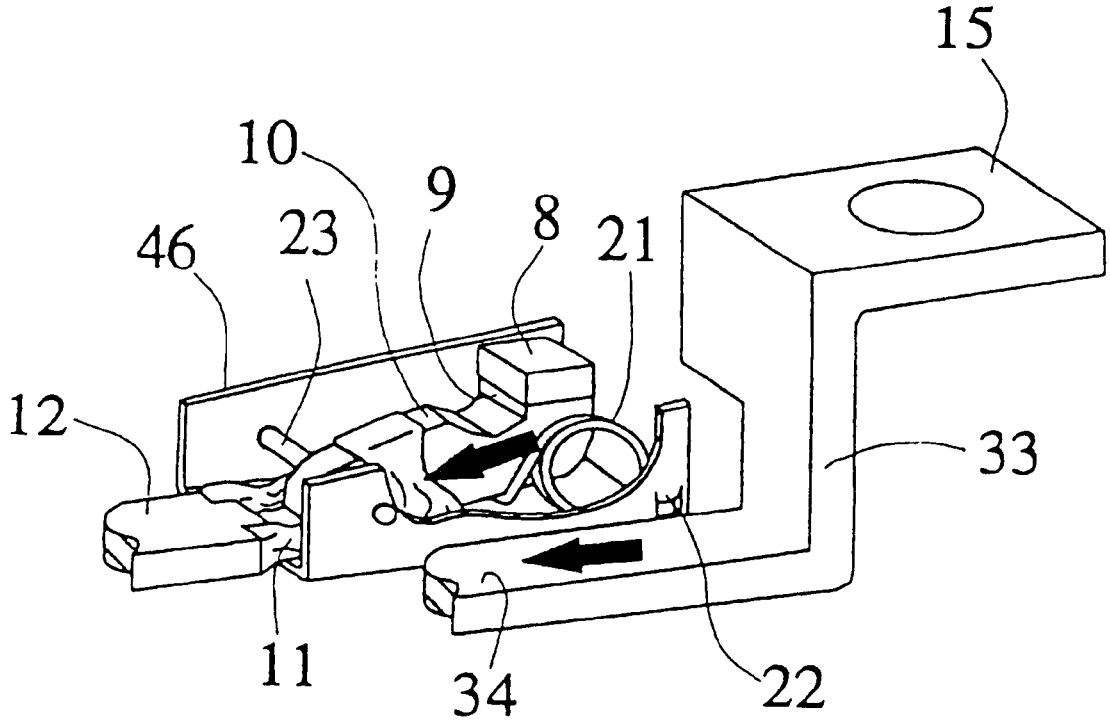
FIG. 20 is a perspective view showing a modification of the repulsive member unit according to the seventh embodiment.

In the embodiments illustrated in FIGS. 18 and 19, the rotary shaft 23 of the repulsive member 7 is directly held by the insulating material defining the accumulating space 27. Also, the conductor horizontal portion 34 is arranged in substantially parallel to the repulsive arm horizontal portion 10 in the closed position at the position transversely displaced from the plane in which the repulsive member 7 rotates. With such the conductor arrangement, the electromagnetic attractive force between the current in the conductor horizontal portion 34 and the current in the repulsive arm horizontal portion 10 acting upon the fault current interruption applies a very large moving force onto the repulsive member 7, some times causing the deformation of the rotary shaft 23 or damages to the member holding the rotary shaft. Accordingly, as shown in FIG. 20, a holding frame 46 having a large mechanical strength made such as of a metal may be additionally provided to hold the repulsive member rotary shaft 23 and to prevent the damages to the holding member. Also, by making the holding frame 46 with a magnetic material, the magnetic flux of the conductor horizontal portion 34 can be absorbed so as not to generate a moving force due to the electromagnetic force on the repulsive member 7, thereby preventing damages to the rotary shaft 23. Further, when the repulsive member 7, the rotary shaft 23 and the spring 21 providing a contacting pressure to the repulsive member 7 are arranged to be held by the holding frame 46, the repulsive member portion can be made into a unit, facilitating the assembly.

Embodiment 8

As previously described, with the conductor arrangement of the seventh embodiment, the conductor horizontal portion 34 is provided at a position slightly displaced from the plane in which the repulsive member 7 and the movable member 1 are rotated. Therefore, the repulsive member 7 and the movable member 1 are subjected to a lateral force perpendicular to the direction of contact separation, causing a factor of decreasing the contact separation speed of the repulsive member 7 and the movable member 1. According to this invention, the movable arm vertical portion on the repulsive arm vertical portion are inserted into the cylindrical insulating material in the contact closed position, so that the movable member or the repulsive member may be brought into contact with the cylindrical insulating material when the movable member or the repulsive member is laterally moved by the above lateral force. When such contact occurs, the contact separation speed is significantly decreased. Also, when the above lateral force causes the deformation of the movable member, the movable member rotary shaft, the repulsive member or the repulsive member rotary shaft, the re-closure is impossible.

Figure 21:
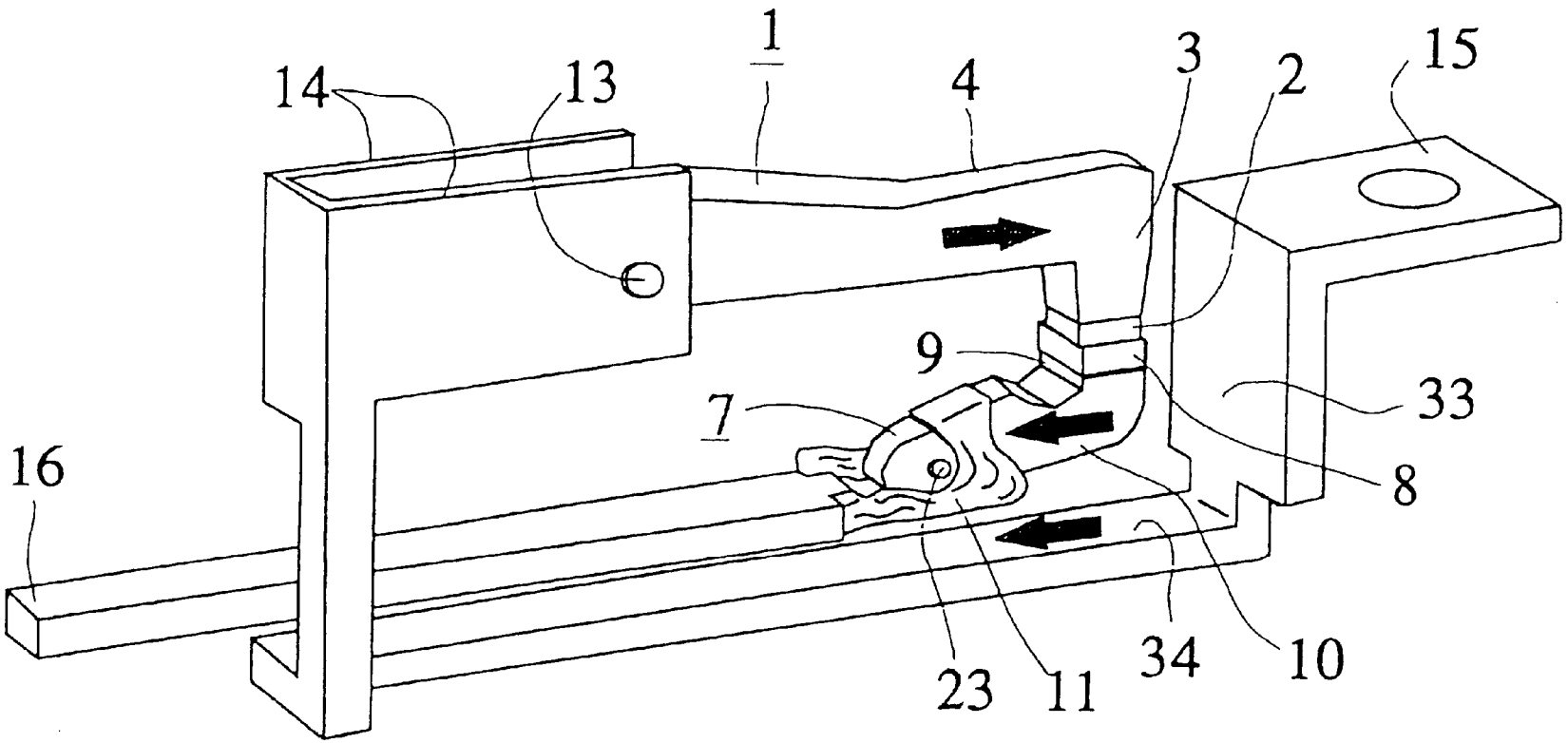
FIG. 21 is a perspective view showing the conductor arrangement of the circuit interrupter having a current limiting function according to the eighth embodiment.

This embodiment has solved this problem, FIG. 21 illustrating the structure. As shown in FIG. 12, the centerline of the conductor horizontal portion 34 is arranged on the plane in which the movable member 1 and the repulsive member 7 are rotated and in substantially parallel to the repulsive arm horizontal portion 10 in the closed position. With such the conductor arrangement, no lateral component force as above described generates in either of the electromagnetic repulsive force due to the opposite direction currents flowing through the movable arm horizontal portion 4 and the conductor horizontal portion 34 or the electromagnetic repulsive force due to the same direction currents flowing through the repulsive arm horizontal portion 10 and the conductor horizontal portion 34.

Figure 22:
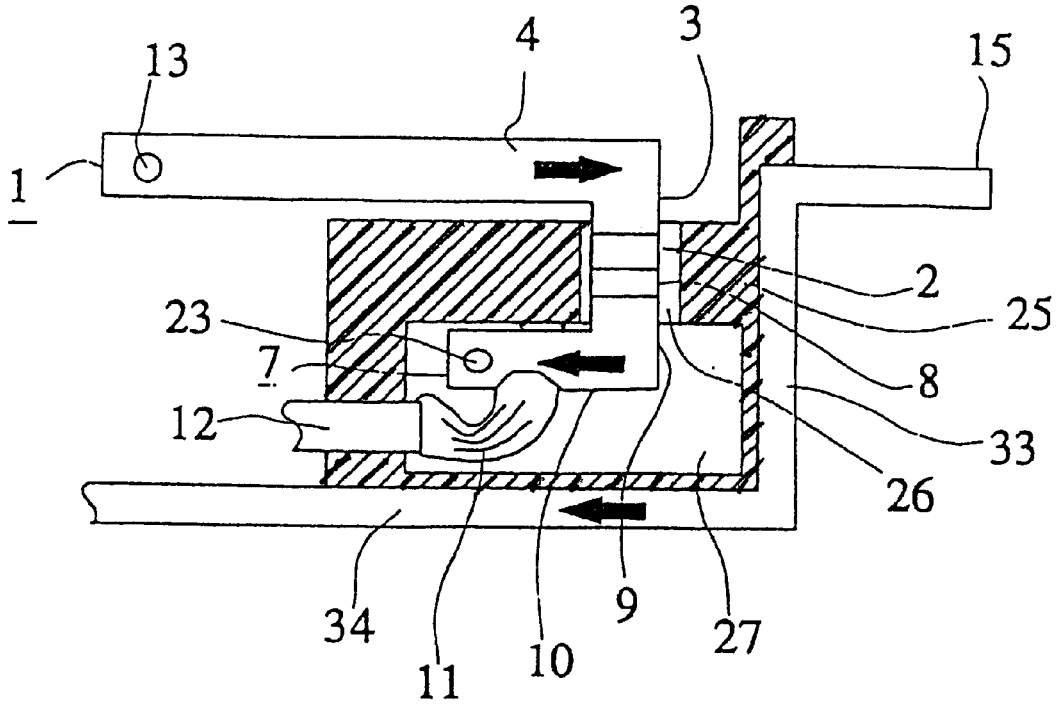
FIG. 22 is a fragmental sectional view of the main portion for explaining the operation of the eighth embodiment.
Figure 23:
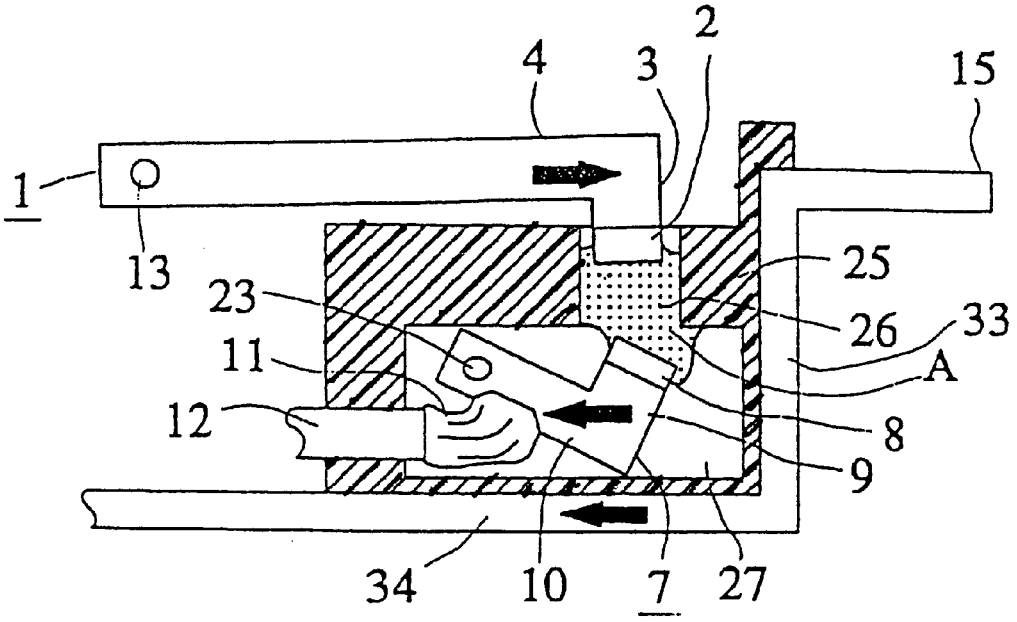
FIG. 23 is a fragmental sectional view of the main portion for explaining the operation of the eighth embodiment.

Further, with the above conductor arrangement, as shown in FIG. 22, not only the electromagnetic repulsive force between the current flowing through the repulsive arm horizontal portion 10 and the current flowing through the movable arm horizontal portion 4, but also the electromagnetic attractive force between the current flowing through the repulsive arm horizontal portion 10 and the current flowing through the conductor horizontal portion 34 can also be utilized as a contact opening force upon the fault current interruption. FIG. 23 illustrates the initial state of the interrupting operation, in which, similarly to the first embodiment, the repulsive member 7 having a smaller moment of inertia is rotated more rapidly than the movable member 1. Thus, when the repulsive member 7 is rotated, the distance between the currents flowing through the movable member 1 and the repulsive member 7 and generating the electromagnetic repulsive force increases and the electromagnetic force is decreased. However, since the distance between the repulsive member 7 and the conductor horizontal portion 34 decreases, the electromagnetic attractive force due to the current flowing through the repulsive member 7 and the conductor horizontal portion 34 is increased. Therefore, the repulsive member 7 is subjected to a large electromagnetic contact opening force until it reaches to the maximum separated position, further increasing the contact opening speed and the fault current peak value is reduced.

Figure 24:
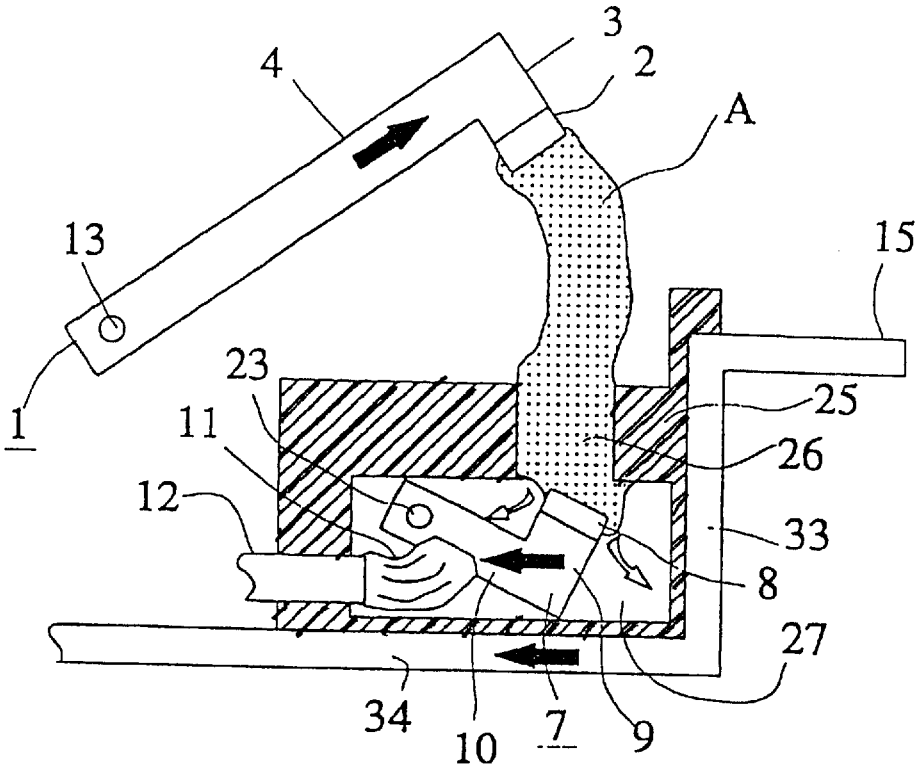
FIG. 24 is a fragmental sectional view of the main portion for explaining the operation of the eighth embodiment.

FIG. 24 illustrates the state in which the interruption operation further progresses and the repulsive member 7 and the movable member 1 reach to their maximum contact open positions. In this state, the distance between the repulsive member 7 and the conductor horizontal portion 34 is minimum and the repulsive member 7 is attracted with a strong force due to the current flowing through the conductor horizontal portion 34. Therefore, the phenomenon in which the repulsive member 7 rapidly separated hits the insulating material 25 defining the pressure accumulating space 27 and bounces back to make the distance between the contacts (in other words, the arc length) small can be limited to be minimum, and the repulsive member 7 is maintained at the maximum separation position against the contacting pressure spring until immediately before the current interruption, whereby a large distance can be maintained between the separated contacts at the latter half of the interruption operation. This allows a current limiting breaker of a high performance in which a high arc voltage is maintained even after the voltage peak, the interruption time is significantly reduced, a sufficient insulating recovery is ensured between the contacts upon and after the current interruption, and which can be applied to a high voltage circuit.

It is to be noted that, while the conductor horizontal portion 34 is arranged on the plane in which the repulsive member 7 rotates in this embodiment, when the direction of separation of the movable contact 2 from the repulsive contact 8 is referred to "up", the conductor horizontal portion 34 may be disposed below the repulsive arm horizontal portion 10 in the open state and in substantially parallel to the repulsive arm horizontal portion 10 in the closed position, then, even when the repulsive arm horizontal portion 10 is at a position laterally displace from the plane in which the repulsive member 7 rotates, the previously described effect of attracting the repulsive member to increase the separation speed as well as the effect of maintaining the repulsive member at the maximum contact separated position.

Embodiment 9

Figure 25:
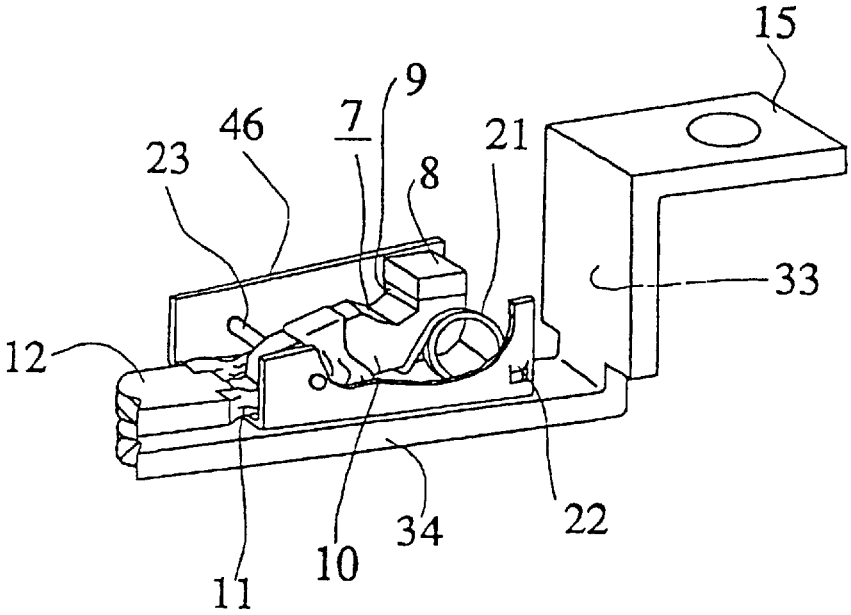
FIG. 25 is a perspective view showing the repulsive member unit of the circuit interrupter having a current limiting function according to the ninth embodiment.

The ninth embodiment of the present invention will now be described in conjunction with the figure. FIG. 25 is a perspective view showing the main portion of this embodiment, with one portion of the holding frame 46 is shown removed. The conductor arrangement in this embodiment is similar to that of the eighth embodiment and the conductor horizontal portion 34 is disposed in a plane including the locus drawn by the repulsive member 7. The repulsive member 7 is rotatably held by the holding frame 46 made of a nonmagnetic material of a U-shaped cross section through the rotary shaft 23. Also, the spring 21 applying a contacting pressure to the repulsive member 7 is engaged at its end portion with the spring holder 22 disposed on the holding frame 46, and the repulsive member 7, the rotary shaft 23, the spring 21 and the holding frame 46 together constitute the repulsive member unit, similarly to the seventh embodiment.

By constituting the holding frame 46 with nonmagnetic material, the magnetic flux generated by the current flowing through the conductor horizontal portion 34 and promoting the separation of the repulsive member 7 and the movable member 1 is not shielded, and even when the holding frame 46 is used to reliably hold the repulsive member 7 to which a massive electromagnetic force is applied, a high speed contact separation similar to that of the eighth embodiment can be obtained, not decreasing the current limiting performance.

Embodiment 10

Figure 26:
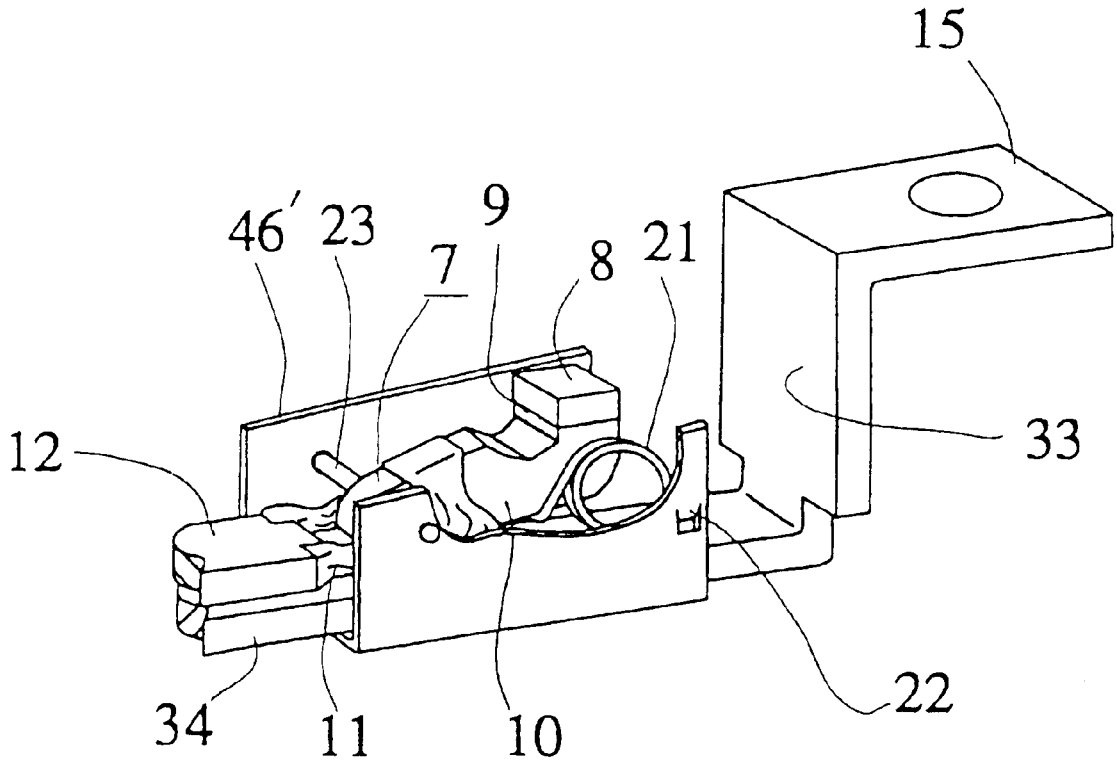
FIG. 26 is a perspective view showing the repulsive member unit of the circuit interrupter having a current limiting function according to the tenth embodiment.

The tenth embodiment of the present invention will now be described in conjunction with the figure. FIG. 26 is a perspective view showing the main portion of this embodiment, with one portion of the holding frame 46' is shown removed. The conductor arrangement in this embodiment is similar to that of the eighth embodiment and the conductor horizontal portion 34 is disposed in a plane including the locus drawn by the repulsive member 7. The repulsive member 7 is rotatably held by the holding frame 46' made of a magnetic material through the rotary shaft 23. Also, the spring 21 applying a contacting pressure to the repulsive member 7 is engaged at its end portion with the spring holder 22 disposed on the holding frame 46'. The holding frame 46' of the magnetic material is arranged to embrace not only the repulsive member 7 by also the conductor horizontal portion 34, differing from that of the ninth embodiment.

By making the holding frame 46' embracing the repulsive member 7 and the conductor horizontal portion 34 with a magnetic material, the magnetic flux component generated by the current flowing through the conductor horizontal portion 34 and promoting the separation of the repulsive member 7 can be increased, thus improving the separating speed of the repulsive member 7.

Embodiment 11

Figure 27:
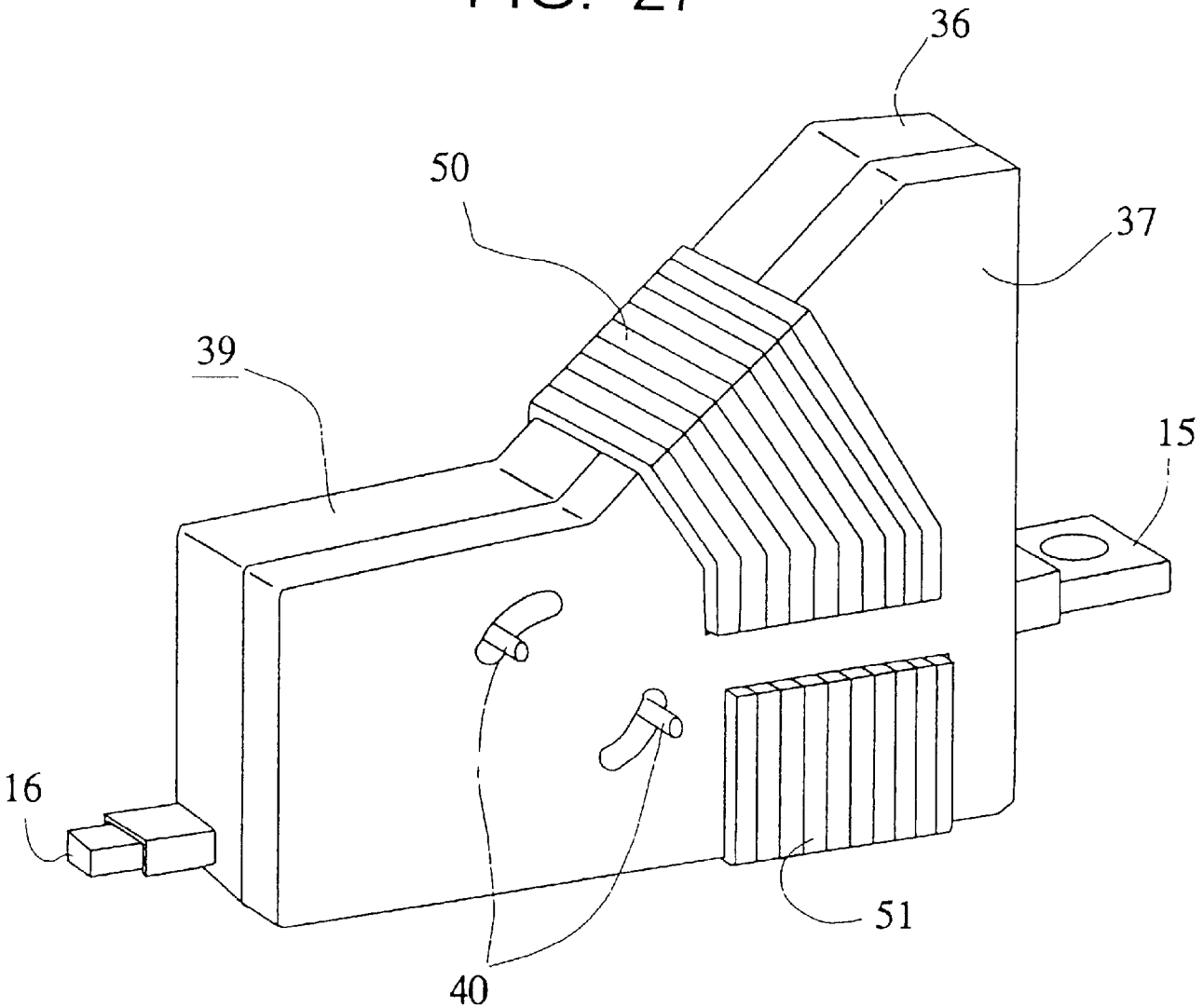
FIG. 27 is a perspective view showing the repulsive member unit of the circuit interrupter having a current limiting function according to the eleventh embodiment.

The eleventh embodiment of the present invention will now be described in conjunction with the figure. FIG. 27 is a perspective view showing the arc extinguishing unit of this embodiment, in which laminated horse shoe-shaped core 50 and 51 are disposed to sandwich the arc extinguishing unit housing main body 36 and the arc extinguishing unit housing cover 37. The core 50 is disposed at the position sandwiching at least the movable member 1 (not shown) in the open position within the arc extinguishing unit, and the core 51 is disposed at the position sandwiching at least the repulsive member 7 (not shown) in the open position within the arc extinguishing unit.

With such the structure, the contact opening electromagnetic force of the movable member 1 during the interruption can be enhanced by the core 50 and the contact opening electromagnetic force of the repulsive member 7 during the interruption can be enhanced by the core 51, thus improving the contact opening speed. Also, since the cores 50 and 51 are disposed to hold the arc extinguishing unit housing from the outside, the force acting on the housing due to the housing internal pressure increase upon the interruption can be supported by the cores, thereby preventing the damages to the housing. Further, the arc extinguishing unit housing main body and the arc extinguishing unit housing cover may be joined through the use of the cores 50 and 51, allowing the fastening components such as screws or the like to be omitted. Also, the housing can be also used as the insulation of the core inside, preventing the arc touch to the cores.

Embodiment 12

Figure 28A:
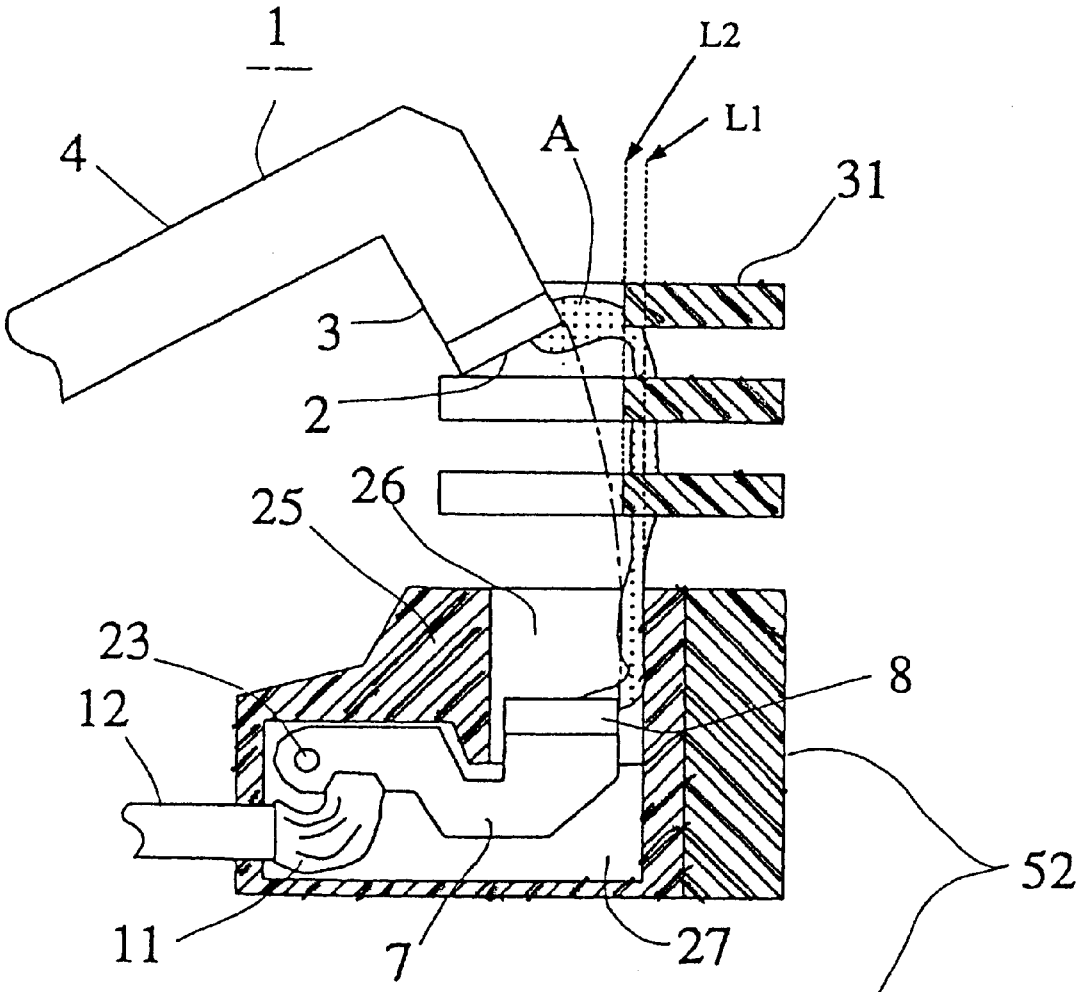
FIG. 28(*a*) is a sectional view (a) of the main portion of and FIG. (28*b*) is a plan view showing the portion lower than the arc extinguishing plate of the circuit interrupter having a current limiting function according to the twelfth embodiment.
Figure 28B:
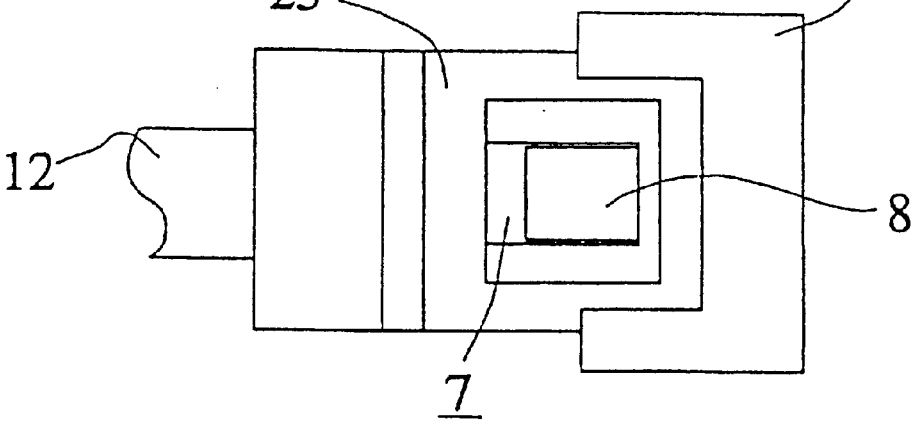

The twelfth embodiment of the present invention will now be described in conjunction with the figure. FIG. 28(*a*) is a fragmental sectional view showing the main portion of this embodiment and FIG. 28(*b*) is a plan view of the portion below the arc extinguishing plates 31 shown in FIG. 28(*a*). In FIG. 28(*a*), a state immediately before current interruption upon the overload current interruption is illustrated, where the repulsive member 7 is not yet rotated and the movable member 1 alone is moved by the action of the mechanism portion 41 (not shown). Upon the current interruption of a relatively small current such as an overload interruption, no pressure can be accumulated in the pressure accumulation space 27, so that no gas flow is generated upon the current interruption blasting from the pressure accumulation space 27 through the cylindrical space 26, whereby the arc extinguishing function by the gas flow cannot be utilized. Therefore, upon overload current interruption, the arc must be brought into contact with the arc extinguishing plates 31 to cool and extinguish it. However, according to this invention, the cylindrical insulating material 25 is used to generate a high pressure atmosphere and to raise the arc voltage, so that the tip portion of the movable member 1 is inevitably in a rod shape in which the contact 2 is attached to the end portion.

Therefore, the movable member side arc spot is difficult to be moved to the end surface of the movable member tip on the arc extinguishing plate side. Accordingly, in this embodiment, a position L2 of the notched portion of the horse shoe-shaped arc extinguishing plates 31 is positioned closer to the movable member rotational center than to a position L1 of the opposite end surface relative to the movable member rotational center (not shown) of the space 26 surrounded by the cylindrical insulating material 25. However, since the rotation of the movable member 1 is obstructed by the arc extinguishing plates 31 if the position L2 of the notched portion intersects with the locus drawn by the tip portion of the movable member 1 shown by the dot-and-dash line in the figure, it is necessary that the position L2 of the notched portion be positioned between the above dot-and-dash line and the above position L1. With such arrangement, the arc is easily brought into contact with the arc extinguishing plates 31, obtaining a sufficient interrupting performance even during the overload current interruption.

Also, when the horse shoe-shaped core 52 is provided to surround a portion of the cylindrical insulating material 25 opposite to the repulsive member rotational center as shown in FIG. 28(*b*), the arc in the vicinity of the repulsive contact 8 is attracted to the side of the core 52, making the arc to more easily brought into contact with the arc extinguishing plates 31.

It is to be noted that the fact that the arc spot on the movable member side is difficult to move to the end surface of the movable member 1 on the side of the arc extinguishing plates 31 is also true in a large current interruption such as a short-circuit interruption and the like. Therefore, it is difficult for the arc to be brought into contact with the arc extinguishing plates 31 even in the latter half of the interruption, not being permitted to effectively utilize the arc cooling effect of the arc extinguishing plates 31, increasing the internal pressure of the arc extinguishing unit housing due to the heat of the arc, easily resulting in the generation of the housing cracks. Therefore, the fact that the arc is made easily brought into contact with the arc extinguishing plates 31 by the structure according to this embodiment also provides the effect of suppressing the internal pressure increase and preventing the cracks at the time of short circuit interruption.

Embodiment 13

Figure 29:
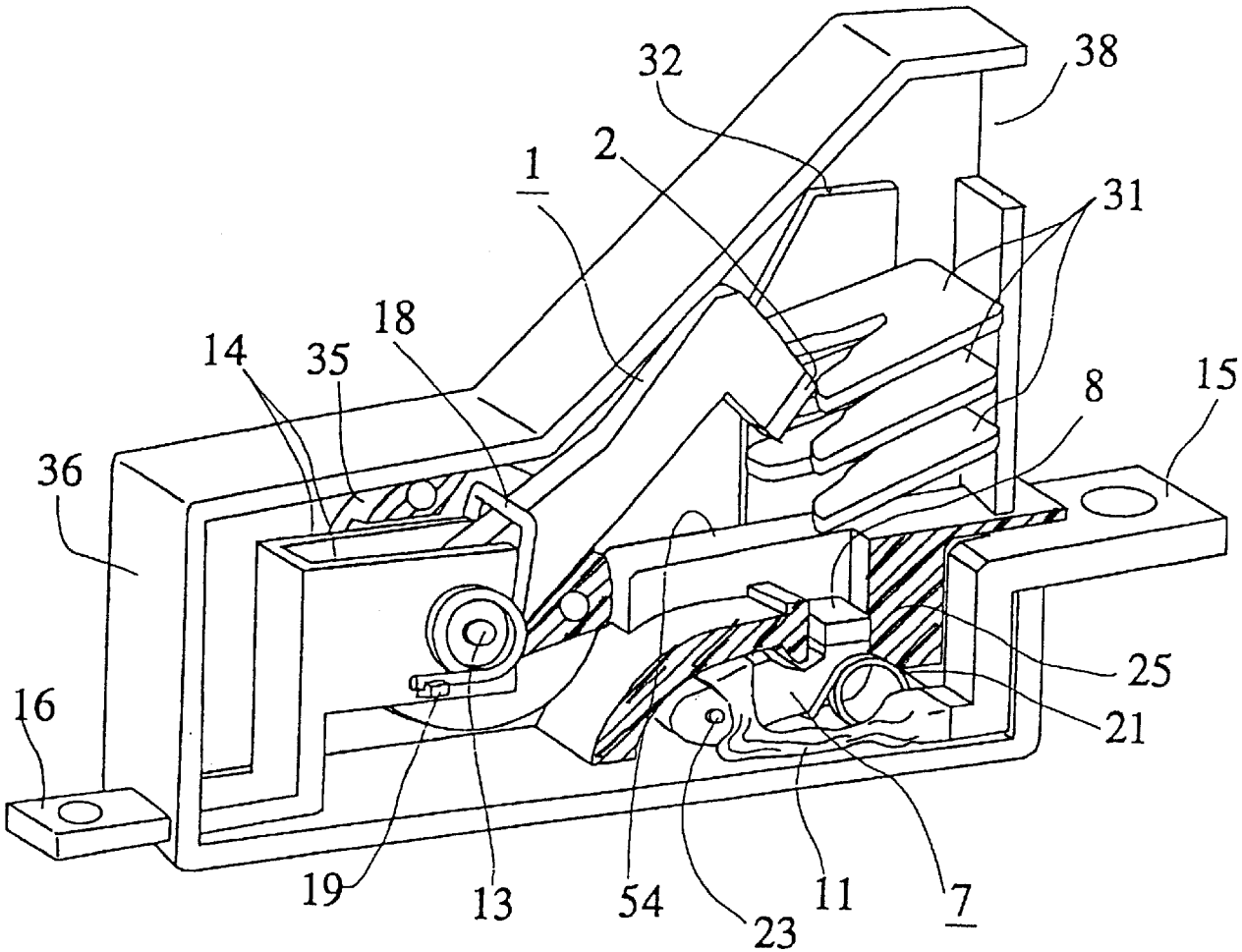
FIG. 29 is a sectional perspective view showing the arc extinguishing unit internal structure of the circuit interrupter having a current limiting function according to the thirteenth embodiment.
Figure 30:
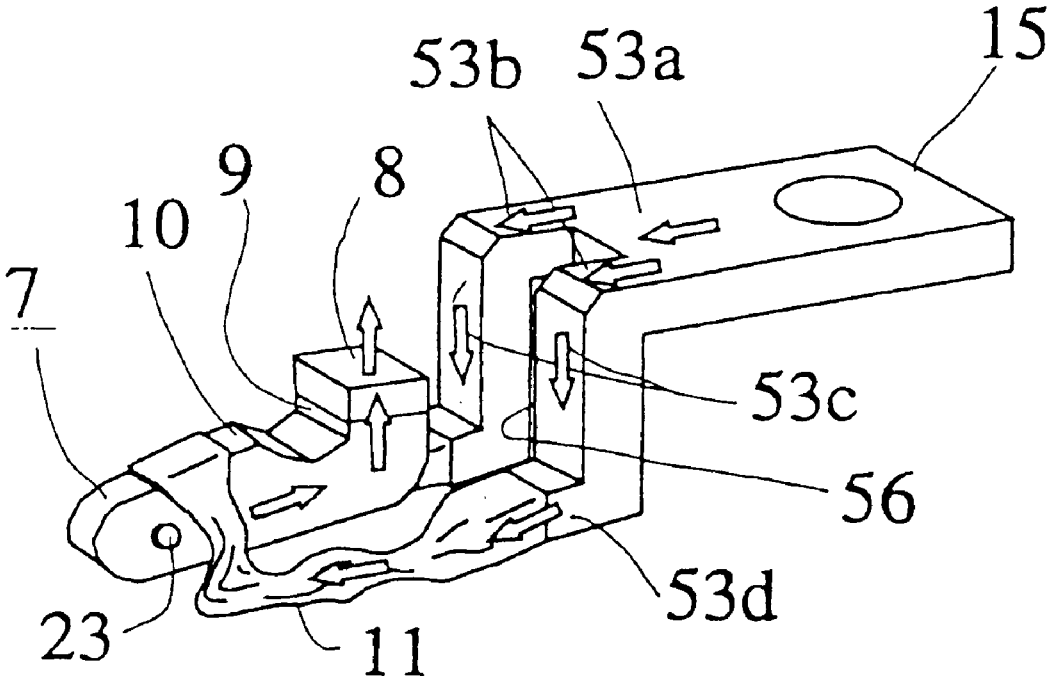
FIG. 30 is a perspective view showing the conductor arrangement in the vicinity of the repulsive member according to the fourteenth embodiment.

The thirteenth embodiment of the present invention will now be described in conjunction with the figure. FIG. 29 is a perspective view showing the interior of the arc extinguishing unit of this embodiment, and FIG. 30 is a perspective view of the conductor arrangement around the repulsive member 7. The arrows in FIG. 30 depict the flow of current. In this embodiment, differing from the seventh and the eighth embodiments, the terminal portin 15 has connected thereto the repulsive member 7 through the electrical paths 53*a*, 53*b*, 53*c* and 53*d* as well as the flexible conductor 11 and the movable member 1 is connected to the terminal portion 16 through the sliding contact 14. These electrical paths 53*a*, 53*b*, 53*c* and 53*d* and the portion of the flexible conductor 11 on the side of the electrical path 53*d* are covered by an insulating material 54 integrally formed with the cylindrical insulating material 25 at the portion that can be "seen" from the arc generated between the contacts 2 and 8. Also, the electrical paths 53*b*, 53*c* and 53*d* has formed therein a slit 56 having a width equal to that of the repulsive member 7 to provide electrical paths laterally shifted in the plane including locus in which the arc column is generated and exapanded.

With such the structure, there is no electrical path corresponding to the conductor horizontal portion which generates the electromagnetic contact separating force discussed in the eighth embodiment, whereby the contact separating speed is decreased as compared to that of the eighth embodiment. However, the conductor length within the arc extinguishing chamber can be made shorter, whereby the cost can be reduced and the structure is simple and the assembly is improved. Also, since there is no conductor extending transversly within the arc extinguishing unit which corresponds to the conductor horizontal portion of the seventh and the eighth embodiments, the insulating distance between the conductor can be easily maintained. Also, while the current flowing mainly through the electrical paths 53*b*, 53*c* and 53*d* generates a force pushing back the arc generated between the contacts to the other side of the arc extinguishing plates 31, making it difficult for the arc to contact the arc extinguishing plates 31, the function of the electrical paths 53*b*, 53*c* and 53*d* pushing back the arc is minimized by the provision of the slit 56 according to this embodiment.

Embodiment 14

Figure 31:
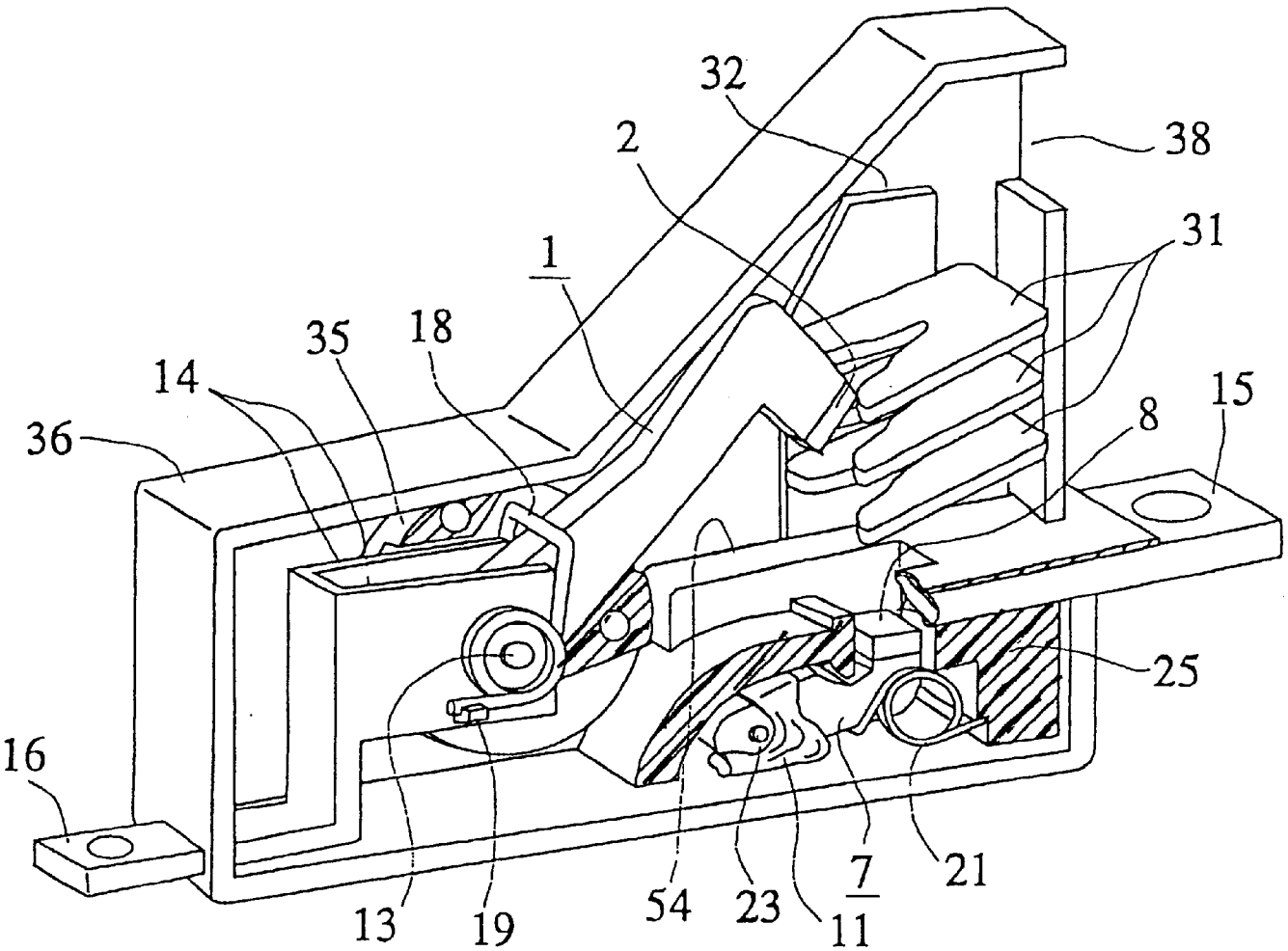
FIG. 31 is a fragmental sectional perspective view showing the arc extinguishing unit internal structure of the circuit interrupter having a current limiting function according to the fourteenth embodiment.
Figure 32:
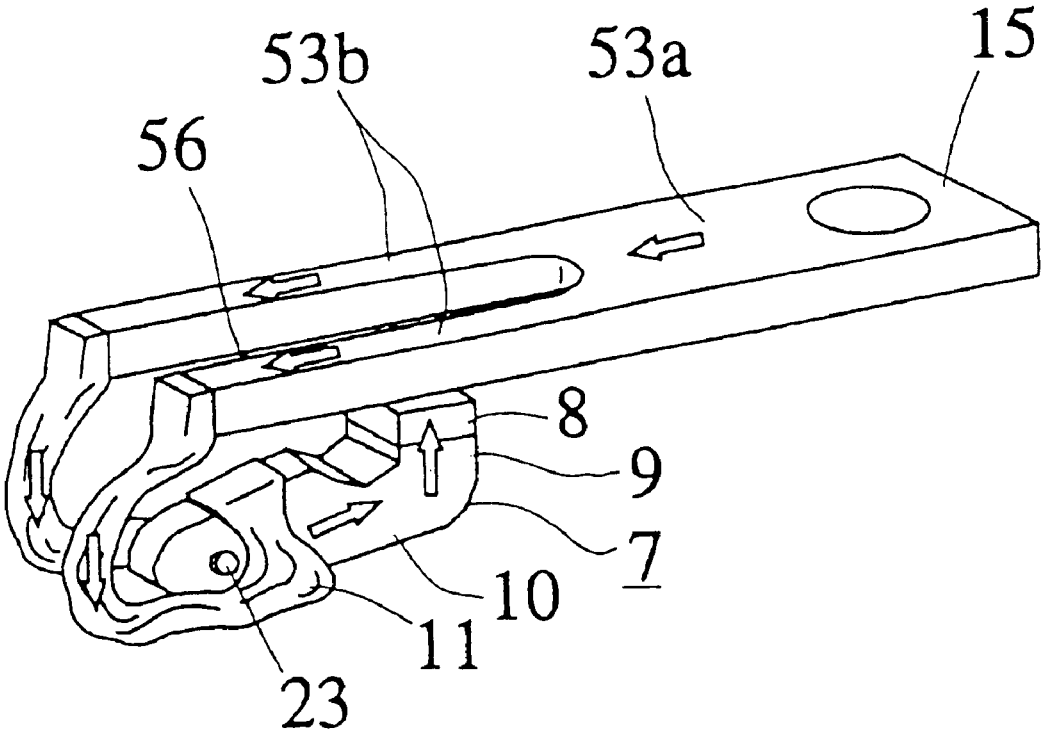
FIG. 32 is a perspective view showing the conductor arrangement in the vicinity of the repulsive member according to the fourteenth embodiment.

The fourteenth embodiment of the present invention will now be described in conjunction with the figure. FIG. 31 is a perspective view showing the interior of the arc extinguishing unit of this embodiment, and FIG. 32 is a perspective view of the conductor arrangement around the repulsive member 7. The arrows in FIG. 32 depict the flow of current. In this embodiment, differing from the seventh and the eighth embodiments, the terminal portin 15 has connected thereto the repulsive member 7 through the electrical paths 53*a*, 53*b*, as well as the flexible conductor 11, and the movable member 1 is connected to the terminal portion 16 through the sliding contact 14. These electrical paths 53*a*, 53*b* and the portion of the flexible conductor 11 on the side of the electrical path 53*b* are covered by the insulating material 54 integrally formed with the cylindrical insulating material 25 at the portion that can be "seen" from the arc generated between the contacts 2 and 8. Also, the electrical path 53*b* has formed therein the slit 56 so as not to obstacte the rotation of the movable member 1. The electrical path 43*a* and 53*b* are positioned above the repulsive member 7.

With such the structure, similarly to the thirteenth embodiment, the conductor length within the arc extinguishing chamber can be made shorter, whereby the cost can be reduced, the structure is simple and the assembly is improved, and since there is no conductor extending transversly within the arc extinguishing unit which corresponds to the conductor horizontal portion of the seventh and the eighth embodiments, the insulating distance between the conductor can be easily maintained. Also, since the current flowing through the electrical path 53*b* is substantially parallel and opposite to the current flowing through the repulsive arm horizontal portion 10 in the closed position, the contact opening electromagnetic force on the repulsive member 7 can be increased more than in the thirteenth embodiment. Further, the current flowing in the vertical direction in the repulsive member 7 also generates a magnetic flux component that strengthen the electromagnetic contact separating force on the repulsive member 7. Therefore, the contact separating speed of the repulsive member 7 is increased to improve the current limiting performance.

Embodiment 15

Figure 33:
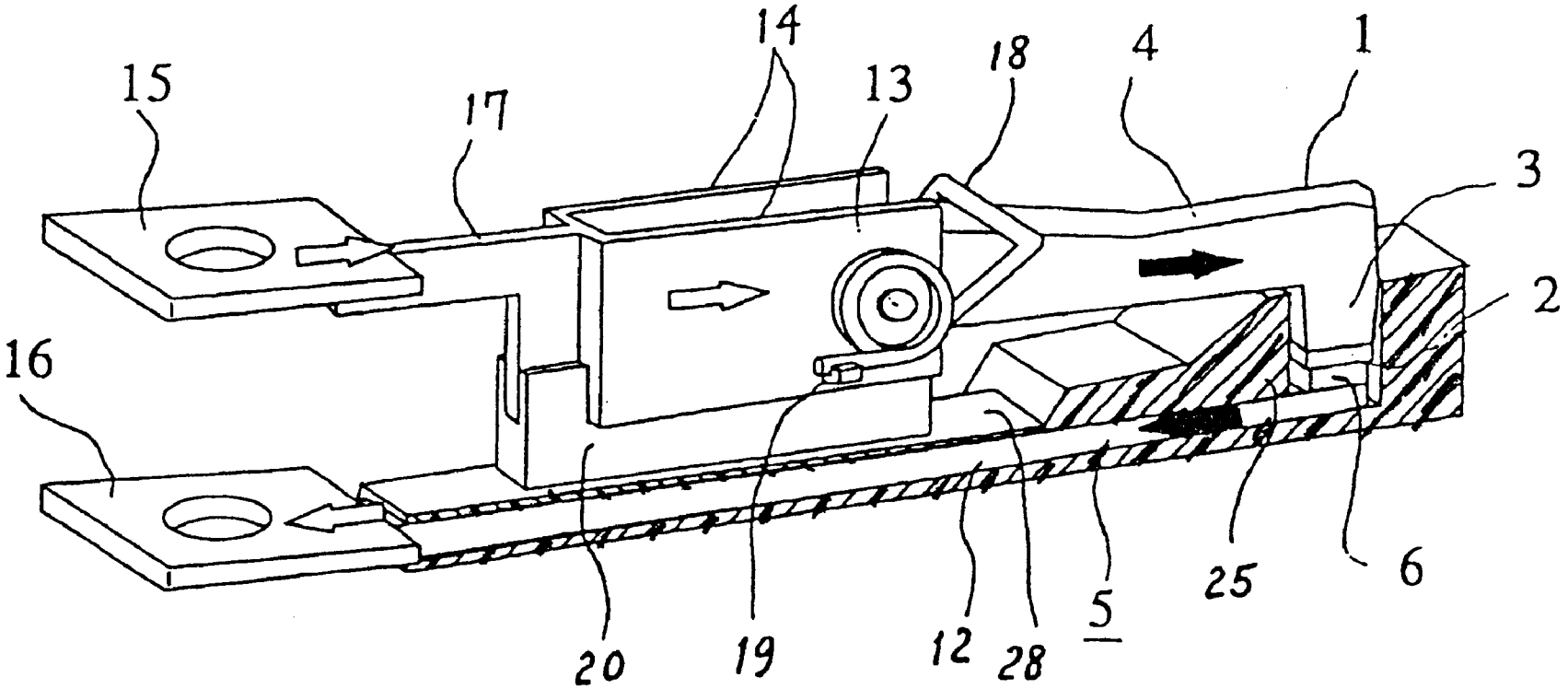
FIG. 33 is a fragmental sectional perspective view showing the main portion of the current limiting device according to the fifteenth embodiment.
Figure 34:
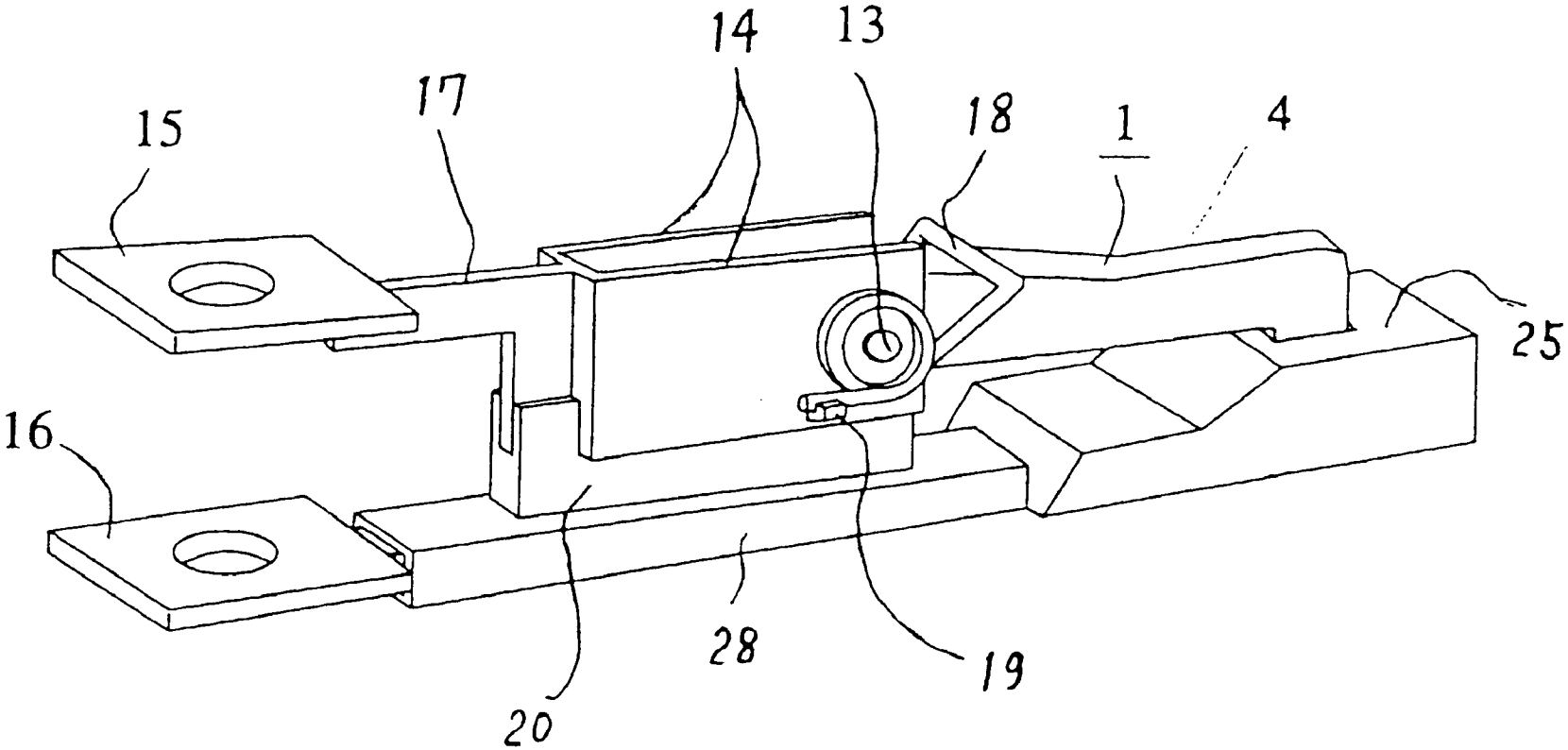
FIG. 34 is a perspective view showing the main portion of the current limiting device of the fifteenth embodiment.

The fifteenth embodiment of the present invention will now be described in conjunction with the figure. FIG. 33 is a perspective view showing the main portion of a current limiting device according to the fifteenth embodiment, with one portion of the cylindrical insulating material 25 and the insulating cover 28 is removed for illustrating the internal structure. FIG. 34 is a perspective view showing the appearance of the one shown in FIG. 33. In FIG. 33, 1 is a substantially L-shaped movable member having a movable contact 2, a movable arm vertical portion 3 to which the movable contact 2 is secured and a movable arm horizontal portion 4 substantially perpendicular to the movable arm vertical portion 3. The movable member 1 forms one contact pair together with a stationary member 5 composed of a stationary contact 6 and a stationary conductor 12, the movable member 1 is urged toward the stationary member 5 by a movable contact contacting spring 18. Also, the movable member 1 is supported rotatably about the movable member rotary shaft 13 and is electrically connected to a terminal 15 through a sliding contact 14 and the connecting conductor 17. On the other hand, the stationary member 5 is covered with the cylindrical insulating material 25 and the insulating cover 28 except for the stationary contact 6 and the connecting portion to the terminal portion 16. Arrows in the figure illustrate the electrical path during the current carrying period, and the arrangement being such that the current in the movable arm horizontal portion 4 and the current in the stationary conductor 12 are substantially in parallel and in opposite to each other.

Figure 35:
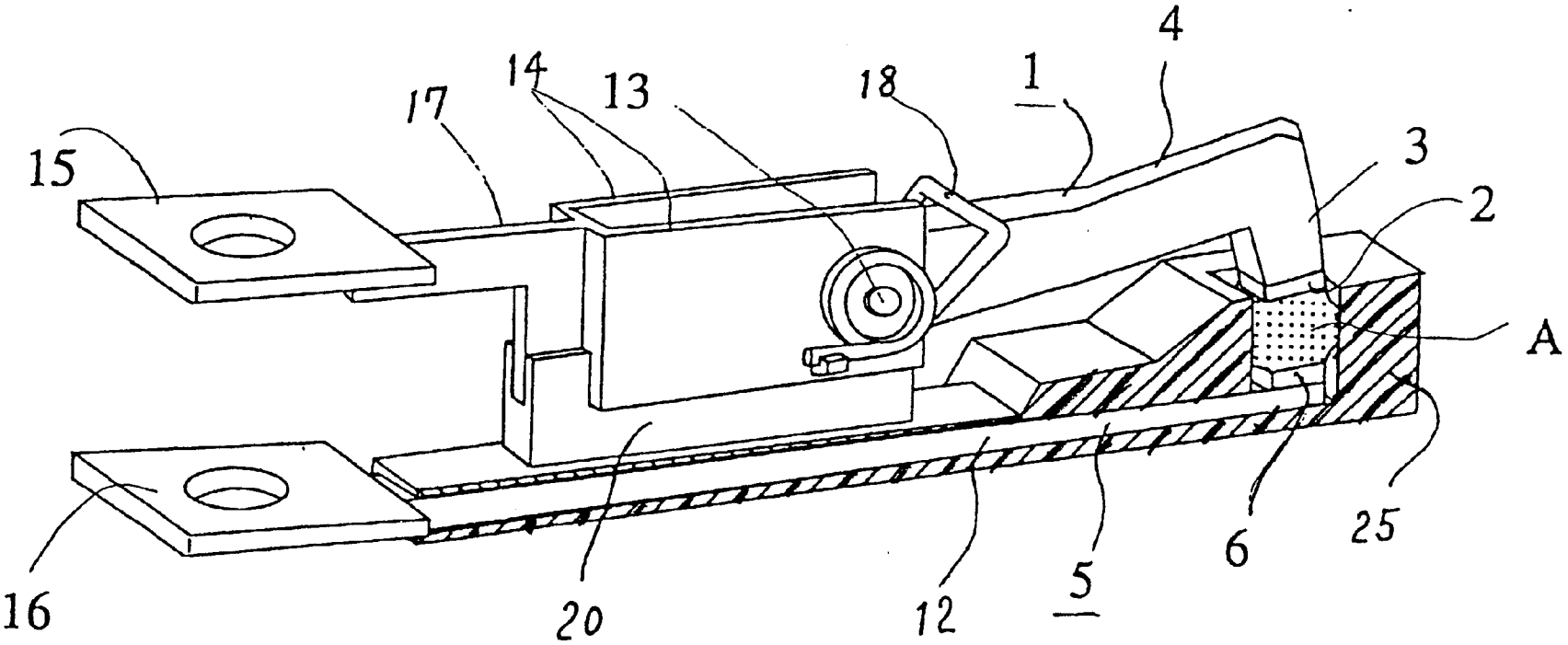
FIG. 35 is a fragmental sectional perspective view for explaining the operation of the fifteenth embodiment.

In the current limiting device shown in FIG. 33, when the current flowing therethrough is abruptly increased due to the generation of a short-circuiting fault or the like, the electromagnetic repulsive force F1 due to the current concentration at the contact contacting surface and the electromagnetic repulsive force F2 due to the current in the stationary conductor 12 substantially parallel and opposite to that in the movable arm horizontal portion 4 cause the contacts to separate against the contacting pressure of the movable member contacting pressure 18 to generate an arc A between the separated contacts. This state is illustrated in FIG. 35. Upon the generation of the arc, the electromagnetic repulsive force F1 due to the current concentration diminishes, but the electromagnetic repulsive force F2 due to the current in the stationary conductor 12 substantially parallel and opposite to that of the movable arm horizontal portion 4 continues to rotate the movable member 1 into the contact separating direction.

Figure 36:
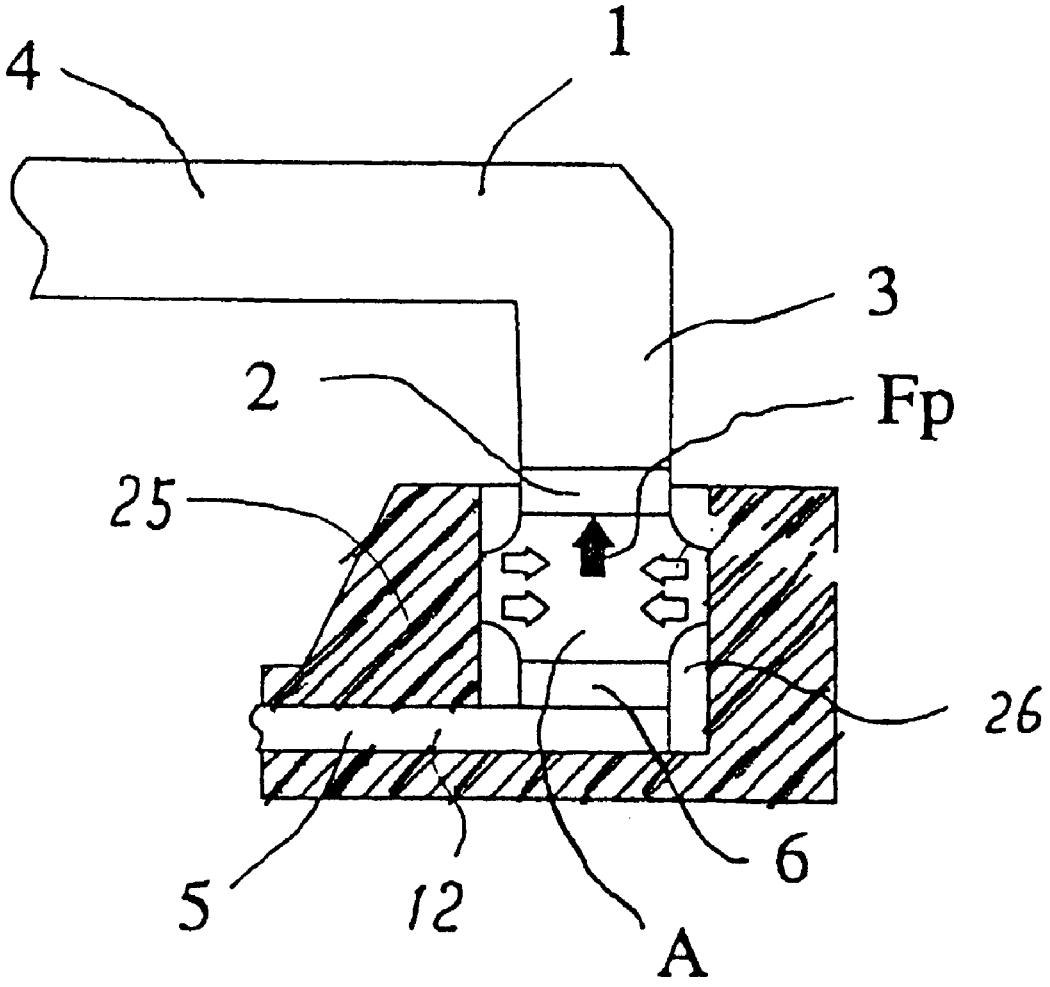
FIG. 36 is a fragmental sectional view for explaining the operation of the fifteenth embodiment.

Also, as shown in FIG. 36, as the arc generates, a large amount of vapor is generated from the inner surface of the cylindrical insulating material 25 due to the arc heat, generating a high pressure atmosphere within the cylindrical space 26 surrounded by the cylindrical insulating material 26. This generation of the high pressure in the cylindrical space 26 applies the movable member 1 a contact separating force Fp due to the pressure difference. This contact separating force Fp due to the pressure difference and the above electromagnetic force F2 cause the movable member 1 to rotate at a high speed, thus rapidly separating the contacts. This high speed contact separation causes the arc length within the high pressure atmosphere to rapidly elongate, rapidly raising the arc voltage, and the fault current reaches to its peak value.

Figure 37:
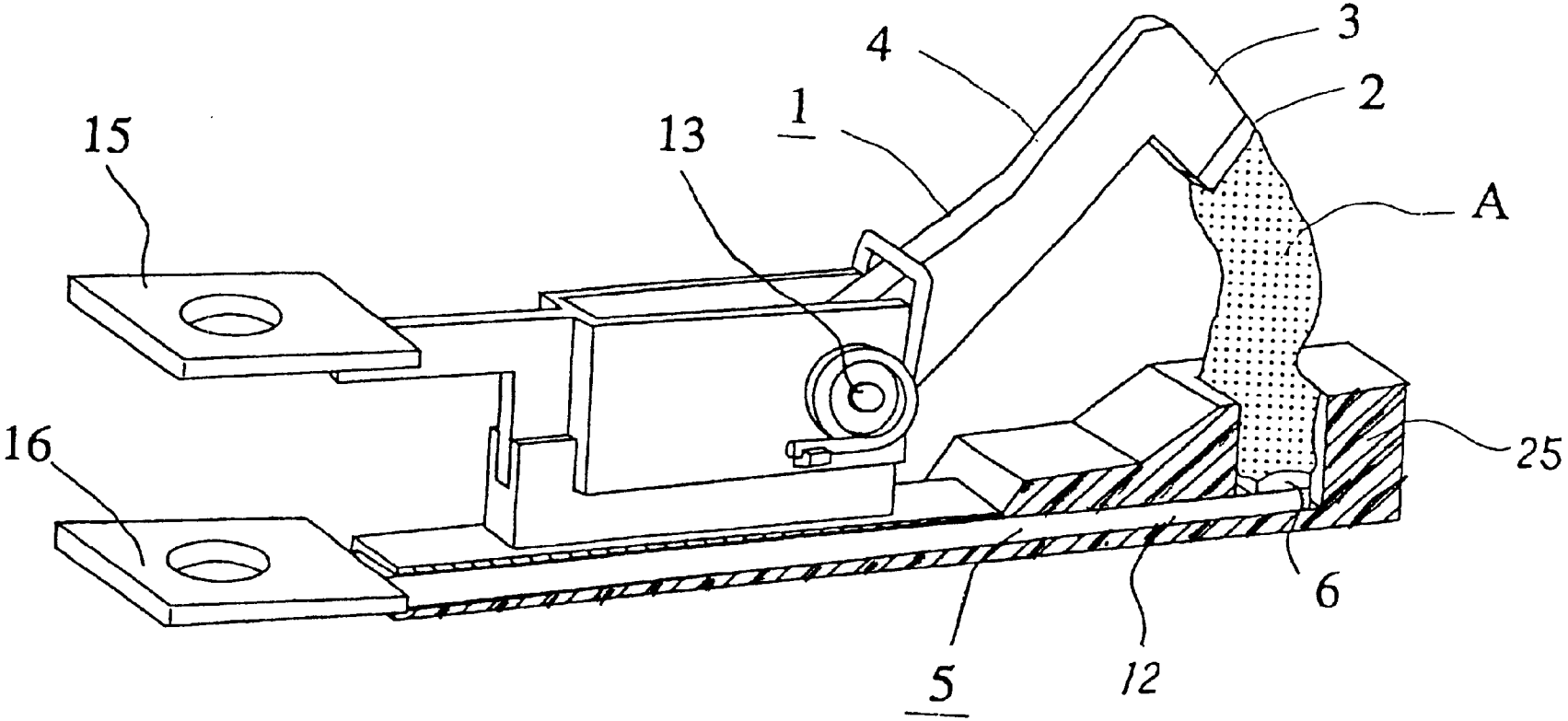
FIG. 37 is a fragmental sectional perspective view for explaining the operation of the fifteenth embodiment.

FIG. 37 illustrates the state in which the movable member 1 further rotates from the positin shown in FIG. 35 and reached to its maximum contact separation position. In this sate, since the current peak is gone and a sufficiently large arc voltage is generated, the fault current reaches the zero point. At this time, since the movable contact 2 is positioned outside of the narrow space surrounded by the cylindrical insulating material 25, the vapor of the electrode metal in the vicinity of the movable contact 2 can easily be diffused or cooled by an ordinary means (such as a vapor flow form the insulating material, a grid or the like), facilitating the interruption of the current at the sufficient insulation recovery between the electrodes. Also, even when the movable member 1 is laterally displaced, it does not touch the inner surface of the cylindrical insulating material 25, thus no re-firing due to the surface insulation breakdown ocurrs. By additionay providing means for restricting the movable member 1 at about the maximum contact separation position and preventing the re-closure (such as a latch mechanism, a linkage or the like), a current limiting device superior in current limiting performance can be obtained.

Also, in this embodiment, differing from the conventional design shown in FIG. 147, there is no need for providing an excitation coil for assisting the contact separation of the movable member, an improved current limiting performance at a low impedance can be obtained and it is possible to apply to a circuit in which a high currently carrying capacity is required.

Further, since the movable member 1 is rotated for the contact separation, the required dimensions in the direction of opening and closing of the movable contact 2 is a sum of the thickness of the statinary conductor 12, the thickness of the stationary contact 6, the space in which the movble member 1 moves, the thickness of the movable contact 2 and the movable arm vertical portion 3, enabling the required dimension in that direction to be smaller than in the conventional direct movement type current limiting device. Therefore, even when the outer dimension is limited, the contact separating distance necessary for efficiently associating the high pressure with the arc voltage increase can be easisly maintained.

Embodiment 16

Figure 38:
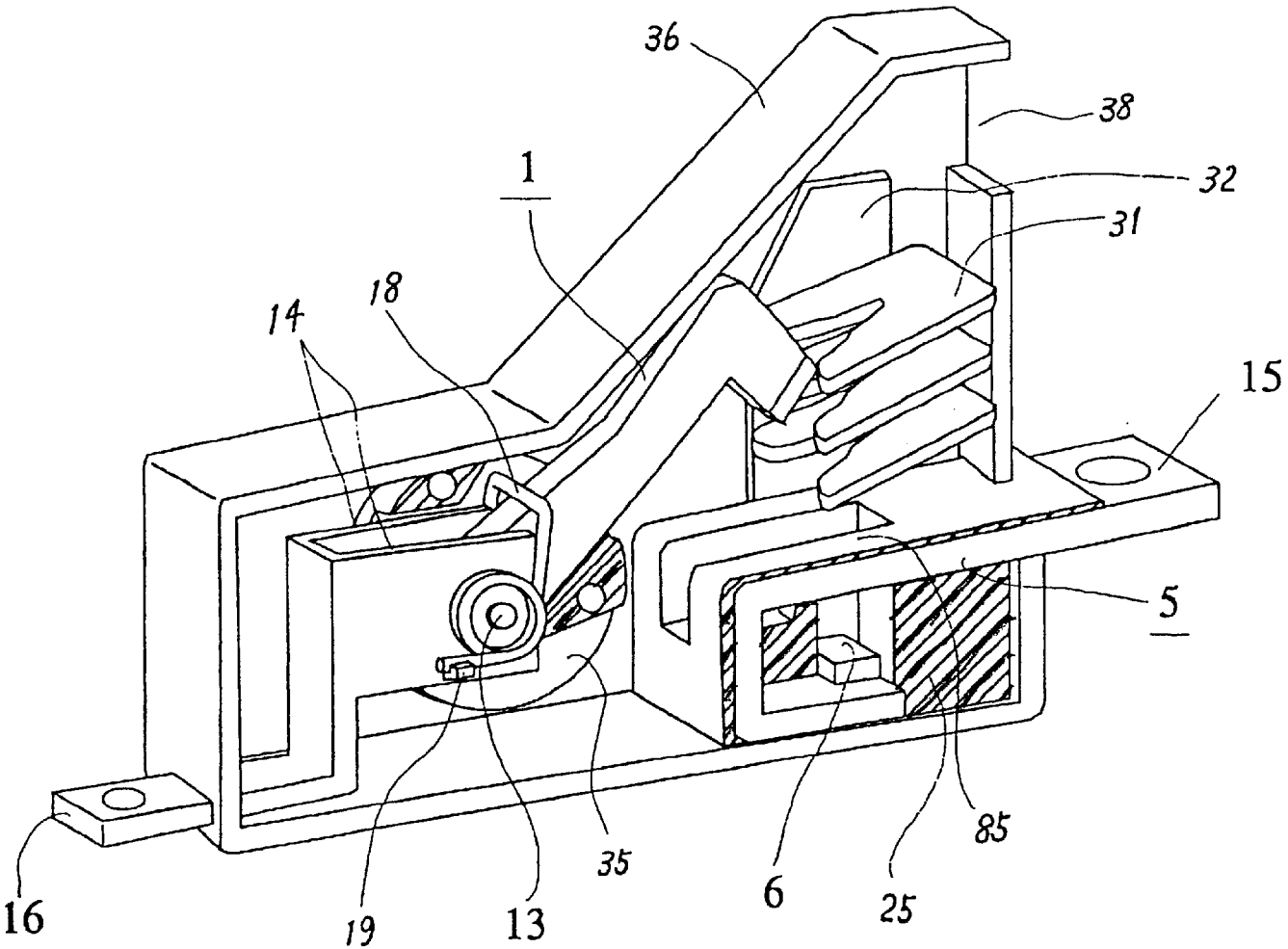
FIG. 38 is a fragmental sectional perspective view showing the arc extinguishing unit of the current limiting device according to the sixteenth embodiment of the present invention.

The sixteenth embodiment of the present invention will now be described in conjunction with FIG. 38. In FIG. 38, the stationary member 5 is directly connected to the terminal portion 15, and the movable member 1 is electrically connected to the relay portion by the terminal 16 through the sliding contct 14. Also, the stationary contact shown in FIG. 39 includes an electrical path **86*c* in which a current substantially parallel and opposite to the movable arm horizontal portion in the closed position. The stationary member 5 is covered by an insulating material 85 integrally formed with the cylindrical insulating material 25 at the portion that can been "seen" from the movable contact 2 in the open positin except for the vicinity of the stationary contact 6**.

An electrical path **86*c* is provided as the electrical path in which a current substantially parallel and opposite to the movable arm horizontal portion 4 in the closed position. While the magnetic field generated by the electrical path 86*b* contributes to the contact opoening electromagentic foce for the movable member 1**, the conductor length within the arc extinguishing chamber can be made shorter, allowing the cost to be decreased, making the structure simple and the assembling easy. Also, the insulating distance can be easily maintained.

Embodiment 17

Figure 39:
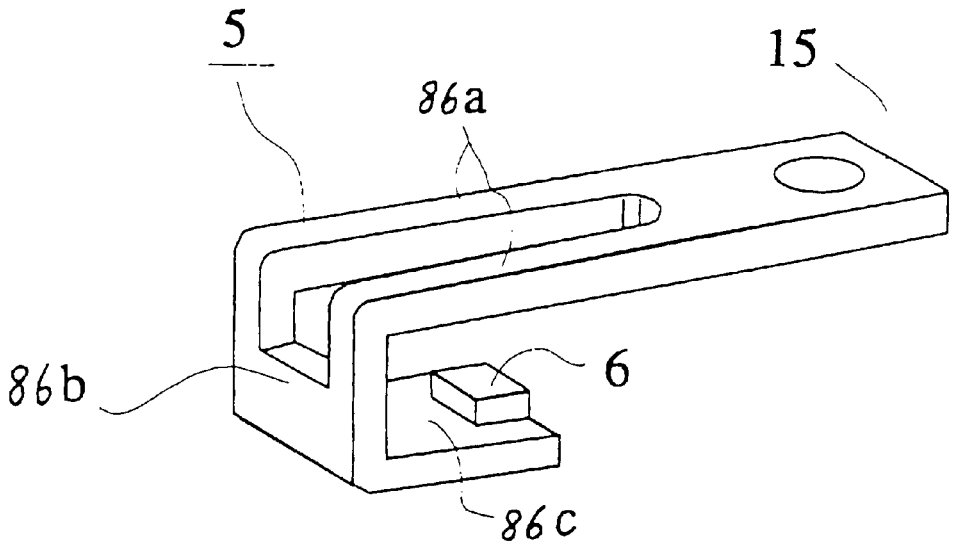
FIG. 39 is a perspective view showing the stationary member configuration shown in FIG. 38.
Figure 40:
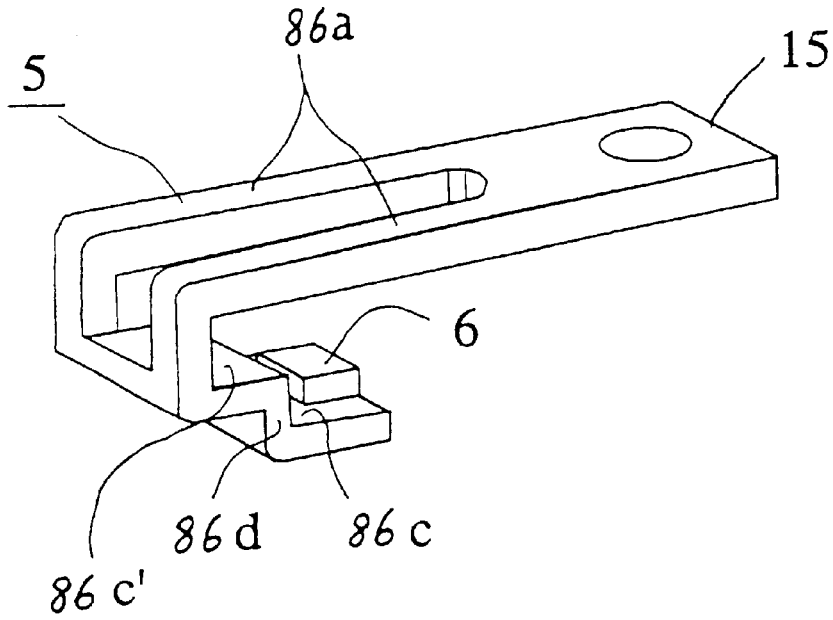
FIG. 40 is a perspective view showing the stationary member configuration of the current limiting device according to the seventeenth embodiment of the present invention.
Figure 41:
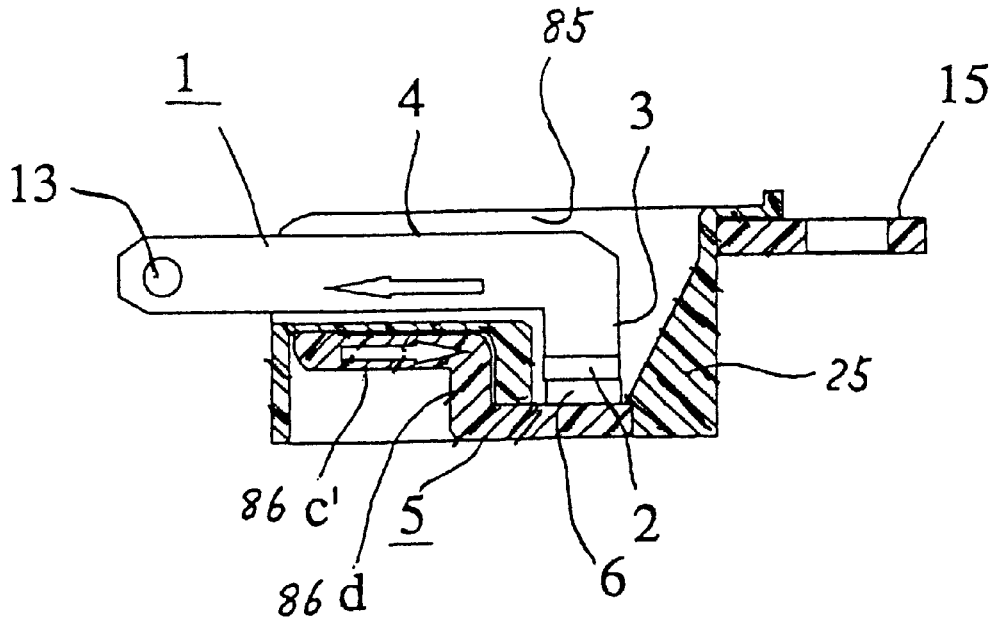
FIG. 41 is a fragmental sectional view for explaining the operation of the seventeenth embodiment of the present invention.

The seventeenth embodiment of the present invention is illustrated in FIGS. 40 and 41. FIG. 40 is a view illustrating the stationary member 5 of this embodiment, one portion of the vertical electrical path 86*b* of the stationary member 5 of FIG. 39 is replaced with a horizontal electrical path 86*c*' and a vertical electrical path 86*d*. FIG. 41 is a cross sectional view illustrating the stationary member 5 shown in FIG. 40, the cylindrical insulating material 25 and the insulating material 85 integrally formed with the cylindrical insulating material 25 and covering the stationary member 5, and arrows in the figure indicate the current flow direction. As apparent from the figure, by using the stationary member configuration shown in FIG. 40, the movable arm horizontal portion 4 and the electrical path 86*c*' of the stationary member 5 can be significantly close to each other, making the electromagnetic contact separating force upon the interruption of a fault current larger than that in the sixteenth embodiment illustrated in FIG. 39.

Embodiment 18

Figure 42:
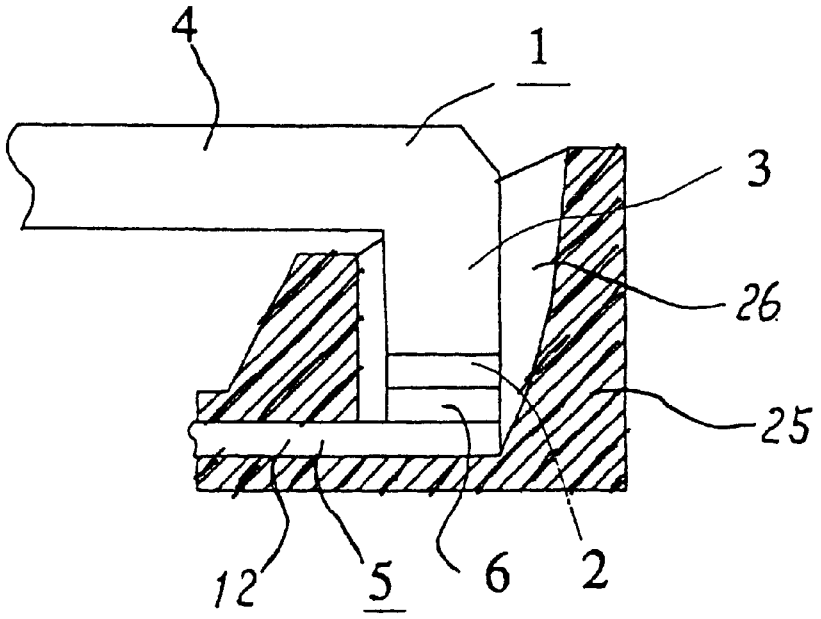
FIG. 42 is a sectional view showing the cylindrical insulator of the current limiting device according to the eighteenth embodiment of the present invention.

The eighteenth embodiment of the present invention is illustrated in FIG. 42. FIG. 42 is a fragmental sectinal view illustrating the cylindrical insulating material 25, the end portion of the stationary member 5 at the side of the stationary contact 6 and the tip portion of the movable member 1 at the side of the movable contact 2, from which it is seen that the wall height of the wall opposite to the movable member rotary shaft out of the walls of the cylindrical insulating material 25 surrounding the cylindrical space 26 is made higher than the height of the wall of the insulating material on the sides of the rotary shaft of the movable member. The arc generated between the contacts upon the interruption is subjected to an electromagnetic drive force in the direction of opposite to the rotary shaft of the movable member. Also, while it is advantageous to make the moment of inertia of the movable member 1 to separate them at a high speed, the moments of inertia of the movable member 1 is increased as the lengths of the movable arm vertical portion 3 which depends upon the height of the cylinder portion of the cylindrical insulating material 25. Accordingly, the height of the wall of the insulating material opposite to the rotary shaft of the movable member is made higher than the height of the wall of the insulating material on the side of the rotary shaft of the movable member and the length of the movable arm vertical portion 3 is made short as illustrated in FIG. 42, whereby the moment of inertia can be reduced and a sufficiently high pressure atmosphere and a sufficient vapor of the cylindrical insulating material can be generated, thereby to further improve the current limiting performance.

Embodiment 19

Figure 43:
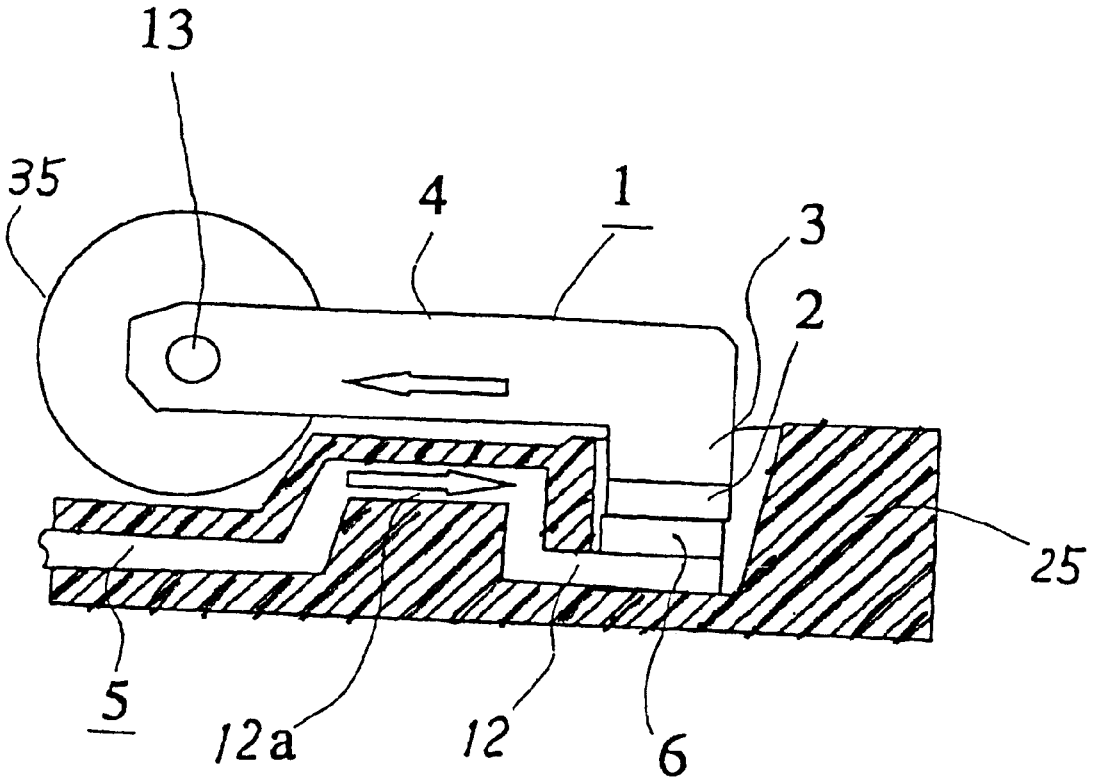
FIG. 43 is a sectional view showing the movable member, the stationary member and the cylindrical insulator of the current limiting device according to the nineteenth embodiment of the present invention.

FIG. 43 illustrates the nineteenth embodiment of the present invention. Illustrated in the figure are the substantially L-shaped movable member 1 in the closed position and the stationary member 5 having the stationary conductor 12 of which portion 12*a* opposing to the movable arm horizontal portion 4 is bent to be positioned closed to the movable arm horizontal portion 4. By disposing the stationary conductor 12 closely to the movable arm, the electromagnetic repulsive force can be increased. Also, in the embodiment, the movable member 1 is maintained substantially in an L-shape, so that the moment of inertia of the movable member is not increased, allowing a high speed contact separation.

Embodiment 20

Figure 44:
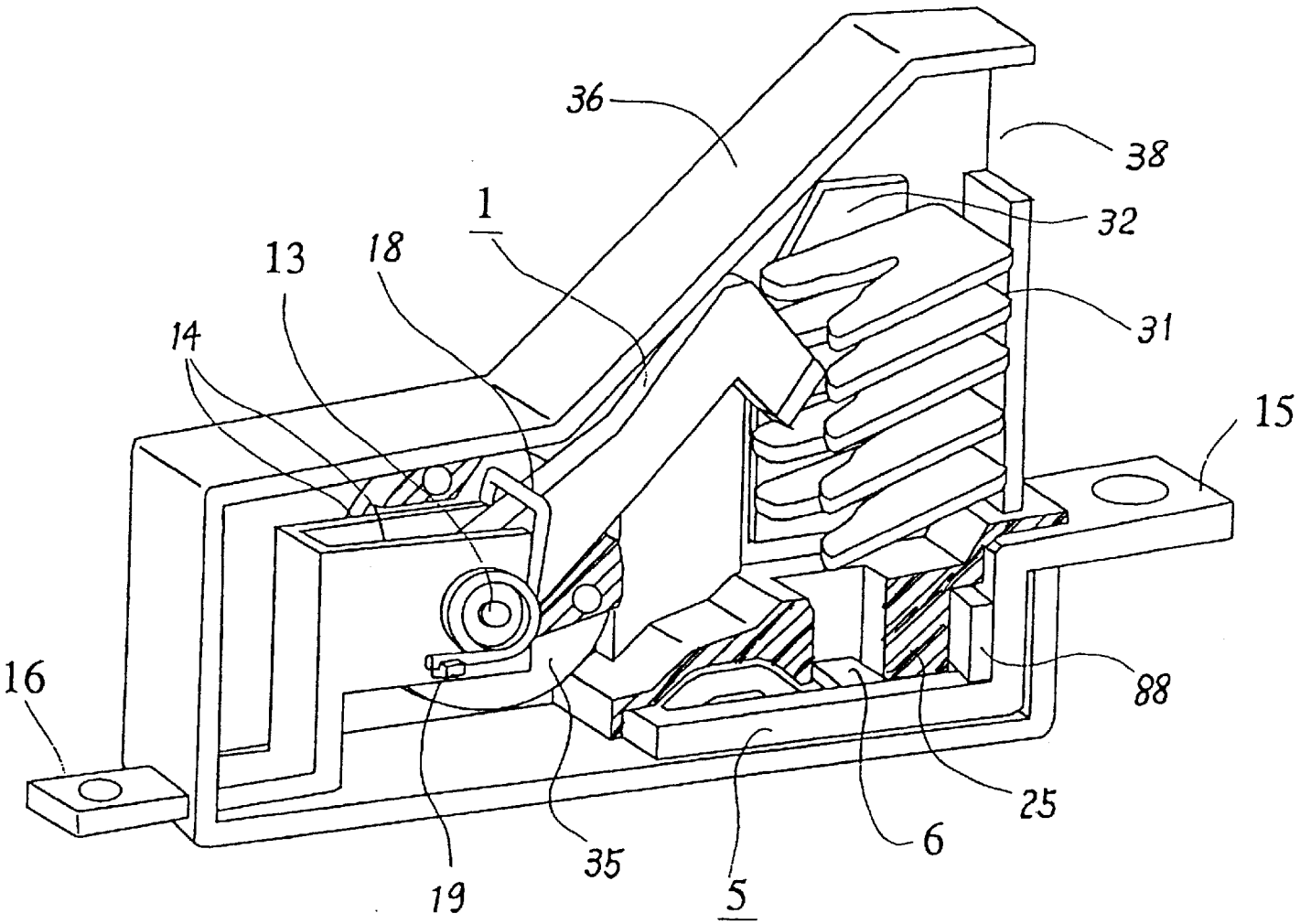
FIG. 44 is a fragmental sectional perspective view showing the arc extinguishing unit of the current limiting device according to the twentieth embodiment of the present invention.

The twentieth embodiment of the present invention will now be described in conjunction with FIG. 44. FIG. 44 is a partially sectioned perspective view showing the internal structure of the arc extinguishing chamber unit, wherein 5 is the stationary member, 25 is the cylindrical insulating material, 88 is the magnetic flux shield plate and a core 89 is disposed at both sides of the movable member 1 as will be described later (FIG. 45).

The stationary member configuration which is one of the features of this embodiment will be first described. FIG. 45 is a partial sectinal view showing the stationary member configuration of FIG. 44, the electrical path being formed by the terminal portin 15, the electrical paths 86*f*, 86*e*, 86*c*, 86*d* and 86*c* and the statinary contact 6. The stationary member 5 has formed therein a slit 87 to position the electrical paths 86*e* and 86*f* laterally displaced from the plane including the locus of the rotation of the movable member in order to decrese the magnetic field component abstracting the contact separation of the movable member and generated by the current flowing through the electrical paths 86*e* and 86*f*. However, the electrical paths 86*c*', 86*d* and 86*c* constitute a current path substantialy parallel and opposite to the movable arm horizontal portion 4 in the closed position, so that the distance between the substantially L-shaped movable arm horizontal portion and the electrical path 86*c*' is decreased. Therefore, the electromagnetic repulsive force acting on the movable member upon the short-circuit interruption is increased and the contact separating speed in increased.

Also, according to the stationary member configuration of this embodiment, the electrical path 86*d* through which the current component in the contact opening direction (vertical direction) flows is disposed at about the stationary contact. The vertical direction component of the current in the electrical path 86*d* is in the opposite direction to the arc generated between the separated contacts and pushing the arc toward the terminal portion 15. Therefore, the arc generated between the contacts is urged against the terminal portion side wall surface of the cylindrical insulating material 25, thus improving the arc cooling function by the vapor from the cylindrical insulating material wall surface.

Figure 45:
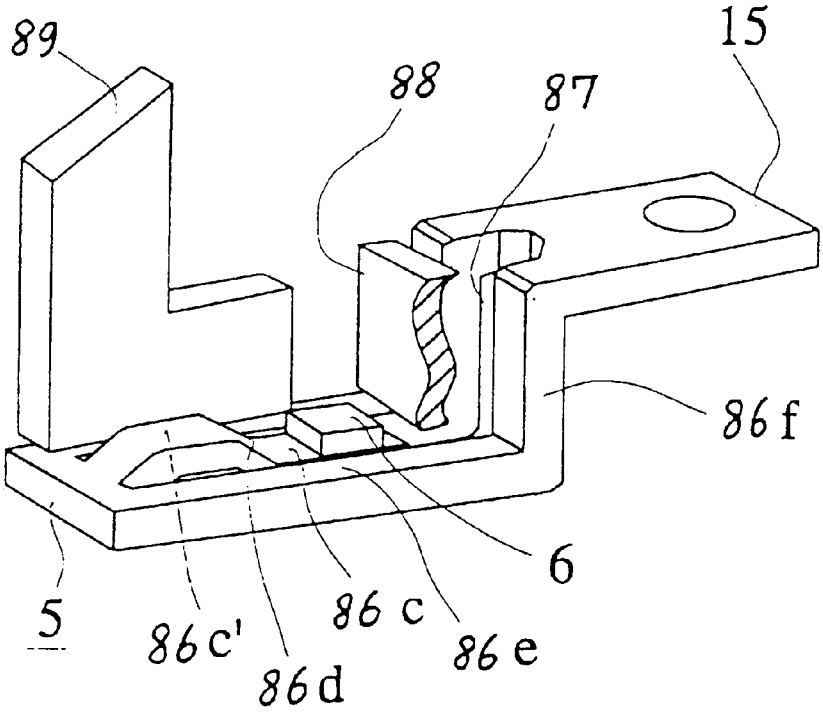
FIG. 45 is a perspective view showing the stationary member configuration shown in FIG. 44.

Illustrated in FIG. 45 are, in addition to the stationary member 5, a magnetic flux shield plate 88 partially removed and one of pair of cores 89 disposed above the electrical path 86*e*. The magnetic flux shield 88 and the core 89 are made of magnetic material such as iron and disposed so as not to directly brought into contact with the arc generated between the separated contacts by means of the insulating material integrally formed with the cylindrical insulating material 25. The magnetic flux shield plate 88 mainly serves to shield the magnetic flux (which functions to prevent the contact separating movement of the movable member and pushing back the arc toward the movable member rotary shaft) generated by the current flowing through the electricla path 86*f*. On the other hand, the core 89 functions to reinforce the magnetic field component generated by the current flowing through the electric paths 86*c*', 86*d* and 86*c* for openng the movable member and to shield the magnetic flux generated by the current flowing through the electrical path 86*e* and preventing the opening of the movable member.

When a magentic flux generated by an abruptly increasing fault current in a ciertain electrical path is to be shielded such as by the magnetic flux shield plate 88 and the core 89, the eddy current flowing in the magnetic material serves in the direction of preventing the entry of the magnetic flux, the conductivity of the magnetic material may be large. Therefore, the magnetic flux shield plate 88 and the core 89 may be formed with an inexpensive iron plate and the electromagnetic contact opening force acting on the movable member can advantageously be significantly improved without the need for using the laminated core which is used to reduce the magneic reluctance and increase the electromagnetic force or using an expensive insulating material core.

Figure 46:
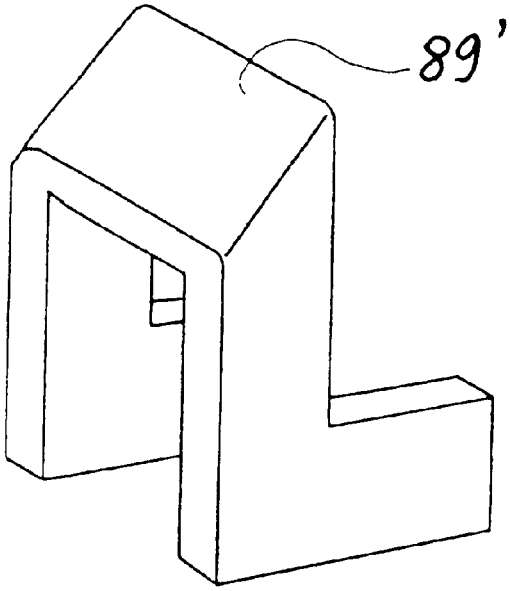
FIG. 46 is a perspective view showing another configuration of the magnetic core according to the twentieth embodiment of the present invention.
Figure 47:
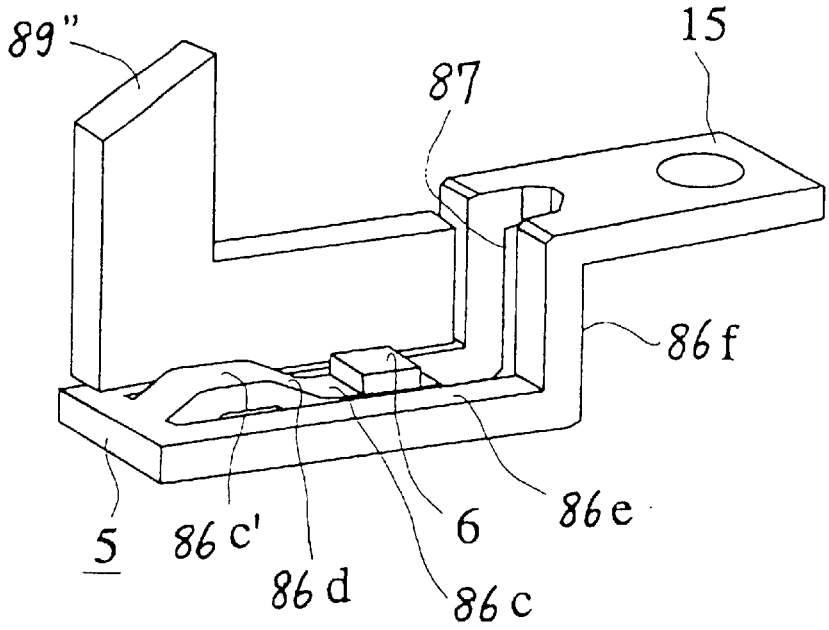
FIG. 47 is a perspective view showing a still another configuration of the magnetic core according to the twentieth embodiment of the present invention.

The core 89' illustrated in FIG. 46 is a modification of the core 89 shown in FIG. 45, having a substantially U-shaped configuration having a pair of core laterally disposed at both sides of the movable member and connected at the end portion on the side of the contact opening direction of the movable member, providing an effect of increased electromagnetic contact opening force. Also, 89' shown in FIG. 47 is a modification in which the magnetic flux shield plate 88 and the core 89 are made one piece, the end portion of the side f the terminal portion 15 being arranged to be close to the electrical path 86*f* so that the magnetic flux due to the current of the electrical path 86*f* is absorbed by the end portion.

Embodiment 21

Figure 48:
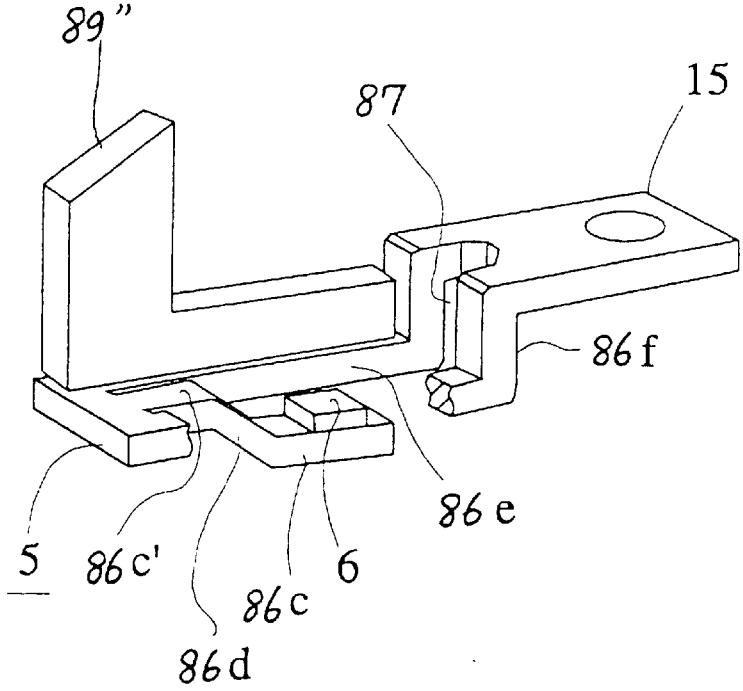
FIG. 48 is a perspective view showing the stationary member configuration of the current limiting device according to the twenty-first embodiment of the present invention.

The twenty-first embodiment is illustrated in FIG. 48. FIG. 48 is a perspective view showing the stationary member 5 and one of the pair of the core 89' of this embodiment, one of the electrical paths 86*e* disposed on the lateral sides of the stationary contact 6 is partially cut away. Other component parts are basically similar to those shown in FIG. 44 although not illustrated.

As compared to that shown in FIG. 45, the stationary member configuration of FIG. 48 is different in the arrangement of the electrical path 86*e* in that the electrical path 86*e* is disposed higher than the electrical path 86*c* and the center line of the electrical path 86*e* is higher than the contacting surface of the contact. With such the arrangement, the electrical path 86*c'* is close to the movable arm horizontal portion in the closed positin to strengthen the electromagnetic contact opening force, and the arc is urged against the wall surface on the side of the terminal portin 15 of the cylindrical insulating material to increase the cooling effect in a manner similar to that of the twentieth embodiment. However, since the electricla path 86*e* is higher than the contact contacting surface, the arc spot on the stationary contact side is easily moved toward the above wall surface by the electromagnetic drive force due to the current in the electrical path 86*e*. Also, the positioning of the electrical path 86*e* high causes the electrical path 86*f* which serves to prevent the contact opening movement of the movable member and to push back the arc toward the movable rotary shaft to become enevitably short, so that movable member separating speed is improved and the the function of urging the arc on the above wall is improved.

Embodiment 22

Figure 49:
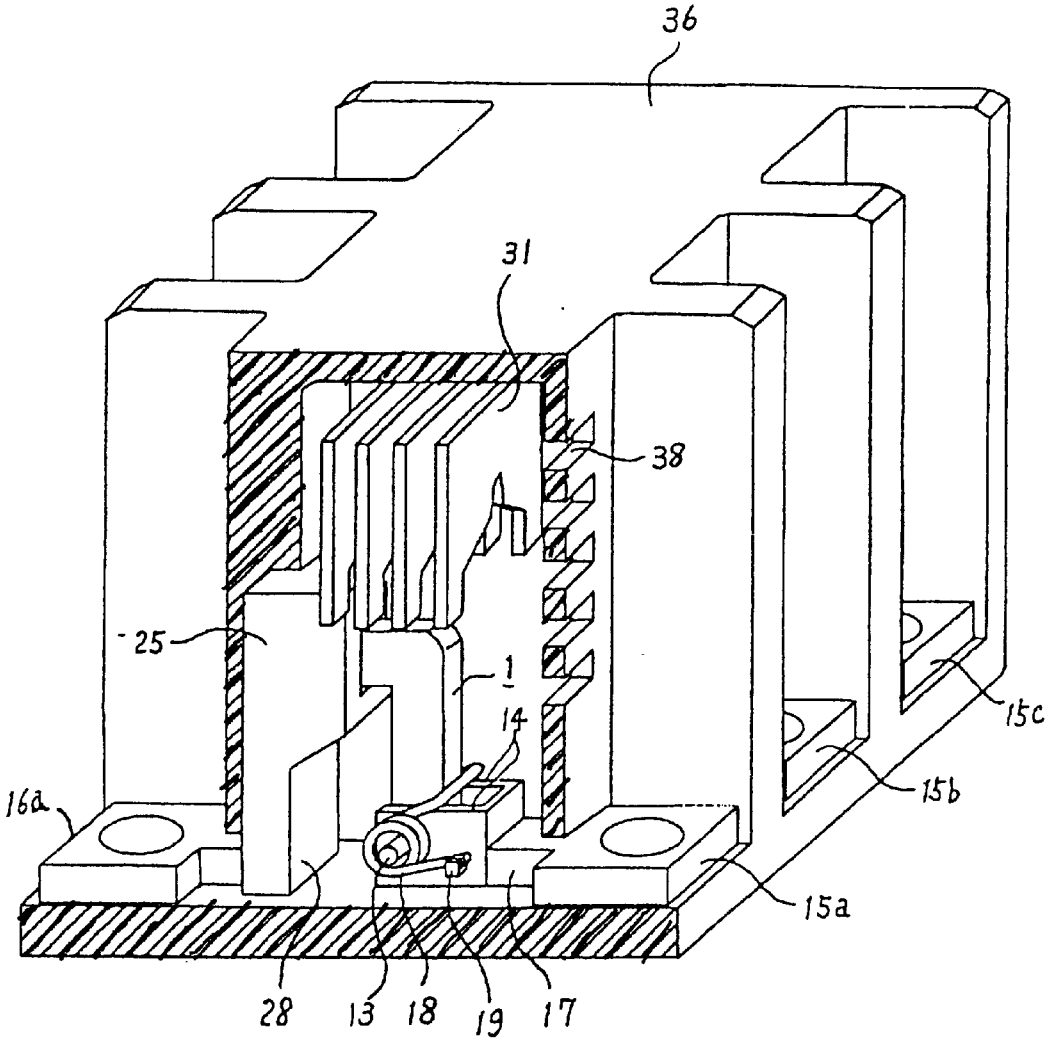
FIG. 49 is a fragmental sectional perspective view showing the thee pole current limiting device according to the twenty-second embodiment of the present invention.
Figure 50:
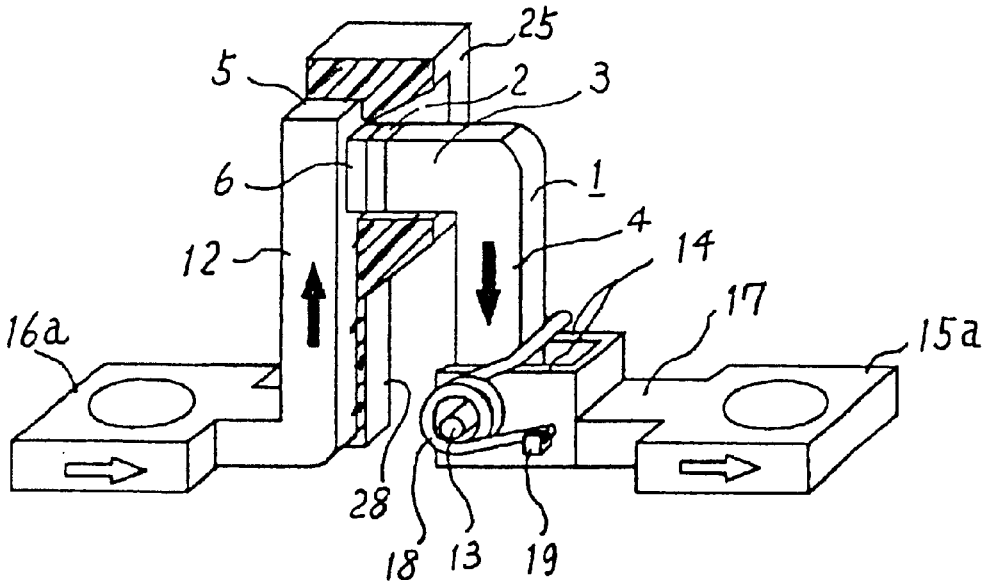
FIG. 50 is a fragmental sectional perspective view showing the main portion of a single pole of the three pole current limiting device shown in FIG. 49.

FIG. 49 is a perspective view showing a three pole current limiting device according to the twenty-second embodiment of the present invention, with a portion of the housing 36 removed in order to illustrate the internal structure. The three pole current limiting device may be used in series connection with the circuit interrupter to constitute a three pole current limiting breaker. FIG. 50 is a perspective view showing the conductor arrangement, the cylindrical insulating materil 25 and the insulating cover 28 for one pole of the three pole current limiting device of FIG. 49 in the closed position, with the cylindrical insulating material 25 and the insulating cover 28 are partially removed for illustration of the components of the conductor portion.

In FIG. 49, 1 is the movable member, 25 is a cylindrical insulating material surrounding a contact pair in the closed position, 28 is an insulating cover, 14 is a sliding contact, 18 is a movable member contact pressure spring which is a urging means for applying the contacting pressure to the contact pair, 19 is a spring holder, 13 is the rotary shaft of the rotor 13, 17 the connecting conductor, 15*a*, 15*b*, 15*c* and 16*a* are terminal portions, 31 is the arc extiguishing plates, 38 is the exhaust port and 36 is an insulating material housing.

In FIG. 50, 1 is the substantially L-shaped movable member comprising the movable contact 2, the movable arm vertical portin 3 having the movable contact 2 attached thereto and the movable arm horizontal portion 4 substantilly perpendicular to the movabel arm vertical protion 3. The movable member 1 forms a contact pair together with a stationary member 5 composed of a stationary contact 6 and a stationary conductor 12, the movable member 1 is urged toward the stationary member 5 by a movable contact contacting spring 18 which is an ruging means for applying a contacting pressure. Also, the movable member 1 is supported rotatably about the movable member rotary shaft 13 and is electrically connected to a terminal portion 15*a* through a sliding contact 14 and the connecting conductor 17. On the other hand, the stationary member 5 is covered with the cylindrical insulating material 25 and the insulating cover 28 except for the stationary contact 6 and the connecting portion to the terminal portion 16*a*. Arrows in the figure illustrate the electrical path during the current carrying period, and the arrangement being such that the current in the movable arm horizontal portion 4 and the current in the stationary conductor 12 are substantially in parallel and in opposite to each other. The contact pair is arranged such that they intersects in the closed position substantially perpendicularly with a line connecting the terminal portion 15*a* and the 16*a*.

Figure 51:
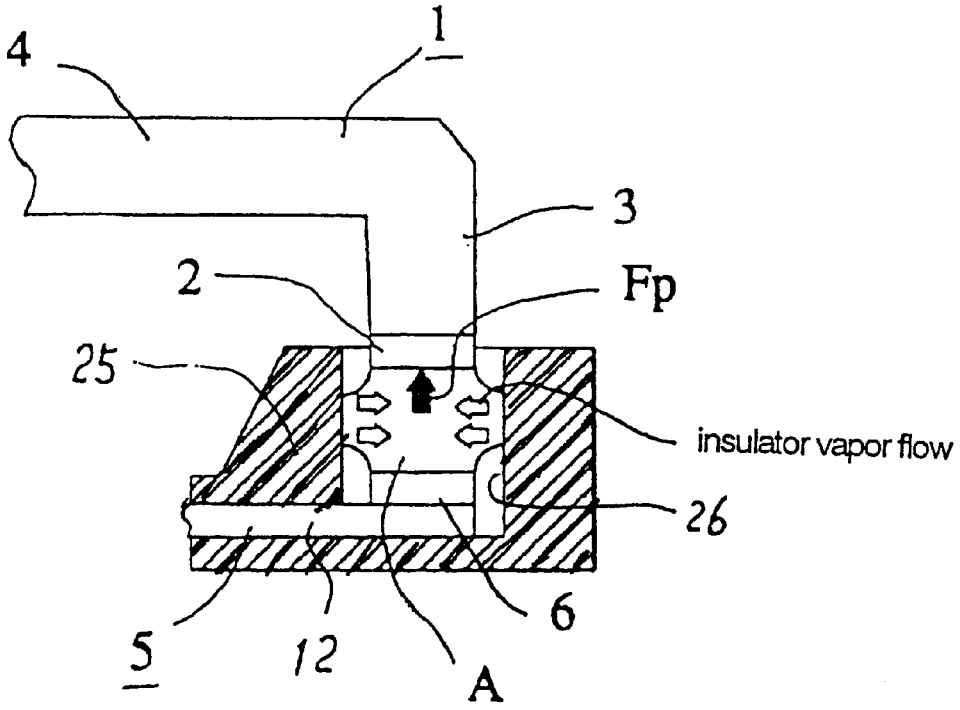
FIG. 51 is a fragmental sectional view for explaining the operation of the twenty-second embodiment.

In the current limiting device shown in FIGS. 49 and 50, when the current flowing therethrough is abruptly increased due to the generation of a short-circuiting fault or the like, the electromagnetic repulsive force F1 due to the current concentration at the contact contacting surface and the electromagnetic repulsive force F2 due to the current in the stationary conductor 12 substantially parallel and opposite to that in the movable arm horizontal portion 4 cause the contacts to separate against the contacting pressure of the movable member contacting pressure 18 to generate an arc A between the separated contacts. This state is illustrated in FIG. 51. Upon the generation of the arc, the electromagnetic repulsive force F1 due to the current concentration diminishes, but the electromagnetic repulsive force F2 due to the current in the stationary conductor 12 and the current in the movable arm horizontal portion 4 continues to rotate the movable member 1 into the contact separating direction.

Also, as shown in FIG. 51, as the arc generates, a large amount of vapor is generated from the inner surface of the cylindrical insulating material 25 due to the arc heat, generating a high pressure atmosphere within the cylindrical space 26 surrounded by the cylindrical insulating material 26. This generation of the high pressure in the cylindrical space 26 applies the movable member 1 a contact separating force Fp due to the pressure difference. This contact separating force Fp due to the pressure difference and the above electromagnetic force F2 cause the movable member 1 to rotate at a high speed, thus rapidly separating the contacts. This high speed contact separation causes the arc length within the high pressure atmosphere to rapidly elongate, rapidly raising the arc voltage, and the fault current reaches to its peak value.

It is to be noted that in this embodiment the cylindrical insulating material 25 is disposed to surround the stationary contact 6 in order to make the arc atmosphere pressure high immediately after the movable member separation. The arrangement in which the heat of the arc generated between the separated contacts is used to generate a large volume of vapor from the insulating material disposed around the stationary contact is disclosed in FIGS. 16 and 17 of Japanese Patent Laid-Open No. 7-22061, for example. However, in this prior example, the insulating material disposed around the stationary contact has a configuration sandwiching the movable member in the lateral direction allowing the vapor generated from the insulating material to immediately flows out to the movable member tip side in the closed position and to the movable member rotation center side, impossible to make the arc atmosphere sufficiently high pressure. In order to abruptly raise the arc voltage, it is necessary to confine the arc at the initial stage of the contact opening within a cylindrical space defined by the stationary contact, the movable contact and the cylindrical insulating material, and it is indispensable for a significant improvement in the arc voltage increasing rate that the insulating material surrounding the stationary contact be in a cylindrical configuration.

Figure 52:
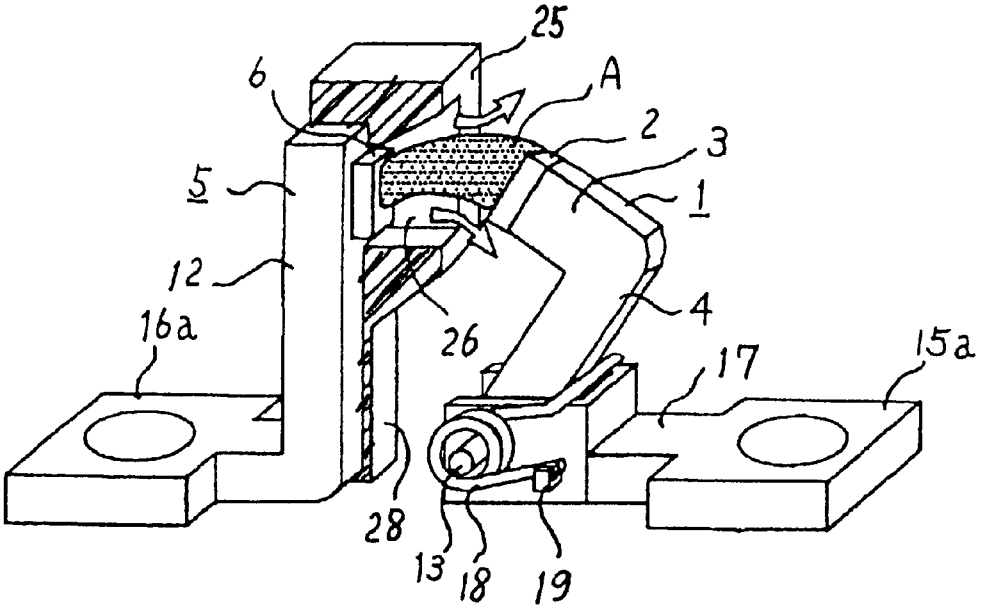
FIG. 52 is a fragmental sectional perspective view for explaining the operation of the twenty-second embodiment.

FIG. 52 illustrates the state in which the movable member 1 further rotates from the positin shown in FIG. 51 and reached to its maximum contact separation position. At this time, the movable contact 2 is positioned outside of the cylindrical space 26 and a sufficiently large arc voltage is generated. Also, as shown by arrows in FIG. 52, the flow of vapor of the insulating material (shown by white arrows) along the axial direction of the arc colum from the cylindrical space 26 absorbs the heat of the arc to cool it, making the arc resistance higher and the fault current quickly moves to the zero point.

Also, as shown in FIG. 49, by providing the exhaust port 38 in the housing wall on the side of the movable member separating direction (opening portion side of the cylindrical insulating material 25), the flow speed of the insulating material vapor shown by the white arrows in FIG. 52 can be made large, thereby allowing the electrode metal vapor around the movable contact 2 to be easily blown off. This allows an insulation recovery sufficient for interrupting the current ocurred between the electrodes, making it possible to obtain a reliable current limiting device that can reliably interrupt current even when a circuit breaker of a low interrupting capacity is use together in series connection.

Also, by moving the movable contact 2 outside of the cylindrical space 26 at the latter half of the interrupting operation after the current peak as above discussed, the vapor generation from the cylindrical insulating material 25 that does not effectively contribute to the increase of the arc voltage can be limited to prevent the unnecesary increase of the internal pressure.

With this embodiment, a high current limiting performance can be obtained by one pair of contacts, so that a current limiting device superior in the low impedance current limiting performance can be obtained, facilitating the application to a circuit in which a large current carrying capacity is required.

Also in this embodiment, only one pair of contacts is used to obtain aa high current limiting performance, so that the thickness of the housing side wall can be large, making it possible to make the housing with an inexpensive material. On the contrary, however, since the increase of the housing internal pressure is supressed in this embodiment, it is possible to make the housing wall thickness small and use a conductor arrangement in which two pairs of contacts are serially connected and, in this case, two series arcs are generated in the cylindrical space during the current limiting operation, thus further improving the current limiting performance.

Embodiment 23

Figure 53:
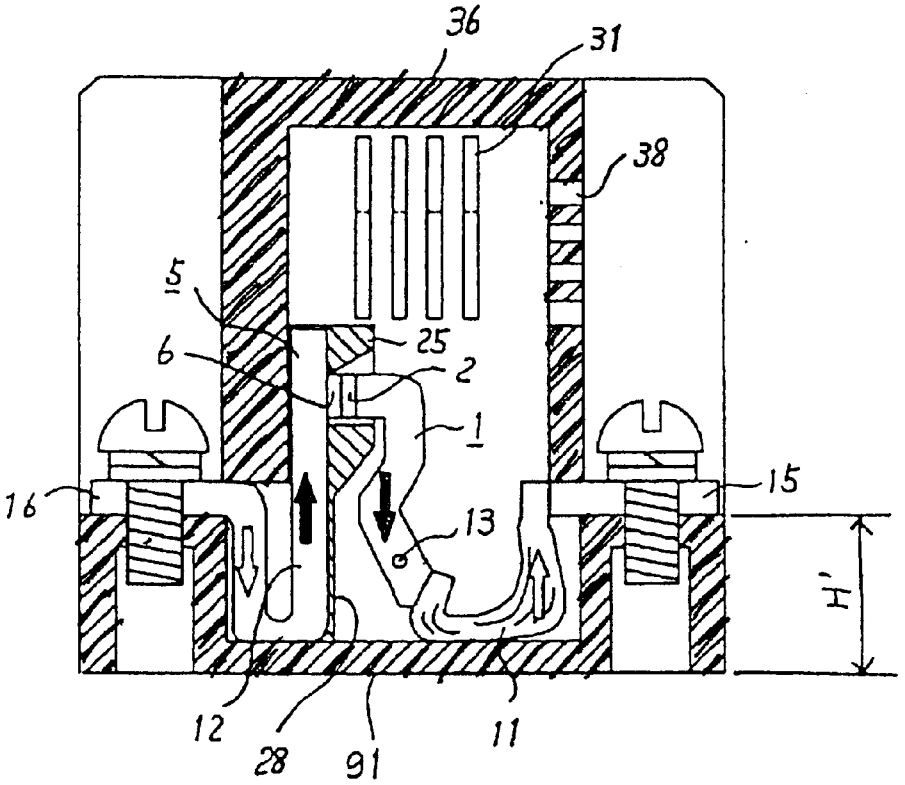
FIG. 53 is a sectional view showing the current limiting device according to the twenty-third embodiment of the present invention.

The twenty-third embodiment of the present invention will be described in conjunction with FIG. 53. FIG. 53 is a sectional view showing the internal structure of the current limiting device of this embodiment with the illustration of the spring or the like is omitted. This embodiment is different from that shown in FIG. 49 only in that the teminal portions 15 and 16 are disposed at positions higher than a mounting surface (bottom) 91 of the housing 36 by H'. Therefore, in this embodiment, in order to ensure the parallel arranged electrical path portion with respect to the arm of the movable member 1 and the stationary member 5 and to connect to the terminal portions 15 and 16, the lower portion of the stationary conductor 12 is bent into a U-shape and connected to the terminal portion 16 and, as for the movable member 1, the flexible conductor 11 is bent into a U-shape and connected to the terminal portion 15.

When a current limiting device is to be directly connected to a circuit beaker, the terminal portion of the current limiting device must be disposed at a position higher than the mounting surface by H'. Also, it is clear that, when an ease of containing within a distribution panel is taken into consideration, the height H of the current limiting device is desirable to be equal to or lower than the eight of the circuit breaker. Under such the limitation of outer configuration, in order to provide a sufficient length of substantially parallel and opposite direction electrical path (hereinafter referred to as a repulsive electrical path), it is necessary that as shown in FIG. 53 the stationary conductor 12 is bent into a substantially U-shape, the electrical path on the stationary member side is folded back at the side of the mounting surface 91 and that the movable member rotary shaft 13 is disposed at a low position on the side of the mounting surface 91 with respect to the height of the terminal portins 15 and 16.

With the above structure, a length of the repulsive electrical path necessary for obtaining a current limiting performance can be provided even when there is the above limitation in the outer configuration. However, in FIG. 53, the magnetic field generated by the current component shown by white arrows function to prevent the high speed separation of the movable member, so that when the repulsive electrical path has the same length as that in the twenty-second embodiment, the contact separating speed is decreased as compared with the twenty-second embodiment. Therefore, the contact separating speed in the following twenty-fourth embodiment is further increased as compared to that of the twenty-second embodiment under the limitation of the height H and the terminal portion height H'.

Embodiment 24

Figure 54:
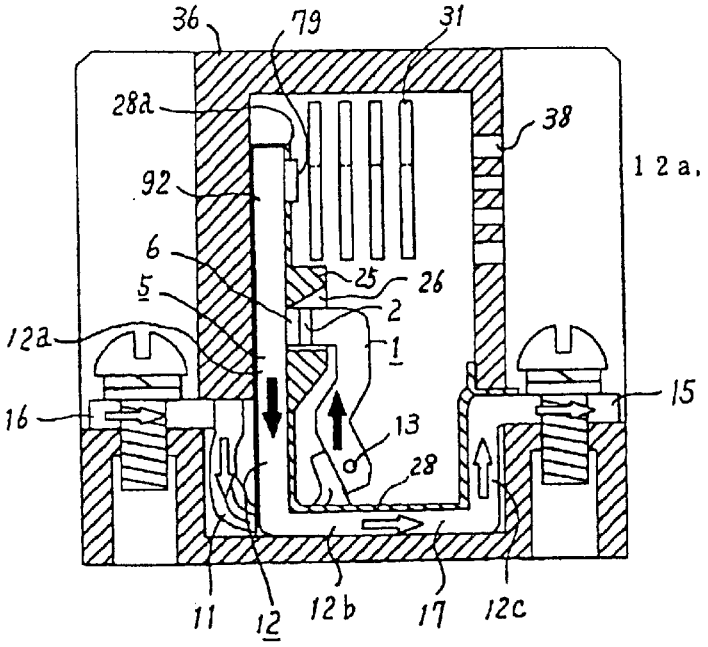
FIG. 54 is a sectional view showing the current limiting device according to the twenty-fourth embodiment of the present invention.

The twenty-fourth embodiment of the present invention is illustrated in FIG. 54. FIG. 54 is a sectional view showing the internal structure of the current limiting device of this embodiment, the spring or the like being omitted from illustration. In this embodiment, differing from the twenty-third embodiment, the movable member 1 is electrically connected by the flexible conductor 11 to the far side or the terminal portion 16 disposed behind the stationary member 5 and the stationary member 5 is electrically connected by the elongated stationary conductor 12 to the far side or the terminal portion 15 disposed behind the movable member 1. The stationary conductor 12 electrically connecting the stationary contact 6 and the terminal portion 15 is composed of the electrical paths 12*a*, 12*b* and 12*c*. 12*a* is the electrical path for defining the repulsive electrical path, 12*b* is the electrical path connected at one end to the electrical path 12*a* and disposed below the movable member 1 perpendicular to the movable arm of the movable member 1 in the closed position and 12*c* is the electrical path connecting the other end of the electrical path 12*b* to the terminal portion 15.

The repulsive electrical path portion of the contact pair in the closed state is disposed to be substantially perpendicular to the line connecting the terminal portions 15 and 16 and a plurality of horse shoe-shaped arc extinguishing plates 31 are provided at a position opposing to the tip portion of the movable member. Also, the stationary conductor on the end portion side to which the stationary contact 6 of the contact member 5 is attached is upwardly extended, and the extended conductor 92 has provided therewith an arc runner 79 exposed toward the arc extinguishing plates 31 from the insulating cover 28*a*.

In the electrical path arrangement as described above, all the magnetic field generated by the current flowing through the stationary conductor 12 functions in the direction of separation of the movable member 1, so that the movable member 1 separates at a higher speed upon the short circuit interruption. Therefore, by the combined use of the above electrical path arrangement together with the cylindrical insulating material 25 which is the means for generating a high pressure atmosphere, the raising of the arc voltage can be significantly improved, further improving the current limiting performance.

On the other hand, since the the arc is generated within the cylindrical insulating material 25 upon the short circuiting interruption in this embodiment, the arc spot on the side of the stationary contact 6 is limited to be in the inner diameter of the cylindrical insulating material 25, whereby the current density is increased. This causes the wear of the stationary contact 6 to become large and the number of current limiting operation that can be performed is limited. In this embodiment, as discussed before, the arc runner 79 to which the arc A transfers is disposed above the stationary contact 6, so that the direction of arc jet at the side of the movalbe contact 2 is changed from the stationary contact 6 toward the arc extinguishing plates 31 at the latter half of the curren limiting operation in which the rotation of the movable member 1 causes the movable contact 2 to move outside of the cylindrical space 26. Also, the arc is subjected to an electromagnetic force toward the arc extinguishing plates 31 due to the current flowing through the stationary conductors 12*a*, 12*b* and 12*c* as well as the movable member 1. These arc driving forces moves the arc spot on the side of the stationary member 5 from the stationary contact 6 to the arc runner 79. Therefore, the wear of the stationary contact 6 and the cylindrical insulating material 25 is suppressed, resulting in a current limiting device that can be repeatedly used and superior in durability.

Figure 55:
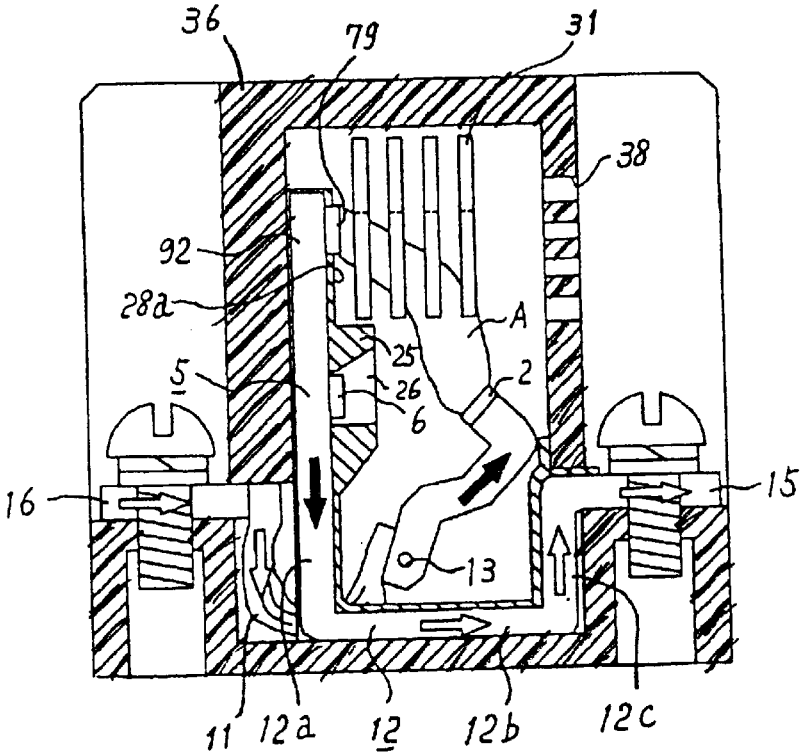
FIG. 55 is a sectional view for explaining the operation of the twenty-fourth embodiment of the present invention.

Further, as shown in FIG. 55, since the arc is brought into contact with the arc extinguishing plates 31 and the arc heat is absorbed by the evaporation latent heat of the arc extinguishing plates 31 and the arc temperature is cooled during the transfer of the arc to the arc runner 79, the internal pressure increase within the housing can be decreased at the latter half of the interrupting operation. The mechanical strength against an impact stress of a molding material used in wiring breaker is generally higher than the mechanical strength against a static stress. Therefore, the decrease of the housing internal pressure at the latter half of the interrupting operation provides the effect of preventing the cracks of the housing made of a molding material.

As has been described, the wear of the stationary contact 6 can be decreased by transferring the arc spot on the side of the stationary contact 6 to the arc runner 79, but the arc aroud the statinary contact 6 moves to the outside of the cylindrical space 26 at the moment when the arc is transferred to the arc runner 79, decreasing the arc voltage elevated by the high pressure atmosphere of the cylindrical space 26. This decrease of the arc voltage ocurrs before the current peak, the current peak is significantly increased to significantly degrade the current limiting performance. Also, even when the decrease of the arc voltage ocurrs after the current peak, it sometimes happen that the rate of decrease of the current at the latter half of the current limiting operation is decreased, increasing the interrupting time and increasing the passing energy. Such the problem is solved by the twenty-fifth embodiment descirbed below.

Embodiment 25

Figure 56:
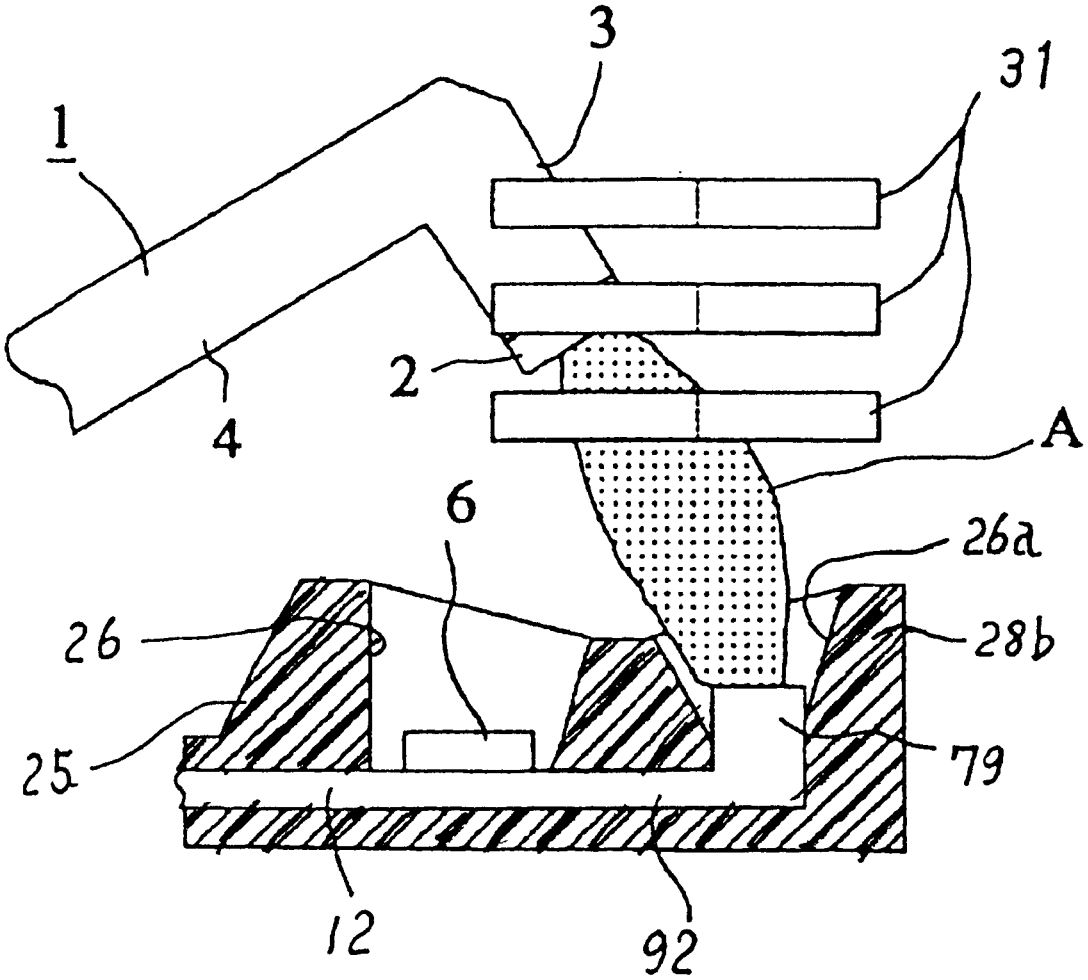
FIG. 56 is a fragmental sectional view showing the contact member portion of the current limiting device according to the twenty-fifth embodiment of the present invention of the present invention.

The twenty-fifth embodiment of the present invention is illustrated in FIG. 56. In the twenty-fifth embodiment illustrated in FIG. 56, the insulating cover 28*b* around the arc runner 79 is made cylindrical to define an arc runner cylindrical space 26*a*. With this arrangement, even after the movable member 1 rotates and the movable contact 2 comes out of the cylindrical space 26, the arc spot on the side of the stationary contact does not immediately transfer to the arc runner 79, allowing to effectively utilize the arc voltage increase by the high pressure atmosphere in the cylindrical space 26, so that the current peak can be supressed to be small. Also, since the arc runner 79 is within the arc runner cylindrical space 26 surrounded by the cylindrical insulating cover 28*b* even after the arc is transferred to the arc runner 79, no arc voltage decrease ocurrs and the interruption time can be shortened, resulting in the decrease in the passing energy.

Embodiment 26

According to this invention, the movable member 1 has a tip portion of substantially L-shape in order to generate an arc at the initial stage of the contact opening within the cylindrical insulating material 25 as shown in FIG. 50, for example. Therefore, it is difficult for the arc spot on the side of the movable member 1 to move from the movable contact 2 to the end surface of the movable member 1 on the side of the arc extinguishing plates, so that the direction of arc jet at the movable member side is not directed to the arc extinguishing paltes even in the latter half of the interruption operation, whereby it is difficult for the arc to be brought into contact with the arc extinguishing plates 31. Therefore, the arc cooling effect of the arc extinguishing opiates 31 cannot be effectively utilized and it is possible that the housing internal pressure be unnecessarily increased without promoting the arc voltage increase at the latter half of the current limiting operation.

Figure 57:
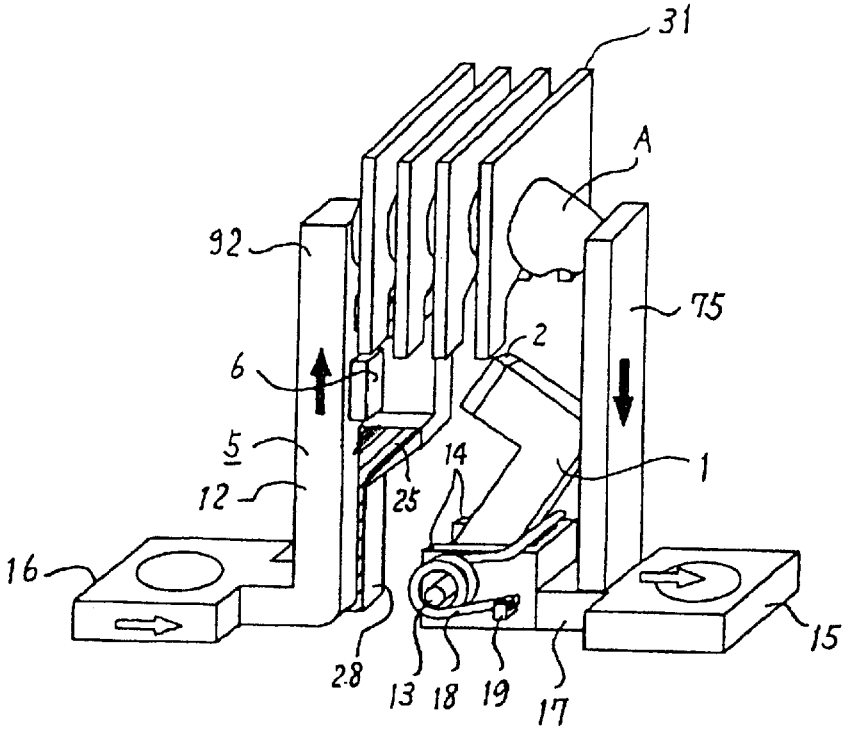
FIG. 57 is a fragmental sectional perspective view showing the main portion of the current limiting device according to the twenty-sixth embodiment of the present invention of the present invention.

Therefore, in the twenty-sixth embodiment of the present invention, as shown in FIG. 57, a transfer electrode 75, which is electrically connected at one end to the connecting conductor 17, extended at the other end toward the arc extinguishing plates 31 and which is at substantially the same electrical potential as the movable member 1, is disposed behind the movable member 1, so that the arc spot on the side of the stationary contact 2 is transferred to the transfer electrode 75 to move toward the arc extinguishing plates 31. Also, in a manner similar to the above embodiment, the arrangement of the side of the stationary member 5 is such that the arc spot is transferred to the side of the arc extinguishing plates 31 by the arc runner, whereby the arc is ensured to be splitted and cooled by the arc extinguishing plates 31. Therefore, the unnecessary increase of the housing internal pressure at the latter half of the current limiting operation can be prevented.

Embodiment 27

Figure 58:
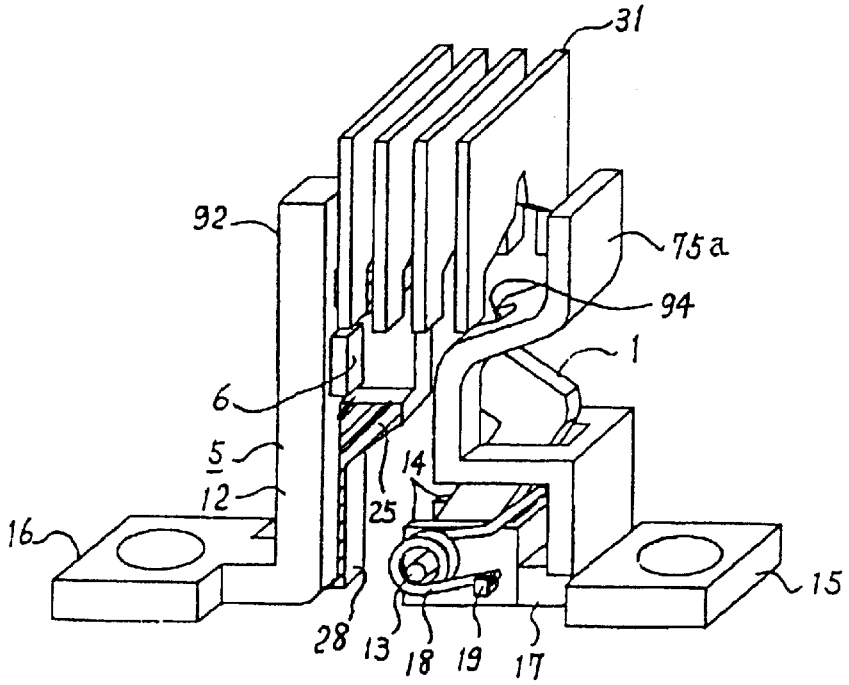
FIG. 58 is a fragmental sectional perspective view showing the main port of the current limiting device according to the twenty-seventh embodiment of the present invention.

As has been described, in the present invention, the arc spot on the side of the movable member 1 is difficult to move to the end surface of the movable member 1 on the side of the arc extinguishing plates because the tip portion of the movable member has a substantially L-shaped configuration. Therefore, the current in the vicinity of the arc spot on the side of the movable member 1 is concentrated at the movable contact 2 to apt to make the wear of the movable contact 2 large. Therefore, in this embodiment, as shown in FIG. 58, the arrangement is such that a transfer electrode 75 is provided with a slit 94 into which the tip portion of the movable member 1 in the open position is received, whereby the arc spot on the movable contact side is ensured to be transferred to the transfer electrode 75*a* at a relatively early period during the current limiting operation.

The arc transferred to the transfer electrode 75*a* is driven to the tip portion of the transfer electrodde 75*a* by a drawing function of the arc extinguishing plates 31 and an electromagnetic drive force due to the currents flowing through the stationary member 5 and the transfer electrode 75*a*, whereby the arc length is quickly increased and the arc voltage is increased. Such the transfer of the arc from the movable member 1 to the transfer electrode 75*a* at a relatively early time point enables the wear of the movble contact 2 to be significantly reduced as compared to that of the twenty-fifth embodiment, improving the durability of the current limiting device.

Embodiment 28

Figure 59:
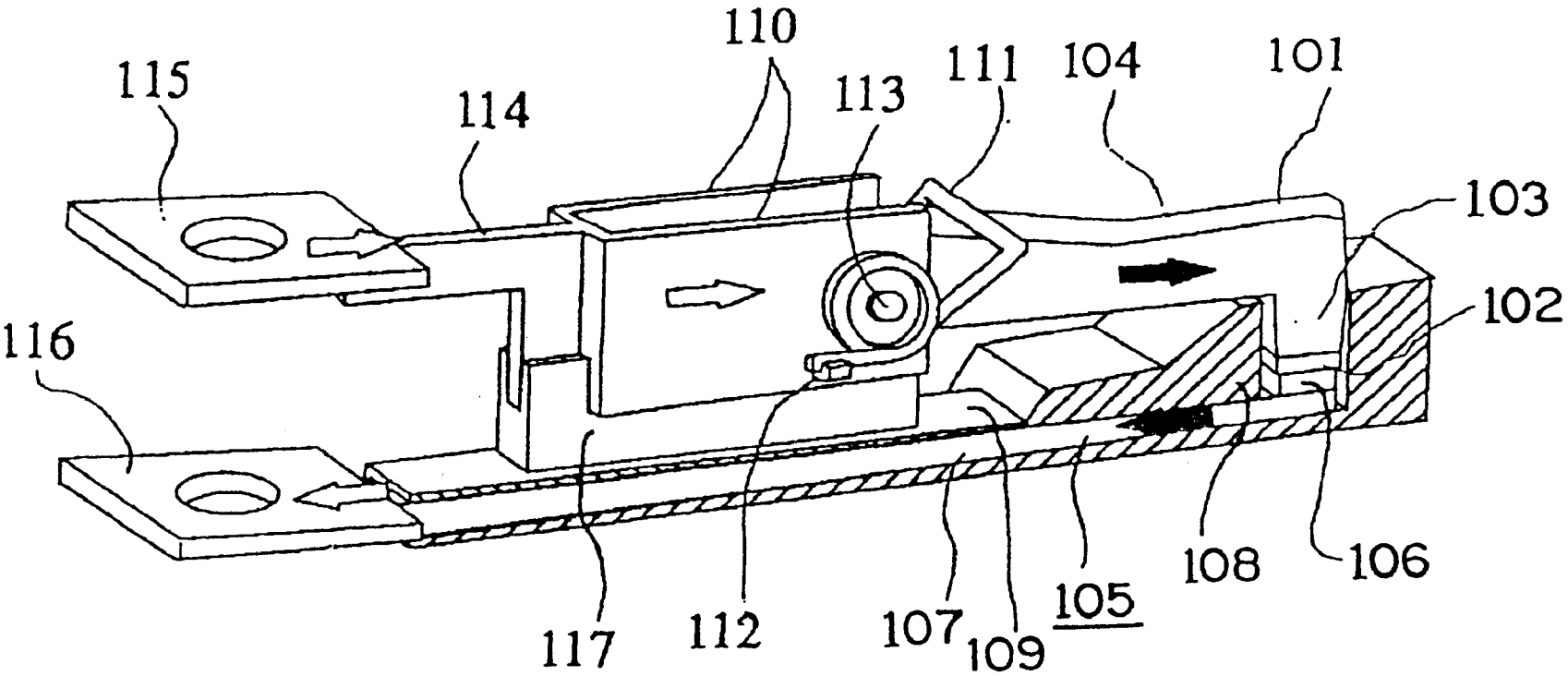
FIG. 59 is a fragmental sectional perspective view showing the main portion of the circuit interrupter according to the twenty-eighth embodiment of the present invention.
Figure 60:
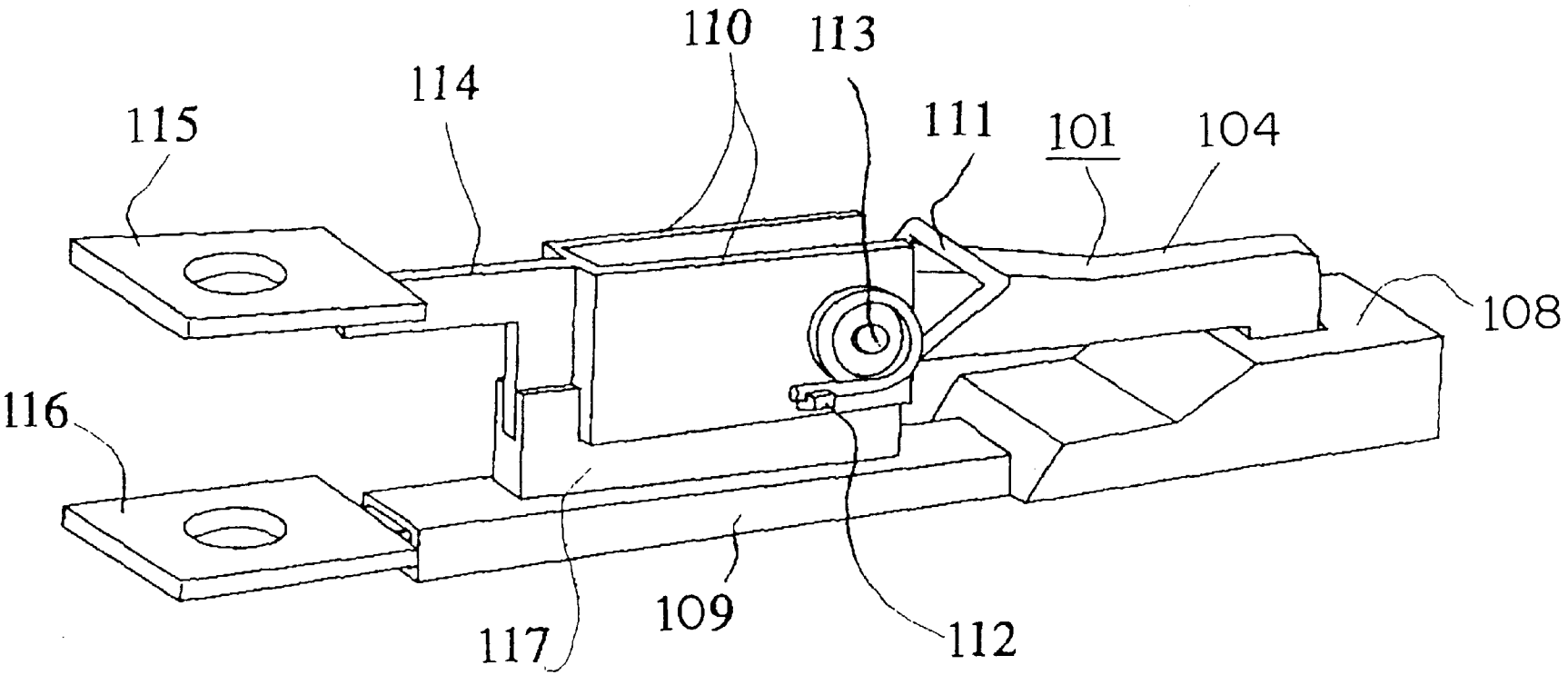
FIG. 60 is a perspective view showing the main portion of the circuit interrupter according to the twenty-eighth embodiment of the present invention.

The twenty-eighth embodiment of the present invention will now be described in conjunction with the figure. FIG. 59 is a perspective view showing the main portion of a current limiting device according to the fifteenth embodiment, with one portion of the cylindrical insulating material 108 and the insulating cover 109 is removed for illustrating the internal structure. FIG. 60 is a perspective view showing the appearance of the one shown in FIG. 59. In FIG. 59, 101 is a substantially L-shaped movable member having a movable contact 102, a movable arm vertical portion 103 to which the movable contact 102 is secured and a movable arm horizontal portion 104 substantially perpendicular to the movable arm vertical portion 103. The movable member 101 forms one contact pair together with a stationary member 105 composed of a stationary contact 106 and a stationary conductor 107, the movable member 101 is urged toward the stationary member 105 by a spring 111. Also, the movable member 101 is supported rotatably about the movable member rotary shaft 113 and is electrically connected to a terminal 115 through a sliding contact 110 and the connecting conductor 114. On the other hand, the stationary member 105 is covered with the cylindrical insulating material 108 and the insulating cover 109 except for the stationary contact 106 and the connecting portion to the terminal portion 116. Arrows in the figure illustrate the electrical path during the current carrying period, and the arrangement being such that the current in the movable arm horizontal portion 104 and the current in the stationary conductor 107 are substantially in parallel and in opposite to each other.

Figure 61:
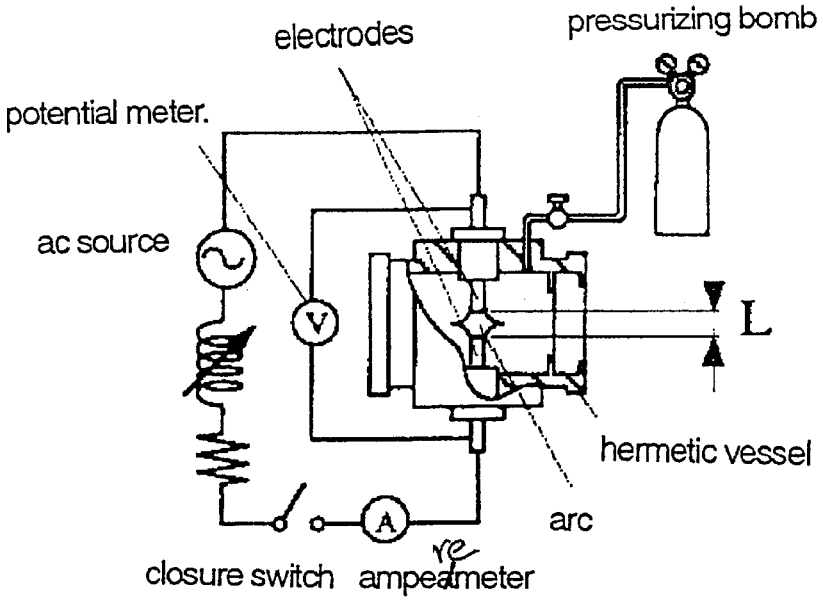
FIG. 61 is a schematic view showing an experiment apparatus for measuring the basic characters of the arc voltage.
Figure 62:
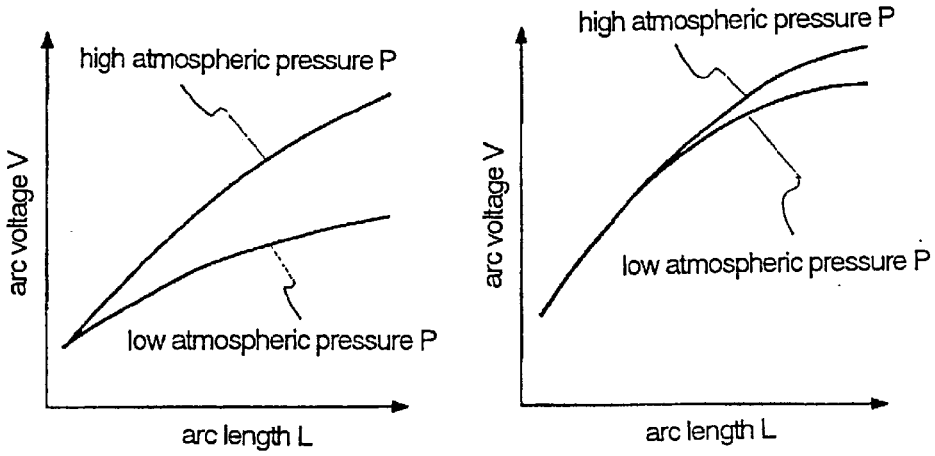
FIG. 62(*a*) and 62(*b*) are graphs showing the effects of the atmosphere pressure on the arc voltage.

The description will now be made as to the arc voltage increase condition under a high pressure of a large current arc at a relatively short gap generated upon the current limiting operation within the circuit interrupter having the arc type current limiting function. The measurement results of the arc voltage changes when an atmospheric pressure P of the short gap large current arc of several centimeters or less is changed with the experimentation apparatus shown in FIG. 61 is used is shown in FIGS. 62(*a*) and 62(*b*). In the experimentation apparatus shown in FIG. 61, the arc is generated between the opposing pair of rod-shaped electrodes, so that the inter-electrode distance equals to the arc length L. As apparent from FIG. 62(*a*), when the arc current value is relatively small, the arc voltage becomes higher as the arc atmospheric pressure P increase at most of the various arc lengths L. On the other hand, as shown in FIG. 62(*b*), when the arc current value is relatively large, the arc voltage is not substantially changed except for when the arc length L is relatively long even when the arc atmosphere pressure P is increased.

Figure 63:
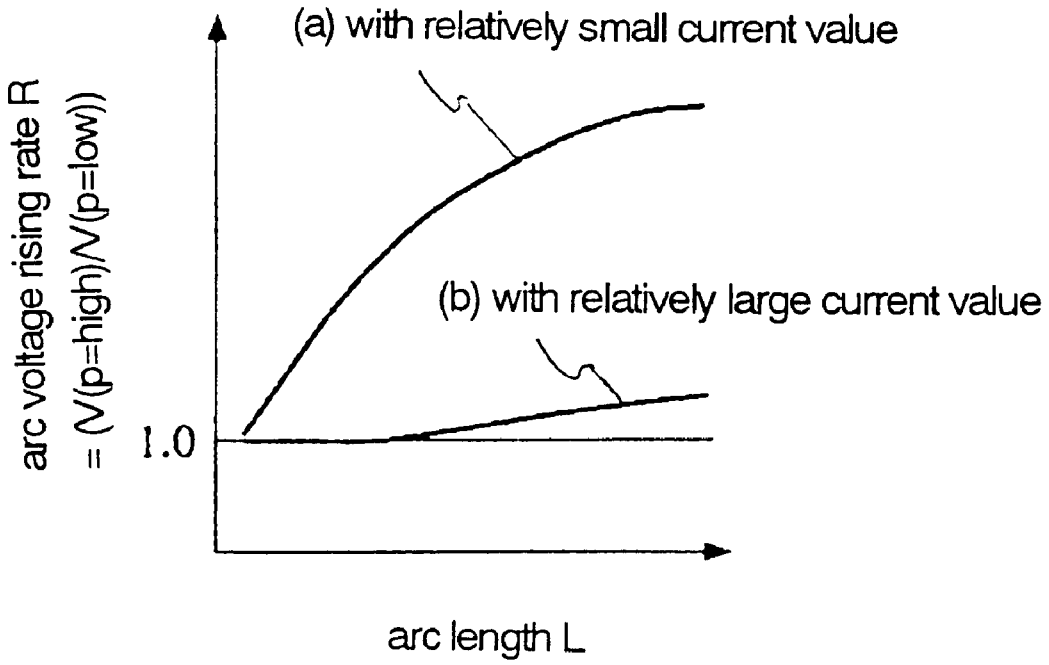
FIG. 63 is a graph showing the effects of the current value to the arc voltage.

The ratio R of the arc voltage V (P=high) when the atmosphere pressure P shown in FIGS. 62(*a*) and 62(*b*) is high and the arc voltage V (P=low) when the atmosphere pressure P is low is obtained and plotted into a graph as shown in FIG. 63. As apparent from FIG. 63, the arc voltage rising rate R when the arc current value is relatively small becomes higher as the arc length increases. On the other hand, the arc voltage rising rate R when the arc current value is relatively large does not substantially increase until the arc length becomes equal to or higher than a certain value. From the above, it is understood that, in the short gap large current arc, the condition for effectively increase the arc voltage by increasing the arc atmosphere pressure is to simultaneously satisfy (a) that the arc current is relatively small and (b) that the arc length is large.

Upon a fault such as short-circuiting, the circuit current rapidly increases immediately after the occurrence of the fault. Therefore, in order to limit the fault current by increasing the arc voltage at a high atmosphere pressure with the above two conditions satisfied, it is necessary that (1) the high pressure atmosphere is generated at least immediately after the generation of the arc (immediately after the generation of the fault) and that (2) the arc length is elongated when the arc current is still relatively small (immediately after the generation of the fault). After the increase of the fault current, the current limiting performance is not very much improved. Further, the high pressure atmosphere after the increase of the fault current does not contribute very much to the improvements in the current limiting performance and, moreover, causes the damages to the housing or the like.

Figure 64:
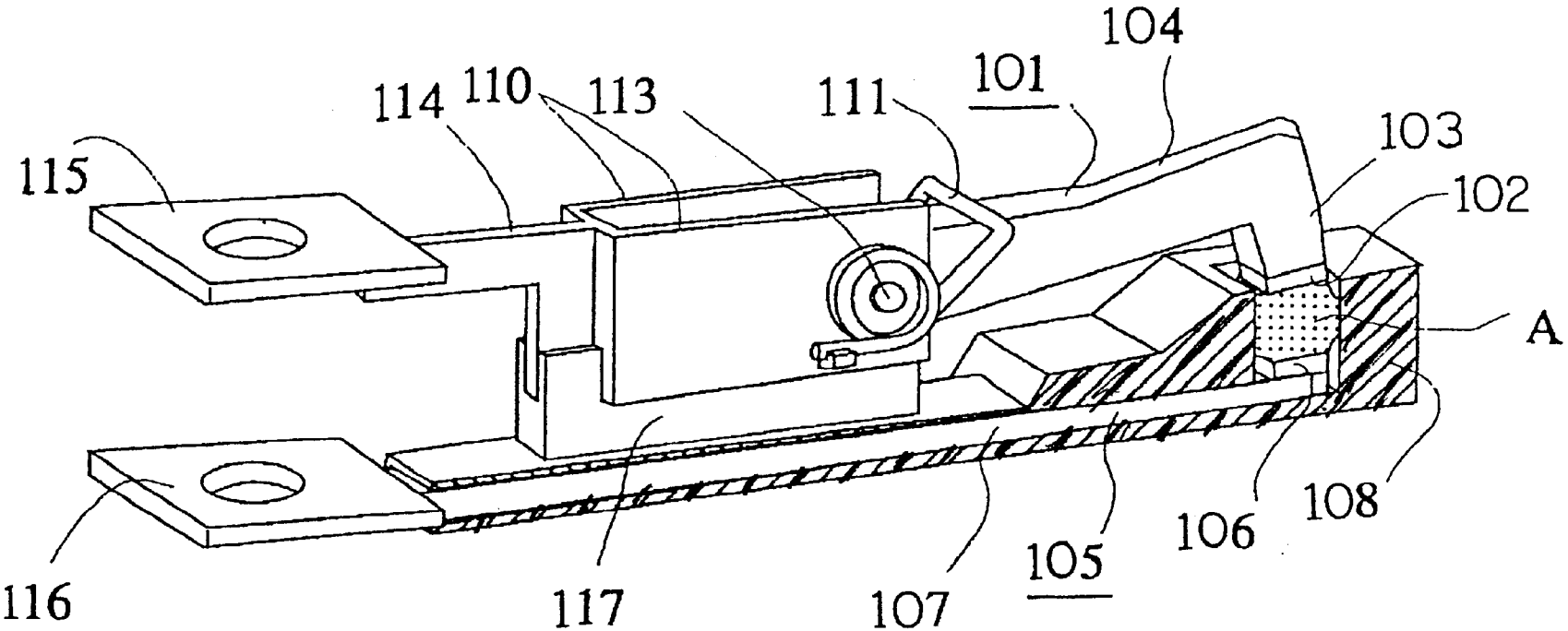
FIG. 64 is a fragmental sectional perspective view for explaining the operation of the twenty-eighth embodiment.

In the circuit breaker shown in FIG. 59, when the flowing current rapidly increases due to the generation of the short circuiting fault or the like, an electromagnetic repulsive force F1 by the current concentration at the contact contacting surface and an electromagnetic repulsive force F2 by a current in the movable arm horizontal portion 104 previously discussed and a substantially parallel and opposite current in the stationary conductor 107 cause the contacts to separate against the contacting pressure provided by spring 111 to generate an arc A across the contacts. This state is illustrated in FIG. 64. Upon the arc generation, the electromagnetic repulsive force F1 due to the current concentration at the contact contacting surface diminishes, but the electromagnetic force F2 by the current in the movable arm horizontal portion 104 and the substantially parallel and opposite current in the stationary conductor 107 continues to cause the rotation of the movable member 101 into the contact separating direction.

Figure 65:
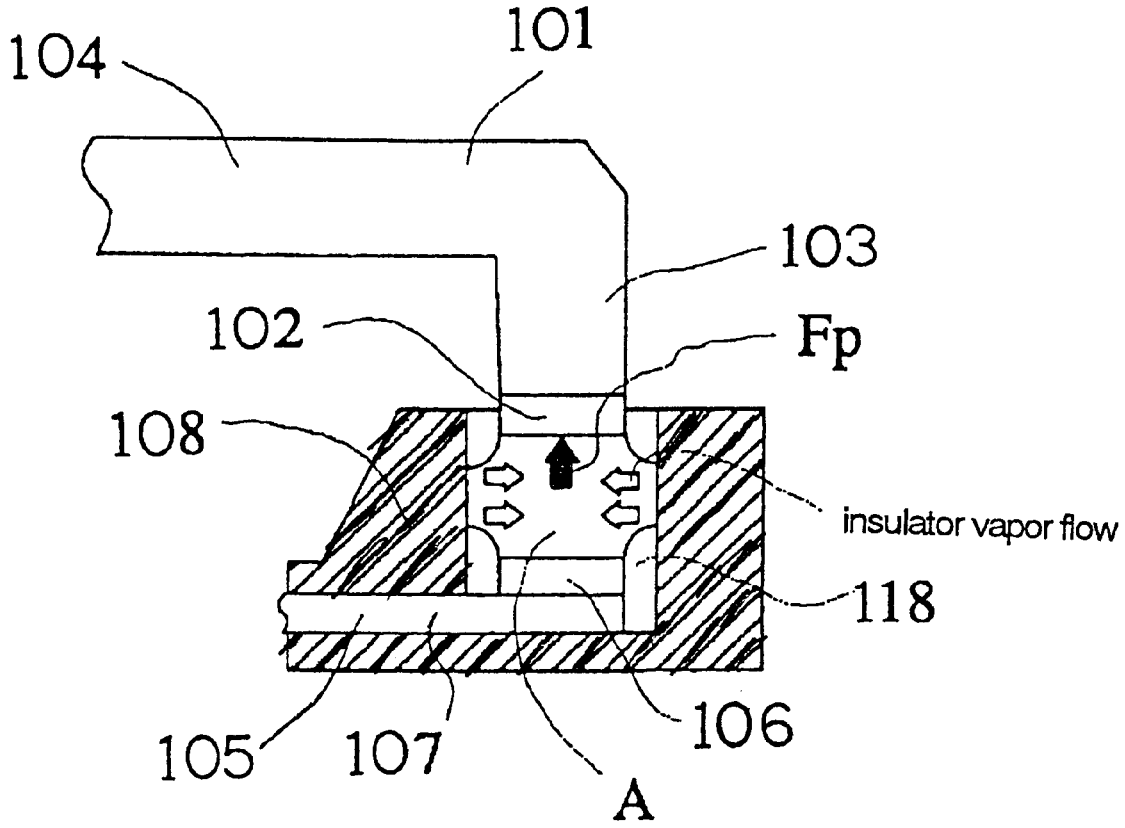
FIG. 65 is a fragmental sectional view for explaining the operation of the twenty-eighth embodiment.

Also, as shown in FIG. 65, upon the generation of an arc, a large amount of vapor generates from the inner surface of the cylindrical insulating material 108 and a high pressure atmosphere is generated within the cylindrical space 118 surrounded by the cylindrical insulating material 108. Due to this high pressure generation within the cylindrical space 18, the movable member 101 is subjected to a contact separating force Fp due to the pressure difference. The contact separating force Fp due to the pressure difference and the previously described electromagnetic force F2 cause the movable member 101 to be rotated at a high speed to rapidly separate the contacts. This rapid contact separation causes the arc length to be quickly elongated within the high pressure atmosphere to sharply raise the arc voltage and the fault current reaches at its peak value.

Figure 66:
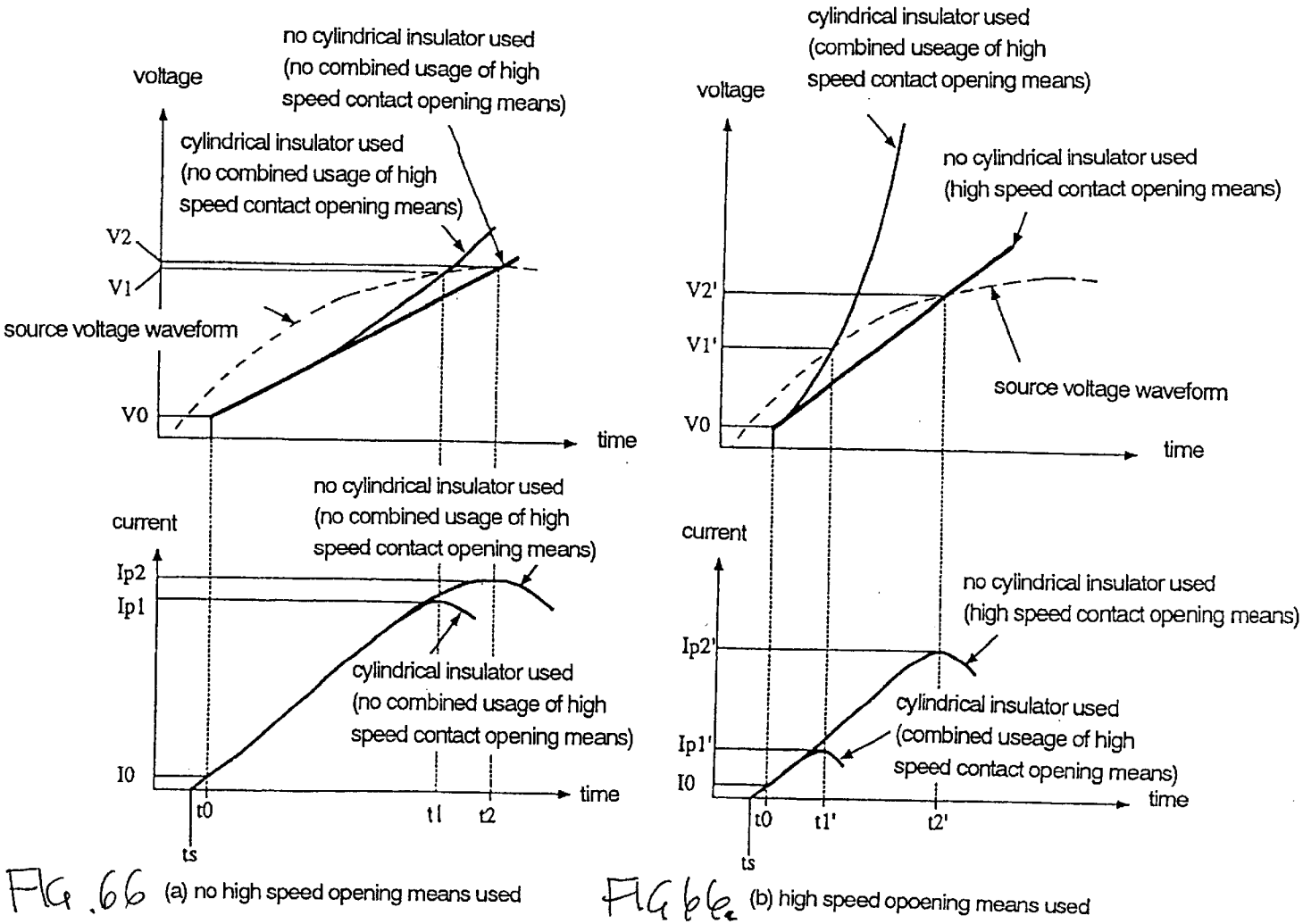
FIG. 66(*a*) and 66(*b*) are graphs showing the effects of the twenty-eighth embodiment.

As described above, according to this embodiment, the high pressure atmosphere and the high speed contact separating means employing the cylindrical insulating material 108 are used together in combination, such the combined use is necessary to obtain a superior current limiting performance. FIGS. 66(*a*) and 66(*b*) illustrates the effect of the cylindrical insulating material 108 when (a) the high speed contact separating means is not used, and (b) the high speed contact separating means is used. In this figure, ts is a time at which the fault is generated, t0 is a time at which the contacts are separated, V0 is a voltage drop between the contacts and a broken line is a source voltage waveform. FIG. 66(*a*) illustrates where no high speed contact separating means is used and a current peak Ip1 and a current peak Ip2 are reached, respectively, at a time t1 (with the cylindrical insulating material) and a time t2 (without the cylindrical insulating material) at which the arc voltage catch up with the source voltage. When no high speed contact separating means is used, the increase of the arc length is slow as compared with the increase of the fault current, so that the above conditions in which the arc length is short and the arc voltage is increased are difficult to be satisfied even when a high pressure atmosphere is generated by the cylindrical insulating material 108.

Therefore, in FIG. 66(*a*), the extent of the improvement of the current peak Ip, i.e., $\Delta Ip = Ip2 - IP1$ is small even when the cylindrical insulating material 108 is used. On the other hand, in FIG. 66(*b*) in which the high speed contact separating means is used, the arc length becomes sufficiently long before the fault current become high, so that the above conditions for increasing the arc voltage in a high pressure atmosphere can be satisfied. It is apparent that the extent of improvement of the current peak Ip, i.e., $\Delta Ip' = Ip2' - IP1'$, where a current peak Ip1' and a current peak Ip2' are reached, respectively, at a time t1' (with the cylindrical insulating material) and a time t2' (without the cylindrical insulating material) at which the arc voltage catch up with the source voltage is dramatically increased as compared with the extent of the improvement ΔIp of the current peak Ip when no high speed contact separating means is used.

It is to be noted that in this embodiment the cylindrical insulating material 108 is disposed to surround the stationary contact 105 in order to make the arc atmosphere pressure high immediately after the movable member separation. The arrangement in which the heat of the arc generated between the separated contacts is used to generate a large volume of vapor from the insulating material disposed around the stationary contact is disclosed in FIGS. 16 and 17 of Japanese Patent Laid-Open No. 7-22061, for example. However, in this prior example, the insulating material disposed around the stationary contact has a configuration sandwiching the movable member in the lateral direction allowing the vapor generated from the insulating material to immediately flows out to the movable member tip side in the closed position and to the movable member rotation center side, impossible to make the arc atmosphere sufficiently high pressure. In order to abruptly raise the arc voltage, it is necessary to confine the arc at the initial stage of the contact opening within a cylindrical space defined by the stationary contact, the movable contact and the cylindrical insulating material, and it is indispensable for a significant improvement in the arc voltage increasing rate that the insulating material surrounding the stationary contact be in a cylindrical configuration.

Figure 67:
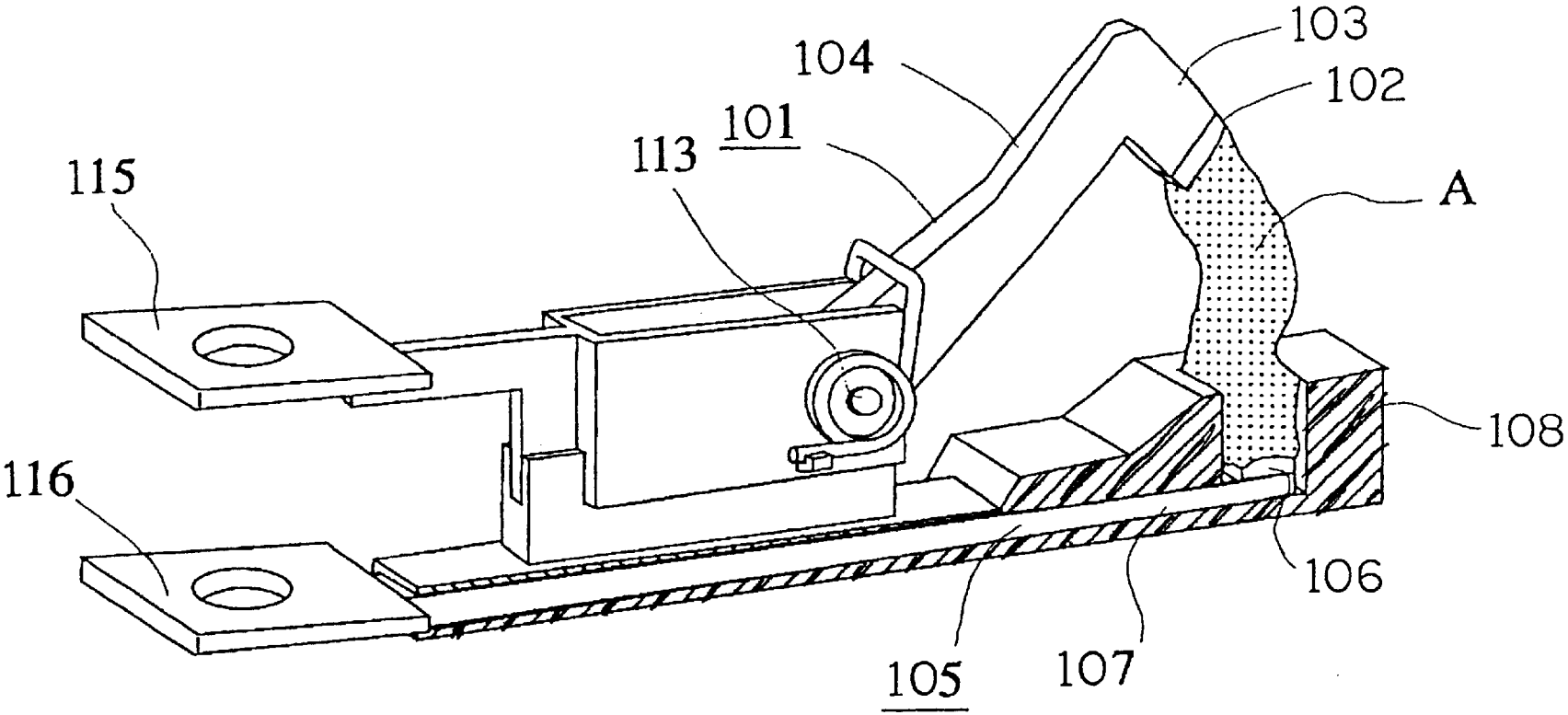
FIG. 67 is a fragmental sectional perspective view for explaining the operation of the twenty-eighth embodiment.

FIG. 67 illustrates the state in which the movable member 101 further rotates from the positin shown in FIG. 64 and reached to its maximum contact separation position. In this state, since the current peak is gone and a sufficiently large arc voltage is generated, the fault current reaches the zero point. At this time, since the movable contact 102 is positioned outside of the narrow space surrounded by the cylindrical insulating material 108, the vapor of the electrode metal in the vicinity of the movable contact 102 can easily be diffused or cooled by an ordinary means (such as a vapor flow form the insulating material, a grid or the like), facilitating the interruption of the current at the sufficient insulation recovery between the electrodes. Also, even when the movable member 101 is laterally displaced, it does not touch the inner surface of the cylindrical insulating material 108, thus no re-firing due to the surface insulation breakdown ocurrs. By additionay providing means for restricting the movable member 101*at* about the maximum contact separation position and preventing the re-closure (such as a latch mechanism, a linkage or the like), a circuit breaker superior in current limiting performance can be obtained.

Also, in this embodiment, differing from the conventional design shown in FIGS. 147 and 148, there is no need for providing an excitation coil for assisting the contact separation of the movable member, an improved current limiting performance at a low impedance can be obtained and it is possible to apply to a circuit in which a high currently carrying capacity is required.

Further, since the movable member 101 is rotated for the contact separation, the required dimensions in the direction of opening and closing of the movable contact 102 is a sum of the thickness of the statinary conductor 107, the thickness of the stationary contact 106, the space in which the movble member 101 moves, the thickness of the movable contact 102 and the movable arm vertical portion 103, enabling the required dimension in that direction to be smaller than in the conventional direct movement type current limiting device. Therefore, even when the outer dimension is limited, the contact separating distance necessary for efficiently associating the high pressure with the arc voltage increase can be easily maintained.

Embodiment 29

The twenty-ninth embodiment of the present invention is illustrated in FIGS. 68(*a*) and 68(*b*). FIGS. 68(*a*) and 68(*b*)

are fragmental partially sectioned perspective views showing the cylindrical insulating material 108 and the end portion of the stationary member 105 on the side of the stationary contact 106, and the cylindrical insulating material 108 has a cylinder inner surface, to which fins in the vertical direction in FIG. 68(*a*) and in the horizontal direction in FIG. 68(*b*) is provided. By increasing the area of the cylindrical space inner surface at which the arc is brought into contact, the vapor generated from the cylindrical insulating material 108 upon the interruption operation is increased, allowing a quick generation of a high pressure atmosphere and improving the current limiting performance.

Embodiment 30

The thirtieth embodiment of the present invention is shown in FIG. 69. FIG. 69 is a fragmental sectional view showing the cylindrical insulating material 108 and the end portion of the stationary contact 105 on the stationary contact side 106, the cylindrical insulating material 108 being composed of an insulator 108*a* defining an inner surface of the cylindrical space 118 and an insulator 108*b*around it. The insulator 108*a* is a mold made of a material that emits a large amount of vapor immediately when exposed to the arc, such as a resin material including only a small amount of or no reinforcing material such as glass fibers, and the insulating material 108*b* is made of an reinforced resin or a ceramic superior in mechanical strength. With this structure, a material that cannot mechanically endure the elevated pressure within the cylindrical space 118 can be used as a material for defining the cylinder inner surface, so that a material for generating a large amount of vapor can be used irrespective of the mechanical properties to improve the current limiting performance.

Embodiment 31

Figure 70:
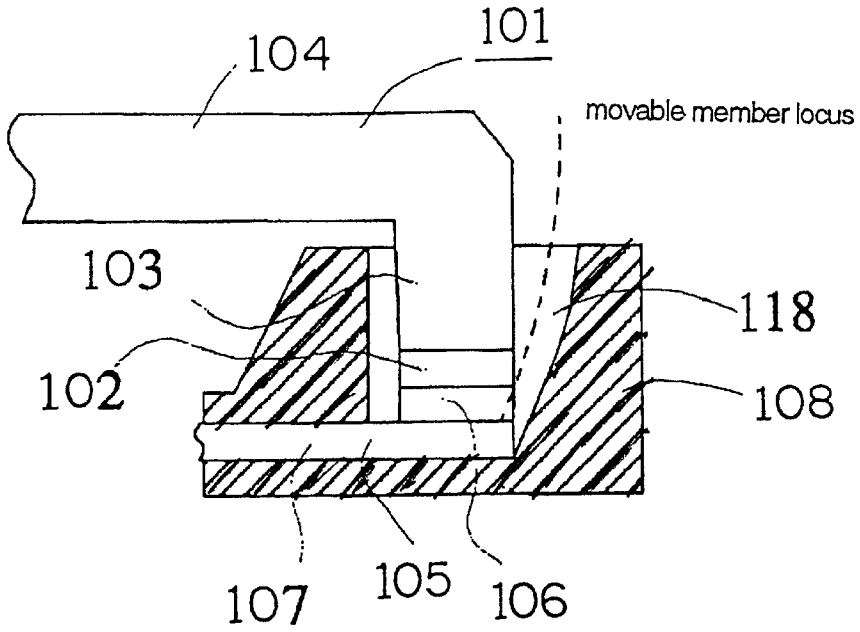
FIG. 70 is a fragmental sectional view showing the cylindrical insulator of the circuit interrupter according to the thirty-first embodiment of the present invention.

The thirty-first embodiment of the present invention is illustrated in FIG. 70. FIG. 70 is a fragmental sectional view showing the cylindrical insulating material 108, the end portion of the stationary member 105 on the side of the stationary contact 106 and the tip portion of the movable member 101 on the side of the movable contact 102, and in the figure, a locus drawn during the contact separating movement by the point of the movable member 101 most remote from its rotating center is depicted by a broken line. The surface portions of the cylindrical insulating material 108 that oppose to the tip portions of the movable member 101 is configured to maintain a constant clearance with respect to the broken line. Generally, the rotatational center of the movable member 101 is disposed above the contact contacting surface, so that the locus of the movable member 101 expand from the stationary contact 106 position in the direction away from the movable member rotary shaft 113. Therefore, when the surface of the cylindrical insulating material 125 opposing to the tip portions of the movable member 101 and the repulsive member 107 are made vertical as shown in FIG. 59, that surface must be positioned far from the stationary contact 106, making the volume surrounded by the cylindrical insulating material 108 is increased. This often increases the time necessary for generating a sufficiently high atmosphere.

Figure 71:
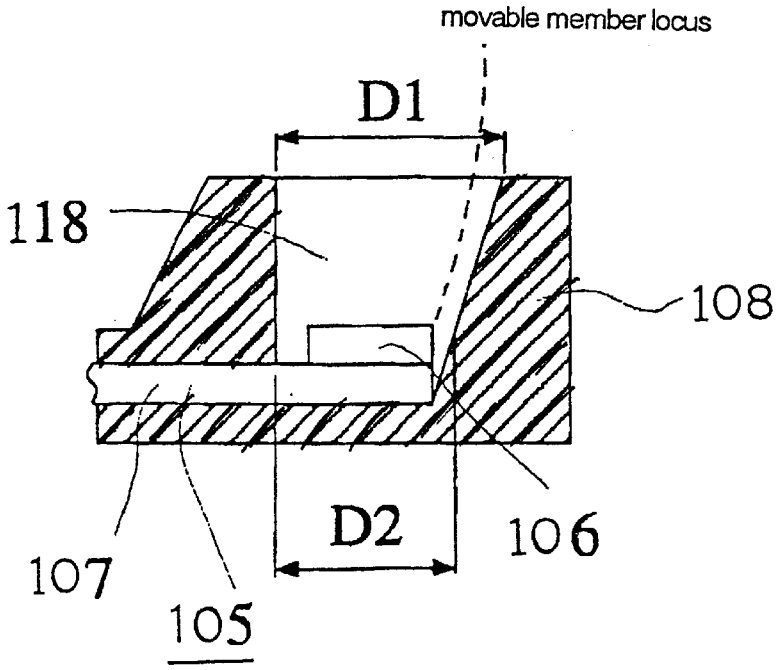
FIG. 71 is a sectional view showing the cylindrical insulator of another configuration according to the thirty-first embodiment.

Therefore, the inner surface of the cylindrical insulating material 108 is formed to extend along the locuses of the tip portions of the movable member 101, whereby the volume surrounded by the cylindrical insulating material 108 can be made small, improving the current limiting performance. Also, while the inner surface of the cylindrical insulating material 108 is formed along the locus of the tip portion of the movable member 101 in FIG. 70, this arc-shaped surface may not be needed when the cylindrical space 118 has a larger width D1 larger than a stationary contact side width D2 as shown in FIG. 71, thereby to improve the current limiting performance. As has been described, it is understood that the cylinder cross sectional area should be larger at the position opposite to the stationary contact than at the stationary contact side in order to improve the current limiting performance while making the volume of the cylindrical space as small as possible.

Embodiment 32

Figure 72:
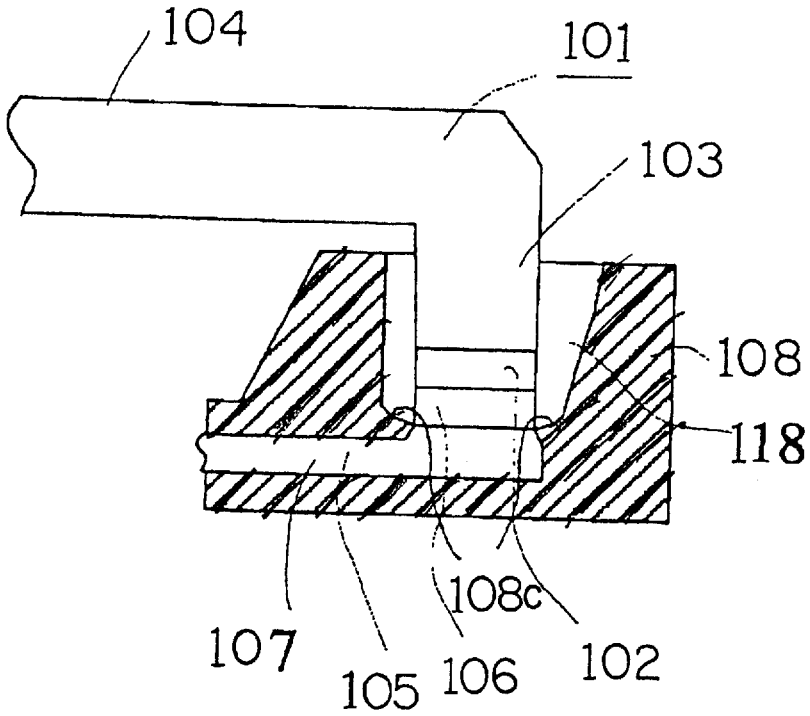
FIG. 72 is a sectional view showing the cylindrical insulator of the circuit interrupter according to the thirty-second embodiment of the present invention.

The thirty-second embodiment of the present invention is illustrated in FIG. 72. FIG. 72 is a fragmental sectional view showing the cylindrical insulating material 108, the end portion of the stationary member 105 on the side of the stationary contact 106 and the tip portion of the movable member 101 on the side of the movable contact 102, and the surrounding area around the stationary contact 106 on the end portion of the stationary member 105 is covered by an inner extension 108*c* extending into the cylindrical space 118 of the cylindrical insulating material 108. The cylindrical space 118 surrounded by the cylidnrical insulating material 108 generally has a larger cross-sectional area than the stationary contact contacting surface taking the locus or the lateral movement of the movable member 1 at the time of opening and closing operation. Therefore, if the above inner extension 108*c* is not provided, a portion of stationary conductor 107 is exposed around the stationary contact 106 when the stationary contact 106 is viewed from the side of the movable member 101. When an arc is generated upon the interrupting operation, the arc spot on the stationary contact side spreads to this exposed portion. On the other hand, with the inner extension 108*c* provided, the arc spot on the statinary member side is limited by the area of the stationary contact 106 which is smaller than that without the inner extension 108*c*, resulting in a higher arc voltage. Also, the amount of generated vapor is increased by an amount corresponding to the insulating material vapor generated from the inner extension 108*c*, allowing a quick formation of a sufficiently high pressure atmosphere, resulting in improvent in the current limiting performance.

Embodiment 33

Figure 73:
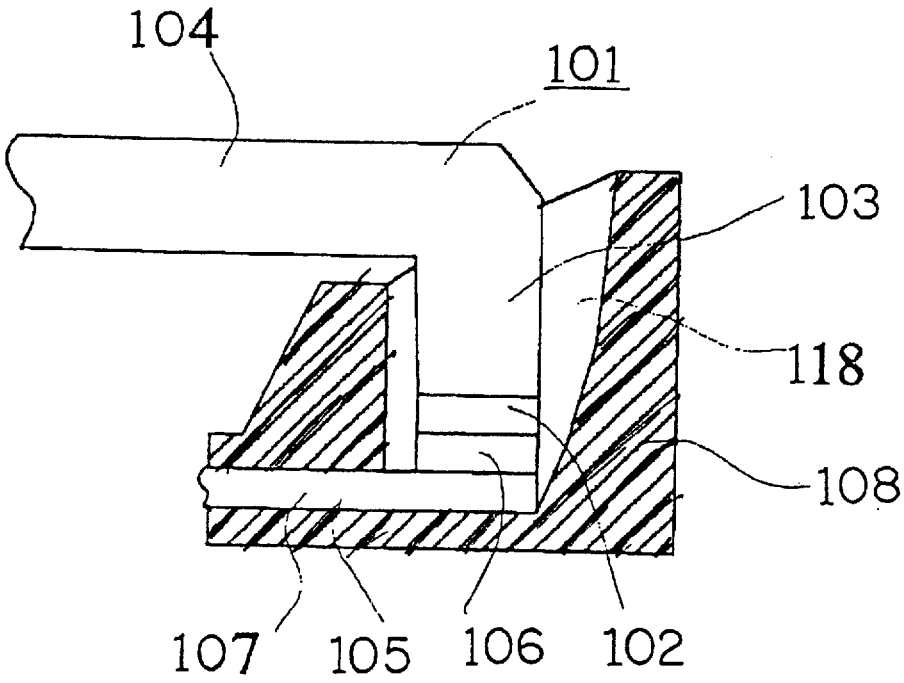
FIG. 73 is a sectional view showing the cylindrical insulator of the circuit interrupter according to the thirty-third embodiment of the present invention.

The thirty-third embodiment of the present invention is illustrated in FIG. 73. FIG. 73 is a fragmental sectional view showing the cylindrical insulating material 108, the end portion of the stationary member 105 on the side of the stationary contact 106 and the tip portion of the movable member 101 on the side of the movable contact 102, and the wall height of the wall oppsite to the movable member rotating center of the cylindrical insulating material 108 surrounding the cylindrical space 118 is made higher than the wall height of the wall on the side of the movable member rotation center. The arc generated between the separated contacts at the time of interruption is subjected to an electromagnetic drive force in the oppsite direction to the movable member rotatin center by the current flowing through the stationary conductor 107 and the movable arm horizontal portion 104. Therefore, the arc within the cylidnrical space 118 is firmly brought into contact with the wall opposite to the movable member rotation center. Also, while it is advantageous to make the moment of inertia small to separate the movable member 101 at a high speed, the moment of inertia of the movable member is increased when the length of the movable arm vertical portion which depends upon the height of the cylindrical insulating material 108 is long. Therefore, by making the wall height of the cylindrical insulating material 108 higher at the opposite portion from the movable member rotation center than the portion on the side of the movable member rotation center, the movable arm vertical portion 103 can be made short to reduce the moment of inertia and at the same time generate a sufficient amount of cylindrical insulating material vapor to generate an atmosphere of a sufficiently high pressure, enabling to further improve the current limiting performance.

Embodiment 34

Figure 74:
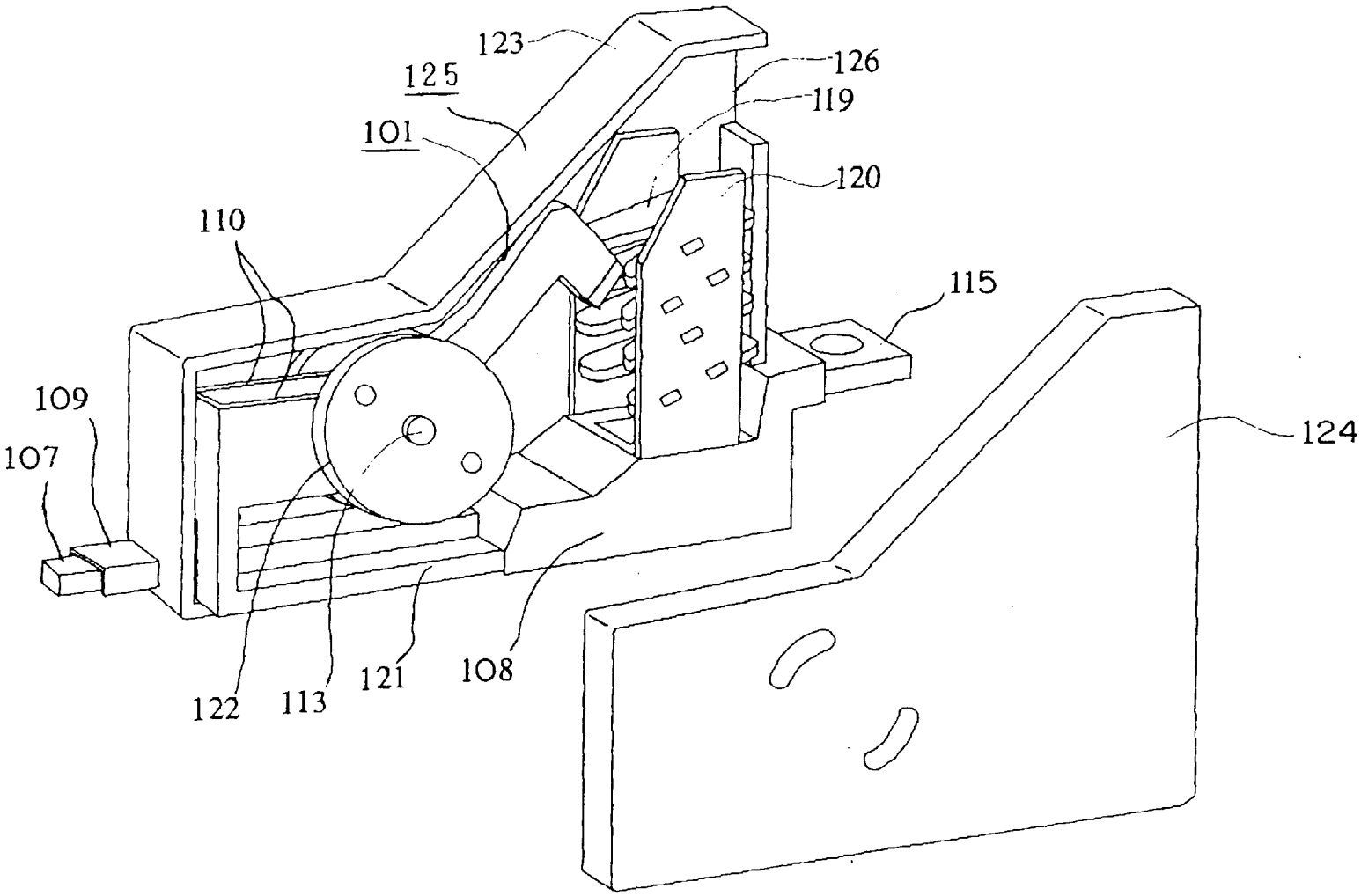
FIG. 74 is a perspective view showing the arc extinguisher unit of the circuit interrupter according to the thirty-fourth embodiment of the present invention.
Figure 75:
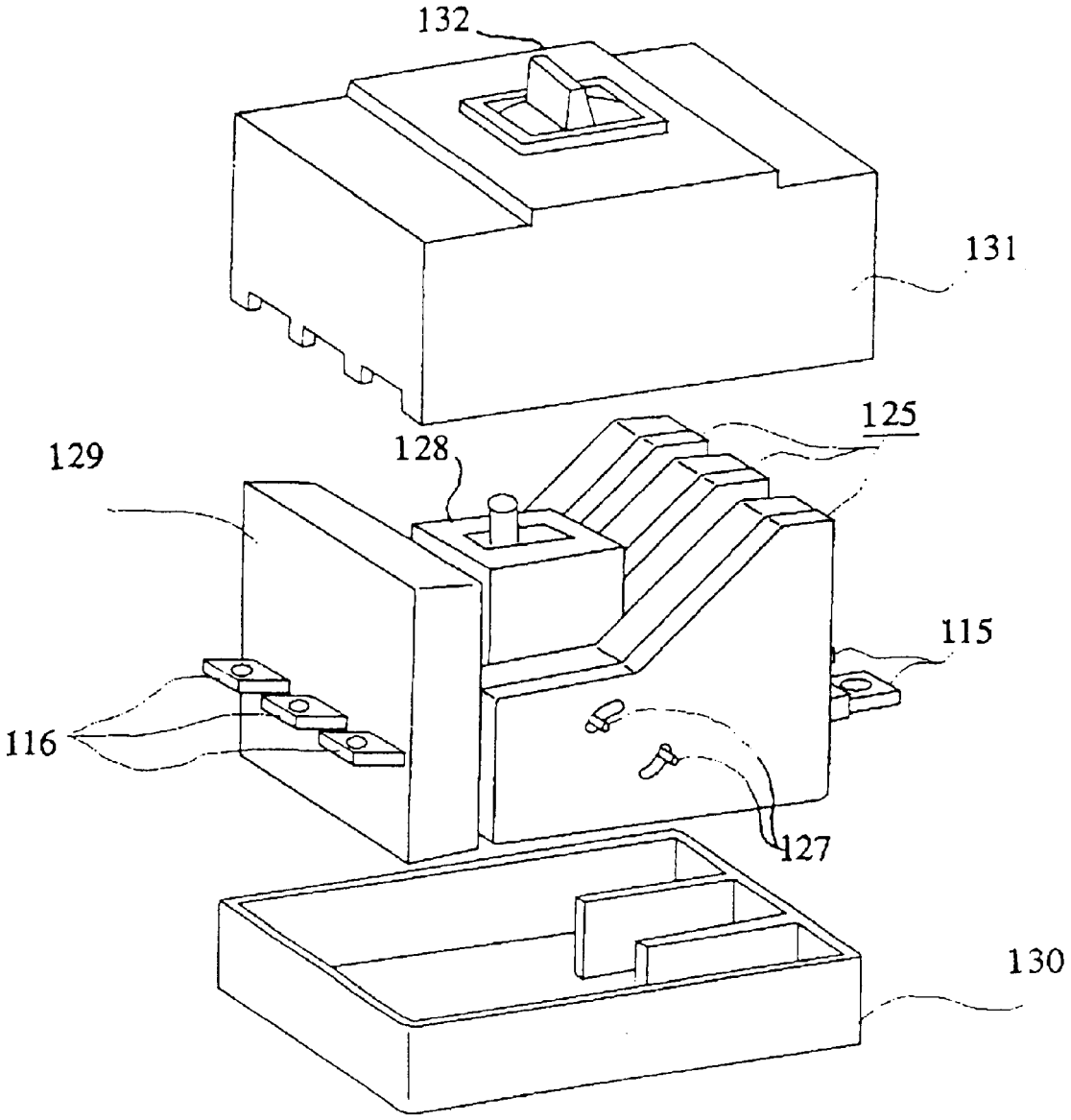
FIG. 75 is an exploded perspective view showing the construction of the circuit interrupter according to the thirty-fourth embodiment.

The thirty-fourth embodiment of the present invention will now be described in conjunction with FIG. 74. FIG. 74 is a perspective view showing a main portion of a circuit interrupter in the shape of a unit for a molded case circuit breaker, the component parts of the arc extinguishing device are housed within an arc extinguishing unit housing main body 123 and an arc extinguishing unit housing cover 124, defining together an arc extinguishing unit 125. 119 are arc extinguishing plates and 120 are arc extinguishing side plates holding the plurality of arc extinguishing plates 119. As shown in FIG. 75, the molded case circuit breaker can be obtained by connecting a plurality of the above arc extinguishing units 125 together by a cross bar 127, and additionally providing a mechanism portion 128 for opening and closing the contacts through the cross bar 127 and a relay portion 129 detecting an abnormal current for operating the mechanism portion 128 for contact opening and closing and a handle 132 for manually operating the mechanism portion 128 within the base 130 and the cover 131. Thus, by making each component part a unit, which can be combined into a molded case circuit breaker, the assembly is simple and the cost can be decreased.

By housing the arc extinguishing device within the arc extinguishing unit housing main body 123 and the arc extinguishing unit cover 124, the pressure increase within the molded case circuit breaker upon the interruption needs not be directly received by the base 130 and the cover 131. The pressure receiving area of the arc extinguishing unit housing is smaller than the pressure receiving area of the base 130 and the cover 131. Therefore, even when an arc extinguishing unit housing of the same material and the same wall thickness as those of the base 130 and the cover 131 is used, the housing can take a larger internal pressure increase, becoming suitable to utilize the current limiting procedure in which the arc atmosphere pressure is increased to increase the arc voltage. Also, while the base and the cover has been made of a mechanically strong and expensive molding material in the conventional design in order to resist the internal pressure increase upon the interruption, the amount of the material of the pressure receiving housing can be decreased by employing the arc extinguishing unit housing.

Figure 76:
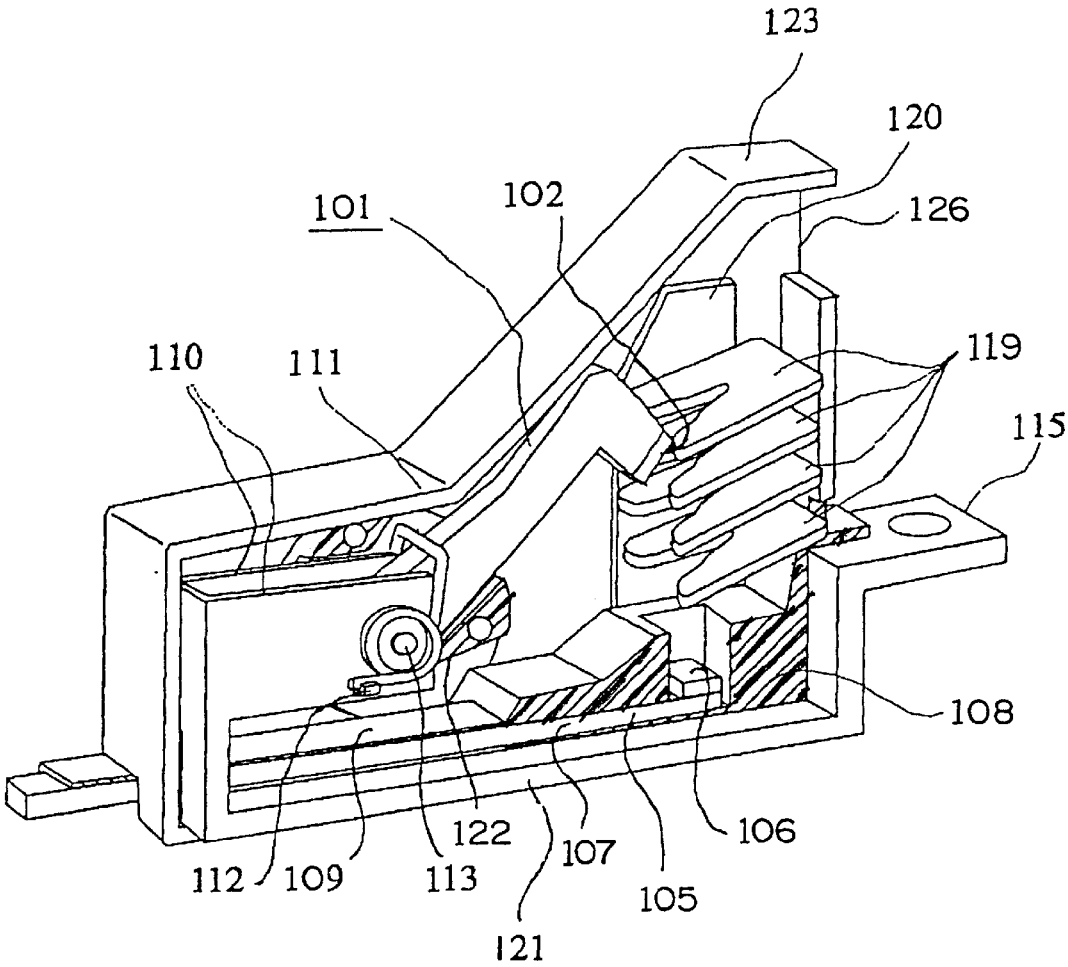
FIG. 76 is a fragmental sectional perspective view showing the arc extinguishing unit of the circuit interrupter according to the thirty-fourth embodiment.
Figure 77:
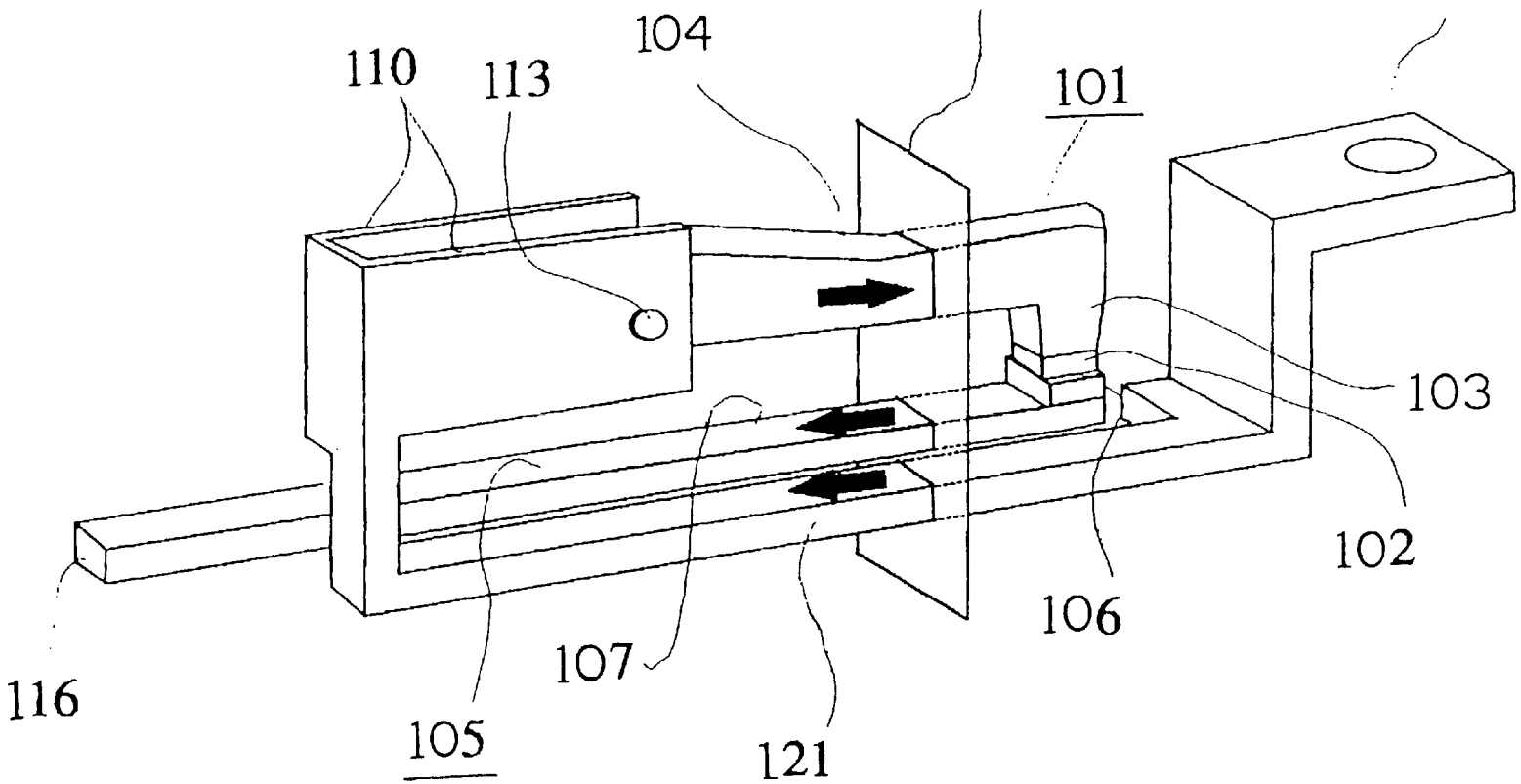
FIG. 77 is a perspective view showing the conductor arrangement of the circuit interrupter according to the thirty-fourth embodiment.
Figure 78:
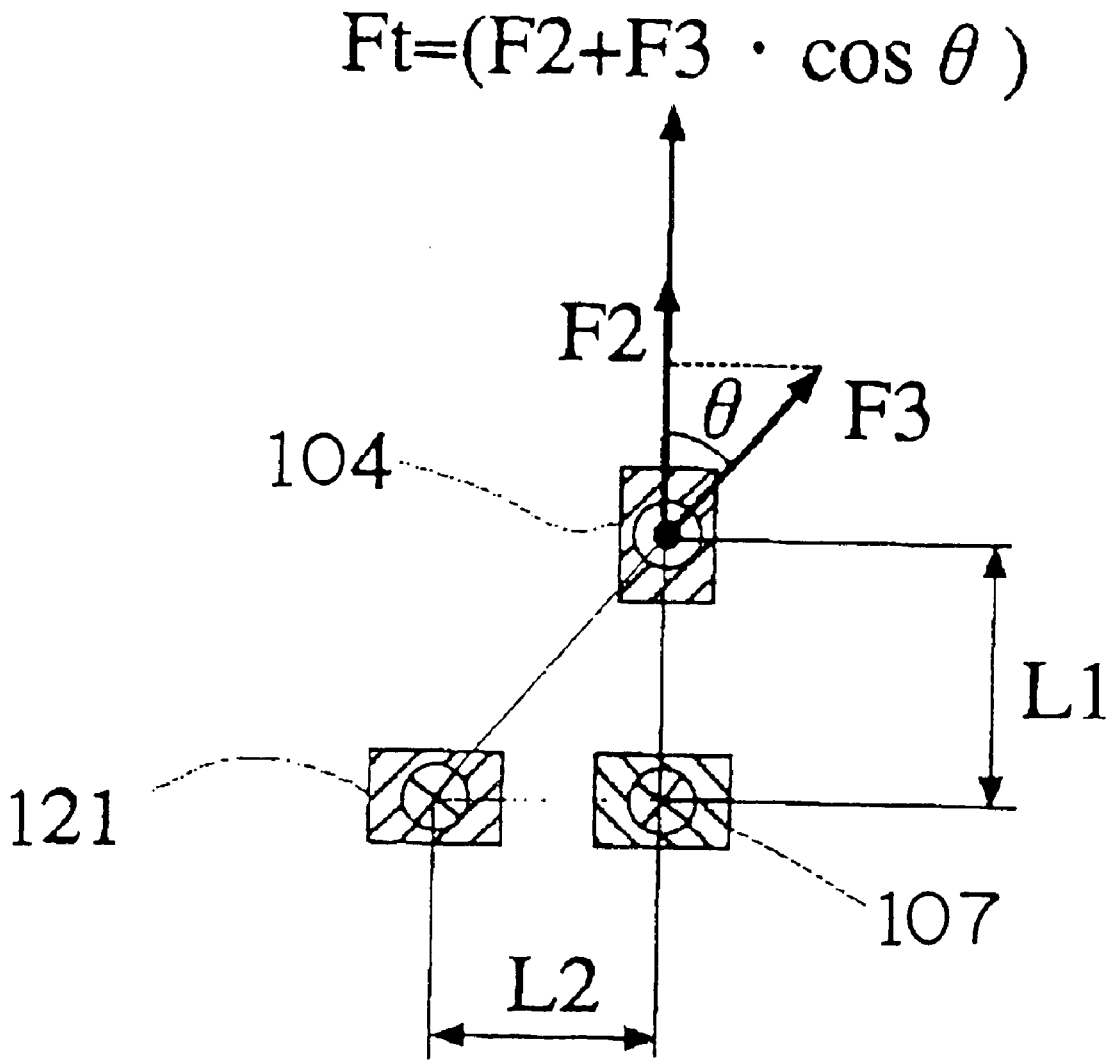
FIG. 78 is a sectional view taken along line C of FIG. 77.

FIG. 76 is a perspective view of the arc extinguishing unit 139 shown in FIG. 74 with one part of the component parts shown in section for illustrating the inner structure. Also, FIG. 77 is a perspective view of the current carrying parts in the closed state with other parts omitted and FIG. 78 is a sectional view of current carrying components at a section C of FIG. 77. In FIG. 77, the flow directions of the current through the movable arm horizontal portion 104, the stationary conductor 107 and the conductor 121 are shown by arrows.

In this embodiment, the ordinary opening and closing operation is achieved by manually operating the handle 132. By this handle operation, a rotor 122 is rotated through the mechanism portion 128 and the cross bar 127, and the movable member 101*a*chieves the opening and closing operation. Also, upon the overload current interruption, the relay portion 129 detects an abnormal current and supplies a trip signal to the mechanical portion 128 and the mechanical portion 128 is operated to rotate the rotor 122 to raise the movable member 101 to open the contacts. However, upon the large current interruption such as during the short-circuiting fault or the like, prior to the rotation of the rotor 122, the contact separates against the contact pressure of the spring 111 and generate an arc between the separated contacts because of a combined force Ft, which is a sum of an electromagnetic repulsive force F1 due to the current concentration at the contact contacting surface, an electromagnetic repulsive force F2 due to the parallel and opposite currents in the movable arm horizontal portion 104 and the stationary conductor 107 as shown in FIG. 78 and a component ($F3 \cdot \cos\theta$) of an electromagnetic repulsive force F3 due to the parallel and opposite currents in the movable arm horizontal portion 104 and the conductor 121. As the arc is generated, the electromagnetic repulsive force F1 due to the current concentration at the contacting surface is diminished, but the electromagnetic repulsive force F2 and the coponent force of the elecromagetic force F3 continues to cause the movable member 101 to rotate in the contact separating direction. Also, upon the arc generation, a large volume of vapor is generated from the inner surface of the cylindrical insulating material 108 due to the arc heat, generating a opening force Fp for pushing up the movable member 101. These forces cause the movable member 101 to rapidly rotate, separating the contacts at a high speed. This high speed separation causes the arc length to quickly elongate, raising the arc voltage quickly, and the fault current reaches at its peak value.

After the current peak, the movable member 101 is further rotated to increase the distance between the contacts. Due to this increase in the distance between the contacts, the arc voltage is further increased and the fault current is directed rapidly toward the zero. When the fault current is pinched to become small, the arc is withdrawn into the arc extinguishing plates 119, whereby the arc is splitted, quenched and extinguished. At this time, the movable contact 102 is positioned outside of the space surrounded by the cylindrical insulating material 108 and the insulation between the contacts is sufficiently recovered, so that no current flows again even when a source voltage is applied across the electrodes, completing the interrupting operation. Also, the interrupting time can be significantly decreased by a high arc voltage due to a large distance between the contacts which is large after the current peak. Therefore, the passing energy $I^2t$ (time integrated second power of the current) which is one of the indexes indicating the current limiting performance is small.

It is to be noted that, in this embodiment, the exhaust port 126 is provided only on the side of the arc extinguishing plates 119 as viewed from between the contact 102 and the contact 106. With such the arrangement, during the current interrupting operation, as the arc current increases, the pressure is accumulated in the space within the housing on the side of the rotor 122 with respect to the arc. As the arc current decreases after the arc current peak, the above accumulated pressure generates a gas flow between the electrodes from the side of the rotor 122 to the side of the exhaust port 126, thereby elongating the arc to the arc extinguishing plates 119. Further, at around the current zero point, the recovery of the insulation between the contacts is significantly improved by the function of the above flow which blasts off the charged particles between the contacts. Therefore, a highly reliable circuit breaker in which the interruption failure is difficult to occur even when applied to a high voltage circuit.

The insulation recovery function of the gas flow by the accumulated pressure becomes larger as the speed of gas flow upon the current interruption increases. In order to increase the flow speed, the accumulation pressure should be made higher or the flow cross-sectional area should be made smaller and for this reason the area of the exhaust port must be small. According to this embodiment, the exhaust port 126 having a relatively small area is provided on the side of the movable contact 101 in the open position. When the current limiting performance is to be improved through the use of the cylindrical insulating material 108, the arc in the vicinity of the arc spot on the side of the stationary contact 106 is restricted by the cylindircal insulating material 108, so that the metal particles constituting the arc cannot be blown off by the gas flow by the accumulator pressure in the space on the side of the rotor 122. On the other hand, the arc in the vicinity of the arc spot on the side of the movable contact is positioned outside of the cylindrical insulating material 108 upon current interruption, so that the arc is easily affected by the function of the gas flow. Therefore, the insulation recovery between the electrodes can be effectively ensured by providing the exhaust port 126 having a relatively small cross-sectional area on the side of the movable contact in the open position.

Embodiment 35

With the conductor arrangement illustrated in FIGS. 77 and 78, the stationary conductor 107 is provided in a plane including the locus of rotatin of the mavable member 101, but the conductor 121 electrically connecting the terminal portion 115 and the sliding contact 110 is disposed at a position slightly displaced from the above plane. Therefore, the movable member 101 is subjected to a lateral force (F3·sin θ) perpendicular to the direction of contact separation, causing a factor of decreasing the contact separation speed of the movable member 101. For example, according to this invention, the movable arm vertical portion 103 is inserted into the cylindrical insulating material 108 in the contact closed position, so that the movable member 101 may be brought into contact with the cylindrical insulating material 108 when the movable member 101 is laterally moved by the above lateral force. When such contact occurs, the contact separation speed is significantly decreased. Also, when the above lateral force causes the deformation of the movable member 101 or the movable member rotary shaft 113, the re-closure is impossible.

Figure 79:
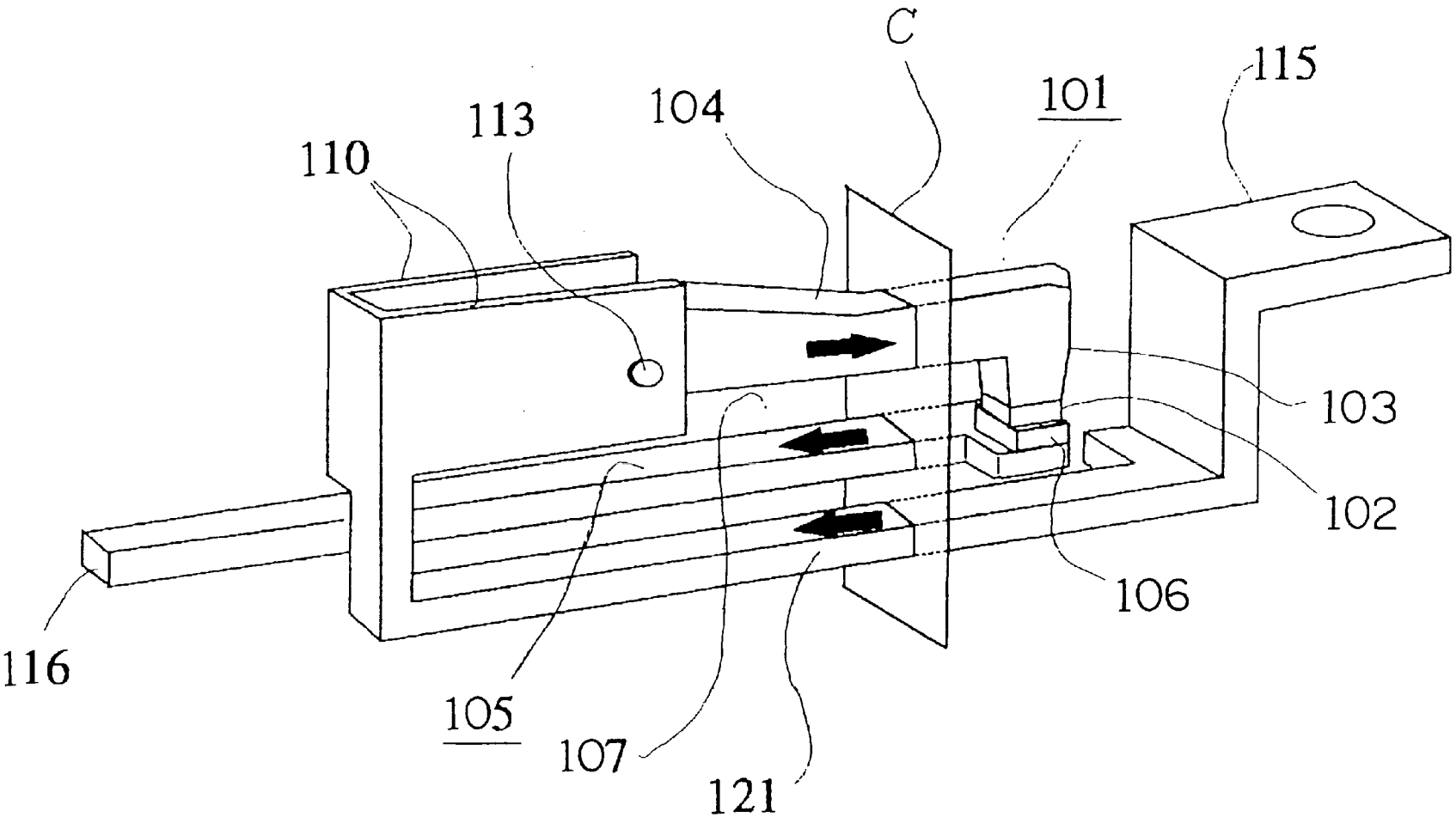
FIG. 79 is a perspective view showing the conductor arrangement of the circuit interrupter according to the thirty-fifth embodiment of the present invention.
Figure 80:
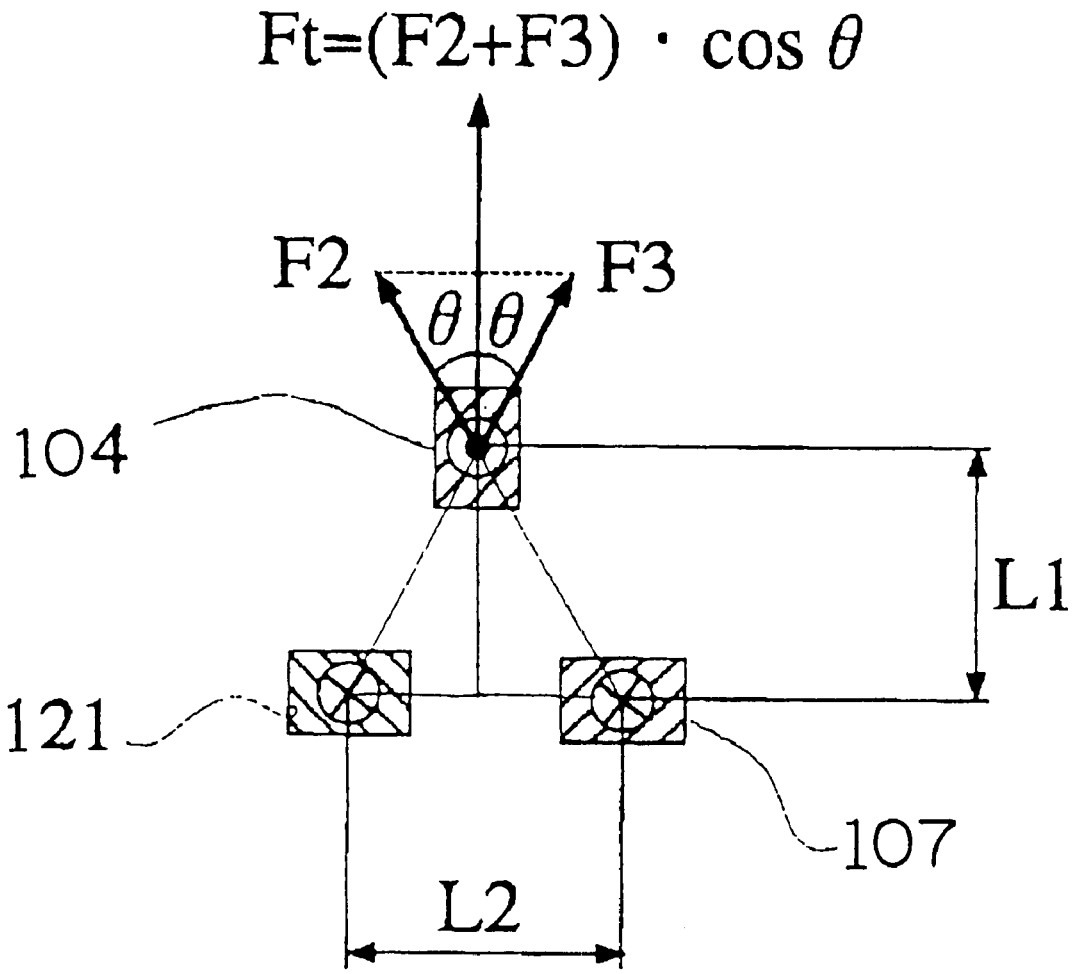
FIG. 80 is a sectional view taken along line C of FIG. 79.

FIGS. 79 and 80 illustrate an embodiment which solves this problem. FIG. 80 is a sectional view at a section C of FIG. 79. As shown in FIGS. 79 and 80, when the stationary conductor 107 and the conductor 121 are symmetrically arranged about the plane including the above locus, the lateral force component (F2·sin θ) of the electromagnetic repulsive force between the movable arm horizontal portion 104 and the statinonary conductor 107 and the lateral force component (F3·sin θ) of the electromagnetic repulsive force between the movable arm horizontal portion 104 and the conductor 121 cancel out with each other, making the electromagnetic repulsive force between the conductor currents a force only in the contact separating direction (Ft=(F2+F3)·cos θ). Therefore, the lateral movement of the movable member 101 can be prevented and the reliability of the opening and closing operation can be increased.

Embodiment 36

Figure 81:
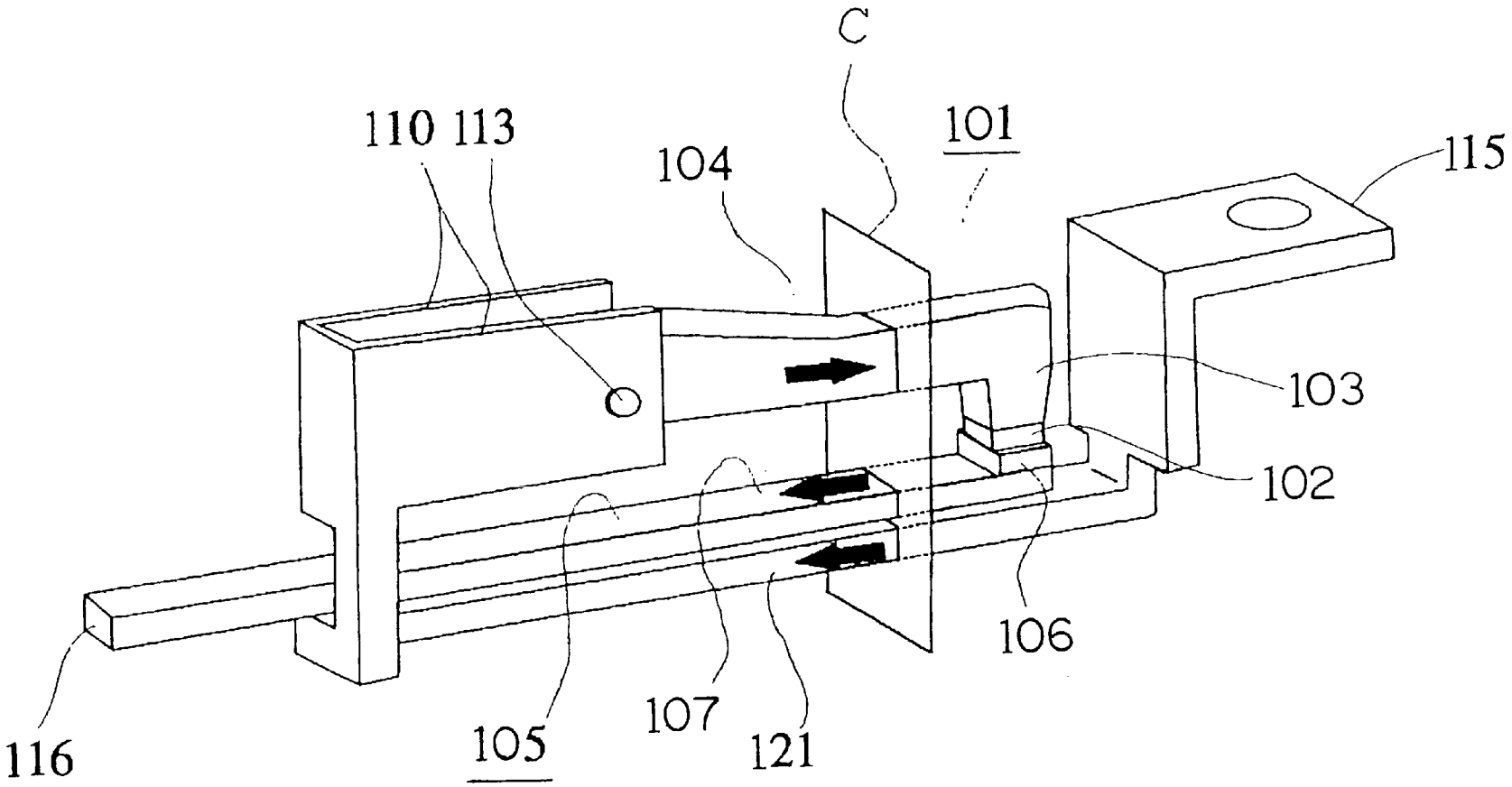
FIG. 81 is a perspective view showing the conductor arrangement of the circuit interrupter according to the thirty-sixth embodiment of the present invention.
Figure 82:
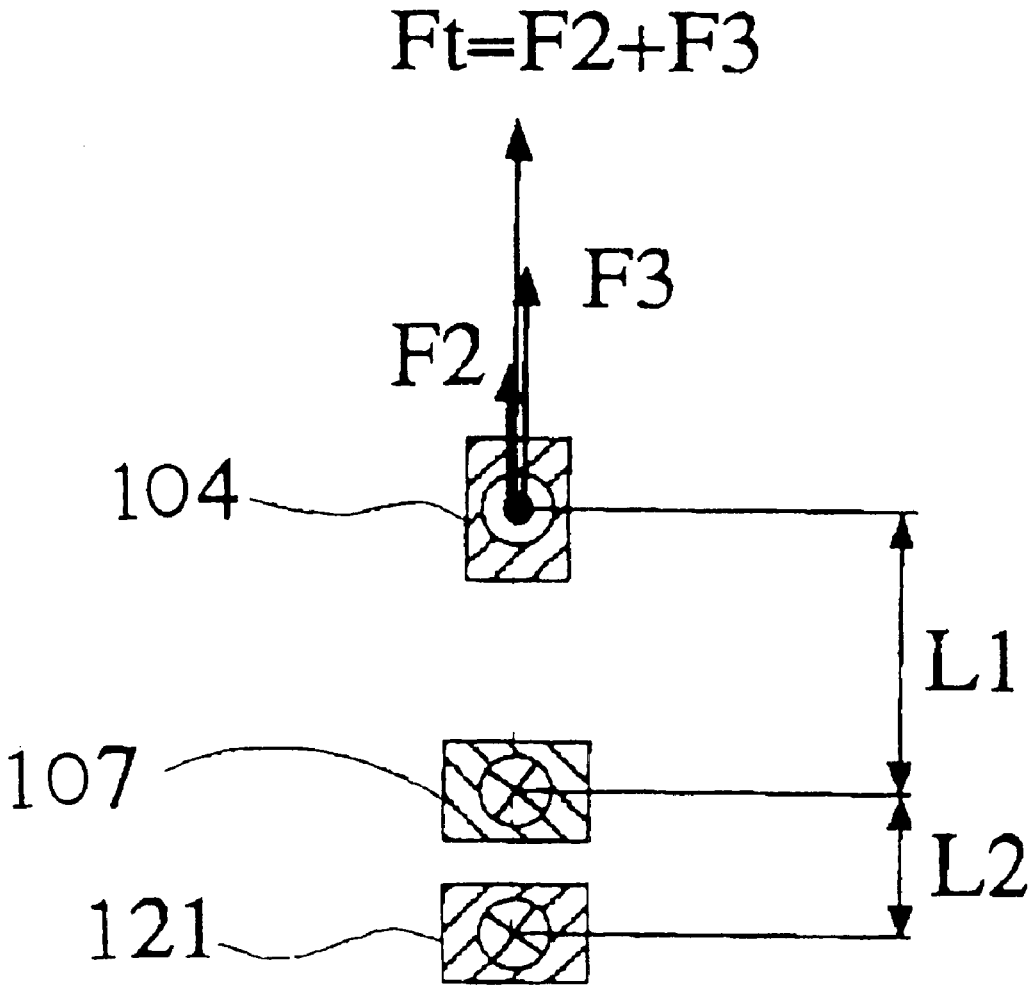
FIG. 82 is a sectional view taken along line C of FIG. 81.

FIGS. 81 and 82 illustrate the thirty-sixth embodiment of the present invention. FIG. 82 is a sectional view at section C of FIG. 81. In this embodiment, the center lines of the stationary conductor 107 and the conductor 121 are disposed on a plane including the previously discussed locus and substantially parallel to the movable arm horizontal portion 104 in the closed position, so that no lateral force component is generated in either of the electromagnetic repulsive force F2 due to the opposite currents flowing through the movable arm 104 and the stationary conductor 107 and the electromagnetic repulsive force F3 due to the opposite currents flowing through the conductor 121 and the stationary conductor 107.

The arrangement of the stationary conductor 107 and the conductor 121 in which the currents generating the electromagnetic force on the movable member 101 is different in the thirty-fourth, thirty-fifth or thirty-sixth embodiment. In general, the smaller the distance between the movable arm horizontal portion 104 and the stationary conductor 107 or the conductor 121, the larger the electromagnetic repulsive force, allowing the contact separating speed to be made high. However, the vertical distance L1 between the movable arm horizontal portion 104 and the stationary conductor 107 shown in FIGS. 78, 80 and 82 is determined mainly by the cylinder height of the cylindrical insulating material, and the distance L2 between the stationary conductor 107 and the conductor 121 is determined by the insulating distance required between the conductors and the sectional configuration of the conductor. These dimensions are then determined by the housing strength of the molded case circuit breaker, the applied circuit voltage, rated current and the like. For example, when height of the cylindrical insulating material 108 is increased, the area of the insulating material that contacts with the arc and the internal pressure of the housing of the arc extinguishing unit is increased, so that a limitation due to the housing strength is posed on the cylindrical insulating material 108. Also, the insulating distance is limited by the circuit voltage and the conductor cross sectional area is limited by the current carrying capacity. Therefore, the conductor arrangement for obtaining the highest electromagnetic separating force varies depending upon the make of the molded case circuit breaker.

Figure 83:
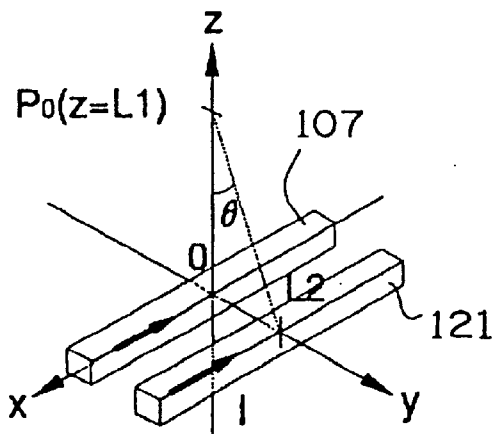
FIG. 83(*a*) and 83(*b*) and 83(*c*) are views for explaining the difference in electromagnetic contact opening force due to the differences in the conductor arrangement.
Figure 83:
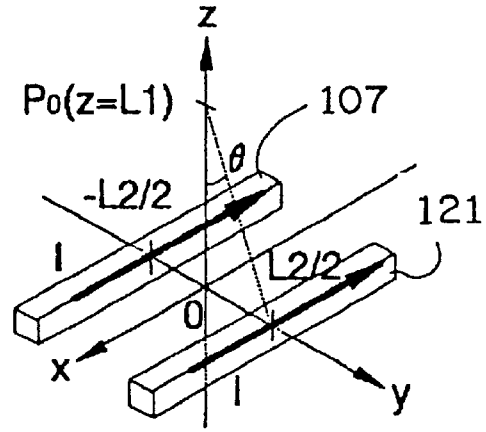
Figure 83:
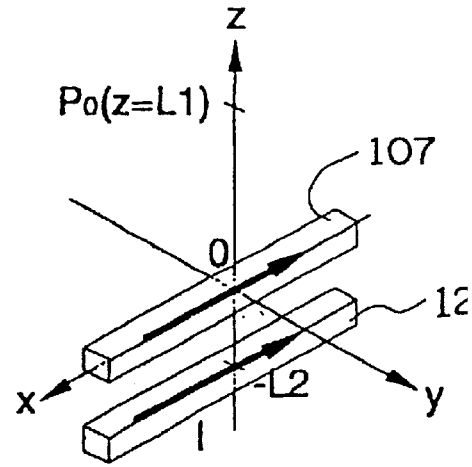

FIG. 83(*a*), 83(*b*), and 83(*c*) illustrates in simplified form the conductor arrangements for generating the electromagnetic forces of the thirty-fourth, the thirty-fifth and the thirty-sixth embodiments. In the figure, z-axis direction is the direction of separation of the contact from the closed position, point P0 (z=L) on the z-axis is the position of the center of the current in the movable arm horizontal portion 104 in the closed position, z=0 is the position of the center in the vertical direction of the stationary conductor and zx-plane corresponds to the plane including the locus drawn by the movable member 101. FIG. 83(*a*) corresponds to the embodiment 34, FIG. 83(*b*) corresponds to the embodiment 35 and FIG. 83(*c*) corresponds to the embodiment 36, and By is a magnetic flux density of the magnetic field component generating the contact separating electromagnetic force on the movable arm horizontal portion 104 out of the magnetic field at the point P0 (z=L1) generated by the currents flowing through the stationary conductor 107 and the conductor 121. When the electrical paths of the stationary conductor 107 and the conductor 121 are sufficiently long and the currents flowing through the stationary conductor 107 and the conductor 121 are substituted with line currents on the center lines of the conductors, the above magnetic flux density By can be expressed by the equation given in FIG. 83.

Figure 84:
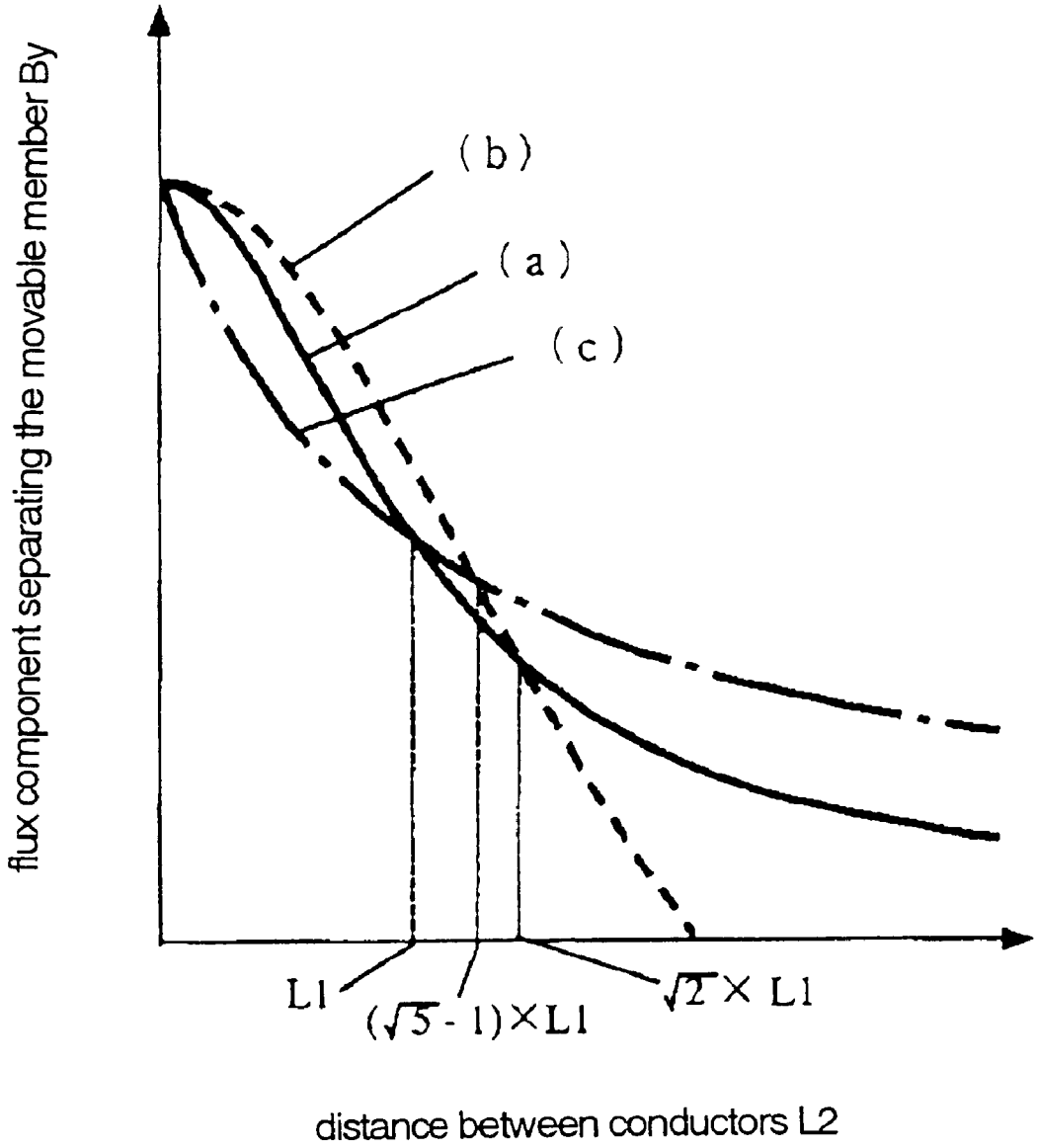
FIG. 84 is a graph explaining the difference in electromagnetic contact opening force due to the difference in the conductor arrangement.

FIG. 84 is a graph in which the calculated change in the above magnetic flux density By when the distance L2 between the stationary conductor 107 and the conductor 121 is changed when the current I and the vertical position L1 of the movable arm horizontal portion in the closed state is equal to each other for (a)–(c) is plotted. From this figure, it is understood that the magnetic flux density By is higher in the order of (b), (a), (c) in the region of $L2<L1$, higher in the order of (b), (c), (a) in the region of $L1<L2<(\sqrt{5-1})\times L1$, higher in the order of (c), (b), (a) in the region of $(\sqrt{5-1})\times L1<L2<\times L1$, and higher in the order of (c), (a), (b) in the region of $L2>\sqrt{2}\times L1$. From the above, it can be said that when there is no limitation on strength or dimensions of the housing and the cylindrical insulating material can be made sufficiently high (when L1 is sufficiently large), a stronger contact separating force can be obtained by arranging the conductors 107 and 121 in lateral direction as in the Embodiments 34 and 35 rather than by arranging the conductors 107 and 121 in the vertical direction as in the Embodiment 36. On the other hand, when the cylindrical height is low, due to the limitation of the housing strength or the like, it can be said that, a stronger contact separating force can be obtained by arranging the conductors in vertical direction as in the Embodiments 36.

Figure 85:
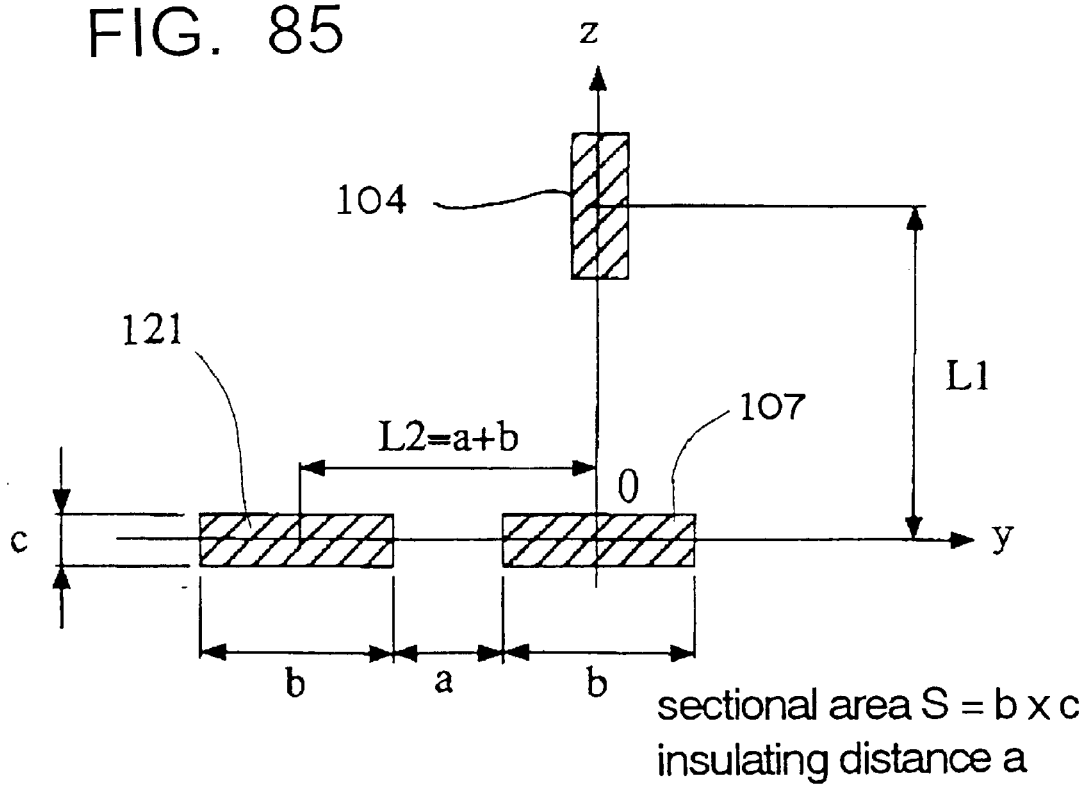
FIG. 85 is a view showing the distance relationship between the conductor sections shown in FIG. 78.
Figure 86:
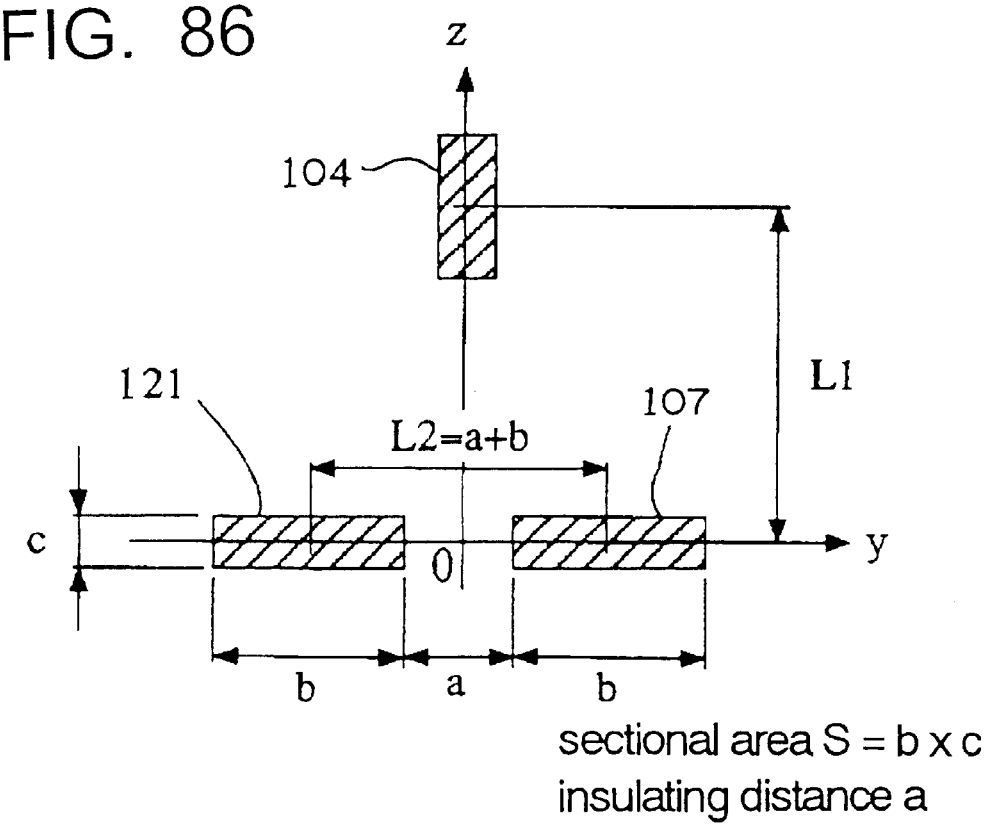
FIG. 86 is a view showing the distance relationship between the conductor sections shown in FIG. 80.
Figure 87:
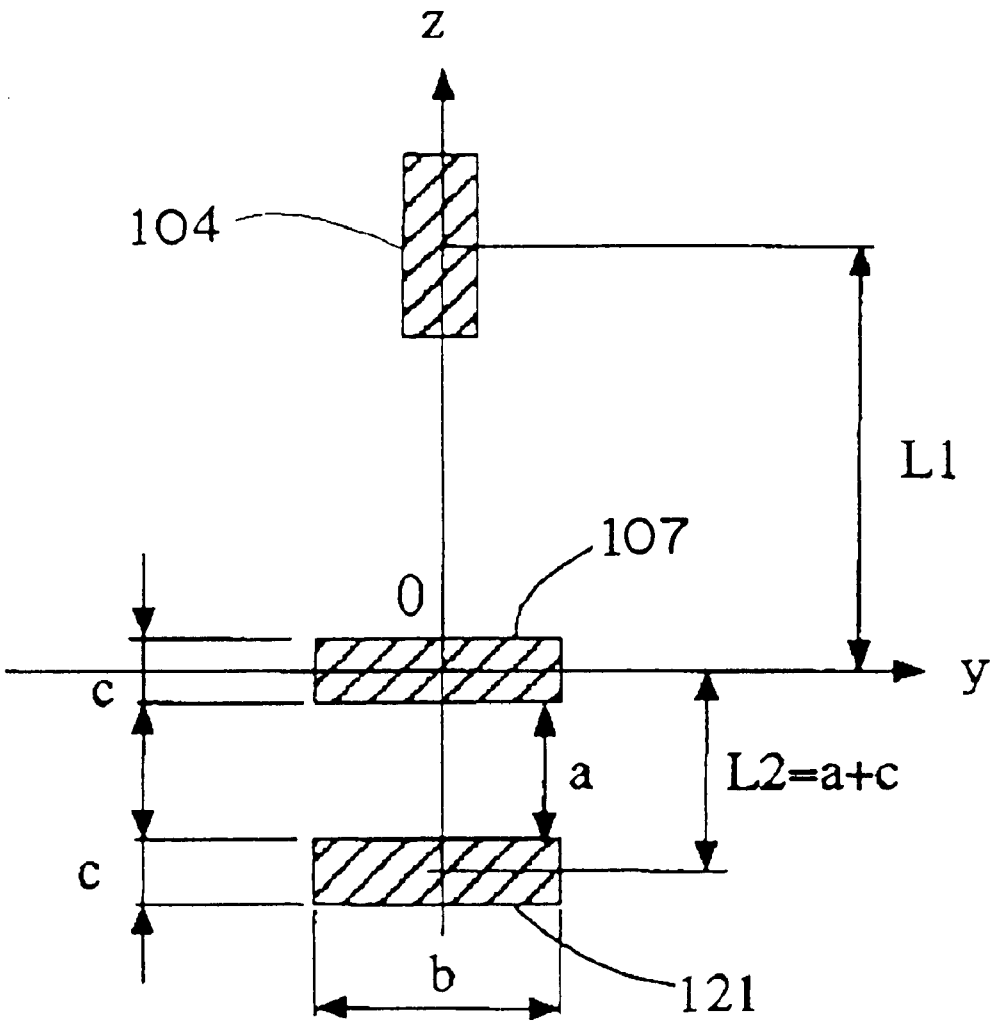
FIG. 87 is a view showing the distance relationship between the conductor sections shown in FIG. 82.

As shown in FIGS. 85, 86 and 87 respectively, L2 is a sum of the insulating distance a and the conductor width b in Embodiments 34 and 35 and is a sum of the insulating distance a and the conductor thickness c in Embodiment 36. Generally, when the terminal portion 115 and the conductor 121 are to be integrally formed by the press-forming or the like, (conductor width b)>(conductor thickness c) usually stands, so that L2 of Embodiments 34 and 35 is larger than L2 of Embodiment 36. From the equation shown in FIG. 83, the condition that the magnetic field component By for generating the magnetic contact separating force in Embodiment 36 is larger than that in Embodiments 34 is obtained as $c<((a+b)^2/L1)-a$. Similarly, the condition that Embodiment 36 generates the By larger than that generated by Embodiment 35 is $c<((2\times L1\times(a+b)^2/((a+b)^2-4\times L1^2))-2$. When the conductor cross sectional area $s=b\times c$ equals between Embodiments 34 and 36 or between Embodiments 35 and 36, the above two equations can be expressed by the conductor cross sectional area s, the insulating distance a, the vertical distance L1 between the movable arm horizontal portion in the closed position and the stationary conductor, and the plate thickness c of the material.

From the above, when c is sufficiently small (such as when the conductor is formed by a press-formed, very thin sheet material), the vertical arrangement of the stationary conductor 107 and the conductor 121 as in Embodiment 36 generates a contact separating force stronger than that obtained by the horizontal arrangement of the conductors as in Embodiment 34 or 35. On the other hand, when a relatively large thickness c is used, the horizontal arrangement of the conductors as in Embodiment 34 or 35 generates a contact separating force stronger than that obtained by the vertical arrangement of the conductors.

Embodiment 37

Figure 88:
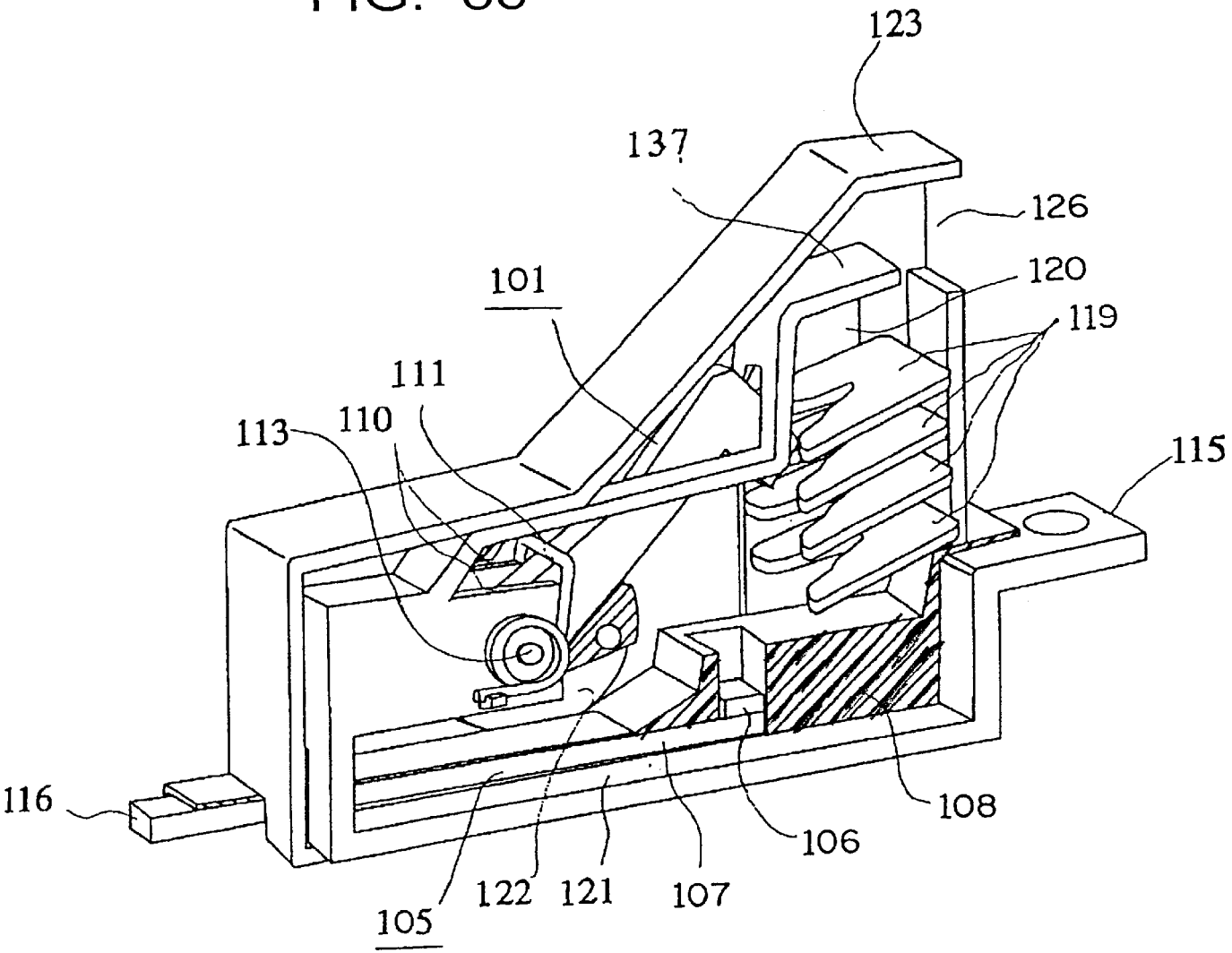
FIG. 88 is a fragmental sectional view showing the arc extinguishing unit internal structure of the circuit interrupter according to the thirty-seventh embodiment.

FIG. 88 is a partially sectioned perspective view showing the thirty-seventh embodiment. The interrupter shown in the figure has the same structure as that shown in FIG. 76 except for the transfer electrode 137. The transfer electrode 137 is electrically connected to the sliding contact member 110 and further toward the exhaust port 126 therefrom with a slit portion in which the movable member 101 in the open position is received provided. The end portion of the transfer electrode 137 on the side of the exhaust port 126 is positioned above the arc extinguishing plates 119, and the exhaust port side end portion of the slit is arranged to oppose to the movable contact side end portion of the movable member 101 in the open position.

In the embodiment shown in FIG. 76, the movable member 101 has a substantially L-shaped configuration in order to generate an arc in the cylindrical insulating material at the initial stage of the contact separation. Therefore, the arc spot on the movable member side is difficult to be moved to the end surface of the movable member 101 on the arc extinguishing plate side, the blasting direction of the movable member side arc being not directed to the arc extinguishing plates, making it difficult for the arc to be brought into contact with the arc extinguishing plates 119. Thus, the arc cooling effect of the arc extinguishing plates 119 cannot effectively be utilized, making the internal pressure of the arc extinguishing unit housing high due to the arc heat to make the housing cracks easily generate. Therefore, when the transfer electrode 137 is arranged as shown in FIG. 88, at the latter half of the interruption operation after the movable member 101 has been fully opened, the arc spot on the movable member side is transferred from the movable member 101 to the transfer electrode 137 and is moved toward the exhaust port 126, the arc can be effectively brought into contact with the arc extinguishing plates 119. Therefore, the arc is cooled by the arc extinguishing plates 119 and the arc temperature is decreased, whereby the internal pressure of the arc extinguishing unit housing is decreased.

Embodiment 38

Figure 89:
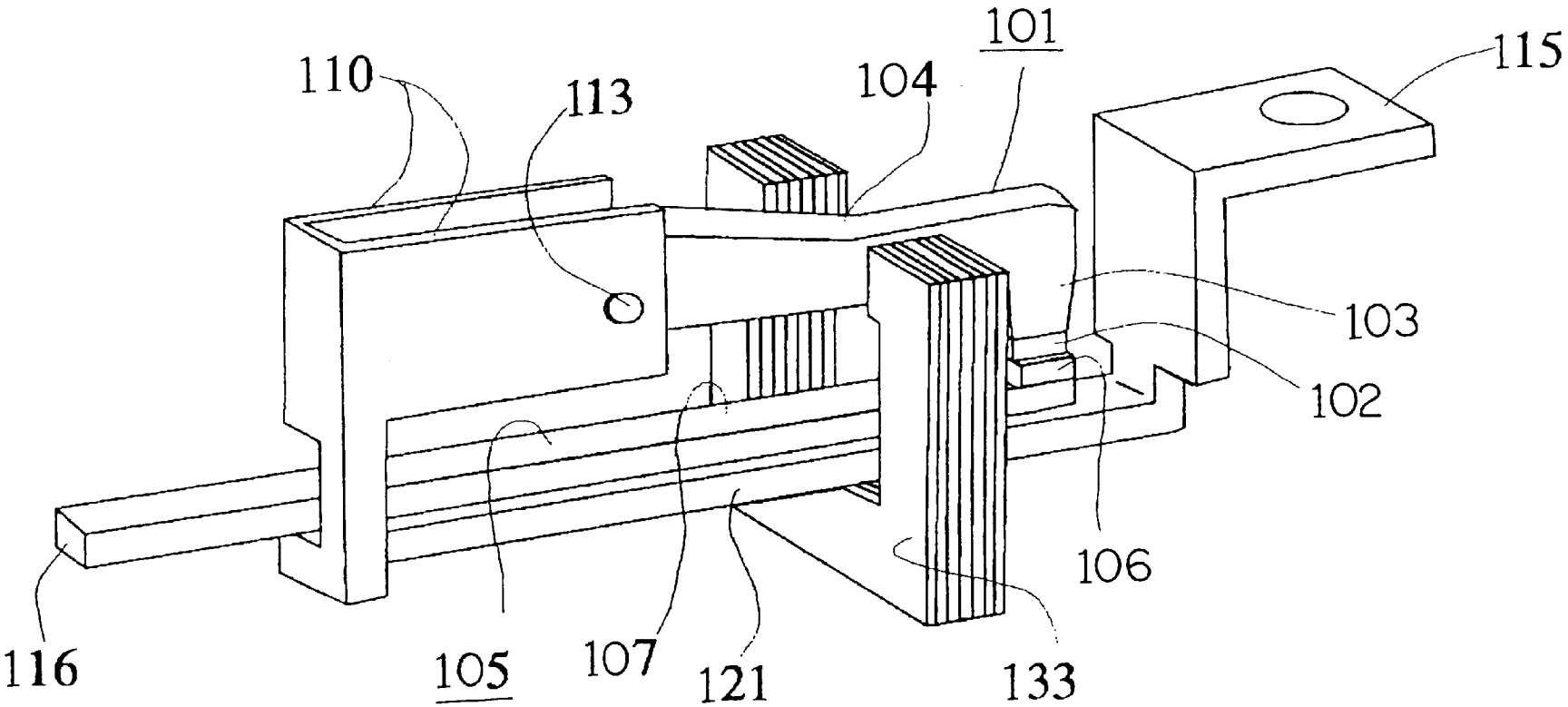
FIG. 89 is a fragmental sectional view showing the conductor arrangement and the magnetic core of the circuit interrupter according to the thirty-eighth embodiment of the present invention.
Figure 90:
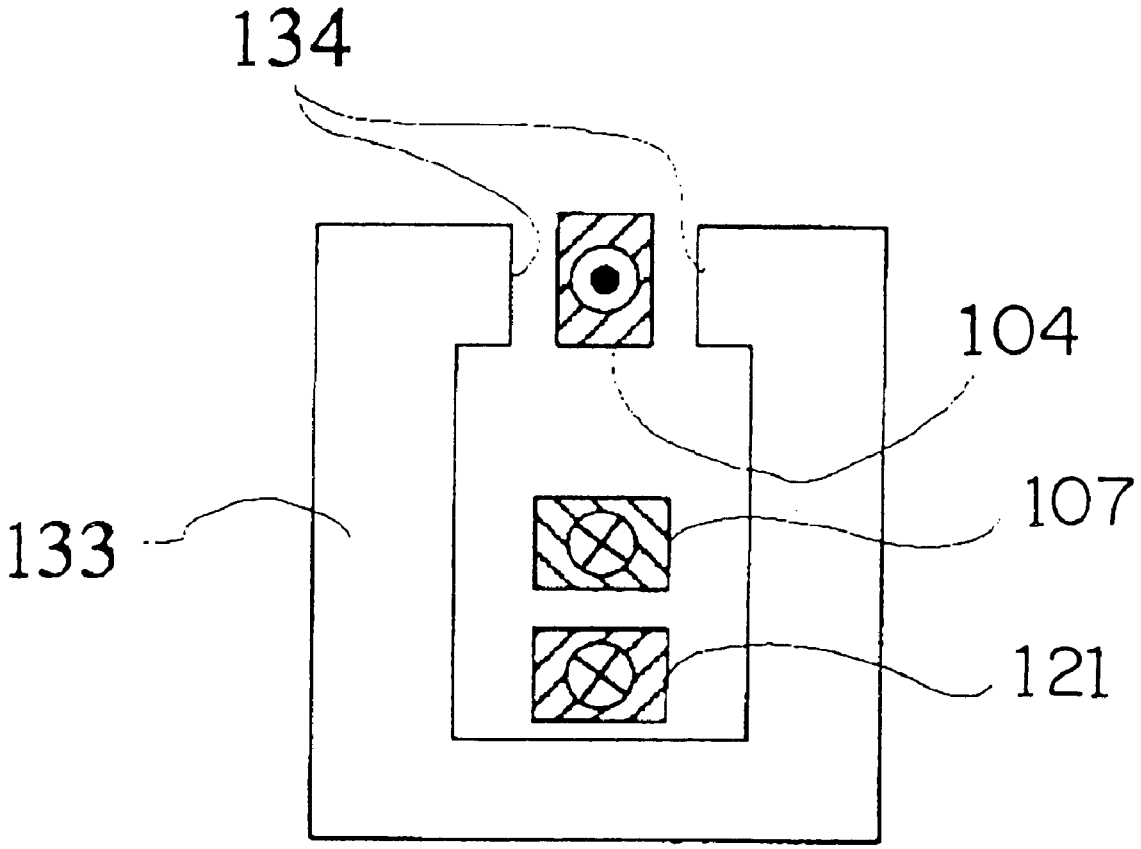
FIG. 90 is a sectional view at the magnetic core portion of FIG. 89.

The thirty-eighth embodiment of the present invention will now be described in conjunction with FIG. 89. FIG. 89 is a perspective view showing the conductor arrangement in closed position and a magnetic core 133 for reinforcing the contact separating electromagnetic force of the circuit interrupter of this embodiment, the cylindrical insulating material, the contact pressure generating means, the arc extinguishing device, the housing and the like are omitted. Although not illustrated, similarly to Embodiment 34, the cylindrical insulating material 108 is disposed to surround the stationary contact 6, the movable contact 102 and the movable arm vertical portion 103 in the closed position, and the arc in the high pressure atmosphere generated between the contacts achieved the current limiting. FIG. 90 is a view showing the core 133 and the section of the movable arm vertical portion 103, the conductor 107 and 121 taken along a plane perpendicular to a plane in which the movable member 101 rotates and to the direction of extension of the stationary conductor 107. As shown in FIGS. 89 and 90, the core 133 is laminated in the direction perpendicular to the conductor 121, arranged to surround the conductor 121 and the stationary conductor 107 and the movable arm horizontal portion 104 in the closed position is received between the projections 134 of the core 133.

With the above structure, the magnetic flux generated by the currents flowing through the conductor 121 and the stationary conductor 107 can be concentrated on the movable arm horizontal portion 104 in the closed position, so that the electromagnetic contact separating force at the initial stage of the fault current interrupting operation is strengthened to improve the contact separating speed. Therefore, the high-pressure atmosphere generated by the vapor of the cylindrical insulating material can be effectively associated with the increase in the arc voltage, improving the current limiting performance. Also, as shown in FIG. 89, when the core 133 is made by stacking thin plates, the eddy currents generated in the core 133 can be reduced, enabling to efficiently concentrate the magnetic flux to the movable arm horizontal portion 104 by the core even at the initial stage of the interrupting operation where the fault current sharply rises.

Embodiment 39

With the core configuration as shown in FIG. 90, when the movable member 101 is rotated by the contact separating operation to move the movable arm outside of the space surrounded by the core 133, the magnetic flux generated by the current flowing through the stationary conductor 7 and the conductor 121 is shielded by the core 133, so that the contact separating electromagnetic force acting on the movable member 101 is reduced because of the use of the core 133.

Figure 91:
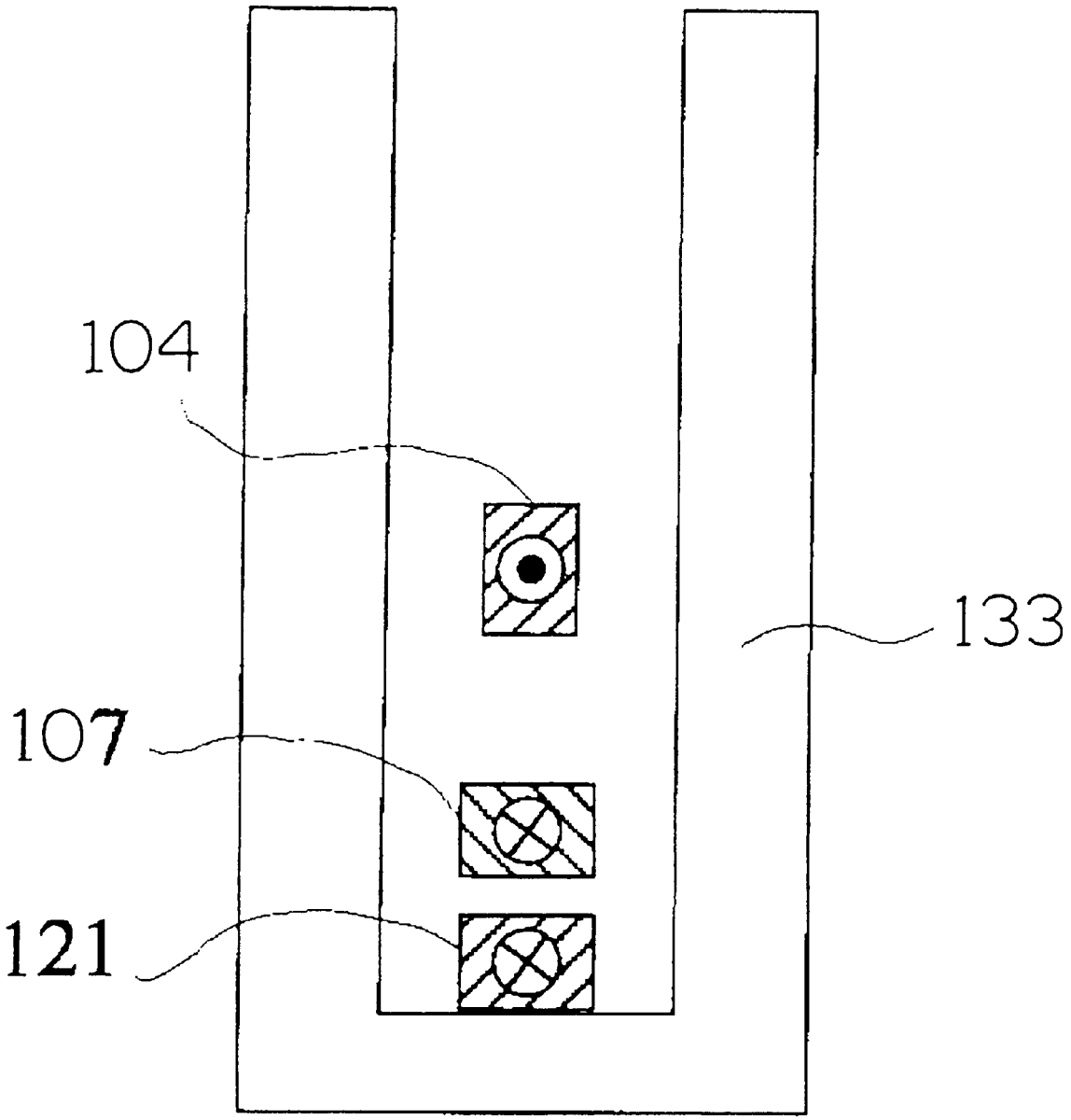
FIG. 91 is a sectional view taken at the magnetic core portion of the circuit interrupter according to the thirty-ninth embodiment.

Accordingly, in this embodiment, as shown in FIG. 91, the U-shaped core configuration having a sufficient height so that the movable arm is positioned within the space surrounded by the core 133 even after the rotary member 101 is rotated is used, so that the electromagnetic contact separating force on the movable member 101 after the rotation of the movable member can be strengthened. Thus, when the arrangement is such that a relatively large electromagnetic contact separating force is provided even after the movable member 101 is in the fully open position, the distance of bounce of the movable member 101 from a stopper (not shown) for determining the fully separated position of the movable member 101 can be decreased, enabling to suppress the decrease of the arc voltage due to the bouncing. While the U-shaped core shown in FIG. 91 is upwardly open, similar effect can be obtained by a downwardly open U-shaped core as sown in FIG. 92 or a fully surrounding core as shown in FIG. 93.

Embodiment 40

Figure 92:
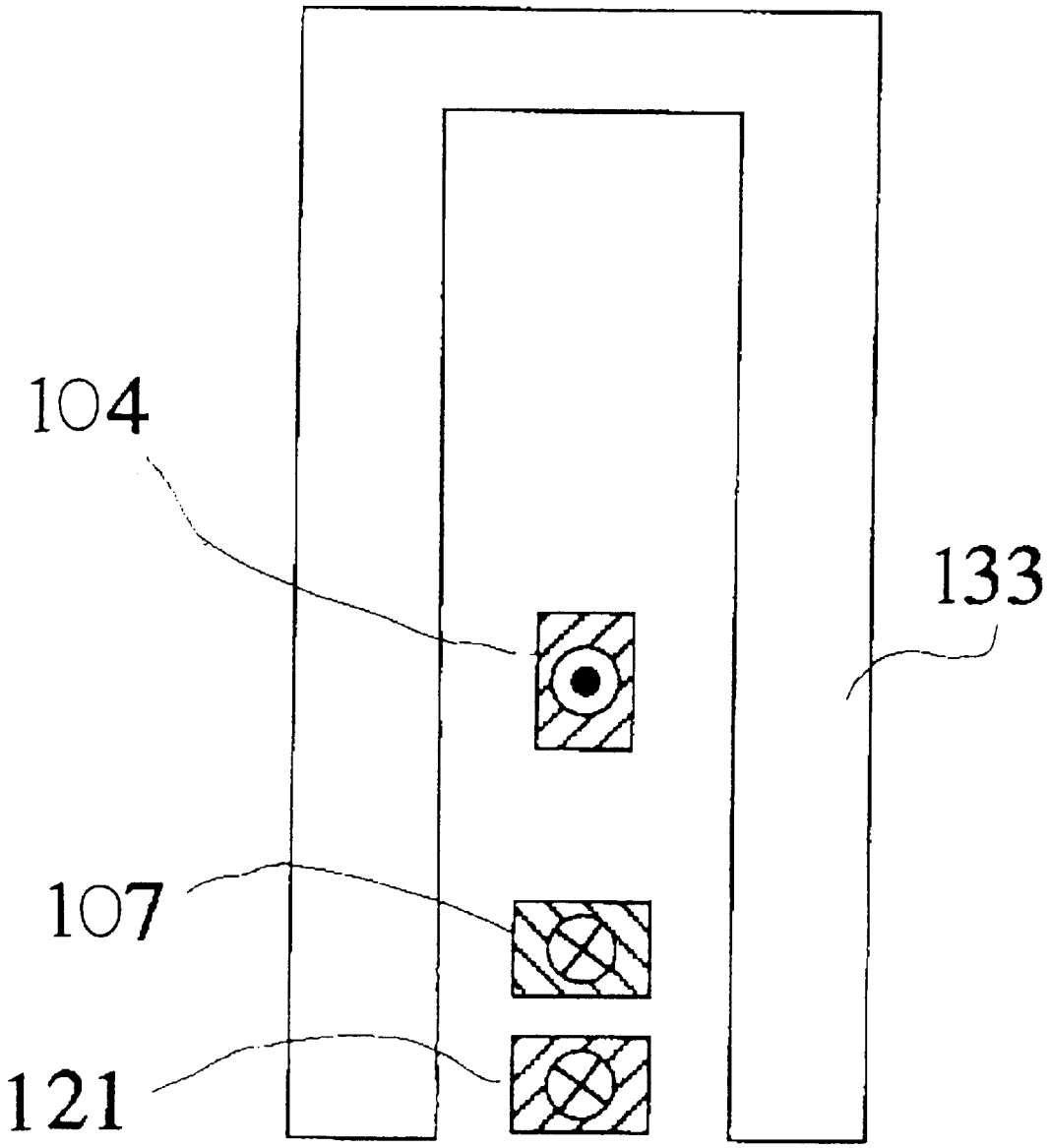
FIG. 92 is a sectional view taken at the magnetic core portion of another circuit interrupter according to the thirty-ninth embodiment.
Figure 93:
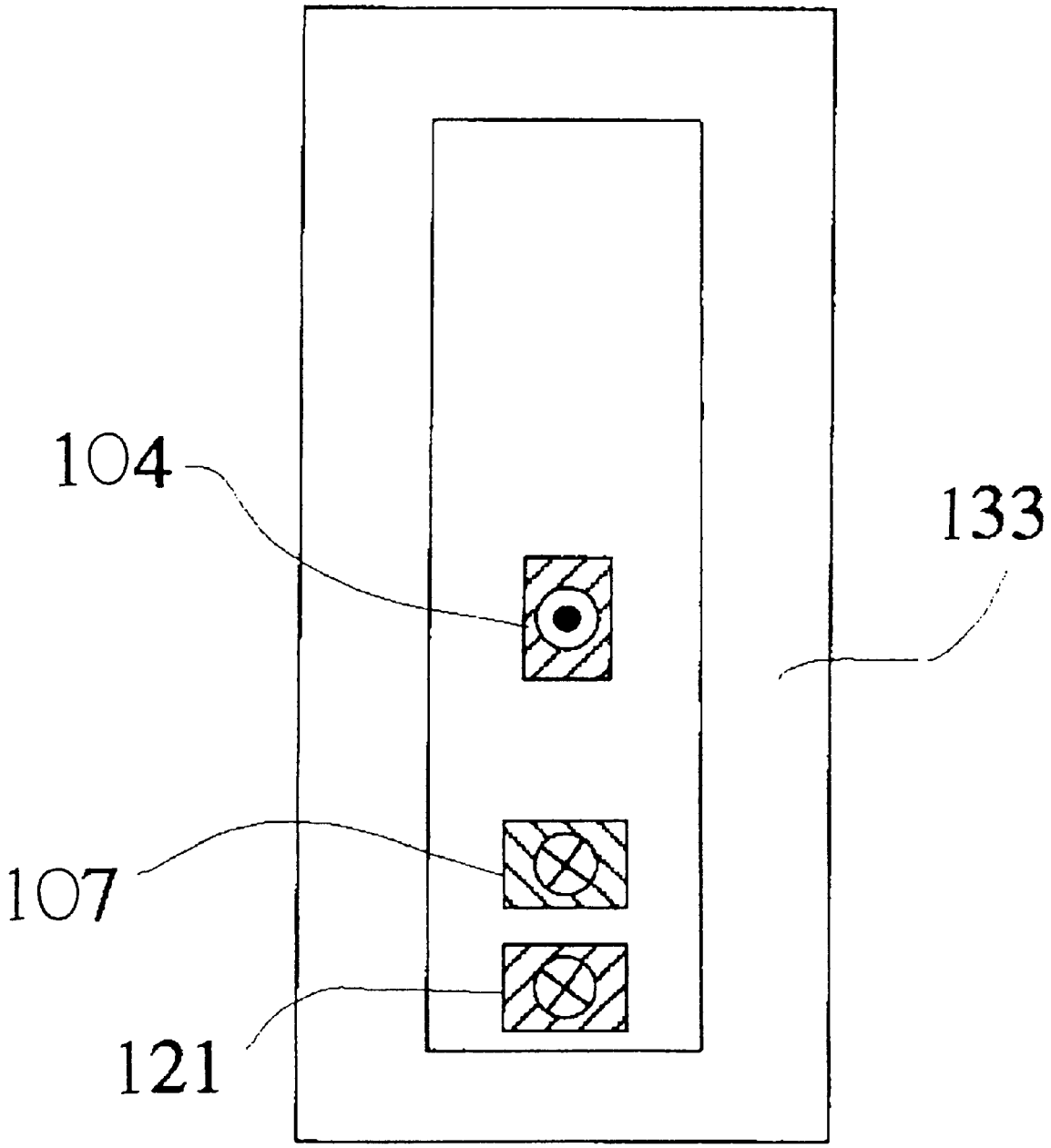
FIG. 93 is a sectional view taken at the magnetic core portion of still another circuit interrupter according to the thirty-ninth embodiment.
Figure 94:
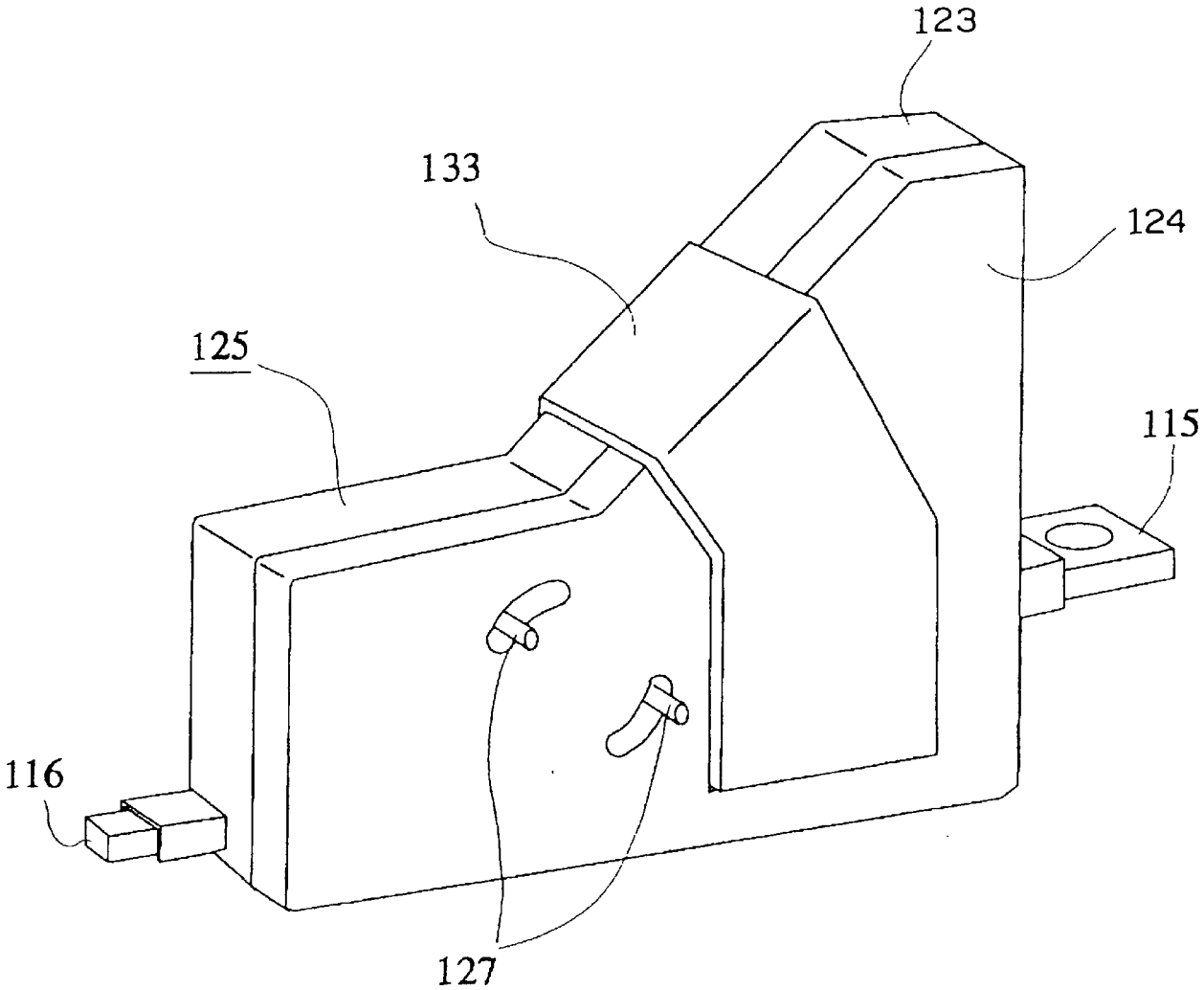
FIG. 94 is a perspective view showing the arc extinguishing unit of the circuit interrupter according to the fortieth embodiment of the present invention.

Also, as shown in FIG. 94, a core 133 having a configuration shown in FIG. 92, for example, may be arranged to sandwich the arc extinguishing unit housing main body 123 and the arc extinguishing unit housing cover 124, whereby the force acting on the housing due to the rise in the housing internal pressure upon the interruption can be received by the core 133, preventing the damages to the housing. Also, the core 133 can achieve the fastening between the arc extinguishing unit housing main body 123 and the arc extinguishing unit housing cover 124, allowing the fastening parts such as screws can be eliminated. Also, the housing serves also to insulate the core inner surface, preventing the arc from touching the core 133. It is to be noted that while the core shown in FIG. 92 is disposed on the upper side of the arc extinguishing unit, the core shown in FIG. 90, 91 or 93 may be arranged to sandwich from the lower side of the arc extinguishing unit or fully surround the housing, and similar effect of preventing the housing damages, eliminating the fastening parts and insulating the core inner surface.

Embodiment 41

The cylindrical space 118 within the cylindrical insulating material 108 shown in the twenty-eighth embodiment and the thirty-fourth embodiment is closed at one side with the stationary member. Therefore, the high temperature gas such as the electrode metal vapor and the molten substances apt to stay within the above space after the fault current interruption. This prevents the insulation recovering and may cause the refiring. Also, when the above molten substances attach to the stationary contact surface, an abnormal temperature increase may be caused at the time of re-closing after the interruption.

Figure 95:
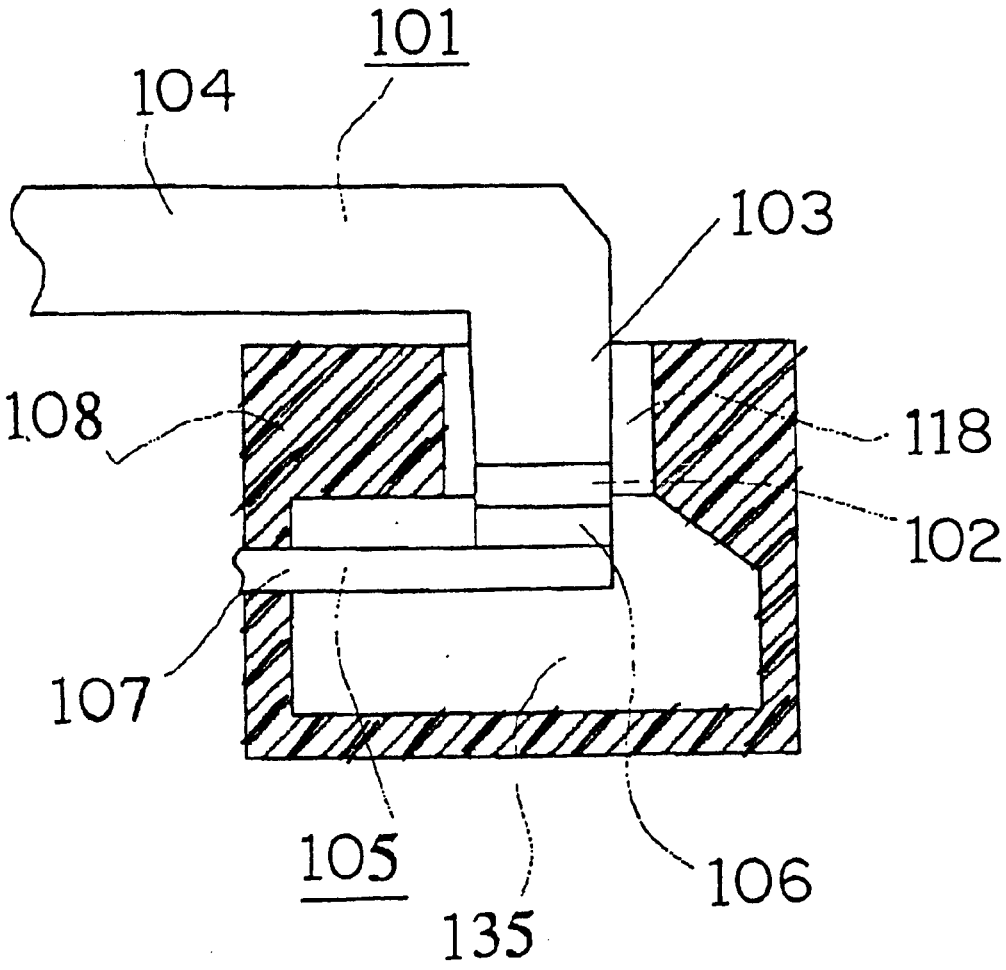
FIG. 95 is a sectional view showing the cylindrical insulator of the circuit interrupter according to the forty-first embodiment of the present invention.
Figure 96:
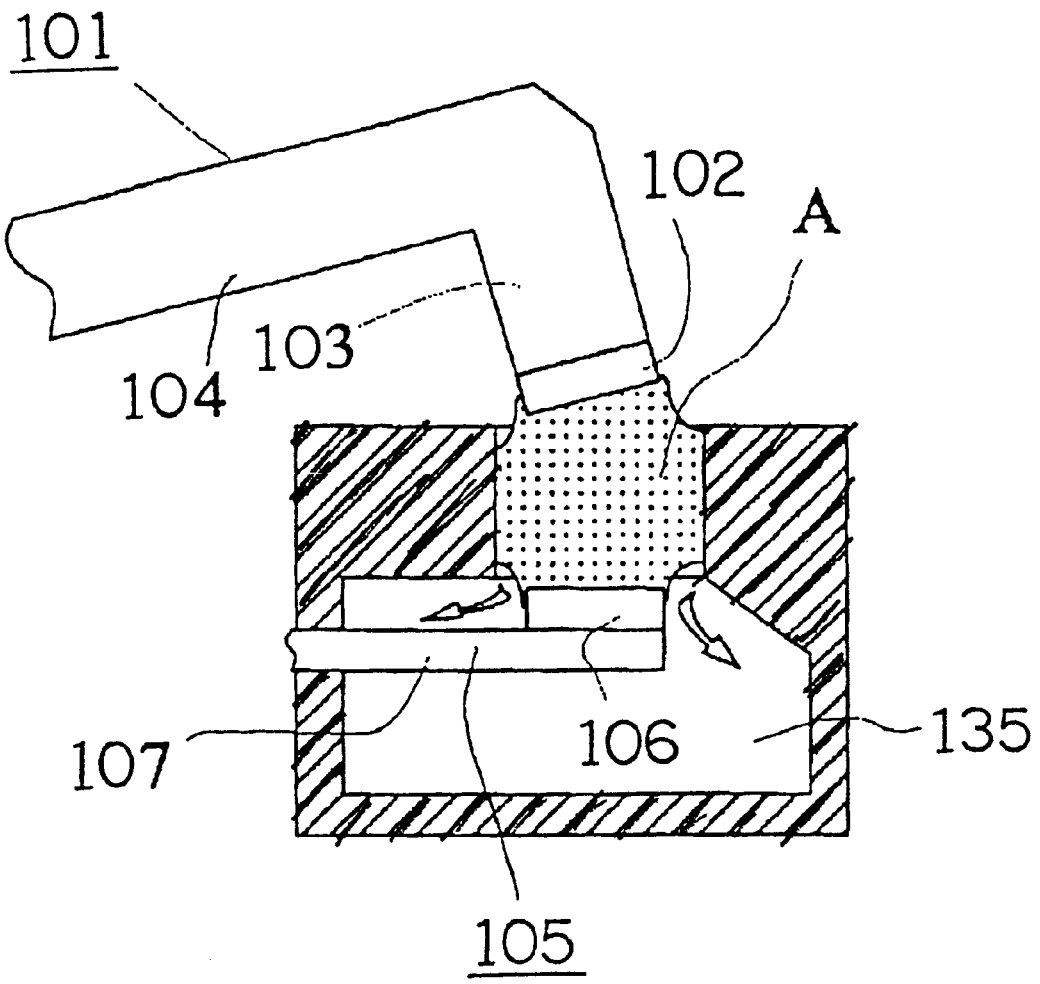
FIG. 96 is a view for explaining the operation of the forty-first embodiment.
Figure 97:
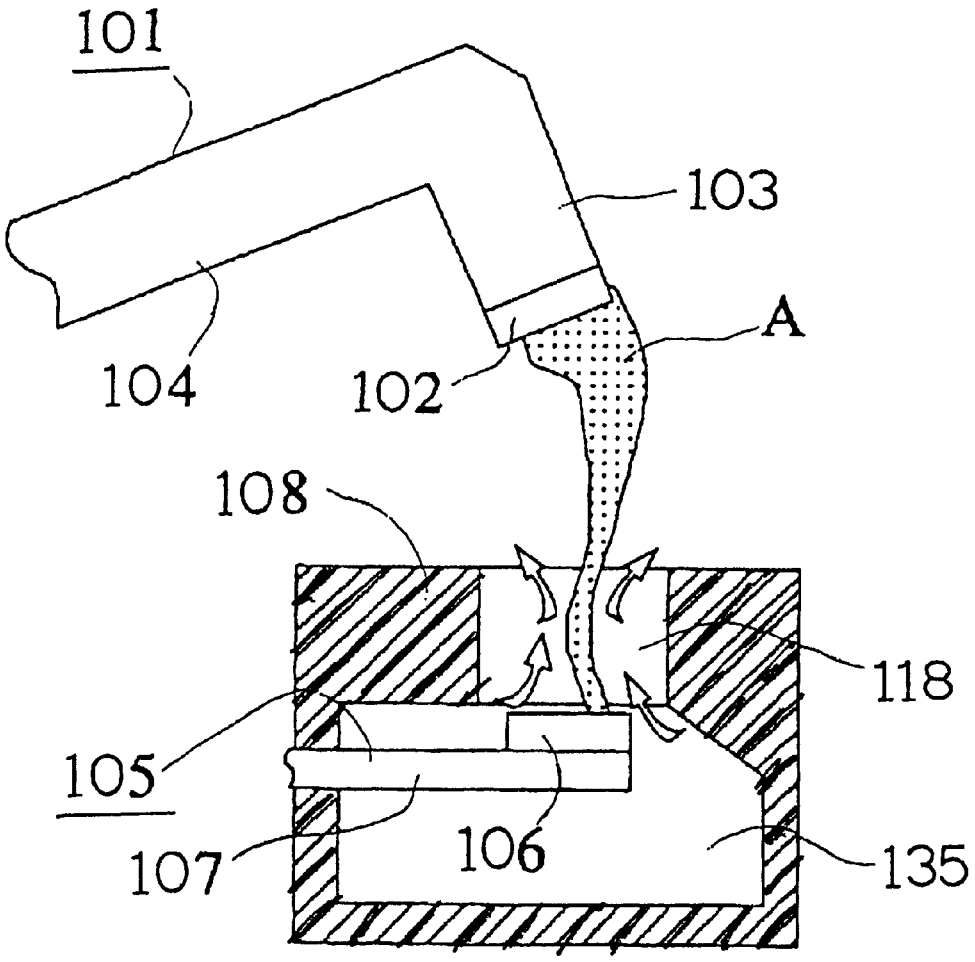
FIG. 97 is a view for explaining the operation of the forty-first embodiment.

FIG. 95 is a view showing a section of the cylindrical insulating material 108 of the forty-first embodiment, one portion of movable contact side of the movable member 101*a*t the closed position and one portion of the stationary contact side of the stationary member 105. The cylindrical insulating material 8 is provided with a pressure accumulating space 135 communicated with the cylindrical space 118. As shown in FIG. 95, with the pressure accumulating space 135 disposed on the side of the stationary contact 106 of the cylindrical insulating material 108, because of the high pressure generated within the pressure accumulation space 135 during the generation of a high current arc generates a flow from the pressure accumulation space 135 to the exterior of the cylindrical insulating material 108 through the cylindrical space 118 at around the time from before the arc extinction to after the current interruption. This phenomenon is illustrated in FIGS. 96 and 97. FIG. 96 illustrates the state in which the pressure is being accumulated within the pressure accumulating space 135 by a large current arc generated upon the interruption. FIG. 97 illustrates the state of immediately before the current interruption, i.e., immediately before the arc extinction, in which white arrows illustrate the flow starting from the pressure accumulation space 135, through the cylindrical space 118, and discharged to the outside. This flow shown by the arrows is at its fastest in the cylindrical space 118 in the shape of a nozzle, this high speed flow removes heat of the arc to promote the arc extinction. Also, this flow causes the previously discussed high temperature gas and the molten substances to be discharged to the outside, so that the insulation in the cylindrical space 118 is quickly recovered and attachment of the molten substances to the surface of the stationary contact can be prevented.

Embodiment 42

Figure 98:
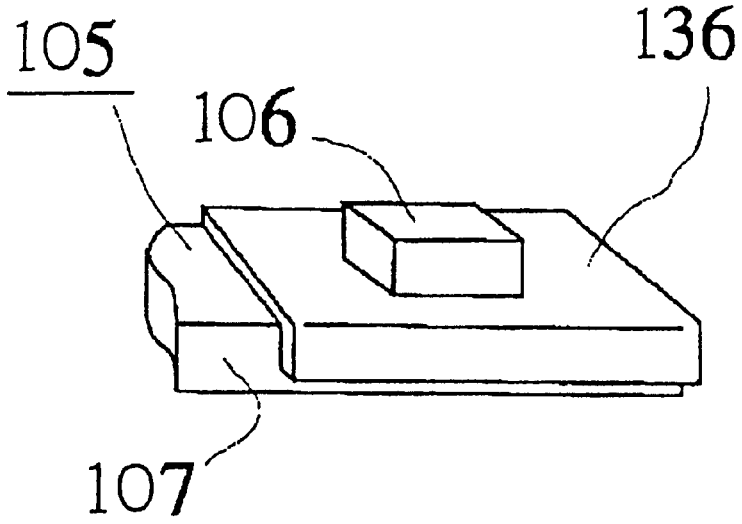
FIG. 98 is a perspective view showing the stationary contact portion of the circuit interrupter according to the forty-second embodiment of the present invention.

FIG. 98 is a respective view of a stationary member 105 of the forty-second embodiment. In this figure, the portion of the stationary conductor 107 around the stationary contact 106 is coated with an insulating material 136. By thus disposing the insulating material 136 around the stationary contact 106, a vapor generates from the insulating material 136 upon a large current arc generation to increase the pressure accumulated within the pressure accumulating space 135, so that the gas flow passing through the cylindrical space 118 during the current interruption becomes strong, increasing the above-discussed functions of the arc extinction, the insulation recovery and the prevention of attachment of molten substances to the stationary contact surface.

Embodiment 43

Figure 99:
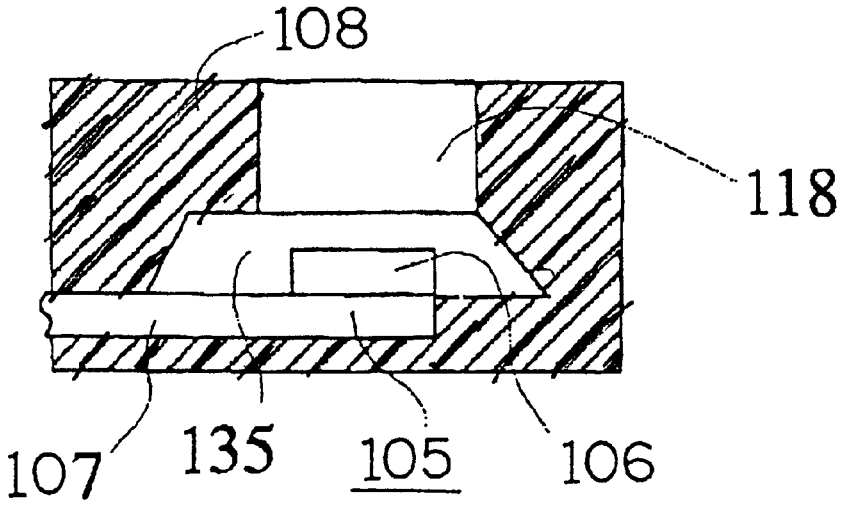
FIG. 99 is a sectional view showing the cylindrical insulator of the circuit interrupter according to the forty-third embodiment of the present invention.

FIG. 99 is a sectional view of a portion of the stationary member 105 of the forty-third embodiment of the present invention. In this figure, differing from the embodiment shown in FIG. 95, the pressure accumulating space 135 is disposed around the stationary contact 6 and not on the surface of the stationary member 105 opposite to the stationary contact. With such the arrangement, similar effects as those of Embodiment shown in FIG. 95 can be obtained and the assembly becomes easy.

Embodiment 44

Since the stationary members shown in connection with Embodiments 28 and 34 are not provided with a component such as an arc runner to which the arc spot on the stationary member side can be transferred, the arc spot on the stationary member side always stays on the stationary contact. Therefore, the arc is difficult to contact with the arc extinguishing plates even at the latter half of the interruption, not effectively utilizing the arc cooling effect of the arc extinguishing plates, whereby the internal pressure within the arc extinguishing unit housing increases due to the arc heat, thus generating the housing cracks.

Figure 100:
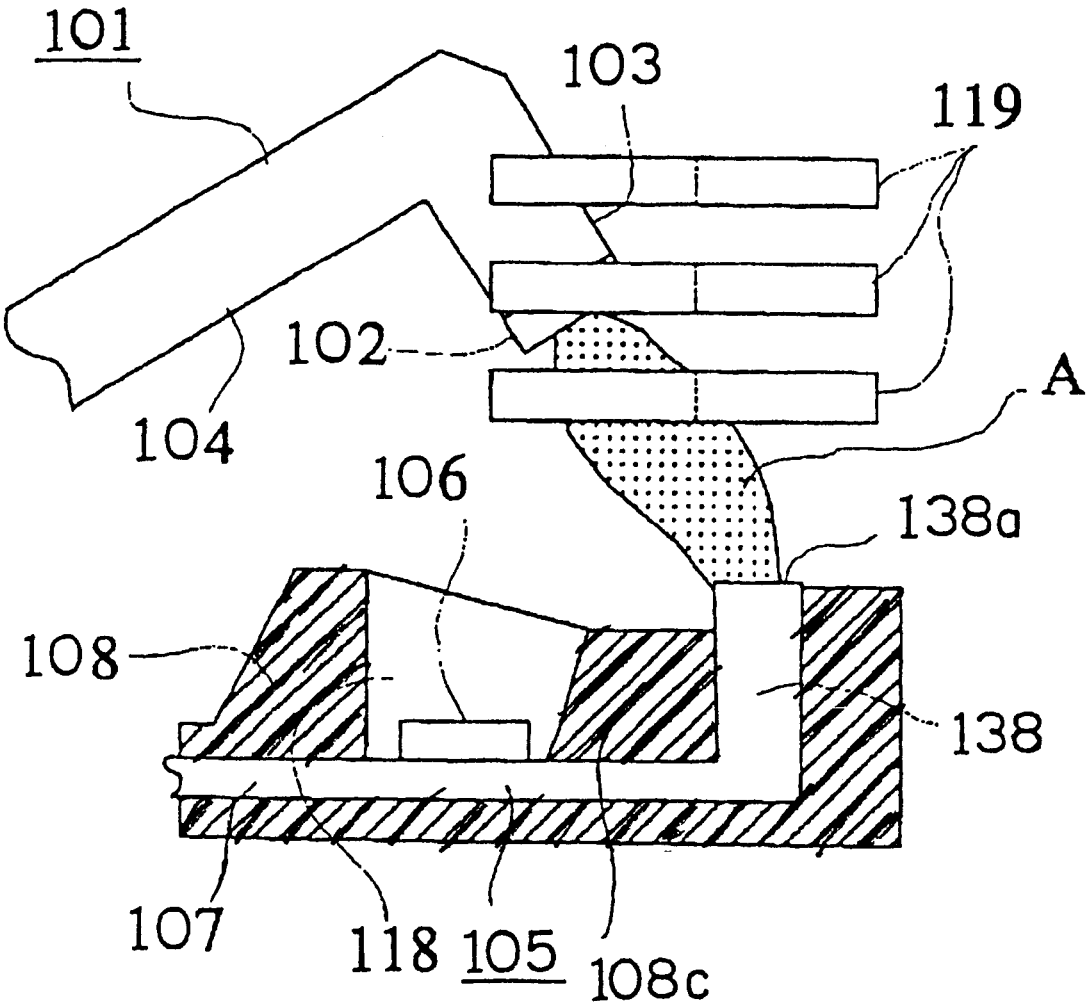
FIG. 100 is a fragmental sectional view showing the main portion of the circuit interrupter according to the forty-fourth embodiment of the present invention.

Therefore, in the forty-fourth embodiment, an arc runner 138 electrically connected to the end portion of the stationary member 105 on the stationary contact side is provided as shown in FIG. 100, and the tip portion 138*a* of the arc runner 138 opposite to the connected end to the stationary member 105 is exposed from the cylindrical insulating material 108 at the position closer to the arc extinguishing plates 119 than the stationary contact 106. With such the arc runner 138, after the movable contact 102 is rotated outside of the space 118 surrounded by the cylindrical insulating material 108 upon the interruption, the arc spot on the stationary member side is transferred to the tip portion 138*a* of the arc runner 138 as shown in FIG. 42, the arc can be effectively brought into contact with the arc extinguishing plates 119. This causes the arc to be cooled by the arc extinguishing plates 119 to decrease the temperature, suppressing the internal pressure increase in the arc extinguishing unit housing. This suppression of the internal pressure allows the required housing strength to be decreased to reduce the cost.

Embodiment 45

In the embodiment illustrated in FIG. 100, the height of the cylindrical insulating material 108 between the cylindrical space 118 and the arc runner tip portion 138*a* is arranged to be lower than the arc runner tip portion 138*a*. With such the arrangement, one portion of the current, which was flowing between the stationary contact 106 and the movable contact 102 at the instance that the movable contact 102 comes out of the cylindrical space 118, begins to be shunt and flow between the arc runner tip portion 138*a* and the movable contact 102, decreasing the arc voltage. When this decrease in the arc voltage occurs before the current peak, the current peak significantly increases and the current limiting performance is significantly decreased. Also, the above shunt current state is changed into a transferred state in which the current flows only between the arc runner tip portion 138*a* and the movable contact 102, the arc spot on the stationary member side is moved to outside of the cylindrical space 118 surrounded by the insulating material, so that the arc voltage is decreased when there is an arc between the stationary contact 106 and the movable contact 102, making the interrupting time long and the passing energy high.

Figure 101:
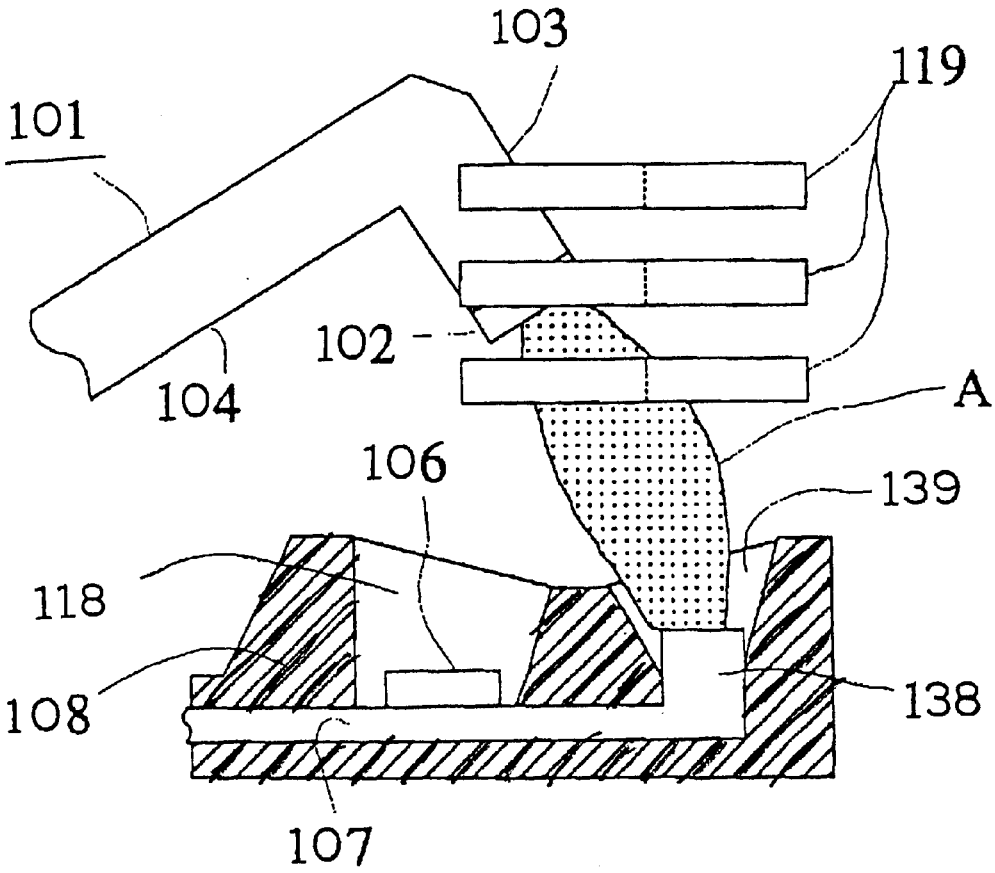
FIG. 101 is a fragmental sectional view showing the main portion of the circuit interrupter according to the forty-fifth embodiment of the present invention.

Therefore, according to the forty-fifth embodiment, as shown in FIG. 101, the arc runner tip portion 138*a* is made lower than the height of the cylindrical insulating material 108 and the insulating material around the arc runner tip portion 138*a* is arranged to be funnel-shaped. With such the arrangement, even when the movable member 101 rotates and the movable contact 102 comes out of the cylindrical space 118, the shunt current state does not immediately starts and the arc voltage increase employing the high pressure atmosphere can be effectively utilized, enabling to suppress the current peak. Also, after the arc has been transferred to the arc runner 138, since the arc runner tip portion 138*a* is positioned within the arc runner cylindrical space 139 surrounded by the funnel-shaped insulating material, no arc voltage decrease occurs, shortening the interrupting time leading to the decrease in the passing energy.

Embodiment 46

Figure 102:
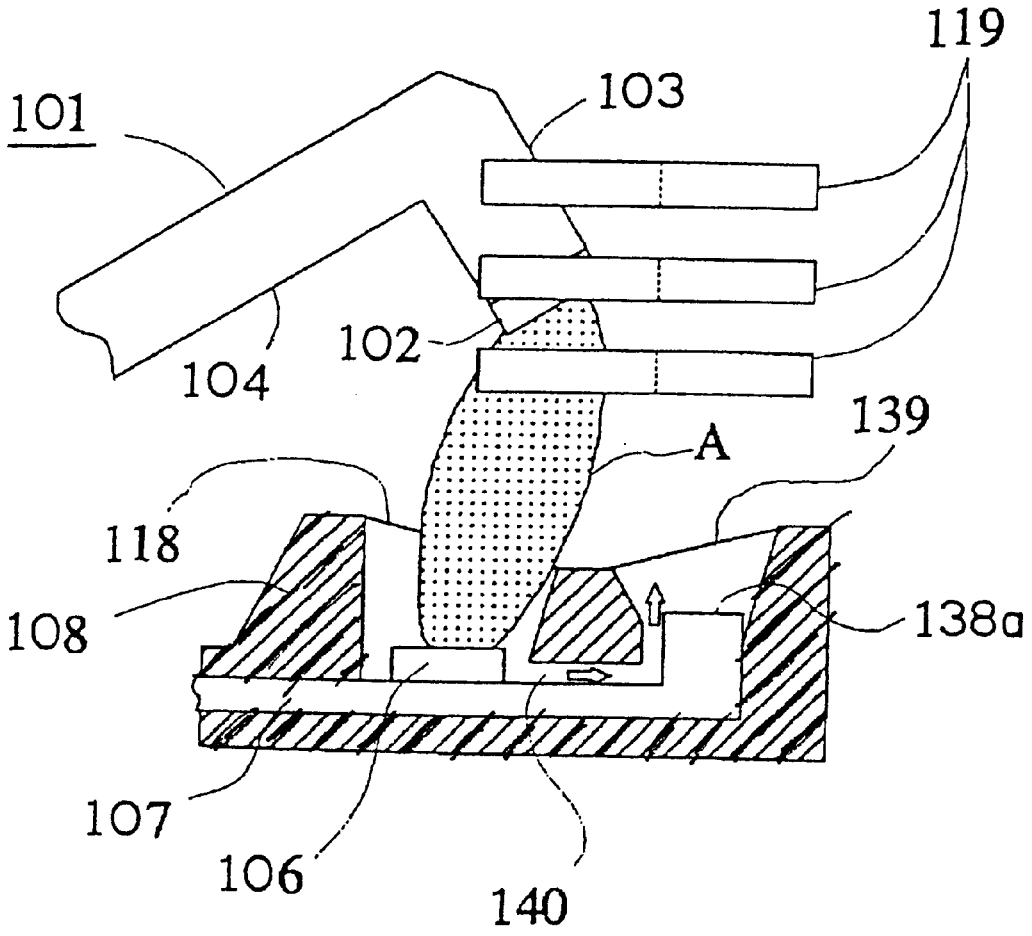
FIG. 102 is a fragmental sectional view showing the main portion of the circuit interrupter according to the forty-sixth embodiment of the present invention.

FIG. 102 illustrates the forty-sixth embodiment. In this embodiment, the cylindrical space 118 in which the stationary contact 106 is disposed and the funnel-shaped arc runner cylindrical space 139 in which the arc runner tip portion 138*a* is disposed are communicated with each other by a conduit 140 of a relatively small cross-sectional area. With this arrangement, one portion of the hot gas generated within the cylindrical space 118 upon the current interruption flows through the conduit 140 and fills the arc runner cylindrical space 139 surrounding the arc runner tip portion 138*a*. Upon the interruption of a large current such as a short circuiting current, a large amount of hot gas is generated and fills the arc extinguishing unit housing, so that the effect of the hot gas arrived at the space 139 through the conduit 140 does not significantly appear. Therefore a similar characteristics as that of the Embodiment 45. However, upon the interruption of a relatively small current such as an overload current or the like, a large amount of hot gas sufficient to fill the arc extinguishing unit housing is not generated. Therefore, the hot gas arrived at the arc runner cylindrical space 139 through the conduit 140 provides a high conduction state at around the arc runner tip portion 138*a* higher than the other portion, whereby the arc transfer to the arc runner 138 is more promoted as compared to the case where no conduit 140 is provided. Therefore, the arc is transferred to the arc runner 138 at an early period of time after the initiation of the interrupting operation to be cooled and splitted at the arc extinguishing plates 119, whereby the interrupting time is shortened and the wear of the stationary contact 106 can be reduced.

Embodiment 47

Figure 103:
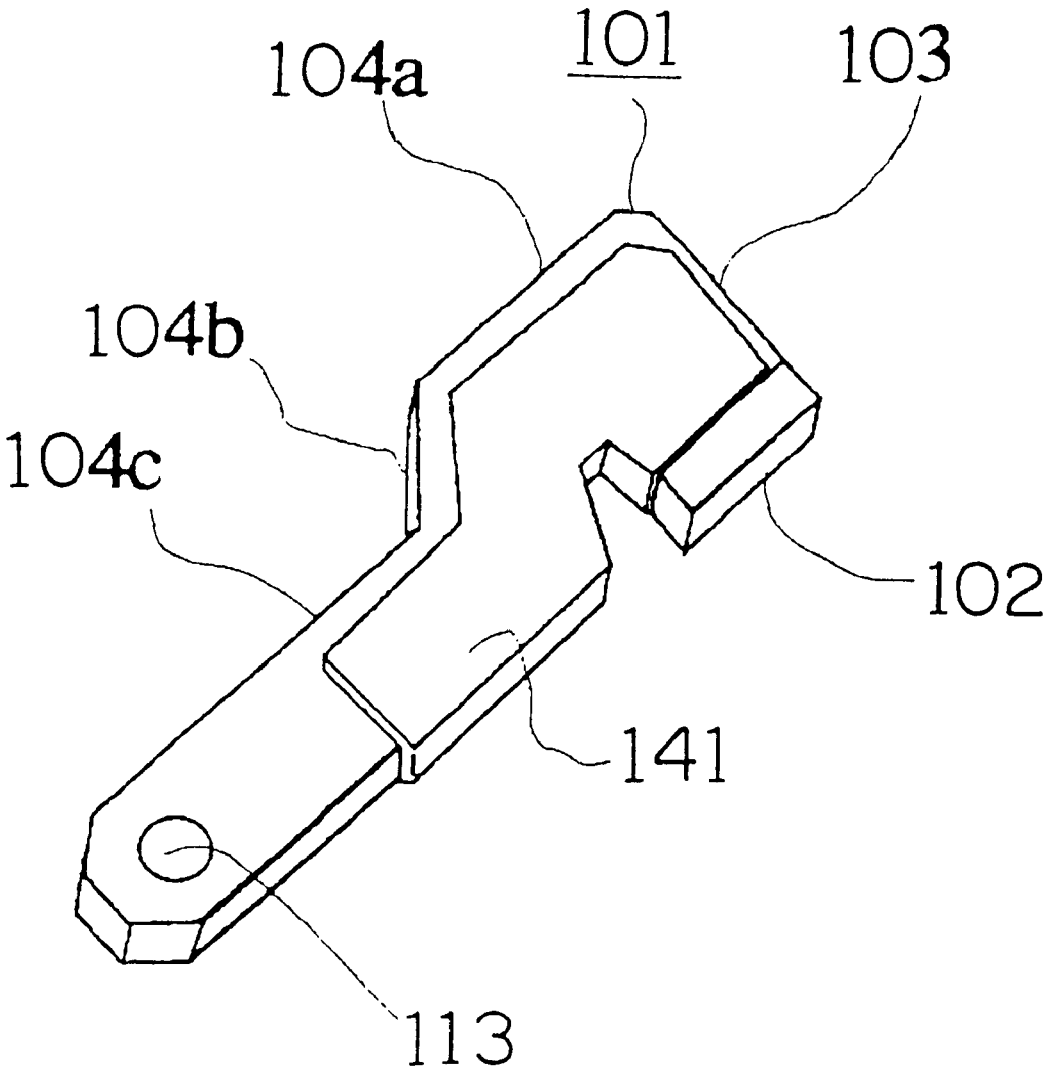
FIG. 103 is a perspective view showing the movable member of the circuit interrupter according to the forty-seventh embodiment of the present invention.

The forty-seventh embodiment of the present invention will now be described in conjunction with FIG. 103. FIG. 103 is a perspective view showing the movable member 101 of this embodiment, and the movable member 101 is composed of the movable contact 102, the movable arm vertical portion 103, the movable arm horizontal portions 104*a*, 104*b* and 104*c*, as well as an insulating material 141 coated on the surfaces of the movable arm on the stationary contact side and is configured into a substantially hook shape. Thus, by making the movable member 101 hook-shaped, the distance between the stationary conductor 107 in the closed position and the movable arm horizontal portion 104 can be made shorter.

Figure 105:
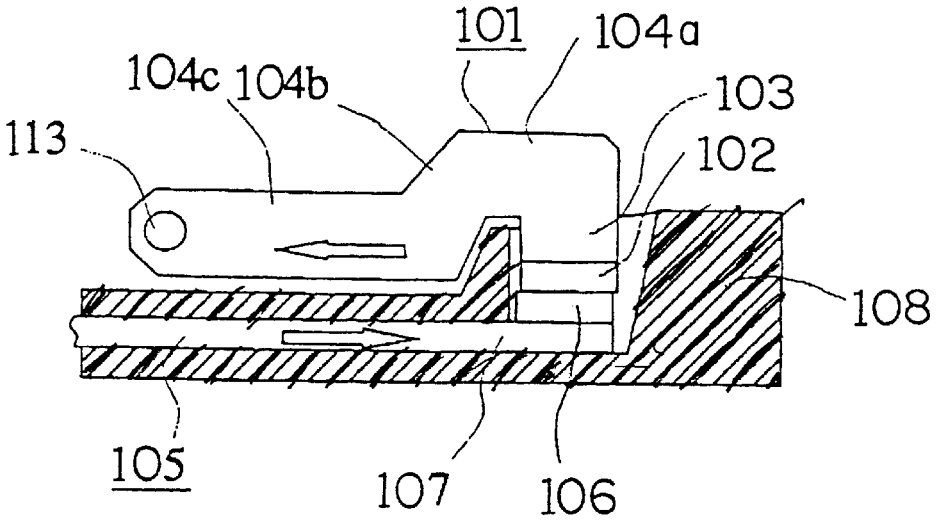
FIG. 105 is a fragmental sectional view showing the positional relationship of the movable member and the stationary member according to the fourth-seventh embodiment.

FIG. 105 is a view illustrating the movable member 101, the stationary member 105 and the cylindrical insulating material 108 of this embodiment, in which the flows of current is illustrated by arrows. As understood from this figure, the opposite currents flowing through the stationary conductor 107 and the movable arm horizontal portion 104*c* are closer to each other than where the L-shaped movable member shown in FIG. 1, increasing the electromagnetic repulsive force and improving the contact separating velocity.

Figure 104:
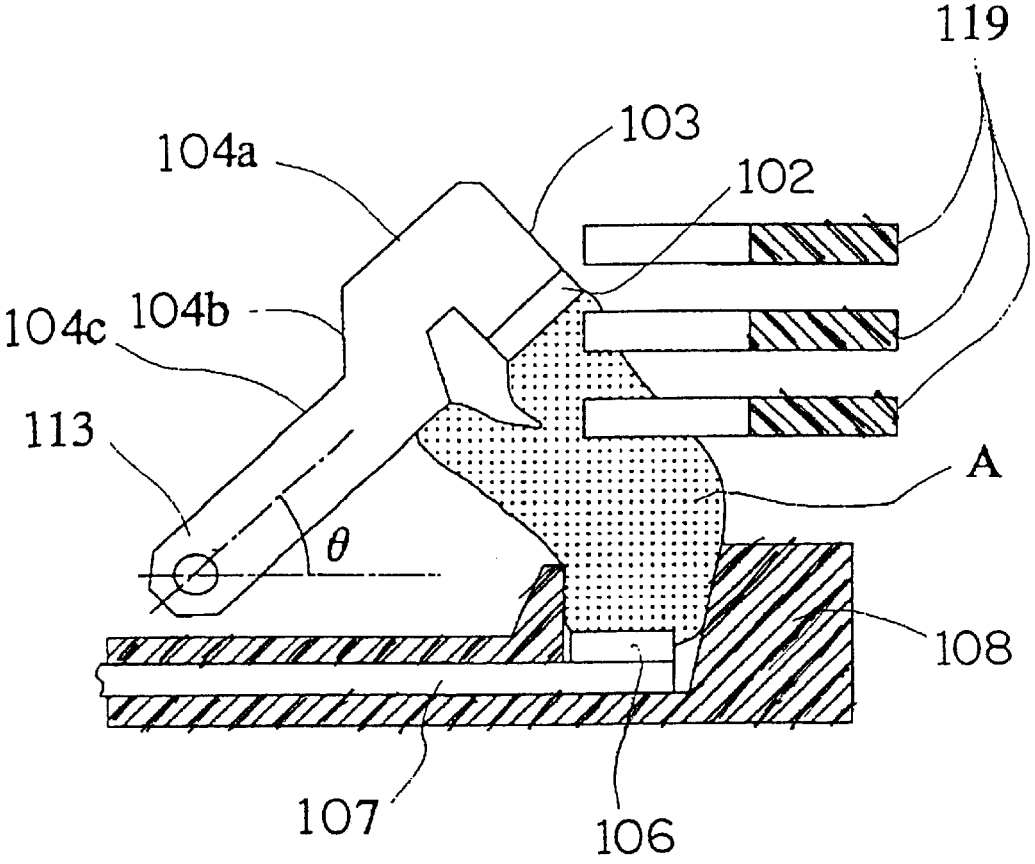
FIG. 104 is a view for explaining the operation of the forty-seventh embodiment.

However, as shown in FIG. 104, when the rotation angle θ of the movable member 101 is large, the hook-shaped movable member 101 increases the possibility that the arc is brought into contact with the movable arc horizontal portion and that the current is shunted. When the arc is brought into contact with the movable arm, the movable arm melts and becomes narrower, whereby the movable arm cannot maintain a mechanical strength required for withstanding the opening and closing of the contacts and also the arc voltage during the latter half of the interruption decreases to deteriorate the current limiting performance. Therefore, the surfaces of the movable arm that can be "seen" at least from the stationary contact 106 in the closed position and on the side of the movable member rotary shaft should be coated with an insulating material 141. The shunting to such the movable arm may be generated even with the substantially L-shaped movable member shown in the twenty-eighth embodiment when the rotational angle θ of the movable member 101 is increased, necessitating the above-described insulation of the movable arm.

Embodiment 48

Figure 106:
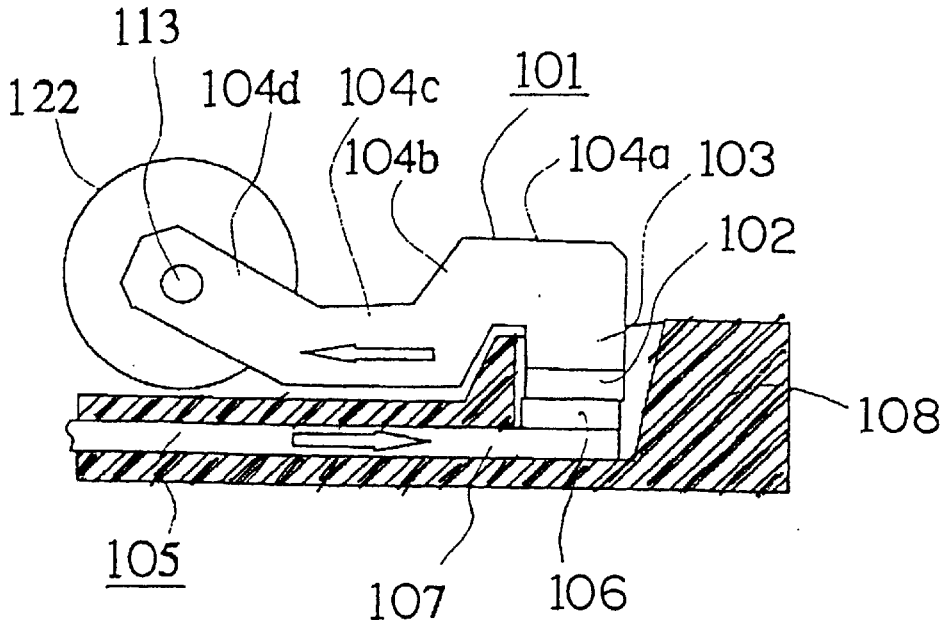
FIG. 106 is a sectional view showing the movable member, the stationary member and the cylindrical insulator of the circuit interrupter according to the forty-eighth embodiment of the present invention.

FIG. 106 illustrates the forty-eighth embodiment of the present invention. Usually, the rotational center of the movable member 101 is supported by a component for transmitting the open and closing operation of the linkage portion such as a rotor 122. Therefore, the distance between stationary member 105 and the movable member rotary shaft 113 cannot be made smaller than a certain value. Therefore, as shown in FIG. 106, by making the configuration of the movable member 101 substantially S-shaped to have one more additional bent portion as compared to the substantially hook-shaped movable member shown in FIG. 103, the movable member rotary shaft 113 can be held by the rotor 122 without increasing the distance between the movable arm horizontal portion 104*c* and the stationary conductor 107, so that a large electromagnetic force can be obtained even when the rotary shaft 113 is farther than the stationary conductor 107.

Embodiment 49

Figure 107:
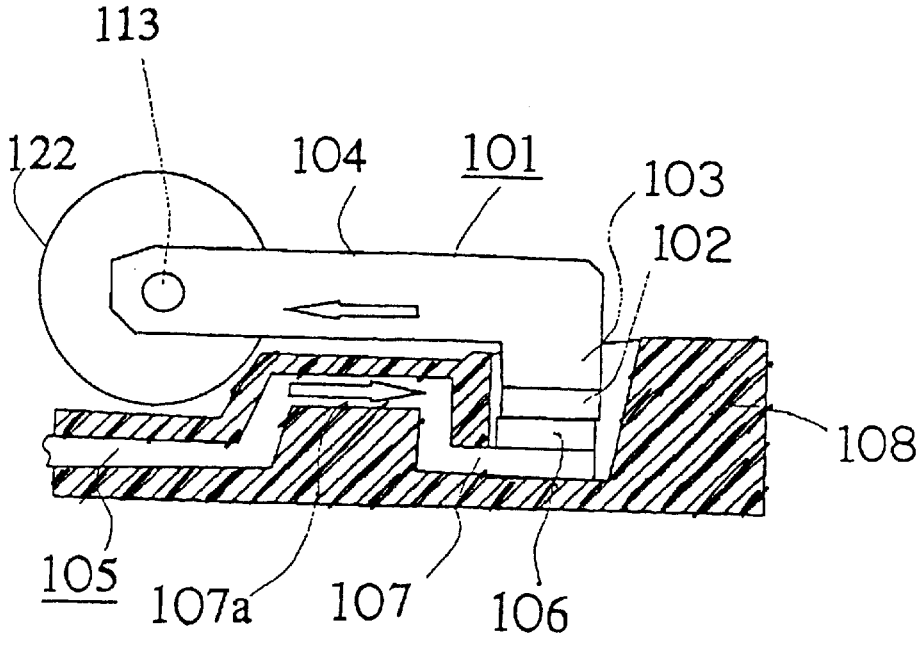
FIG. 107 is a sectional view showing the movable member, the stationary member and the cylindrical insulator of the circuit interrupter according to the forty-ninth embodiment of the present invention.

FIG. 107 illustrates the forty-ninth embodiment of the present invention. In the figure, there are illustrated the substantially L-shaped movable member 101 in the closed position and the stationary member 105 in which a portion of the stationary conductor 107 opposite to the movable arm horizontal portion 104 is bent to become close to the movable arm horizontal portion 104. By positioning the stationary conductor 107 closed to the movable arm, a similar effect to that in Embodiment 48 can be obtained. Further, in this embodiment, the movable member 101 is substantially L-shaped, so that the moment of inertia can be made smaller than that in the substantially hook-shaped movable member or the substantially S-shaped movable member shown in connection with Embodiment 47 or 48, enabling a faster contact opening.

Embodiment 50

As discussed in the description of Embodiment 37, the embodiment shown in FIG. 76 uses the substantially L-shaped movable member configuration, so that the arc spot on the movable member side is difficult to be transferred to the end surface of the arc extinguishing plate side of the movable member 101 and is difficult to be brought into contact with the arc extinguishing plates 119 even at the latter half of the interruption operation. Therefore, the arc cooling effect of the arc extinguishing plates cannot be effectively utilized, increasing the internal pressure of the arc extinguishing unit housing because of the arc heat, making it easy to generate cracks of the housing. In order to prevent this, it is necessary to bring the arc into contact with the arc extinguishing plates to cool it and rapidly extinguish.

Figure 108:
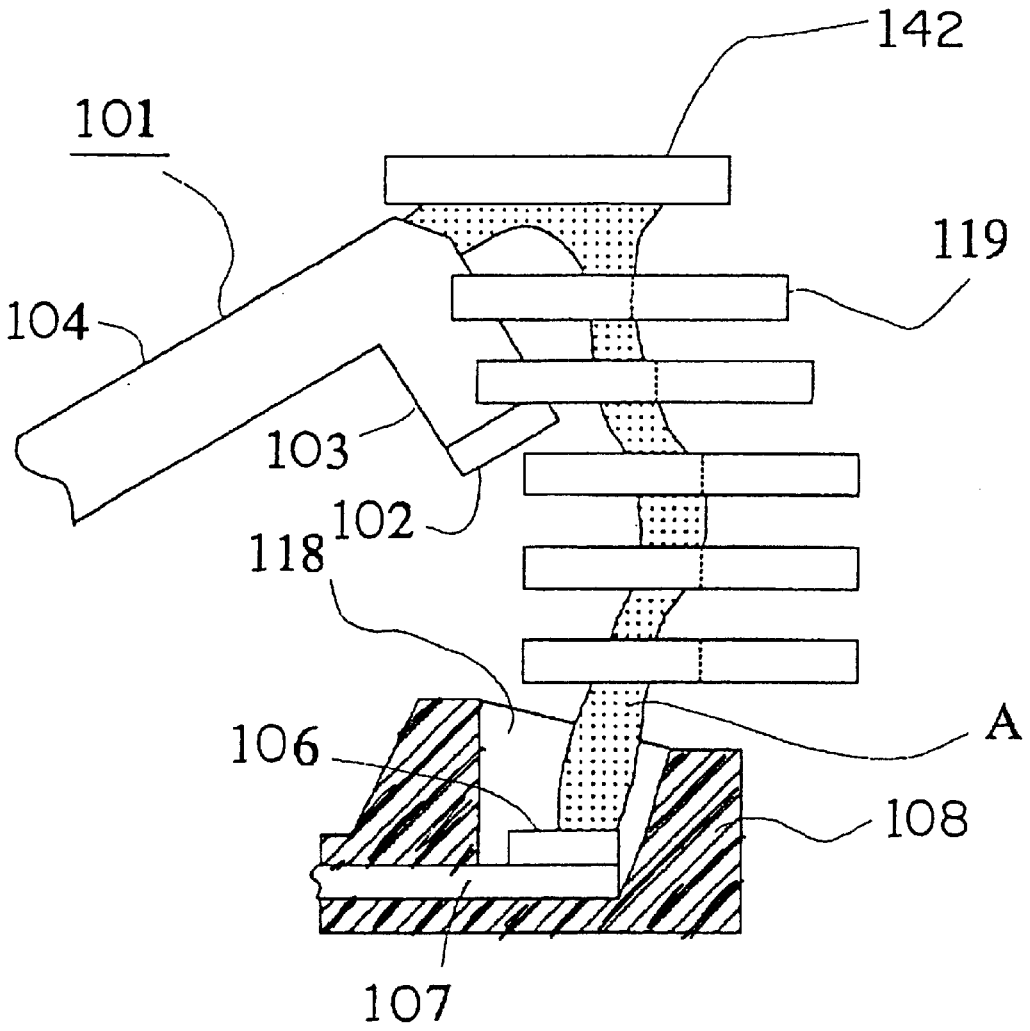
FIG. 108 is a fragmental sectional view of the main portion of the circuit interrupter according to the fiftieth embodiment of the present invention.
Figure 109:
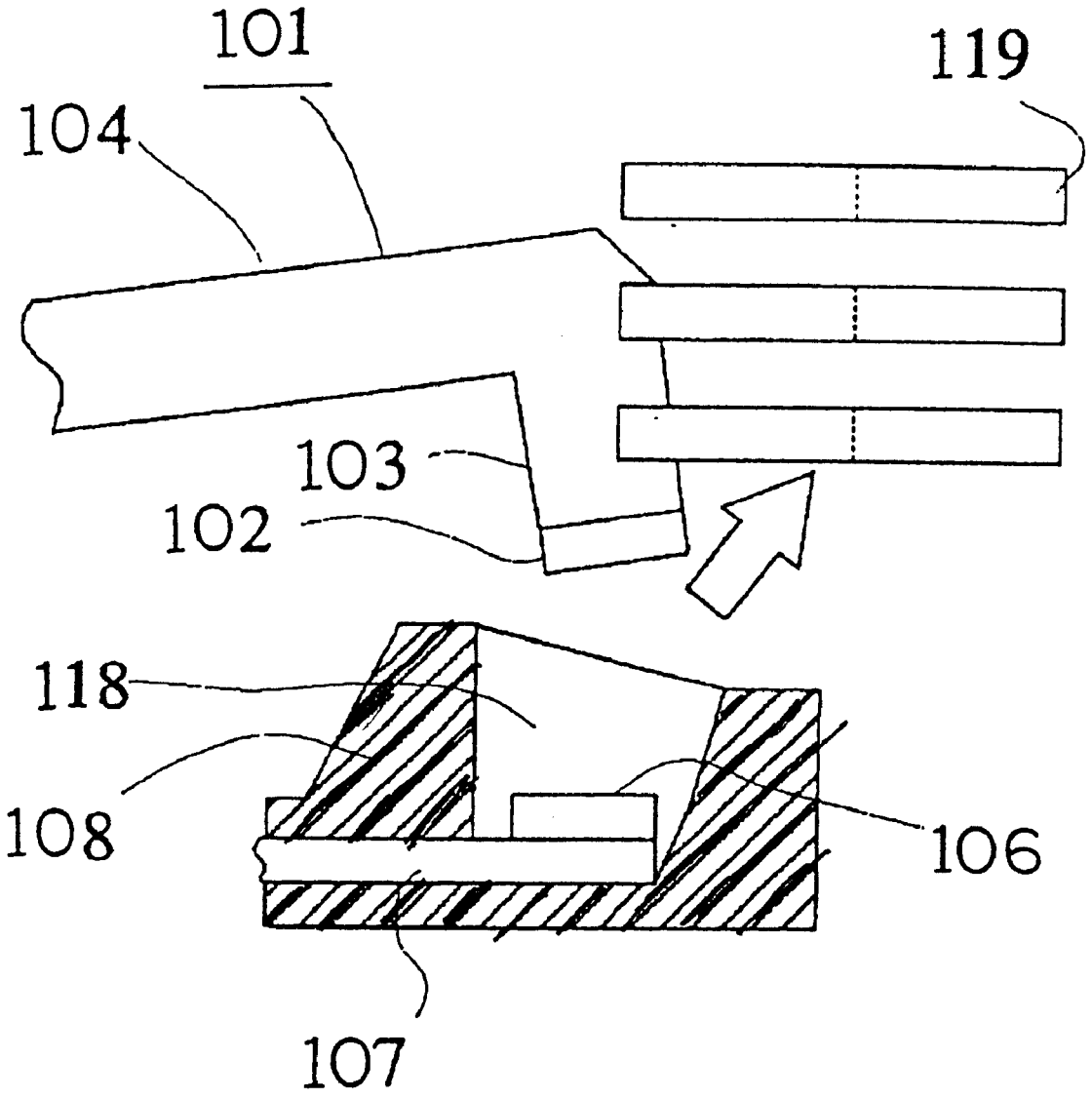
FIG. 109 is a fragmental sectional view for explaining the operation of the cylindrical space of the fiftieth embodiment of the present invention.
Figure 110:
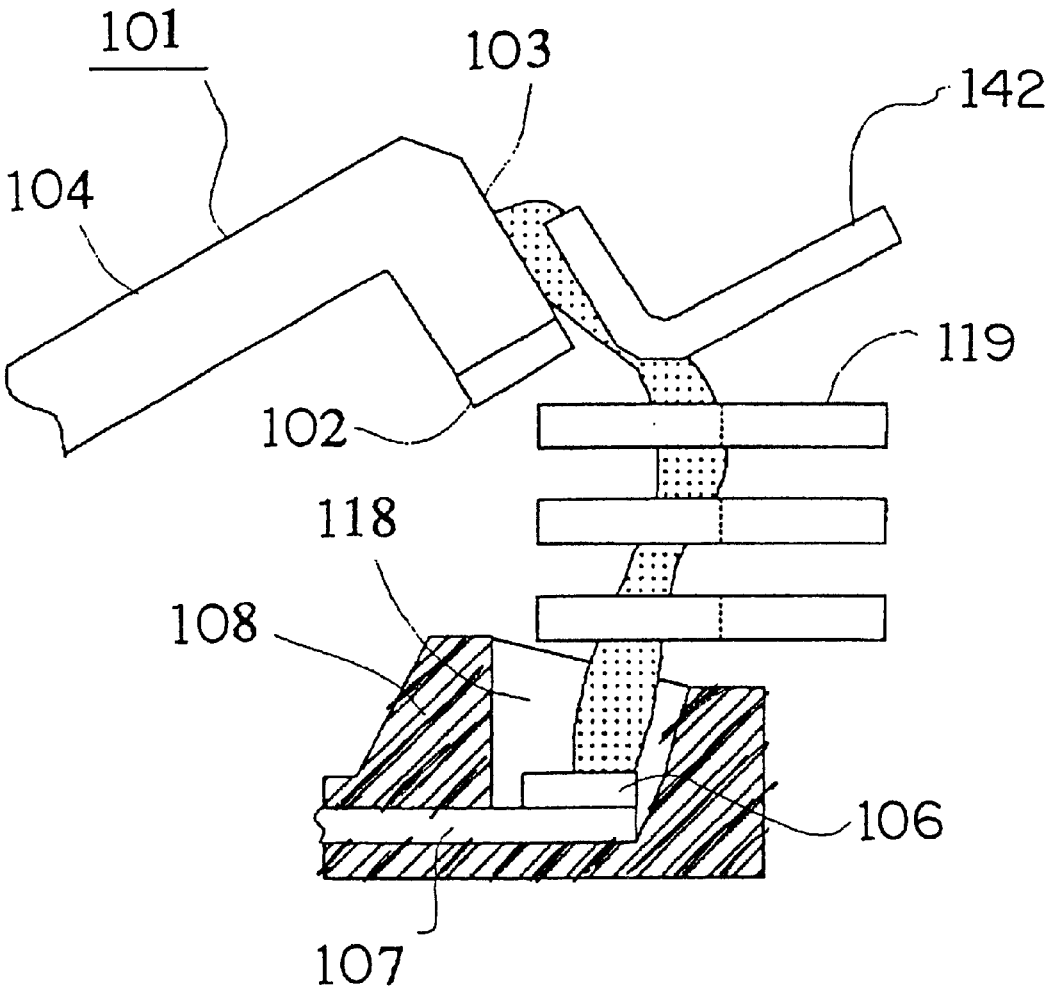
FIG. 110 is a fragmental sectional view showing the main portion of the circuit interrupter according to the fiftieth embodiment of the present invention.

In the embodiment shown in FIG. 108, the height of the wall of the cylindrical insulating material 108 surrounding the cylindrical space 118 on the side opposite to the movable member rotational center is made lower than the wall height on the side of the movable member rotary center. i.e., the upper end of the cylindrical space 118 is directed toward the arc extinguishing plates 119. With such the arrangement, as shown in FIG. 109, immediately after the movable contact 102 comes out of the cylindrical space 118 upon the interruption, a flow of the hot gas as shown by the arrows in the figure is generated from the cylindrical space 118 toward the arc extinguishing plates 119, making it easy for the arc to be brought into contact with the arc extinguishing plates 119, whereby the arc can be quickly cooled and extinguished.

Although the plate-like opposing electrodes 142 are used in FIG. 108, the opposing electrodes 142 of the L-shape disposed to face at one leg portion to the end surface of the movable member on the side of the arc extinguishing plates can be equally employed to cause transfer of the arc spot to the end surface of the L-shaped movable member on the arc extinguishing plate side.

Embodiment 51

While the arc is brought into contact with the arc extinguishing plates through the use of the opposing electrode in above Embodiment 50, the center position M2 of the notched portions of the horse-shoe shaped arc extinguishing plates 119 may be positioned closer to the movable member rotary center than the end surface position Ml of the cylindrical insulating material 108 surrounding the cylindrical space 118 opposite to the movable member rotary center, enabling the arc to be brought into contact with the arc extinguishing plates 119 without the need for using the opposing electrode. However, the position M2 of the above notched portion should be between the locus of the tip portion of the movable member depicted by the dot-and-dash line and the above position M1 because the arc extinguishing plates 119 interfere with the rotation of the movable member 101 when the notched portion position M2 intersects with the above dot-and-dash line.

Figure 111A:
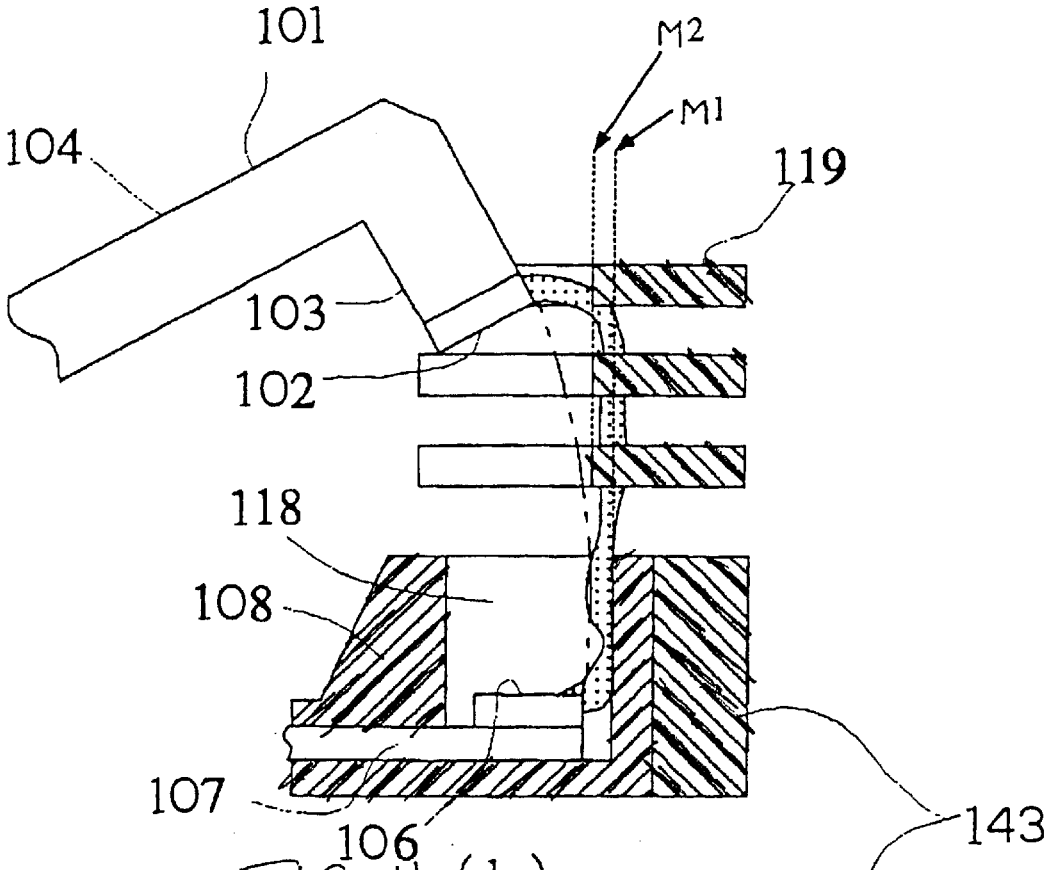
FIG. 111(*a*) is a fragmental sectional view and FIG. 111(*b*) is a plan view showing the main portion of the circuit interrupter according to the fifty-first embodiment of the present invention.
Figure 111:
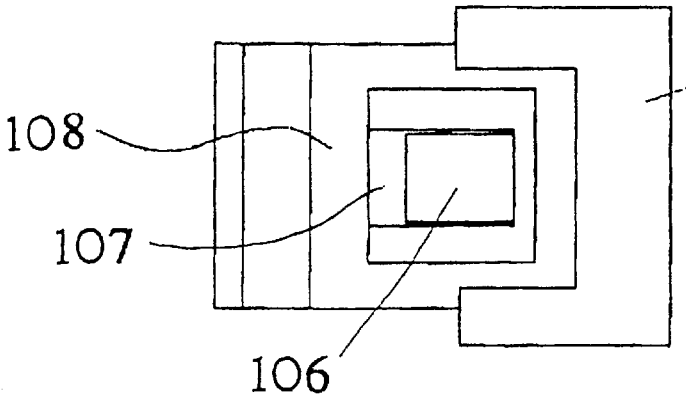

Also, in FIG. 111(*a*) and 111(*b*), the cylindrical insulating material 108 is surrounded by the horse shoe-shaped core 143 from the side opposite from the movable member rotary center. By this core 143, the arc of an overload current of a relatively small current and the arc of a small current immediately before the current interruption upon the short circuit current interrupting operation are urged against the inner wall of the cylindrical space 118 opposite to the movable member rotational center, so that they are cooled by the arc extinguishing plates 119 as well as the vapor generated from the inner wall of the cylindrical space 118, thus interruption can be ensured.

Embodiment 52

Figure 112:
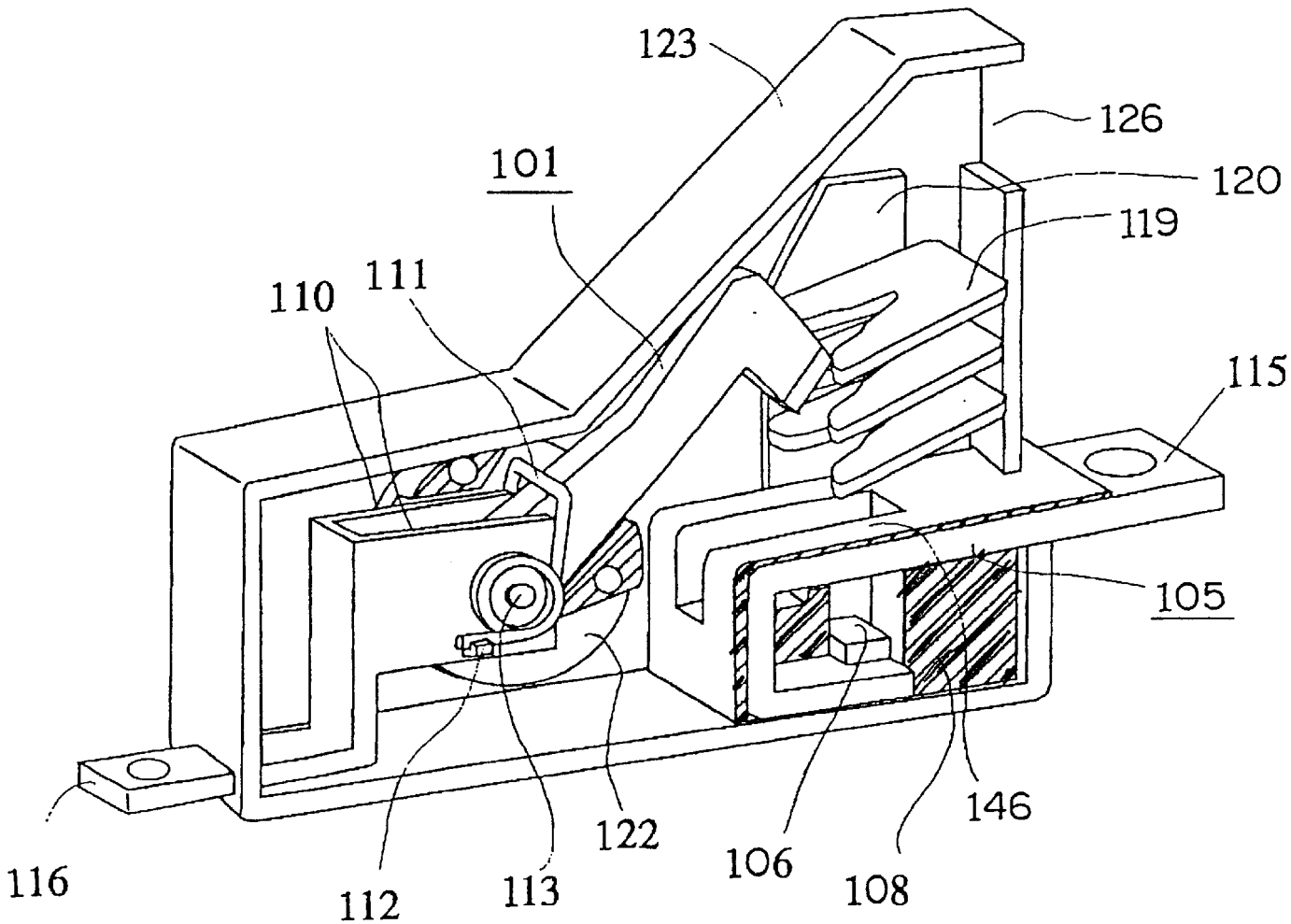
FIG. 112 is a fragmental sectional view showing the main portion of the circuit interrupter according to the fifty-second embodiment of the present invention.

The fifty-second embodiment of the present invention will now be described in conjunction with FIG. 112. In FIG. 112, differing from Embodiment 34, the terminal portion 115 has directly connected thereto the stationary member 105 and the movable member 101 is electrically connected to the relay portion by the terminal 116 through the sliding contact 110. Also, the stationary member 105 shown in FIG. 113 has the stationary member configuration disclosed in Japanese Patent Laid-Open No. 6-20547, which has an electric path

145*c* for flowing a current substantially parallel to the opposite to the movable arm horizontal portion in the closed position. The stationary member 105 is coated with an insulating material 146 integrally molded with the cylindrical insulating material 108 at least at the portion that can be "seen" from the movable contact 102 in the open position except for the portion around the stationary contact 106.

While the stationary conductor 107 and the conductor 121 are disposed as the electrical path for allowing a current flowing in substantially parallel and opposite to the movable arc horizontal portion 104 in the closed position in Embodiment 34, only the electrical path 145*c* is provided in this embodiment. Although the magnetic field generated by the electrical path 145*b* also contributes to the contact separating electromagnetic force for the movable member 101, the contact separating speed is lower when compared with that of Embodiment 34. However, since the conductor length within the arc extinguishing chamber can be made shorter, cost can be reduced, structure can be simplified, improving the assembly. Also, the insulating distance can be easily maintained.

Embodiment 53

Figure 113:
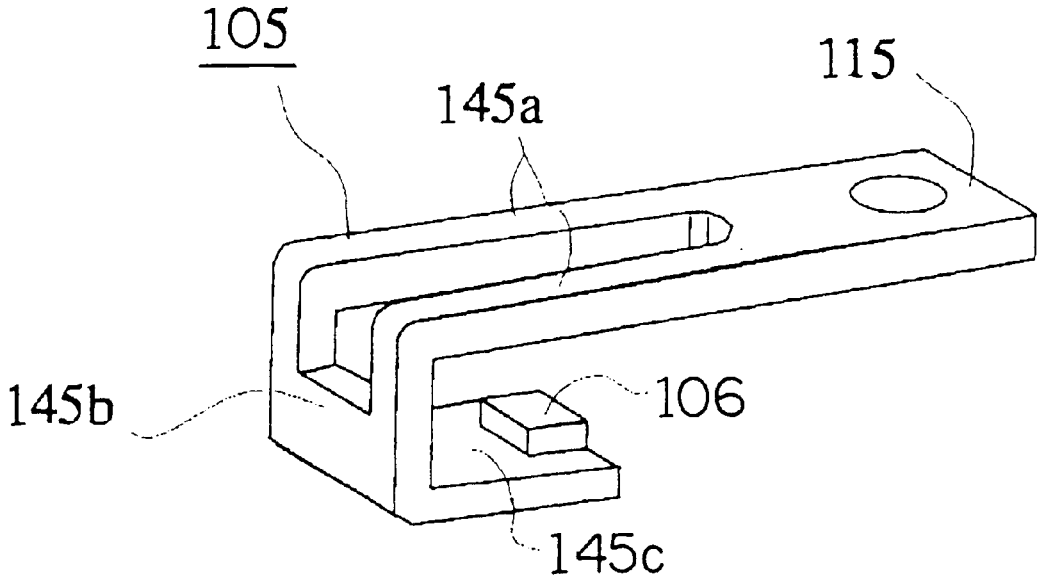
FIG. 113 is a perspective view showing the stationary member configuration shown in FIG. 112.
Figure 114:
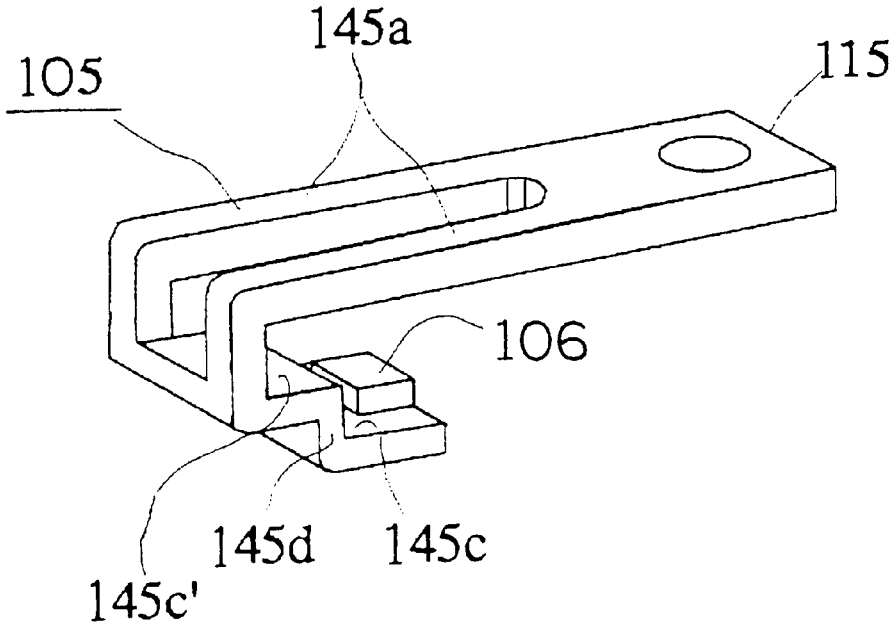
FIG. 114 is a perspective view showing the stationary member configuration of the circuit interrupter according to the fifty-third embodiment of the present invention.
Figure 115:
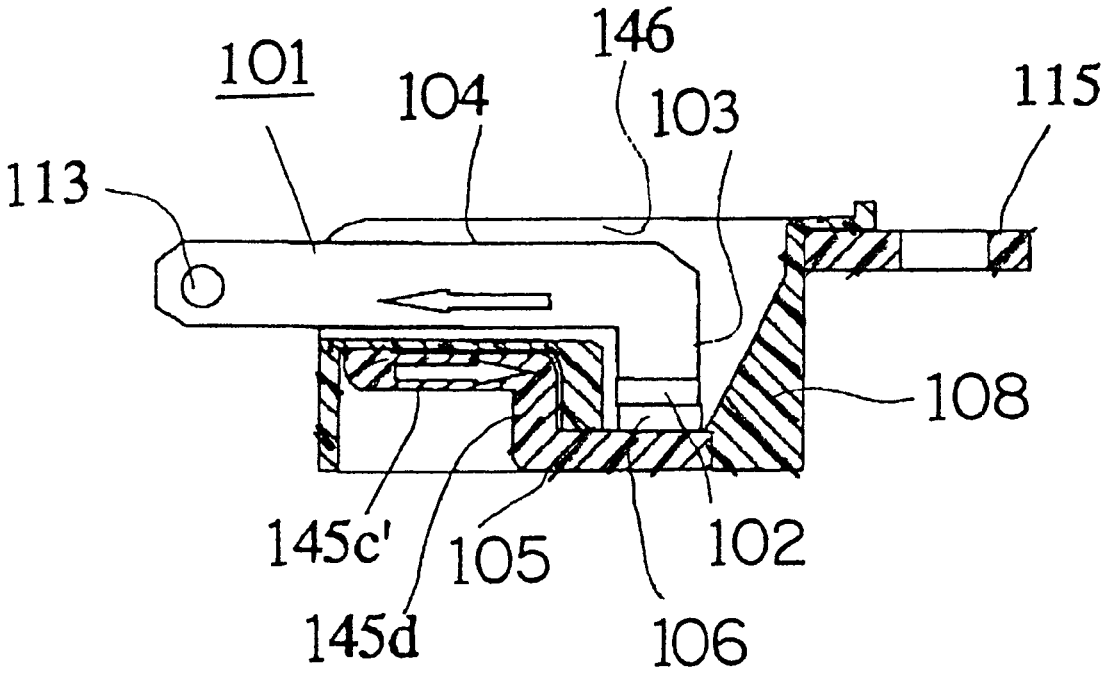
FIG. 115 is a perspective view for explaining the operation of the fifty-third embodiment.

The fifty-third embodiment of the present invention is illustrated in FIGS. 114 and 115. FIG. 114 is a view showing the stationary member 105 of this embodiment, in which one portion of the vertical electrical path 145*b* of the stationary member 105 of FIG. 113 is replaced by the horizontal electrical path 145*c*' and the vertical electrical path 145*d*. FIG. 115 is a sectional view showing the stationary member 105, the cylindrical insulating material 108 and the insulating material 146 for coating the stationary member and integrally molded with the cylindrical insulating material 108, and the current direction is shown by an arrow. As apparent from the figure, the movable arm horizontal portion 104 and the electrical path 145*c*' of the stationary member 101 are significantly close to each other because of the configuration of the stationary member shown in FIG. 114, the electromagnetic contact separating force upon the interruption of a fault current is larger than that of the embodiment shown in FIG. 113.

Embodiment 54

Figure 116:
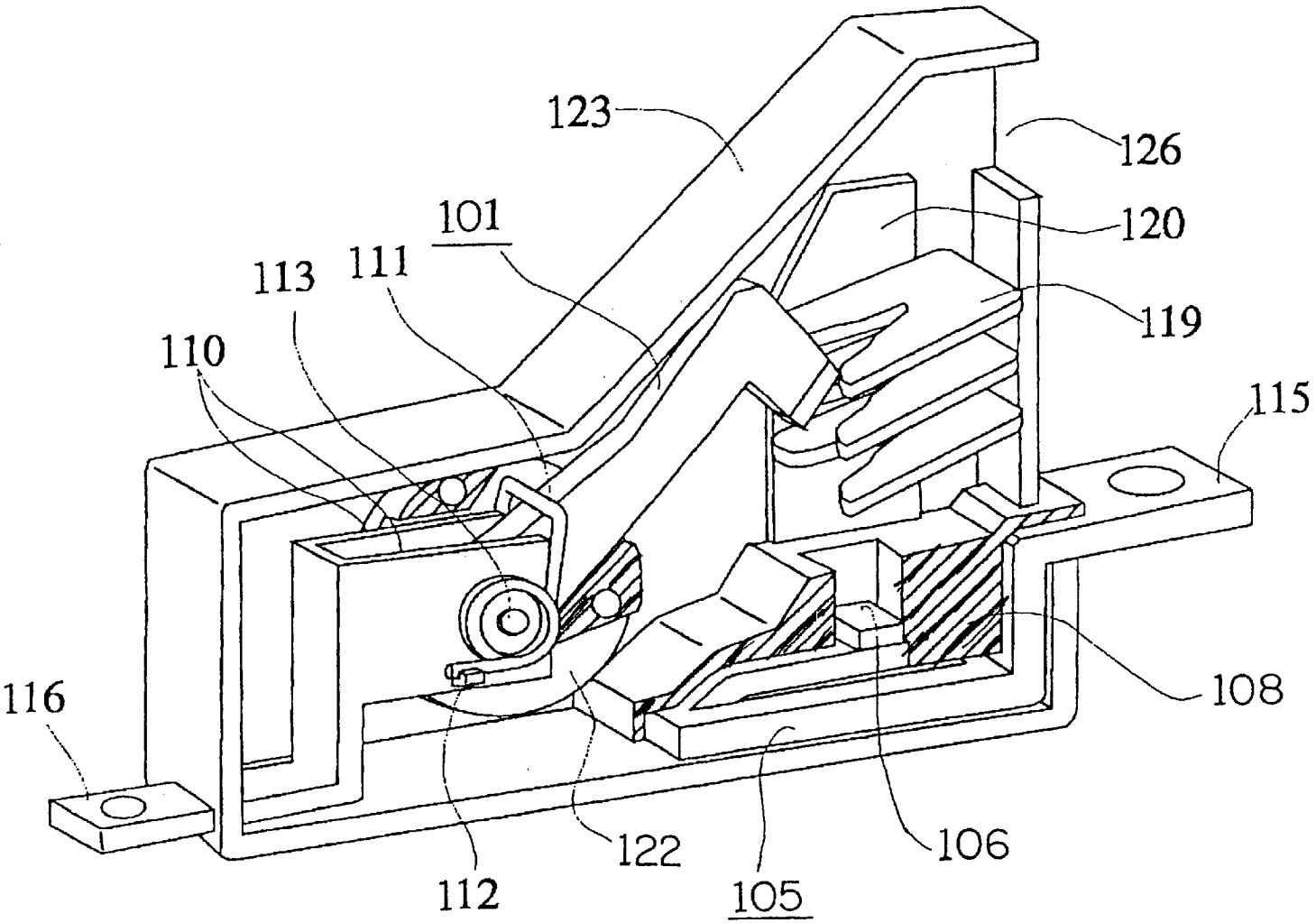
FIG. 116 is a fragmental sectional perspective view showing the arc extinguishing unit of the circuit interrupter according to the fifty-fourth embodiment of the present invention.
Figure 117:
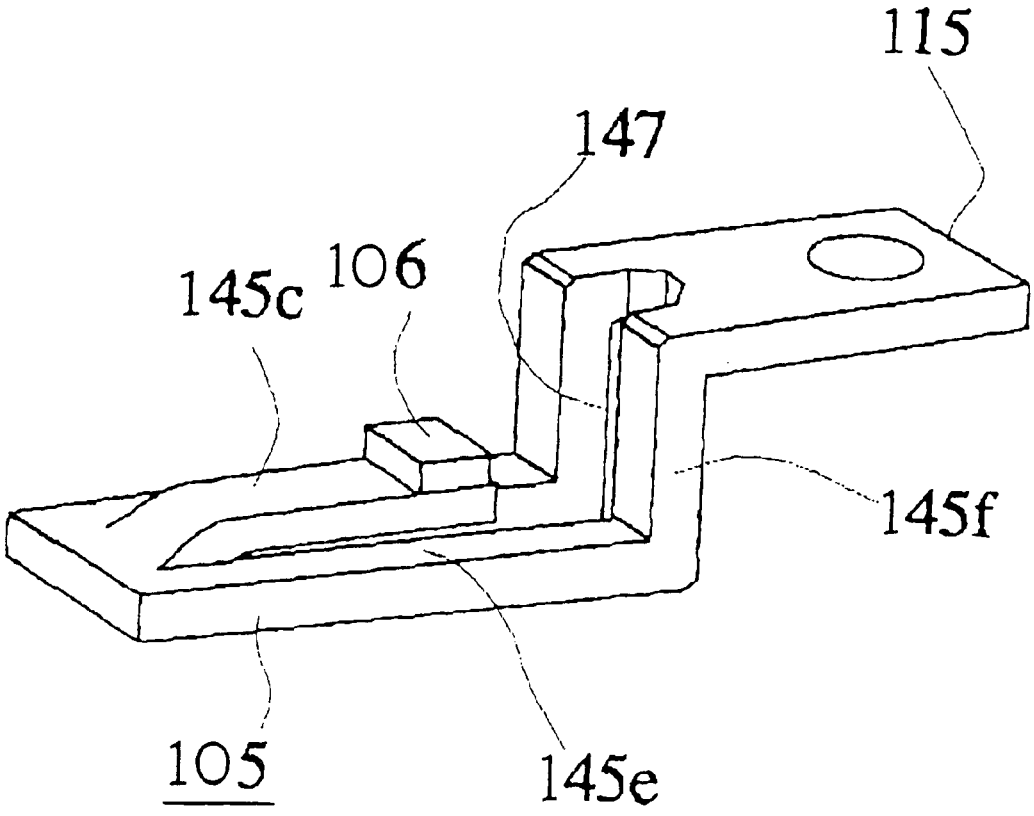
FIG. 117 is a perspective view showing the stationary member configuration shown in FIG. 116.
Figure 118:
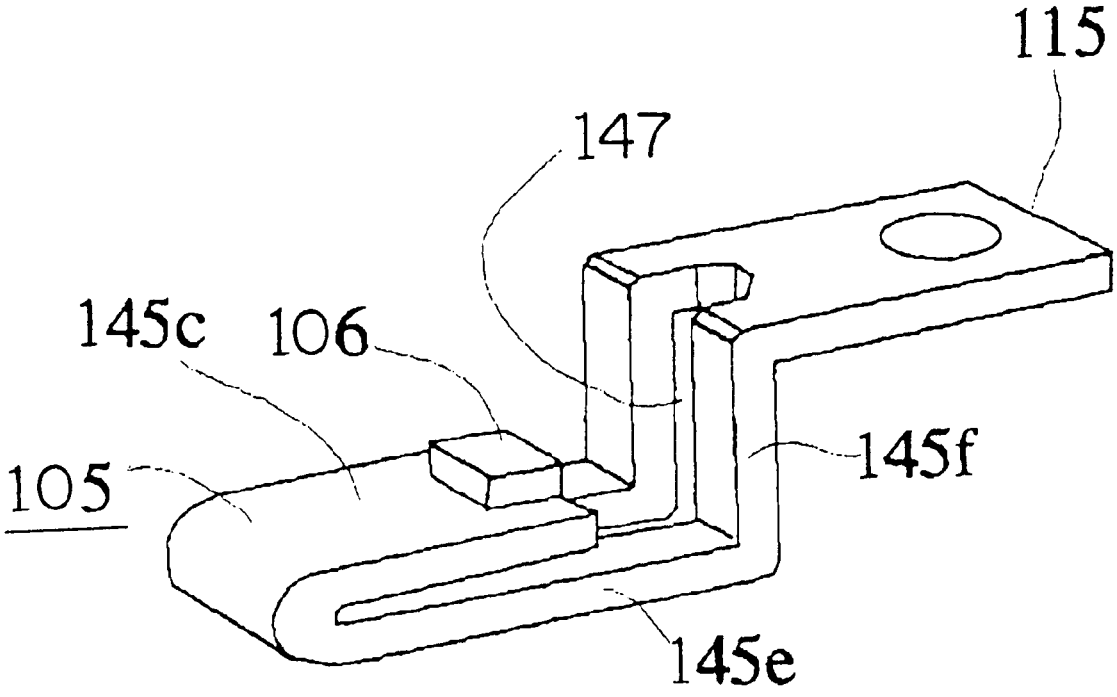
FIG. 118 is a perspective view showing another stationary member configuration according to the fifty-fourth embodiment of the present invention.

The fifth-forth embodiment of the present invention is illustrated in FIG. 116. Also, the configuration of the stationary member shown in this figure is illustrated in FIG. 117. In the stationary member shown in FIG. 117, the electrical path 145*c* is provided for allowing a current substantially parallel and opposite to the movable arm horizontal portion 104 in the closed position. However, the currents in the electrical paths 145*e* and 145*f* generate an electromagnetic field of the direction preventing the separation of the movable member 101. In order to minimize the influence of this magnetic field preventing the contact separation, the stationary member is provided with the slit 147 and the electric paths 145*e* and 145*f* are arranged at positions laterally shifted from the plane including the locus of the movable arm 101. With such the arrangement, the contact separating speed is slower than that of the embodiment shown in FIG. 113 and the current limiting performance is decreased, but the manufacture of the stationary member 105 is simple and the material cost can be reduced, thus allowing an inexpensive interrupter with a current limiting function to be realized. Similar effect can also be obtained by using the stationary member configuration as shown in FIG. 118.

Embodiment 55

Figure 119:
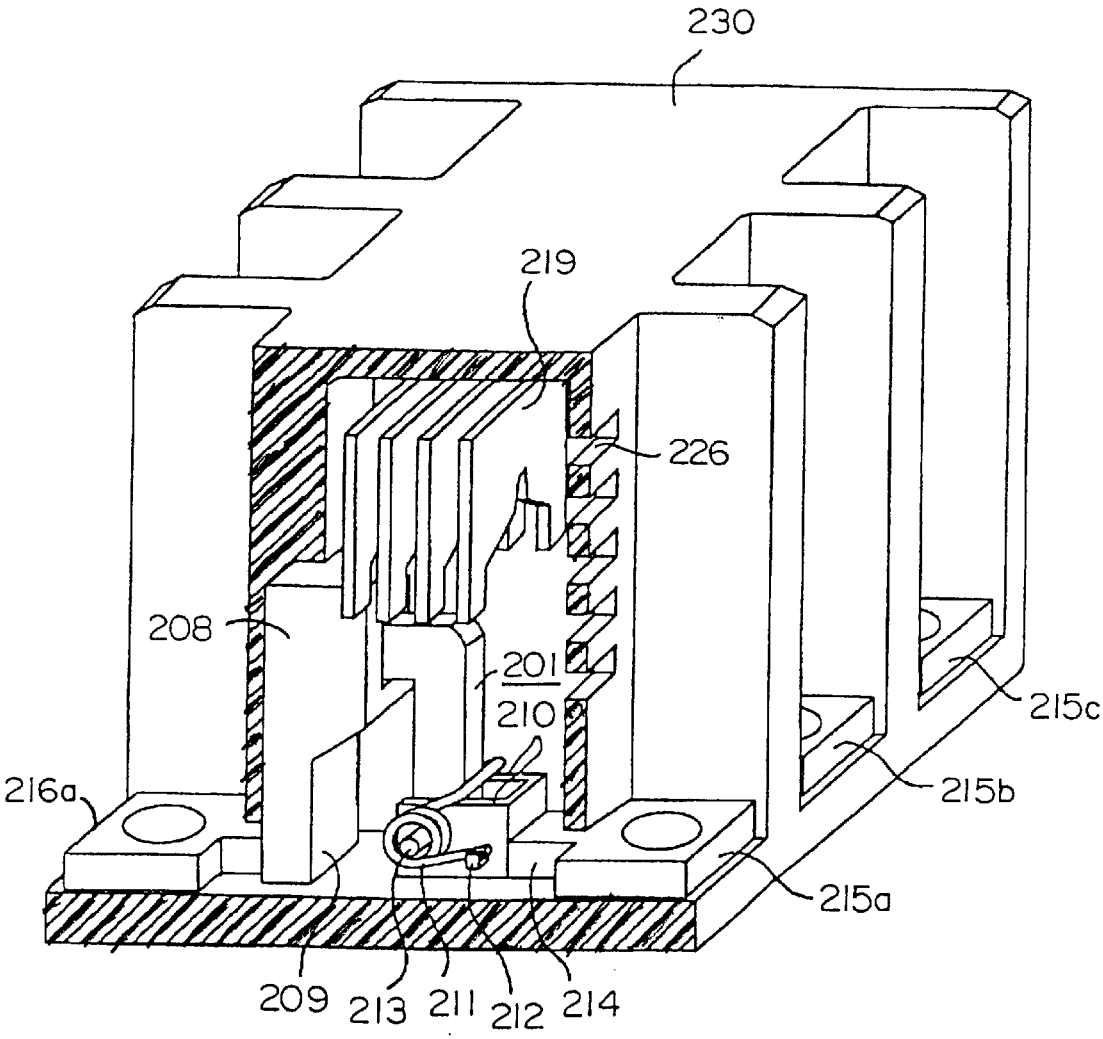
Figure 120:
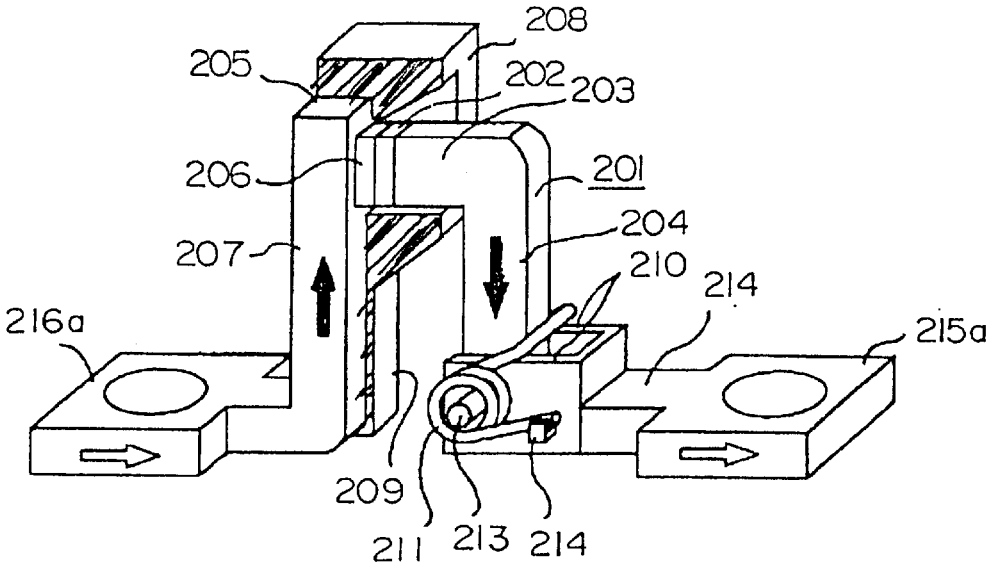

FIG. 119 is a perspective view showing a three pole current limiting device according to the fifty-fifth embodiment of the present invention, with a portion of the housing 230 removed in order to illustrate the internal structure. The three-pole current limiting device may be used in series connection with the circuit interrupter to constitute a three pole current limiting breaker. FIG. 120 is a perspective view showing the conductor arrangement, the cylindrical insulating material 208 and the insulating cover 209 for one pole of the three pole current limiting device of FIG. 119 in the closed position, with the cylindrical insulating material 208 and the insulating cover 209 partially removed for illustration of the components of the conductor portion.

In FIG. 119, 201 is the movable member, 208 is a cylindrical insulating material surrounding a contact pair in the closed position, 209 is an insulating cover, 210 is a sliding contact, 211 is a movable member contact pressure spring which is a urging means for applying the contacting pressure to the contact pair, 212 is a spring holder, 213 is a rotary shaft of the movable member 201, 214 is a connecting conductor, 215*a*, 215*b*, 215*c* and 216*a* are terminal portions, 219 is arc extinguishing plates, 226 is an exhaust port and 230 is an insulating material housing.

In FIG. 120, 201 is the substantially L-shaped movable member comprising a movable contact 202, a movable arm vertical portion 203 having the movable contact 202 attached thereto and a movable arm horizontal portion 204 substantially perpendicular to the movable arm vertical portion 203. The movable member 201 forms a contact pair together with a stationary member 205 composed of a stationary contact 206 and a stationary conductor 207, the movable member 201 is urged toward the stationary member 205 by a movable contact contacting spring 211 which is an urging means for applying a contacting pressure. Also, the movable member 201 is supported rotatably about the movable member rotary shaft 213 and is electrically connected to a terminal portion 215*a* through a sliding contact 210 and the connecting conductor 214. On the other hand, the stationary member 205 is covered with the cylindrical insulating material 208 and the insulating cover 209 except for the stationary contact 206 and the connecting portion to the terminal portion 216*a*. Arrows in the figure illustrate the electrical path during the current carrying period, and the arrangement being such that the current in the movable arm horizontal portion 204 and the current in the stationary conductor 207 are substantially in parallel and in opposite to each other. The contact pair is arranged such that they intersect in the closed position substantially perpendicularly with a line connecting the terminal portion 215*a* and the 216*a*.

Figure 121:
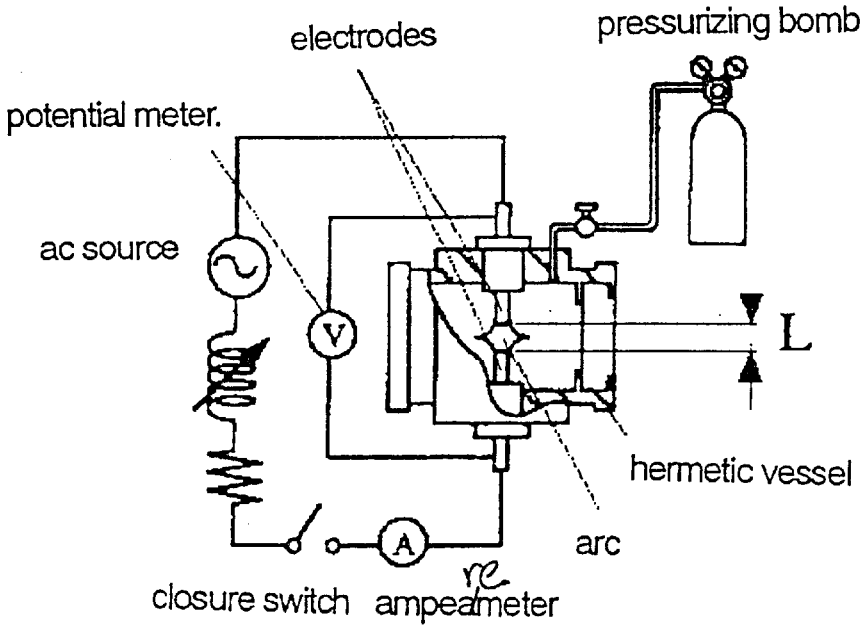

The description will now be made as to the arc voltage increase condition under a high pressure of a large current arc at a relatively short gap generated upon the current limiting operation within the circuit interrupter having the arc type current limiting function. The measurement results of the arc voltage changes when an atmospheric pressure P of the short gap large current arc of several centimeters or less is changed with the experimentation apparatus shown in FIG. 121 is used is shown in FIGS. 122(*a*) and 122(*b*). In the experimentation apparatus shown in FIG. 121, the arc is generated between the opposing pair of rod-shaped electrodes, so that the inter-electrode distance equals to the arc length L. As apparent from FIG. 122(*a*), when the arc current value is relatively small, the arc voltage becomes higher as the arc atmospheric pressure P increase at most of the various arc lengths L. On the other hand, as shown in FIG. 122(*b*), when the arc current value is relatively large, the arc voltage is not substantially changed except for when the arc length L is relatively long even when the arc atmosphere pressure P is increased.

The ratio R of the arc voltage V (P=high) when the atmosphere pressure P shown in FIGS. 122(*a*) and 122(*b*) is high and the arc voltage V (P=low) when the atmosphere pressure P is low is obtained and plotted into a graph as shown in FIG. 123. As apparent from FIG. 123, the arc voltage rising rate R when the arc current value is relatively small becomes higher as the arc length increases. On the other hand, the arc voltage rising rate R when the arc current value is relatively large does not substantially increase until the arc length becomes equal to or higher than a certain value. From the above, it is understood that, in the short gap large current arc, the condition for effectively increase the arc voltage by increasing the arc atmosphere pressure is to simultaneously satisfy (a) that the arc current is relatively small and (b) that the arc length is large.

Upon a fault such as short-circuiting, the circuit current rapidly increases immediately after the occurrence of the fault. Therefore, in order to limit the fault current by increasing the arc voltage at a high atmosphere pressure with the above two conditions satisfied, it is necessary that (1) the high pressure atmosphere is generated at least immediately after the generation of the arc (immediately after the generation of the fault) and that (2) the arc length is elongated when the arc current is still relatively small (immediately after the generation of the fault). After the increase of the fault current, the current limiting performance is not very much improved. Further, the high pressure atmosphere after the increase of the fault current does not contribute very much to the improvements in the current limiting performance and, moreover, causes the damages to the housing or the like.

In the current limiting device shown in FIGS. 119 and 120, when the flowing current rapidly increases due to the generation of the short circuiting fault or the like, an electromagnetic repulsive force F1 by the current concentration at the contact contacting surface and an electromagnetic repulsive force F2 by a current in the movable arm horizontal portion 204 previously discussed and a substantially parallel and opposite current in the stationary conductor 207 cause the contacts to separate against the contacting pressure provided by spring 211 to generate an arc A across the contacts. This state is illustrated in FIG. 124. Upon the arc generation, the electromagnetic repulsive force F1 due to the current concentration at the contact contacting surface diminishes, but the electromagnetic force F2 by the current in the movable arm horizontal portion 204 and the substantially parallel and opposite current in the stationary conductor 207 continues to cause the rotation of the movable member 201 into the contact separating direction.

Also, as shown in FIG. 124, upon the generation of an arc, a large amount of vapor generates from the inner surface of the cylindrical insulating material 208 and a high pressure atmosphere is generated within the cylindrical space 218 surrounded by the cylindrical insulating material 208. Due to this high pressure generation within the cylindrical space 218, the movable member 201 is subjected to a contact separating force Fp due to the pressure difference. The contact separating force Fp due to the pressure difference and the previously described electromagnetic force F2 cause the movable member 201 to be rotated at a high speed to rapidly separate the contacts. This rapid contact separation causes the arc length to be quickly elongated within the high pressure atmosphere to sharply raise the arc voltage and the fault current reaches at its peak value.

As described above, according to this embodiment, the high pressure atmosphere and the high speed contact separating means employing the cylindrical insulating material 208 are used together in combination, such the combined use is necessary to obtain a superior current limiting performance. FIGS. 125(*a*) and 125(*b*) illustrate the effect of the cylindrical insulating material when (a) the high speed contact separating means is not used, and (b) the high speed contact separating means is used. In this figure, ts is a time at which the fault is generated, t0 is a time at which the contacts are separated, V0 is a voltage drop between the contacts and a broken line is a source voltage waveform. FIG. 125(*a*) illustrates where no high speed contact separating means is used and a current peak Ip1 and a current peak Ip2 are reached, respectively, at a time t1 (with the cylindrical insulating material) and a time t2 (without the cylindrical insulating material) at which the arc voltage catch up with the source voltage. When no high speed contact separating means is used, the increase of the arc length is slow as compared with the increase of the fault current, so that the above conditions in which the arc length is short and the arc voltage is increased are difficult to be satisfied even when a high pressure atmosphere is generated by the cylindrical insulating material. Therefore, in FIG. 125(*a*), the extent of the improvement of the current peak Ip, i.e., $\Delta Ip = Ip2 - IP1$ is small even when the cylindrical insulating material is used.

On the other hand, in FIG. 125(*b*) in which the high speed contact separating means is used, the arc length becomes sufficiently long before the fault current become high, so that the above conditions for increasing the arc voltage in a high pressure atmosphere can be satisfied. It is apparent that the extent of improvement of the current peak Ip, i.e., $\Delta Ip' = Ip2' - IP1'$, where a current peak Ip1' and a current peak Ip2' are reached, respectively, at a time t1' (with the cylindrical insulating material) and a time t2' (without the cylindrical insulating material) at which the arc voltage catch up with the source voltage is dramatically increased as compared with the extent of the improvement ΔIp of the current peak Ip when no high speed contact separating means is used.

It is to be noted that in this embodiment the cylindrical insulating material 208 is disposed to surround the stationary contact 206 in order to make the arc atmosphere pressure high immediately after the movable member separation. The arrangement in which the heat of the arc generated between the separated contacts is used to generate a large volume of vapor from the insulating material disposed around the stationary contact is disclosed in FIGS. 16 and 17 of Japanese Patent Laid-Open No. 7-22061, for example. However, in this prior example, the insulating material disposed around the stationary contact has a configuration sandwiching the movable member in the lateral direction allowing the vapor generated from the insulating material to immediately flows out to the movable member tip side in the closed position and to the movable member rotation center side, impossible to make the arc atmosphere sufficiently high pressure. In order to abruptly raise the arc voltage, it is necessary to confine the arc at the initial stage of the contact opening within a cylindrical space defined by the stationary contact, the movable contact and the cylindrical insulating material, and it is indispensable for a significant improvement in the arc voltage increasing rate that the insulating material surrounding the stationary contact be in a cylindrical configuration.

FIG. 126 illustrates the state in which the movable member 201 further rotates from the position shown in FIG. 124 and reached to its maximum contact separation position. In this state, the movable contact 202 is positioned outside of the cylindrical space 218 and a sufficiently large arc voltage is generated. Also, as shown by arrows in FIG. 126, the flow of vapor of the insulating material (shown by white arrows) along the axial direction of the arc column from the cylindrical space 218 absorbs the heat of the arc to cool it, making the arc resistance higher and the fault current quickly moves to the zero point.

Also, as shown in FIG. 119, by providing the exhaust port 226 in the housing wall on the side of the movable member separating direction (opening portion side of the cylindrical insulating material 208), the flow speed of the insulating material vapor shown by the white arrows in FIG. 126 can be made large, thereby allowing the electrode metal vapor around the movable contact 202 to be easily blown off. This allows an insulation recovery sufficient for interrupting the current occurred between the electrodes, making it possible to obtain a reliable current limiting device that can reliably interrupt current even when a circuit breaker of a low interrupting capacity is use together in series connection.

Also, by moving the movable contact 202 outside of the cylindrical space 218 at the latter half of the interrupting operation after the current peak as above discussed, the vapor generation from the cylindrical insulating material 208 that does not effectively contribute to the increase of the arc voltage can be limited to prevent the unnecessary increase of the internal pressure.

With this embodiment, differing from the conventional example shown in FIG. 149 in which two pairs of contacts are provided, a high current limiting performance can be obtained by one pair of contacts, so that a current limiting device superior in the low impedance current limiting performance can be obtained, facilitating the application to a circuit in which a large current carrying capacity is required.

Also, when the current limiting device is directly connected to the circuit interrupter as in the conventional example shown in FIG. 150, it is apparently preferable that the width W of the current limiting device is equal to or smaller than the width W of the circuit interrupter with the ease of containing within the power distribution panel. In the conventional arrangement in which two pairs of contact pairs are disposed side by side, the thickness of the housing side wall parallel to the plane in which the movable member rotates cannot be made thick in view of the limitation of such the width W, the housing has thin walls made of an expensive insulating material having a high strength. However, in this embodiment, only one pair of contacts is used to obtain a high current limiting performance, so that the thickness of the housing side wall can be large even when there is the above-discussed limitation in the width W, making it possible to make the housing with an inexpensive material. On the other hand, since the increase of the housing internal pressure is suppressed in this embodiment, it is possible to make the housing wall thickness small and use a conductor arrangement in which two pairs of contacts are serially connected.

Embodiment 56

The fifty-sixth embodiment of the present invention will be described in conjunction with FIG. 127. FIG. 127 is a sectional view showing the internal structure of the current limiting device of Embodiment 56 with the illustration of the spring or the like is omitted. This embodiment is different from that shown in FIG. 119 only in that the terminal portions 215 and 216 are disposed at positions higher than a mounting surface (bottom) 296 of the housing 230 by H'. Therefore, in this embodiment, in order to ensure the parallel arranged electrical path portion with respect to the arm of the movable member 201 and the stationary member 205 and to connect to the terminal portions 215 and 216, the lower portion of the stationary conductor 207 is bent into a U-shape and connected to the terminal portion 216 and, as for the movable member 201, the flexible conductor 272 is bent into a U-shape and connected to the terminal portion 215.

When a current limiting device is to be directly connected to a circuit beaker, the terminal portion of the current limiting device must be disposed at a position higher than the mounting surface by H'. Also, it is clear that, when an ease of containing within a distribution panel is taken into consideration, the height H of the current limiting device is desirable to be equal to or lower than the eight of the circuit breaker. Under such the limitation of outer configuration, in order to provide a sufficient length of substantially parallel and opposite direction electrical path (hereinafter referred to as a repulsive electrical path), it is necessary that as shown in FIG. 127 the stationary conductor 207 is bent into a substantially U-shape, the electrical path on the stationary member side is folded back at the side of the mounting surface 91 and that the movable member rotary shaft 213 is disposed at a low position on the side of the mounting surface 296 with respect to the height of the terminal portions 215 and 216.

With the above structure, a length of the repulsive electrical path necessary for obtaining a current limiting performance can be provided even when there is the above limitation in the outer configuration. However, in FIG. 127, the magnetic field generated by the current component shown by white arrows function to prevent the high speed separation of the movable member, so that when the repulsive electrical path has the same length as that in the twenty-second embodiment, the contact separating speed is decreased as compared with the twenty-second embodiment. Therefore, the contact separating speed in the following twenty-fourth embodiment is further increased as compared to that of Embodiment 55 under the limitation of the height H and the terminal portion height H'.

Embodiment 57

The fifty-seventh embodiment of the present invention is illustrated in FIG. 128. FIG. 128 is a sectional view showing the internal structure of the current limiting device of this embodiment, the spring or the like being omitted from illustration. In this embodiment, differing from Embodiment 56, the movable member 201 is electrically connected by the flexible conductor 272 to the far side or the terminal portion 216 disposed behind the stationary member 205 and the stationary member 205 is electrically connected by the elongated stationary conductor 207 to the far side or the terminal portion 215 disposed behind the movable member 201. The stationary conductor 207 electrically connecting the stationary contact 206 and the terminal portion 205 is composed of the electrical paths 207*a*, 207*b* and 207*c*. 207*a* is the electrical path for defining the repulsive electrical path, 207*b* is the electrical path connected at one end to the electrical path 207*a* and disposed below the movable member 201 perpendicular to the movable arm of the movable member 201 in the closed position and 207*c* is the electrical path connecting the other end of the electrical path 207*b* to the terminal portion 215.

The repulsive electrical path portion of the contact pair in the closed state is disposed to be substantially perpendicular to the line connecting the terminal portions 215 and 216 and a plurality of horse shoe-shaped arc extinguishing plates 219 are provided at a position opposing to the tip portion of the movable member. Also, the stationary conductor on the end portion side to which the stationary contact 206 of the contact member 205 is attached is upwardly extended, and the extended conductor 238 has provided therewith an arc runner 234 exposed toward the arc extinguishing plates 19 from the insulating cover 209*a*.

In the electrical path arrangement as described above, all the magnetic field generated by the current flowing through the stationary conductor 207 functions in the direction of separation of the movable member 201, so that the movable member 201 separates at a higher speed upon the short circuit interruption. Therefore, by the combined use of the above electrical path arrangement together with the cylindrical insulating material 208 which is the means for generating a high pressure atmosphere, the raising of the arc voltage can be significantly improved, further improving the current limiting performance.

On the other hand, since the arc is generated within the cylindrical insulating material 208 upon the short circuiting interruption in this embodiment, the arc spot on the side of the stationary contact 206 is limited to be in the inner diameter of the cylindrical insulating material 208, whereby the current density is increased. This causes the wear of the stationary contact 206 to become large and the number of current limiting operation that can be performed is limited. In this Embodiment 57, as discussed before, the arc runner 234 to which the arc A transfers is disposed above the stationary contact 206, so that the direction of arc jet at the side of the movable contact 202 is changed from the stationary contact 206 toward the arc extinguishing plates 219 at the latter half of the current limiting operation as shown in FIG. 129 in which the rotation of the movable member 201 causes the movable contact 202 to move outside of the cylindrical space 218. Also, the arc is subjected to an electromagnetic force toward the arc extinguishing plates 219 due to the current flowing through the stationary conductors 207*a*, 207*b* and 207*c* as well as the movable member 201. These arc-driving forces moves the arc spot on the side of the stationary member 205 from the stationary contact 206 to the arc runner 234. Therefore, the wear of the stationary contact 206 and the cylindrical insulating material 208 is suppressed, resulting in a current limiting device that can be repeatedly used and superior in durability.

Further, as shown in FIG. 129, since the arc is brought into contact with the arc extinguishing plates 219 and the arc heat is absorbed by the evaporation latent heat of the arc extinguishing plates 234 and the arc temperature is cooled during the transfer of the arc to the arc runner 234, the internal pressure increase within the housing can be decreased at the latter half of the interrupting operation. The mechanical strength against an impact stress of a molding material used in wiring breaker is generally higher than the mechanical strength against a static stress. Therefore, the decrease of the housing internal pressure at the latter half of the interrupting operation provides the effect of preventing the cracks of the housing made of a molding material.

As has been described, the wear of the stationary contact 206 can be decreased by transferring the arc spot on the side of the stationary contact 206 to the arc runner 234, but the arc aroud the stationary contact 206 moves to the outside of the cylindrical space 218 at the moment when the arc is transferred to the arc runner 234, decreasing the arc voltage elevated by the high pressure atmosphere of the cylindrical space 218. This decrease of the arc voltage occurs before the current peak, the current peak is significantly increased to significantly degrade the current limiting performance. Also, even when the decrease of the arc voltage occurs after the current peak, it sometimes happen that the rate of decrease of the current at the latter half of the current limiting operation is decreased, increasing the interrupting time and increasing the passing energy. Such the problem is solved by Embodiment 58 described below.

Embodiment 58

The fifty-eighth embodiment of the present invention is illustrated in FIG. 130. In Embodiment 58 illustrated in FIG. 130, the insulating cover 209*a* around the arc runner 34 is made cylindrical to define an arc runner cylindrical space 239. With this arrangement, even after the movable member 201 rotates and the movable contact 202 comes out of the cylindrical space 218, the arc spot on the side of the stationary contact does not immediately transfer to the arc runner 234, allowing to effectively utilize the arc voltage increase by the high pressure atmosphere in the cylindrical space 218, so that the current peak can be suppressed to be small. Also, since the arc runner 234 is within the arc runner cylindrical space 218 surrounded by the cylindrical insulating cover 209*a* even after the arc is transferred to the arc runner 234, no arc voltage decrease occurs and the interruption time can be shortened, resulting in the decrease in the passing energy.

Embodiment 59

According to this invention, the movable member 201 has a tip portion of substantially L-shape in order to generate an arc at the initial stage of the contact opening within the cylindrical insulating material 208 as shown in FIG. 120, for example. Therefore, it is difficult for the arc spot on the side of the movable member 201 to move from the movable contact 202 to the end surface of the movable member 201 on the side of the arc extinguishing plates, so that the direction of arc jet at the movable member side is not directed to the arc extinguishing plates even in the latter half of the interruption operation, whereby it is difficult for the arc to be brought into contact with the arc extinguishing plates 219. Therefore, the arc cooling effect of the arc extinguishing plates 219 cannot be effectively utilized and it is possible that the housing internal pressure be unnecessarily increased without promoting the arc voltage increase at the latter half of the current limiting operation.

Therefore, in Embodiment 59 of the present invention, as shown in FIG. 131, a transfer electrode 237, which is electrically connected at one end to the connecting conductor 214, extended at the other end toward the arc extinguishing plates 219 and which is at substantially the same electrical potential as the movable member 201, is disposed behind the movable member 201 so that the arc spot on the side of the stationary contact 202 is transferred to the transfer electrode 237 to move toward the arc extinguishing plates 219. Also, in a manner similar to the Embodiments 57 and 58, the arrangement of the side of the stationary member 205 is such that the arc spot is transferred to the side of the arc extinguishing plates 219 by the arc runner, whereby the arc is ensured to be splitted and cooled by the arc extinguishing plates 219. Therefore, the unnecessary increase of the housing internal pressure at the latter half of the current limiting operation can be prevented.

Embodiment 60

As has been described, in the present invention, the arc spot on the side of the movable member 201 is difficult to move to the end surface of the movable member 201 on the side of the arc extinguishing plates because the tip portion of the movable member has a substantially L-shaped configuration. Therefore, the current in the vicinity of the arc spot on the side of the movable member 201 is concentrated at the movable contact 202 to apt to make the wear of the movable contact 202 large. Therefore, in this embodiment, as shown in FIG. 132, the arrangement is such that a transfer electrode 237*a* is provided with a slit 247 into which the tip portion of the movable member 201 in the open position is received, whereby the arc spot on the movable contact side is ensured to be transferred to the transfer electrode 237*a* at a relatively early period during the current limiting operation as compared to the rod-shaped transfer electrode 237 shown in FIG. 131.

The arc transferred to the transfer electrode 237*a* is driven to the tip portion of the transfer electrode 237*a* by a drawing function of the arc extinguishing plates 219 and an electromagnetic drive force due to the currents flowing through the stationary member 205 and the transfer electrode 237*a*, whereby the arc length is quickly increased and the arc voltage is increased. Such the transfer of the arc from the movable member 201 to the transfer electrode 237*a* at a relatively early time point enables the wear of the movable contact 202 to be significantly reduced as compared to that of Embodiment 59, improving the durability of the current limiting device.

Embodiment 61

The sixty-first embodiment of the present invention is shown in FIG. 133. FIG. 133 is a fragmental sectional view showing the end portion of the stationary member 205 on the side of the stationary contact 206, the tip portion of the movable member 201 and the arc extinguishing plate 219, the movable member 201 being at a position of being separated. The cylindrical insulating material 208 shown in FIG. 133 is shaped to expand toward the open end of the cylindrical space 218 and the wall of the cylindrical insulating material on the far side relative to the movable member rotational center (the rotary shaft 213, not shown) is shaped to expand like a trumpet. Because of this configuration of the cylindrical insulating material 208, the flow of the high pressure vapor generated in the cylindrical space 218 is directed toward the arc extinguishing plates 219 as shown by an arrow in the figure, whereby the arc between the contacts is elongated to the arc extinguishing plates 219 by his vapor flow.

This function of leading the arc to the arc extinguishing plates 219 by the vapor flow is enhanced by making the height of the wall of the cylindrical insulating material on the side far from the movable member rotational center lower than the wall height on the side near to the movable member rotary center. Thus, by the arrangement for effectively utilizing the arc cooling effect by the arc extinguishing plates 219, it is possible to prevent the internal pressure of the arc extinguishing unit housing by the arc heat and to decrease the mechanical strength of the housing, leading to the reduction of cost.

Embodiment 62

The sixty-second embodiment of the present invention is shown in FIG. 134. FIG. 134 is a fragmental sectional view showing the cylindrical insulating material 208 and the end portion of the stationary contact 205 on the stationary contact side, the cylindrical insulating material 208 being composed of an insulator 208*a* and an insulator 208*b* around it. The insulator 208*a* is a mold made of a material that emits a large amount of vapor immediately when exposed to the arc, such as a resin material including only a small amount of or no reinforcing material such as glass fibers, and the insulating material 208*b* is made of an reinforced resin or a ceramic superior in mechanical strength.

With this structure, a material that cannot mechanically endure the elevated pressure within the cylindrical space 218 can be used as a material for defining the cylinder inner surface, so that a material for generating a large amount of vapor can be used as a material for the cylindrical insulating material 208 irrespective of the mechanical properties, whereby the pressure rising speed within the cylindrical space 218 at the initial stage of the contact opening can be increased to sharply raise the arc voltage, thus improving the current limiting performance.

Embodiment 63

The sixty-third embodiment of the present invention is illustrated in FIG. 135. FIG. 135 is a fragmental sectional view showing the cylindrical insulating material 208, the end portion of the stationary member 205 on the side of the stationary contact 206 and the tip portion of the movable member 201 on the side of the movable contact 202, and in the figure, a locus drawn during the contact separating movement by the point of the movable member 201 most remote from its rotating center is depicted by a broken line. The surface portions of the cylindrical insulating material 208 that oppose to the tip portions of the movable member 201 is configured to maintain a constant clearance with respect to the broken line.

Generally, the rotational center of the movable member 201 is disposed above the contact contacting surface, so that the locus of the movable member 201 expand upwardly (to the far side from the stationary member) from the stationary contact 206 position in the direction away from the movable member rotary center. Therefore, when the surface of the cylindrical insulating material 208 opposing to the tip portions of the movable member 201 is made vertical, that surface must be positioned far from the stationary contact 206, making the volume of the cylindrical space 218 surrounded by the cylindrical insulating material 208 is increased. This often increases the time necessary for generating a sufficiently high atmosphere. Therefore, the inner surface of the cylindrical insulating material 208 is formed to extend along the locuses of the tip portions of the movable member 201, whereby the volume surrounded by the cylindrical insulating material 208 can be made small to increase the pressure raising speed of the pressure within the above space, so that the arc voltage can be sharply raised, improving the current limiting performance.

Embodiment 64

The sixty-forth embodiment of the present invention is illustrated in FIG. 136. FIG. 136 is a fragmental sectional view showing the cylindrical insulating material 208, the end portion of the stationary member 205 on the side of the stationary contact and the tip portion of the movable member 201 on the side of the movable contact, and the surrounding area around the stationary contact 206 on the end portion of the stationary member 205 is covered by an insulating portion 8*c* extending into the cylindrical space of the cylindrical insulating material 218.

The cylindrical space 218 surrounded by the cylindrical insulating material 208 generally has a larger cross-sectional area than the stationary contact contacting surface taking the locus or the lateral movement of the movable member 201 at the time of opening and closing operation. Therefore, if the above insulating portion 208*c* is not provided, a portion of stationary conductor 207 is exposed around the stationary contact 206 when the stationary contact 206 is viewed from the side of the movable member 201. When an arc is generated upon the interrupting operation, the arc spot on the stationary contact side spreads to this exposed portion. On the other hand, with the insulating portion 208*c* provided, the arc spot on the stationary member side is limited by the area of the stationary contact 206 which is smaller than that without the insulating portion 208*c*, resulting in a higher arc voltage. Also, the amount of generated vapor is increased by an amount corresponding to the insulating material vapor generated from the insulating portion 208*c*, allowing a quick formation of a sufficiently high pressure atmosphere, resulting in improvement in the current limiting performance.

Embodiment 65

The sixty-fifth embodiment of the present invention is illustrated in FIG. 137. FIG. 137 is a fragmental sectional view showing the cylindrical insulating material 208, the end portion of the stationary member 205 on the side of the stationary contact 206 and the tip portion of the movable member 201 on the side of the movable contact 202, and the wall height of the wall opposite to the movable member rotating center of the cylindrical insulating material 208 surrounding the cylindrical space 218 is made higher than the wall height of the wall on the side of the movable member rotation center.

The arc generated between the separated contacts at the time of interruption is subjected to an electromagnetic drive force in the opposite direction to the movable member rotation center by the current flowing through the stationary conductor 207 and the movable arm horizontal portion 204. Therefore, the arc within the cylindrical space 218 is brought into firm contact with the wall opposite to the movable member rotation center. Also, while it is advantageous to make the moment of inertia small to separate the movable member 201 at a high speed, the moment of inertia of the movable member is increased when the length of the movable arm vertical portion which depends upon the height of the cylindrical insulating material 208 is long. Therefore, by making the wall height of the cylindrical insulating material 208 lower at the near side from the movable member rotation center than the portion on the side of the movable member rotation center, the movable arm vertical portion 203 can be made short to reduce the moment of inertia and at the same time generate a sufficient amount of cylindrical insulating material vapor to generate an atmosphere of a sufficiently high pressure, enabling to further improve the current limiting performance.

Embodiment 66

The sixty-sixth embodiment of the present invention will now be described in conjunction with FIG. 138. FIG. 138 is a perspective view showing the movable member 201 of this embodiment, and the movable member 201 is composed of the movable contact 202, the movable arm vertical portion 203, the movable arm horizontal portions 204 including the portions 204*c*, 204*d* and 204*e*, as well as an insulating material 241 coated on the surfaces of the movable arm on the stationary contact side and is configured into a substantially hook shape. Thus, by making the movable member 201 hook-shaped, the distance between the stationary conductor in the closed position and the movable arm horizontal portion 204*e* can be made shorter.

FIG. 139 is a view illustrating the movable member 201, the stationary member 205 and the cylindrical insulating material 208 of this embodiment, in which the flows of current is illustrated by arrows. As understood from this figure, the opposite currents flowing through the stationary conductor 207 and the movable arm horizontal portion 204*e* are closer to each other than those are where the L-shaped movable member shown in FIG. 137, increasing the electromagnetic repulsive force and improving the contact separating velocity.

However, as shown in FIG. 140, when the rotation angle θ of the movable member 201 is large, the hook-shaped movable member 201 increases the possibility that the arc is brought into contact with the movable arc horizontal portion and that the current is shunted. When the arc is brought into contact with the movable arm, the movable arm melts and becomes narrower, whereby the movable arm cannot maintain a mechanical strength required for withstanding the opening and closing of the contacts and also the arc voltage during the latter half of the interruption decreases to deteriorate the current limiting performance. Therefore, the surfaces of the movable arm that can be "seen" at least from the stationary contact 206 in the closed position and on the side of the movable member rotary shaft should be coated with an insulating material 241. The shunting to such the movable arm may be generated even with the substantially L-shaped movable member shown in the previous embodiment when the rotational angle θ of the movable member 201 is increased, necessitating the above-described insulation of the movable arm.

Embodiment 67

FIG. 141 illustrates the sixty-seventh embodiment of the present invention. Usually, the rotational center of the movable member 201 is provided around it with a component for rotatably supporting and electrically connecting the movable member. In the embodiment shown in FIG. 120, the sliding contact member 210 is provided. Also, when the contacting pressure is given by the torsion spring 211, the spring is disposed in the vicinity of the rotary center of the movable member. Therefore, the distance between stationary member 205 and the movable member rotary shaft 213 cannot be made smaller than a certain value.

Therefore, as shown in FIG. 141, by making the configuration of the movable member 201 substantially S-shaped to have one more additional bent portion as compared to the substantially hook-shaped movable member shown in FIG. 139, the sliding contact portion, the torsion spring or the like can be mounted without increasing the distance between the movable arm horizontal portion 204*e* and the stationary conductor 207, so that a large electromagnetic force can be obtained even when the rotary shaft 213 is farther than the stationary conductor 207.

Embodiment 68

FIG. 142 illustrates the sixty-eighth embodiment of the present invention. In the figure, there are illustrated the substantially L-shaped movable member 201 in the closed position and the stationary member 205 in which a portion of the stationary conductor 207 opposing to the movable arm horizontal portion 204 is bent to become close to the movable arm horizontal portion 204. By positioning the stationary conductor closed to the movable arm 204, a similar effect to that in Embodiment 67 can be obtained. Further, in this embodiment, the movable member 201 is substantially L-shaped, so that the moment of inertia can be made smaller than that in the substantially hook-shaped movable member or the substantially S-shaped movable member shown in connection with Embodiment 66 or 67, enabling a faster contact opening.

Embodiment 69

While the current limiting device having a pair of contacts is described in conjunction with Embodiment 55, the current limiting performance can be further improved by the conductor arrangement in which two pairs of contacts as shown in FIGS. 152 and 153 are used, the end portions of both the movable member are in substantially L-shaped, and in which the cylindrical insulating material as shown in FIG. 120 is disposed around both of the stationary contacts to generate two series arcs within the cylindrical space upon the current limiting operation. Since this enhances the function of protecting the electromagnetic switch serially connected to the circuit, the resistivity to the welding of the electromagnetic switch can be increased and the cost of the overall power distribution system can be reduced.

By connecting the current limiting device shown and described in conjunction with Embodiments 55 to 69 in the longitudinal direction of the circuit interrupter having a function of interrupting a small, pinched current by this current limiting device, a circuit interrupter having a good current limiting performance can be obtained. At this time, by making the width dimension and the height dimension of the current limiting device equal to or smaller than those of the above circuit interrupter as in the conventional example shown in FIGS. 150 and 151, the ease of containing them within the distribution panel is improved.

Embodiment 70

The seventieth embodiment of the present invention is illustrated in FIGS. 143 to 145. FIG. 143 is basically the same as the embodiment shown in FIG. 38 except for the configuration of the cylindrical insulating material 225 and the arc runner 279 composed of the elongated conductor 292 extending along the stationary member 205. The section of the cylindrical insulating material 25 of FIG. 143 has a shape expanding toward the terminal portion 215, differing from that of Embodiment 16. Also, on the end portion of the stationary member 5 closed to the stationary contact, the arc runner 279 extending to the terminal portion 215 are provided.

When the cylinder cross section of the cylindrical insulating material 25 is made substantially equal to that of the stationary contact 206 as in the embodiment shown in FIG. 38, the pressure increase is high within the cylindrical space upon the generation of the arc across the contacts at the time of short circuiting current interruption, so that the arc voltage rises sharply to obtain a superior current limiting performance. This superior current limiting performance decreases the energy passing through the interrupter, so that the wear of the contacts and the arc extinguishing plates is reduced. However, in a circuit with a relatively high circuit voltage, the current limiting function owing to the arc voltage is sometimes not clearly appreciable. In such case, the energy passing through the interrupter cannot be suppressed by the arc voltage, increasing the wear of the contacts and the arc extinguishing plates, sometimes making it impossible to allow the current to flow again and repeat the interruption. Particularly, when a cylindrical insulating material of a relatively small cross-sectional area as in the embodiment shown in FIG. 38, the arc spot on the stationary member side stays always on the stationary contact in the high pressure atmosphere, making the wear of the stationary contact dramatically increase when the fault current is not sufficiently pinched. Also, when the stationary member side arc spot always stays on the stationary member, the stationary member significantly wears even upon the frequent interruption of a relatively small current such as rated current interruption or the like, sometimes limiting the charged switching life of the circuit interrupter.

Accordingly, in this embodiment, the cylindrical space of the cylindrical insulating material 25 is expanded to the terminal portion 215 and the arc runner 279 to which the arc spot on the stationary contact 206 is provided. With such the arrangement, as shown in FIG. 144, the arc generated immediately after the contact separation is quickly urged and moved toward the terminal portion 215 by the electromagnetic drive force due to the current in the electrical paths 286*b*and 286*c* and the force due to the vapor flow generated from the cylindrical wall surface of the cylindrical insulating material on the side of the movable member rotating center 213 as depicted by a black arrow in the figure, so that the damage and wear of the stationary contact 206 can be minimized. Also, when the contact separation distance is increased to a certain extent, the arc spot on the stationary member side is transferred to the tip portion of the arc runner 279 as shown in FIG. 145, making it easy for the arc to be brought into contact with the horse shoe-shaped arc extinguishing plates 219 made of iron. Therefore, the arc temperature can be lowered and the rising of the housing internal pressure can be suppressed. Also, even when the creeping resistance is decreased because of the carbonization or deterioration of the cylindrical wall surface of the cylindrical insulating material due to the frequent switching of the relatively small current, the arc is sufficiently drawn deep into the arc extinguishing plates, whereby the current can be interrupted by the arc extinguishing function by the arc extinguishing plates, improving the reliability of the interruption.

While the stationary member shown in FIGS. 143 to 145 is substantially J-shaped, an arc runner may de additionally provided to the stationary contact side end portion of the stationary member shown in FIGS. 33, 40 and 48 and combined with the cylindrical insulating material spread toward the arc runner side, then a similar effect can be obtained. In particular, in FIGS. 40, 44 and 48 in which the electrical path 86*d* for flowing a current having a current component opposite to the arc is provided at the movable member rotating center side in the vicinity of the stationary contact, the electromagnetic drive force acting to the arc due to the current in the electrical path 86*d* is strong and the arc is transferred to the arc runner at an early time point after the contact separation, resulting in a larger effect of improving the contact wear.

By increasing the cylinder cross sectional area like this, the internal pressure rise in the cylindrical space is retarded and the rising speed of the arc voltage immediately after the contact separation is decreased as compared with the case where the cylindrical insulating material having a relatively small cylinder cross sectional area shown in FIG. 38. However, comparing with the conventional technique in which the insulators are provided at the both sides of the conventional movable member to utilize the cooling vapor from the insulators to increase the arc voltage, the cylindrical space internal pressure becomes higher than before and the arc voltage rising speed becomes faster because the arc contacts the cylinder wall surface on the movable member rotary center side at the initial stage of the contact opening and because the arc is urged against the cylinder wall surface on the side of the terminal portion 215. Also, as shown in FIG. 143, both contact pairs are positioned within the arc extinguishing unit housing main body 36 and the arc extinguishing unit housing cover 237 (not shown) so that the pressure increased by the arc generated in the cylindrical space 226 is not immediately discharged to the ousted, causing increase of the internal pressure of the housing 36 and 37. Therefore, by making the cylindrical insulating material by an insulating material of a relatively low decomposing temperature such as resin to generate a sufficient amount of vapor from the cylindrical insulating material, a sufficient pressure rise for increasing the arc voltage and improving the current limiting performance can be obtained.

Embodiment 71

The seventy-first embodiment of the present invention is illustrated in FIG. 146. This embodiment is basically similar to the Embodiment 70 except for the arc extinguishing plates 19*a* shown in FIG. 146. FIG. 146 illustrates the state around the contact pair when the contact separation distance is increased to a certain extent during the fault current interrupting operation. As shown in FIG. 146, at the latter half of the interrupting operation after the current peak in which the contact separation distance is increased to a certain extent, the stationary member side arc spot is transferred t the tip portion of the arc runner 279. At this time, by providing the arc extinguishing plates 219*a* in the cylindrical space on the side of the terminal portion 215, the arc is brought into contact with the arc extinguishing plates within the cylindrical space to lower the arc temperature, suppressing the rise of the housing internal pressure. Therefore, the mechanical strength required for the housing can be made small, resulting in an inexpensive housing.

As has been described, according to the present invention, a low cost current limiting device having a superior current limiting function with a single arc extinguisher can be obtained, and the current limiting performance can be improved, impedance can be made small and the dimension in the direction of opening and closing the contact can be small.

Also, a current limiting device with a current limiting function in which the housing internal pressure upon the interruption that does not effectively contribute to the improvement in the current limiting performance can be suppressed and the required strength of the housing can be decreased.

Also, the electrical path arrangement of the movable member and the stationary member is such that an electromagnetic repulsive force is generated irrespective of the vertical positions of the terminal portions disposed at the opposite side faces of the housing, a high speed contact separation can be realized.

Also, a highly reliable current limiting device can be obtained, in which the contact wear is decreased by the provision of the arc runner or the transfer electrode and that is endurable against the repeated use.

Also, a current limiting interrupter having integrally connected together a circuit interrupter can be easily obtained by making the height position of the terminal portions on the both sides of the housing the same as the terminal portion of the circuit interrupter and directly connecting the terminals to each other.

Further, according to the present invention, a low cost current limiting device having a superior current limiting function with a single arc extinguisher can be obtained, and the current limiting performance can be improved, impedance can be made small and the dimension in the direction opening and closing the contact.

Also, a highly reliable current limiting device in which the opening and closing movement of the movable member is not impeded by the cylindrical insulating material and that is superior in current limiting performance and reliable in opening and closing operation.

Also, even when the height of the insulating wall on the movable member rotary center side is lowered in order that the cylindrical insulating material does not prevent the closure of the movable member, a high pressure atmosphere sufficient to increase the arc voltage can be generated to obtain a superior current limiting performance.

Also, the arc is easily brought into contact with the arc extinguishing plates and the current can be reliably interrupted, so that an interrupter with a highly reliable current limiting function can be obtained.

Also, a very large electromagnetic contact separating force can be obtained and the contact separating speed is significantly improved, so that a circuit interrupter with a current limiting function of a superior current limiting performance can be obtained.

Also, a highly reliable interrupter with a current limiting function can be obtained, in which the current can be reliably interrupted and the re-firing due to the insulation breakdown is difficult to occur.

Also, a highly reliable circuit interrupter having a current limiting function can be obtained, in which the arc spot on the stationary contact side is transferred at the latter half of the interrupting operation to the arc runner tip portion exposed from the insulating material cylindrically surrounding around the stationary contact, making the arc easily brought into contact with the arc extinguishing plates to be ensured to be cooled and interrupted, thus reliably interrupting the current.

Also, a highly reliable circuit interrupter having a current limiting function can be obtained, in which a high speed gas flow due to the pressure accumulated in the pressure accumulation space at the time of the arc extinction and flowing toward the gas exhausting port is generated, which blow off the highly electrically conductive hot gas such as metal vapor between the contacts to rapidly recover the insulation between the electrodes, whereby the current is reliable interrupted and the re-firing due to the insulation breakdown is difficult to occur.

Also, the movable arm does not melt due to the arc during the current interrupting operation, enabling to prevent the mechanical strength of the movable member from being reduced.

Furthermore, according to the present invention, the arrangement is such that the movable contact in the closed position and the stationary contact are disposed within the cylindrical space defined by the cylindrical insulating material and that the movable contact in the open position comes out of the cylindrical space, so that the atmosphere pressure at the initial stage of the arc generation can be increased, the interruption performance can be improved with a simple structure of a small number of components and the unnecessary rise of the housing internal pressure can be prevented.

Also, by changing the shape and the material of the cylindrical space of the cylindrical insulating material, the arc can be ensured to be lead to the arc extinguishing plates to effectively utilize the arc cooling effect and the generation of the vapor by the arc can be made easy to increase the rising speed of the pressure within the cylindrical space, whereby the arc voltage is rapidly raised to prevent the housing internal pressure from becoming high.

Also, the electrical path arrangement of the movable member and the stationary member is such that to generate an electromagnetic repulsive force irrespective of the height positions of the terminal portions disposed on the both side surfaces of the housing, so that a high speed contact separation can be realized.

Also, a reliable current limiting device in which the contact wear is reduced and that can be repeatedly used can be obtained by the provision of the arc runner and the transfer electrode.

Also, a current limiting interrupter having integrally connected together a circuit interrupter can be easily obtained by making the height position of the terminal portions on the both sides of the housing the same as the terminal portion of the circuit interrupter and directly connecting the terminals to each other.

Industrial Applicability

The current limiting device and the circuit interrupter using the same and having a current limiting function according to the present invention have utility as the device for protecting a circuit against a large fault current such as a short-circuited current.

What is claimed is:

1. A current limiting device comprising:

first and second contact members, each contact member having a first end with a contact, the contacts of said first and second contact members defining a contact pair;

means for applying a contacting pressure to said contact pair;

a tubular insulator adjacent to and circumferentially surrounding said contact pair in a closed state of said contact pair, at least one of said first and second contact members being rotatably supported at a second end; and an electrical path including said first and second contact members and through which current flows, said electrical path including first and second parts directly opposite each other so that the current flows in opposite directions through said first and second parts, wherein said first ends are positioned within a cylindrical space defined by said tubular insulator when said contact pair is in the closed state, and said contact of said rotatably supported contact member is positioned outside of the cylindrical space when said contact pair is in an open state so that, upon initial opening of said contact pair in response to an excessive current flow through said first and second parts, and formation of an arc between said first and second contact members, gas pressure at the arc is increased due to gas confinement within said tubular insulator.

2. The current limiting device as claimed in claim 1 comprising:

a movable member having a movable contact and a movable arm rotatable about a movable member rotary shaft;

a stationary member having a stationary contact making said contact pair with said movable contact, and a stationary conductor opposing said movable arm, said stationary conductor and said movable arm comprising said first and second parts of said electrical path;

a contact pressure spring as said means for applying the contacting pressure to said contact pair, said movable arm having a first movable arm portion and a second movable arm portion, substantially defining an L-shape, and, in the closed state, said first movable arm portion is positioned to provide an electrical current flow substantially parallel to and opposite in direction from said stationary conductor; and a movable member tip portion having said movable contact and a stationary member tip portion having said stationary contact positioned within the cylindrical space, wherein, in the open state, said movable contact is positioned outside of the cylindrical space.

3. The current limiting device as claimed in claim 2, including a conductor bent substantially into a U-shape with a first end connected to a terminal portion of said movable member remote from said movable member rotary shaft, and a second end having on an inner side said stationary contact, said stationary member on which said stationary contact is disposed being substantially opposite said first movable arm portion in the closed state, said stationary member including a slit for opening and closing of said movable member at a position crossing a rotary trace of said movable member, a portion, other than said stationary contact, of said stationary member directly facing said movable contact in the open state being covered by an insulating material.

4. The current limiting device as claimed in claim 2, wherein said stationary member is a conductor connected to a terminal portion of said movable member remote from said movable member rotary shaft and includes a stationary conductor having said stationary contact making said contact pair with said movable contact and opposing said first movable arm portion of said movable member and through which an electrical current flows opposite in direction to current flow through said movable arm, and including a magnetic core on the electrical path disposed at opposite sides of said stationary conductor and introducing a current to said stationary conductor from said terminal portion.

5. The current limiting device as claimed in claim 1, comprising:

a movable member having a movable contact and a movable arm and rotatable about a movable member rotary shaft;

a repulsing member having a repulsing contact making said contact pair with said movable contact and a repulsing arm substantially opposing said movable arm and rotatable about a repulsive member rotary shaft;

a contact pressure spring as said means for applying the contacting pressure to said contact pair, a pressure accumulating space communicating at a main opening with the cylindrical space defined by said tubular insulator and containing said repulsing member, said repulsing arm having a first repulsing arm portion and a second repulsing arm portion substantially defining an L-shape and, in the closed state, said first repulsing arm portion is positioned to provide a current flow substantially parallel to and opposite in direction with respect to a portion of said movable arm, and a movable member tip portion having said movable contact, and a repulsing member tip portion having said repulsing contact positioned within the cylindrical space defined by said tubular insulator, and, in the open state, said movable contact member tip portion is positioned outside of the cylindrical space.

6. The current limiting device as claimed in claim 5, wherein the electrical path for supplying a current to said repulsing member intersects a plane including a contact opening locus of said repulsing member, the electrical path including a slot for opening and closing of one of said repulsing member and said movable member, and the electrical path is closer to said movable arm than to said first repulsing arm portion so that an electrical current flows parallel to and opposite to said first repulsing arm portion.

7. The current limiting device as claimed in claim 1, comprising:

a movable member contained within an electrically insulating housing and having a movable contact and a substantially L-shaped movable arm rotatable about a movable member rotary shaft;

a stationary member having a stationary contact making said contact pair with said movable contact and the electrical path is substantially parallel to one portion of said movable arm for electrical current flow in a direction opposite said movable arm upon contact closing;

an arc extinguishing plate opposing a tip of said movable member; and terminals disposed on a side of said insulating housing opposite from said movable contact and connected to said movable member and said stationary member, respectively, said stationary member being substantially perpendicular to a line connecting said terminals.

8. The current limiting device as claimed in claim 2, wherein said tubular insulator has a wall that is higher opposite said movable member rotary shaft than adjacent said movable member rotary shaft.

9. The current limiting device as claimed in claim 2, including a housing housing said movable member, said stationary member, and said tubular insulator, said housing having an exhaust port in a face of said housing, opposite said movable member rotary shaft as viewed from said movable contact, and wherein said exhaust port has an area no larger than one half the face of said housing including said exhaust port and positioned proximate said movable member in the open state.

10. The current limiting device as claimed in claim 2, wherein the portion of said stationary conductor opposing said movable member and through which an electrical current flows opposite to the electrical current flowing in said movable member is bent toward said movable member.

11. A circuit interrupter having a current limiting function comprising:

a movable member having a movable contact and a movable arm and rotatable about a movable member rotary shaft;

a stationary member having a stationary contact making a contact pair with said movable contact and a stationary conductor substantially opposing said movable arm;

a tubular insulator adjacent to and circumferentially surrounding said contact pair in a closed state; and a contact pressure spring providing contacting pressure to said contact pair, said contact pair being positioned within a cylindrical space defined by said tubular insulator in the closed state, and said movable contact being positioned outside of the cylindrical space in an open state so that, upon initial opening of said contact pair in response to an excessive current flow through said movable arm and said stationary conductor, and formation of an arc between said movable contact and said stationary contact, gas pressure at the arc is increased due to gas confinement within said tubular insulator.

12. The circuit interrupter having a current limiting function as claimed in claim 11, wherein said movable arm has a first movable arm portion and a second movable arm portion defining an L-shape, and, in the closed state, said first movable arm portion is positioned to provide a current flow parallel to and opposite in direction from current flow in said stationary conductor.

13. The circuit interrupter having a current limiting function as claimed in claim 11, wherein said tubular insulator has a wall that is higher opposite said movable member rotary shaft than adjacent said movable member rotary shaft.

14. The circuit interrupter having a current limiting function as claimed in claim 11, wherein said stationary conductor and one portion of a conductor for supplying an electrical current to said movable member are parallel and located, relative to each other, so that electrical currents flowing through both of said stationary conductor and said conductor supplying current to said movable member coincide in direction of current flow.

15. The circuit interrupter having a current limiting function as claimed in claim 11, including a housing housing said movable member, said stationary member, and said tubular insulator, the housing having an exhaust port in a face of the housing opposite said movable member rotary shaft as viewed from said movable contact, and wherein said exhaust port has an area no larger than one half the face of the housing including the exhaust port and positioned proximate said movable member in the open state.

16. The circuit interrupter having a current limiting function as claimed in claim 11, wherein said stationary contact is positioned within a pressure accumulating space in communication with the cylindrical space.

17. The circuit interrupter having a current limiting function as claimed in claim 11, further comprising an arc extinguisher plate disposed at a position opposing a tip of said movable member and an arc runner extending along a current carrying conductor to said stationary member, an end portion of said arc runner being exposed to a side of the arc extinguisher plate opposite a center of said movable member rotary shaft.

18. The circuit interrupter having a current limiting function as claimed in claim 11, wherein said stationary conductor having said stationary contact is bent into substantially a U-shape to lead to a far side from said movable member rotary shaft, and including a slit, for closing of said movable member, in a portion of said stationary conductor intersecting with a rotation locus of said movable member.

19. A current limiting device comprising:

a movable member contained within an electrically insulating housing and having a movable contact and an L-shaped movable arm rotatable about a movable member rotary shaft;

a stationary member having a stationary contact making a contact pair with said movable contact and an electrical path substantially parallel to one portion of said movable arm for flow of an electrical current in a direction opposite current flow in said movable arm upon contact closing;

a tubular insulator adjacent to and circumferentially surrounding the contact pair in a closed state;

biasing means for applying contacting pressure to said contact pair;

an arc extinguishing plate opposing a tip of said movable member; and terminals disposed on a side of said insulating housing opposite said movable contact and said stationary member, said contact pair, in the closed state, being positioned within a cylindrical space defined by said tubular insulator and, in an open state, said movable contact being positioned outside of the cylindrical space so that, upon initial opening of said contact pair in response to an excessive current flow through said movable member and said stationary member, and formation of an arc between said movable contact and said stationary contact, gas pressure at the arc is increased due to gas confinement within said tubular insulator.

20. The current limiting device as claimed in claim 19, including an arc runner extending along a current carrying conductor to said stationary member, a tip portion of said arc runner being exposed to a side of said arc extinguisher plate.

* * * * *